US012662298B2

(12) United States Patent
Peeler et al.

(10) Patent No.: US 12,662,298 B2
(45) Date of Patent: Jun. 23, 2026

(54) ASSEMBLED PACKAGE INCLUDING TRAY DEFINING RIDGE

(71) Applicant: Altria Client Services LLC, Richmond, VA (US)

(72) Inventors: Andrew T Peeler, Richmond, VA (US); Christopher L. Simpson, Richmond, VA (US); Terrance T Bache, Richmond, VA (US); Evan A Hutker, Dedham, MA (US); Aniket K Warade, Boston, MA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 18/360,392

(22) Filed: Jul. 27, 2023

(65) Prior Publication Data

US 2024/0150104 A1 May 9, 2024

Related U.S. Application Data

(63) Continuation-in-part of application No. 18/053,141, filed on Nov. 7, 2022.

(51) Int. Cl.
*B65D 81/02* (2006.01)
*B65D 1/40* (2006.01)
(Continued)

(52) U.S. Cl.
CPC ..... *B65D 77/046* (2013.01); *B65D 1/40* (2013.01); *B65D 63/00* (2013.01); *B65D 2203/12* (2013.01)

(58) Field of Classification Search
CPC ..... B65D 11/188; B65D 25/10; B65D 63/10; B65D 81/133; B65D 77/046; B65D 1/40;
(Continued)

(56) References Cited

U.S. PATENT DOCUMENTS 3,065,896 A 11/1962 Grapp
3,372,800 A 3/1968 Arneson
(Continued)

FOREIGN PATENT DOCUMENTS

EM 0004863290005 7/2006
EM 0006029900001 10/2006
(Continued)

OTHER PUBLICATIONS

U.S. Appl. No. 17/979,103, filed Nov. 2, 2022.
(Continued)

*Primary Examiner* — Luan K Bui
(74) *Attorney, Agent, or Firm* — Harness, Dickey & Pierce, P.L.C.

(57) ABSTRACT

The assembled package includes an outer container including a first section and a second section, and a first tray within the outer container, the first tray defining a first ridge along a periphery of the first tray, the first ridge being held between a first peripheral edge of the first section and a second peripheral edge of the second section when the outer container is in a closed position, the first tray including first vertical sidewalls that extend downward from a first top surface of the first tray, the first ridge extending horizontally away from the first vertical sidewalls.

45 Claims, 116 Drawing Sheets

*(VIEW CXXV-CXXV OF FIG. 102)*

(51) Int. Cl.
*B65D 63/00* (2006.01)
*B65D 77/04* (2006.01)

(58) Field of Classification Search
CPC ..... B65D 63/00; B65D 2203/12; B65D 2543/00101; B65D 2543/00194; B65D 2543/00296; B65D 2543/00527; B65D 2543/00537; B65D 43/0222; B65D 75/366; B65D 75/367; B65D 81/05; B65D 1/34
USPC ..... 206/277, 583, 587, 461, 509, 511, 499; 220/4.21, 4.24, 4.28, 522, 529; 229/87.05, 87.18, 200, 240; 294/140, 294/149, 164
See application file for complete search history.

(56) References Cited

U.S. PATENT DOCUMENTS 3,485,416 A 12/1969 Fohrman
3,501,082 A 3/1970 Lock
3,759,378 A 9/1973 Werth
RE29,063 E 12/1976 Graser
3,999,661 A * 12/1976 Jones ..... B65D 81/027 229/406
4,091,953 A 5/1978 Daenen
4,105,121 A 8/1978 Mascetti
4,407,414 A 10/1983 Rey et al.
4,453,664 A 6/1984 Oliff
4,807,776 A 2/1989 Cortopassi
5,368,169 A * 11/1994 Ensor ..... B25B 27/02 209/403
5,540,381 A 7/1996 Davis
D373,307 S 9/1996 Menaged
5,575,848 A * 11/1996 Chedville ..... A47J 43/22 118/19
5,636,738 A 6/1997 Riedel
5,743,402 A 4/1998 Gics
5,871,116 A * 2/1999 Picchietti ..... A47J 47/14 220/4.24
5,888,565 A * 3/1999 Gics ..... B65D 77/0433 206/769
5,900,264 A 5/1999 Gics
D432,414 S 10/2000 Simpson et al.
D443,899 S 6/2001 Stephens
D484,798 S 1/2004 Bukowski
6,698,608 B2 * 3/2004 Parker ..... B65D 25/22 220/4.23
D529,378 S 10/2006 Spencer et al.
D577,295 S 9/2008 Miller et al.
D592,494 S 5/2009 Wichowski
D595,150 S 6/2009 Cain
D596,485 S 7/2009 Andre et al.
D606,858 S 12/2009 Kesselman
D609,855 S 2/2010 Patel et al.
D612,094 S 3/2010 Bellamah et al.
D615,402 S 5/2010 Doster
D617,043 S 6/2010 Patel et al.
D618,390 S 6/2010 Moore et al.
D618,391 S 6/2010 Moore et al.
D618,999 S 7/2010 Akana et al.
D626,688 S 11/2010 Gibson et al.
D630,505 S 1/2011 Westemeyer et al.
D630,525 S 1/2011 Patel et al.
D637,076 S 5/2011 Akana et al.
D638,297 S 5/2011 Gelardi et al.
D640,131 S 6/2011 Gibson et al.
D642,048 S 7/2011 Ocampo et al.
D643,972 S 8/2011 Krohn
D646,159 S 10/2011 Bellamah et al.
D649,284 S 11/2011 Patel et al.
D650,267 S 12/2011 Gibson et al.
D650,268 S 12/2011 Gibson et al.
D654,810 S 2/2012 Mansouri
D657,693 S 4/2012 Krankkala et al.
D658,377 S 5/2012 Corwin et al.
D661,188 S 6/2012 Fahy
D663,204 S 7/2012 Fallon
D665,253 S 8/2012 Bellamah et al.
D666,100 S 8/2012 Fallon
D667,301 S 9/2012 Jones et al.
D668,718 S 10/2012 Clark et al.
D668,965 S 10/2012 Crawford
D673,848 S 1/2013 Bailey et al.
D674,688 S 1/2013 Loftin et al.
D675,516 S 2/2013 Horton et al.
D676,321 S 2/2013 Jones et al.
D677,164 S 3/2013 Jones et al.
D687,300 S 8/2013 Jones et al.
D688,938 S 9/2013 Bailey et al.
D690,588 S 10/2013 Pipes et al.
D692,298 S 10/2013 Pipes et al.
D693,242 S 11/2013 Birchmeier
D694,102 S 11/2013 Bellamah et al.
D694,123 S 11/2013 Bowman
D694,623 S 12/2013 Bellamah
D696,144 S 12/2013 Akana et al.
8,607,986 B2 * 12/2013 Lipinski ..... B65D 75/02 206/764
D699,591 S 2/2014 Malley et al.
D702,765 S 4/2014 Williams
D704,050 S 5/2014 Pipes et al.
D706,642 S 6/2014 Fath et al.
D709,758 S 7/2014 Burdock-Latter et al.
D709,953 S 7/2014 Williams
D710,213 S 8/2014 Birchmeier
D714,639 S 10/2014 Royer et al.
D717,645 S 11/2014 Wilmers
D722,264 S 2/2015 Saideh
D722,870 S 2/2015 Fohner et al.
D723,387 S 3/2015 Fath et al.
D727,723 S 4/2015 Pipes et al.
D727,724 S 4/2015 Pipes et al.
D730,728 S 6/2015 Fath
D740,018 S 10/2015 Zhang et al.
D741,703 S 10/2015 Janson et al.
D748,498 S 2/2016 Pipes et al.
D751,251 S 3/2016 Fath et al.
D760,036 S 6/2016 Hucuptan
9,446,869 B2 9/2016 Foltz
D769,732 S 10/2016 Shoshan
D778,156 S 2/2017 Follett et al.
D780,598 S 3/2017 Zeitlin et al.
D782,326 S 3/2017 Fath et al.
D784,124 S 4/2017 Zeitlin et al.
D786,670 S 5/2017 Lin
D786,976 S 5/2017 Keating
D793,251 S 8/2017 Jones et al.
D796,204 S 9/2017 Wax
D798,736 S 10/2017 Shoshan
D798,737 S 10/2017 Miller et al.
D806,537 S 1/2018 Cernokus et al.
D806,565 S 1/2018 Fath et al.
D811,005 S 2/2018 Fath et al.
D812,472 S 3/2018 Sefton
D812,493 S 3/2018 Sefton
D813,672 S 3/2018 Doster
D814,296 S 4/2018 Collins
D817,172 S 5/2018 Jones et al.
D819,441 S 6/2018 Doster
D823,681 S 7/2018 Hendricks et al.
D823,696 S 7/2018 O'Neill
D826,005 S 8/2018 Walters Pennington et al.
D830,853 S 10/2018 Mitten et al.
D833,270 S 11/2018 Fath et al.
D833,863 S 11/2018 Zeitlin et al.
D833,872 S 11/2018 Lefebvre et al.
D834,937 S 12/2018 McKenzie et al.
D840,146 S 2/2019 Hauss
D852,616 S 7/2019 Thesing
D854,922 S 7/2019 Piscopo et al.
D856,158 S 8/2019 Willis, III
D856,822 S 8/2019 Fath et al.

(56) References Cited

U.S. PATENT DOCUMENTS

| | | | | |
|---|---|---|---|---|
| D860,811 | S | 9/2019 | Mitten et al. | |
| D862,231 | S | 10/2019 | Hatcher et al. | |
| D863,677 | S | 10/2019 | Chung et al. | |
| D863,965 | S | 10/2019 | Lee et al. | |
| D864,710 | S | 10/2019 | Watson | |
| D865,515 | S | 11/2019 | McKenzie et al. | |
| D868,577 | S | 12/2019 | Watson | |
| D872,595 | S | 1/2020 | Troudt et al. | |
| D875,307 | S | 2/2020 | Storcks et al. | |
| D875,520 | S | 2/2020 | Zeitlin et al. | |
| D876,821 | S | 3/2020 | Lee | |
| D882,078 | S | 4/2020 | Kangastupa | |
| D889,967 | S | 7/2020 | Glass et al. | |
| D892,632 | S | 8/2020 | Bogdziewicz | |
| D895,439 | S | 9/2020 | Meech et al. | |
| D901,891 | S | 11/2020 | Way | |
| D902,580 | S | 11/2020 | Amatoury et al. | |
| D903,939 | S | 12/2020 | Tung | |
| D905,903 | S | 12/2020 | Ryczek | |
| D908,498 | S | 1/2021 | Natsume et al. | |
| D909,196 | S | 2/2021 | Tung et al. | |
| D911,162 | S | 2/2021 | Tung | |
| D914,689 | S | 3/2021 | Culver et al. | |
| D915,880 | S | 4/2021 | Markoulis et al. | |
| D932,317 | S | 10/2021 | Kelly et al. | |
| D949,470 | S | 4/2022 | Liu | |
| D957,932 | S | 7/2022 | David et al. | |
| D957,937 | S | 7/2022 | Milbrandt | |
| D974,025 | S | 1/2023 | Chen | |
| D1,003,732 | S | 11/2023 | Goncalez et al. | |
| D1,009,620 | S | 1/2024 | Lewandowski | |
| 11,878,846 | B2 | 1/2024 | Cox et al. | |
| D1,027,634 | S | 5/2024 | Thakkar et al. | |
| 11,981,495 | B2 | 5/2024 | Lewandowski | |
| D1,042,108 | S | 9/2024 | Vergin et al. | |
| 2006/0144744 | A1* | 7/2006 | Rodriquez | B65D 21/0222 206/509 |
| 2007/0169716 | A1 | 7/2007 | Conger et al. | |
| 2011/0287146 | A1 | 11/2011 | Stowe et al. | |
| 2013/0068653 | A1 | 3/2013 | Lipinski | |
| 2013/0264224 | A1* | 10/2013 | Young | B65D 11/10 206/1.5 |
| 2016/0136049 | A1 | 5/2016 | Weinstein et al. | |
| 2021/0078755 | A1 | 3/2021 | Sollie et al. | |
| 2021/0284382 | A1 | 9/2021 | Walters et al. | |
| 2024/0150104 | A1 | 5/2024 | Peeler et al. | |
| 2024/0150105 | A1 | 5/2024 | Peeler et al. | |

FOREIGN PATENT DOCUMENTS

| | | | |
|---|---|---|---|
| EM | 0009470150001 | | 7/2008 |
| EM | 0009470150002 | | 7/2008 |
| EM | 0009470150003 | | 7/2008 |
| EM | 0009470150004 | | 7/2008 |
| EM | 0009470150005 | | 7/2008 |
| EM | 0009470150006 | | 7/2008 |
| EM | 0009470150007 | | 7/2008 |
| EM | 0011136660002 | | 5/2009 |
| EM | 0011362380001 | | 5/2009 |
| EM | 0009962690003 | | 11/2010 |
| EM | 0010817230001 | | 7/2011 |
| EM | 0010817230002 | | 7/2011 |
| EM | 0011570690001 | | 1/2012 |
| EM | 0011570690002 | | 1/2012 |
| EM | 0011570690003 | | 1/2012 |
| EM | 0021571560001 | | 1/2013 |
| EM | 0013835410002 | | 11/2013 |
| EM | 0013835410003 | | 11/2013 |
| EM | 0025547330001 | | 10/2014 |
| EM | 0024924960009 | | 12/2016 |
| EM | 0014589390001 | | 1/2017 |
| EM | 0037292270001 | | 1/2017 |
| EM | 0040256090004 | | 2/2017 |
| EM | 0040256090003 | | 6/2017 |
| EM | 0046784070004 | | 1/2018 |
| EM | 0052556190003 | | 5/2018 |
| EM | 0056083870003 | | 8/2018 |
| EM | 0056083870004 | | 8/2018 |
| EM | 0056087000004 | | 8/2018 |
| EM | 0056248550001 | | 12/2018 |
| EM | 0014589210001 | | 1/2019 |
| EM | 0043788830004 | | 3/2019 |
| EM | 0043788830005 | | 3/2019 |
| EM | 0033984030001 | | 4/2019 |
| EM | 0033984030003 | | 4/2019 |
| EM | 0046784070003 | | 9/2019 |
| EM | 0056087000003 | | 8/2020 |
| EM | 0014783820002 | | 9/2020 |
| EM | 0014783820003 | | 9/2020 |
| EM | 0080330210004 | | 9/2020 |
| EM | 0080330210008 | | 9/2020 |
| EM | 0087340320007 | | 3/2022 |
| EM | 0087340320008 | | 3/2022 |
| EM | 0087340320009 | | 3/2022 |
| EM | 0087340320010 | | 3/2022 |
| EM | 0150272960001 | | 8/2023 |
| FR | 2673912 | A1 | 9/1992 |
| GB | 90011362380001 | | 5/2009 |
| GB | 90011570690003 | | 7/2009 |
| GB | 90011570690001 | | 1/2012 |
| GB | 90011570690002 | | 1/2012 |
| GB | 90033984030001 | | 9/2016 |
| GB | 90033984030003 | | 9/2016 |
| GB | 90034382090001 | | 10/2016 |
| GB | 90014589210002 | | 1/2017 |
| GB | 90014589390001 | | 1/2017 |
| GB | 90056087000004 | | 8/2018 |
| GB | 90014589210001 | | 1/2019 |
| GB | 90037292270001 | | 1/2019 |
| GB | 90046784070003 | | 9/2019 |
| GB | 90046784070004 | | 9/2019 |
| GB | 6060117 | | 5/2020 |
| GB | 6093152 | | 6/2020 |
| GB | 6124214 | | 4/2021 |
| GB | 6124215 | | 6/2021 |
| GB | 6124216 | | 6/2021 |
| GB | 6173752 | | 2/2022 |
| GB | 6280191 | | 5/2023 |
| GB | 6280192 | | 5/2023 |
| GB | 6280194 | | 5/2023 |
| GB | 6280195 | | 5/2023 |
| GB | 6280196 | | 5/2023 |
| JP | 1763356 | S | 2/2024 |
| JP | 1763357 | S | 2/2024 |
| KR | 30-0536710 | S | 8/2009 |
| WO | 2009068280 | A1 | 6/2009 |
| WO | WO-D217943-001 | | 6/2022 |
| WO | WO-D217943-002 | | 6/2022 |

OTHER PUBLICATIONS

Office Action dated May 22, 2023, issued in corresponding Korean Patent Application No. 30-2023-0017235.

Office Action dated Jun. 5, 2023, issued in corresponding Korean Patent Application No. 30-2023-0017235.

Office Action dated Jun. 5, 2023, issued in corresponding Korean Patent Application No. 30-2023-0017213.

Office Action dated Jun. 7, 2023, issued in corresponding Korean Patent Application No. 30-2023-0017213.

International Search Report and Written Opinion, dated Apr. 23, 2024, issued in International Application No. PCT/US2023/078916.

Japanese Office Action, dated Mar. 19, 2024, issued in Japanese Patent Application No. 2023-009252.

Japanese Office Action, dated Mar. 19, 2024, issued in Japanese Patent Application No. 2023-009253.

Office Action dated Sep. 26, 2023, issued in corresponding Japanese Design Application No. 2023-009311.

Japanese Office Action, dated Feb. 13, 2024, issued in Japanese Patent Application No. 2023-009308.

Japanese Office Action, dated Feb. 13, 2024, issued in Japanese Patent Application No. 2023-009307.

(56) References Cited

OTHER PUBLICATIONS

Japanese Office Action, dated Feb. 13, 2024, issued in Japanese Patent Application No. 2023-009253.
Japanese Office Action, dated Feb. 13, 2024, issued in Japanese Patent Application No. 2023-009252.
Japanese Office Action, dated Feb. 13, 2024, issued in Japanese Patent Application No. 2023-009251.
International Search Report and Written Opinion, dated Feb. 15, 2024, issued in International Patent Application No. PCT/US2023/078925.
Chinese Office Action, dated Sep. 19, 2024, issued in Chinese Patent Application No. 202430027489.6.
Japanese Office Action, dated Oct. 1, 2024, issued in Japanese Patent Applicaiton No. 2024-001040.
Japanese Office Action, dated Oct. 1, 2024, issued in Japanese Patent Application No. 2024-001041.
Canadian Office Action, dated Aug. 6, 2024, issued in Canadian Patent Application No. 221226.
Office Action, dated Dec. 16, 2024, issued in U.S. Appl. No. 18/053,141.
Office Action issued Mar. 11, 2025 in U.S. Appl. No. 18/053,086.
Final Office Action issued May 19, 2025 in U.S. Appl. No. 18/053,141.
International Preliminary Report on Patentability issued May 15, 2025 in International Patent Application No. PCT/US2023/078916.
International Preliminary Report on Patentability issued May 15, 2025 in International Patent Application No. PCT/US2023/078925.
Notice of Allowance issued Jul. 29, 2025 in U.S. Appl. No. 18/053,141.
Ex Parte Quayle Office Action issued Aug. 29, 2025 in U.S. Pat. No. 29/880,886. (11 pages).
available May 28, 2025, [online], [site visited Aug. 5, 2025], Available from internet, URL: https://www.stanews.com/2025/05/28/iqos-philip-morris-heated-tobacco-product-american-rollout-viewed-skeptically-anti-smoking-groups/ (Year: 2025). With aura readings and a Lauryn Hill concert, Philip Morris rolls out a new tobacco product in the U.S. (1 page).
Ex Parte Quayle Office Action issued Aug. 29, 2025 in U.S. Appl. No. 29/867,741. (8 pages).
Notice of Allowance issued Nov. 7, 2025 in U.S. Appl. No. 18/053,141.
Restriction Requirement issued Dec. 23, 2025 in U.S. Appl. No. 29/867,743.
Final Office Action issued Jan. 23, 2025 in U.S. Appl. No. 29/880,886.
Notice of Allowance issued Jan. 28, 2026 in U.S. Appl. No. 29/867,741.
Notice of Allowance issued Feb. 27, 2026 in U.S. Appl. No. 18/053,141.
Notice of Allowance dated Apr. 22, 2026 issued in U.S. Appl. No. 29/880,886.

* cited by examiner (VIEW VIII-VIII)

(VIEW XVIII-XVIII)

(VIEW XVIII-XVIII)

(VIEW XIX-XIX)

(VIEW XIX-XIX)

(VIEW XXXI-XXXI)

(VIEW XXXI-XXXI)

(VIEW XXXIII-XXXIII)

(VIEW XXXVIII-XXXVIII)

(VIEW XL-XL)

(VIEW XLI-XLI)

(VIEW XLII-XLII)

(VIEW XLIII-XLIII)

(VIEW XLII-XLII)

(VIEW XLIII-XLIII)

(VIEW LXIII-LXIII)

(VIEW LXIV-LXIV)

(VIEW LXV-LXV)

(VIEW CXV-CXV OF FIG. 106)

(VIEW CXVI-CXVI OF FIG. 114)

(VIEW CXVII-CXVII OF FIG. 106)

(VIEW CXVIII-CXVIII OF FIG. 114)

(VIEW CXXI-CXXI OF FIG. 120C)

(VIEW CXXI-CXXI OF FIG. 120C)

(VIEW CXXK-CXXK OF FIG. 120C)

(VIEW CXXI-CXXI OF FIG. 119)

(VIEW CXXIII-CXXIII OF FIG. 119)

(VIEW CXXIV-CXXIV OF FIG. 119)

(VIEW CXXV-CXXV OF FIG. 102)

(VIEW CXXVI-CXXVI OF FIG. 102)

(VIEW CXXV-CXXV OF FIG. 102)

(VIEW CXXVI-CXXVI OF FIG. 102)

ASSEMBLED PACKAGE INCLUDING TRAY DEFINING RIDGE

CROSS-REFERENCE TO RELATED APPLICATION

This application is a continuation in part of U.S. patent application Ser. No. 18/053,141, filed Nov. 7, 2022, the entire contents of which is hereby incorporated by reference.

BACKGROUND

Field

Example embodiments generally relate to a package including one or more trays for a consumer product.

Description of Related Art

Packages can store and dispense consumer products that may be impacted by exposure to ambient air.

SUMMARY

At least one example embodiment is directed toward a package.

In at least one example embodiment, the package includes an outer container including a first section and a second section; and a first tray within the outer container, the first tray defining a ridge along a periphery of the first tray, the ridge being held between a first peripheral edge of the first section and a second peripheral edge of the second section when the outer container is in a closed position and the first tray is being held within the outer container.

In at least one example embodiment, a first outer surface of the ridge is visible from outside of the package when the outer container is in the closed position and the first tray is being held within the outer container.

In at least one example embodiment, a first outer surface of the ridge is flush with a second outer surface of the first section and the second section when the outer container is in the closed position and the first tray is being held within the outer container.

In at least one example embodiment, a first outer surface of the ridge forms part of an overall outer surface of the package when the outer container is in the closed position and the first tray is being held within the outer container.

In at least one example embodiment, the ridge extends horizontally away from first sidewalls of the first tray.

In at least one example embodiment, each of the first section and the second section have second sidewalls extending from an end wall, the first section and the second section being identical to each other.

In at least one example embodiment, the first peripheral edge and the second peripheral edge are distal ends of the second sidewalls that are furthest from the end wall of each of the first section and the second section, respectively.

In at least one example embodiment, a first interior surface of the second sidewalls is inclined in an outwardly direction from the end wall to the first peripheral edge and the second peripheral edge of the first section and the second section, respectively.

In at least one example embodiment, the second sidewalls of each of the first section and the second section include a first pair of opposing sidewalls and a second pair of opposing sidewalls.

In at least one example embodiment, the second sidewalls have a horizontal cross-section that is substantially rectangular in shape.

In at least one example embodiment, the first section and the second section each define first interior and exterior corners between the end wall and the second sidewalls that are rounded, and the first section and the second section each define second interior and exterior corners between each of the first pair of opposing sidewalls and the second pair of opposing sidewalls that are rounded.

In at least one example embodiment, the first tray defines an impression of a first consumer product.

In at least one example embodiment, the first tray is selectively removable from the outer container.

In at least one example embodiment, the package further includes a second tray within the outer container, wherein a first lower portion of the first tray is at least partially connected to a first upper portion of the second tray.

In at least one example embodiment, the first tray and the second tray are selectively removable from the outer container.

In at least one example embodiment, a lower surface of the second tray contacts an end wall of the first section of the outer container when the second tray is being held within the outer container.

In at least one example embodiment, a first upper surface of the first tray forms at least a portion of a second upper surface of the package when the second section of the outer container is removed from the package and the first tray and the second tray are held within the first section.

In at least one example embodiment, a second upper portion of the ridge forms part of the second upper surface.

In at least one example embodiment, the first tray includes first sidewalls that extend vertically downward from the first upper surface, and the first lower portion includes at least part of a distal end of the first sidewalls.

In at least one example embodiment, the first tray includes first sidewalls that extend vertically downward from the first upper surface, the first sidewalls including first lower corners that are rounded at locations where the first sidewalls are joined, the first lower portion including a distal end of the first lower corners of the first sidewalls.

In at least one example embodiment, the first upper portion of the second tray defines first exterior corners that are rounded, the first lower corners being configured to grip the first exterior corners to connect the first tray to the second tray.

In at least one example embodiment, a first exterior surface of the first sidewalls and a second exterior surface of the second tray are conformed to a shape of a first interior surface of the first section.

In at least one example embodiment, the second exterior surface of the second tray, a third upper surface of the second tray, and second sidewalls of the first section define a ravine, the first sidewalls of the first tray being fitted into the ravine when the first tray and the second tray are connected together and are held in the first section.

In at least one example embodiment, the ravine is defined along an entire periphery of the second tray when the second tray is held in the first section.

In at least one example embodiment, the first tray defines at least one first impression of at least one first consumer product, and the second tray defines at least one second impression of at least one second consumer product.

In at least one example embodiment, the package further includes the at least one first consumer product contained within the at least one first impression; and the at least one second consumer product contained within the at least one second impression.

In at least one example embodiment, the at least one first consumer product is a heat-not-burn device, and the at least one second consumer product includes accessory items for the heat-not-burn device.

In at least one example embodiment, the package further includes consumer information material, wherein a third upper surface of the second tray defines a first inset surface, the consumer information material being held within the first inset surface.

In at least one example embodiment, at least one surface of the at least one first consumer product is viewable within the at least one first impression when the second section is removed from the package and the first tray is held within the first section.

In at least one example embodiment, the package further includes a band circumscribing at least a portion of the outer container, the band including at least one wide panel that is conformed to and in direct contact with at least one major surface of the first section, the second section or both the first section and the second section.

In at least one example embodiment, the band defines at least one tear strip that runs across a width of a portion of the band, the at least one tear strip being aligned with and running in front of a portion of the ridge.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

FIG. 113 is an illustration of a perspective view of the first tray holding a consumer product, in accordance with at least one example embodiment;

FIG. 114 is an illustration of a top view of the first tray holding the consumer product, in accordance with at least one example embodiment;

FIG. 115 is an illustration of a cross-section view of the first tray (view CXV-CXV of FIG. 106), in accordance with at least one example embodiment;

FIG. 116 is an illustration of a cross-section view of the first tray holding the consumer product (view CXVI-CXVI of FIG. 114), in accordance with at least one example embodiment;

FIG. 117 is an illustration of a cross-section view of the first tray (view CXVII-CXVII of FIG. 106), in accordance with at least one example embodiment;

FIG. 118 is an illustration of a cross-section view of the first tray holding the consumer product (view CXVIII-CXVIII of FIG. 114), in accordance with at least one example embodiment;

FIG. 119 is an illustration of a perspective view of the first tray and a second tray being held in the first section, in accordance with at least one example embodiment;

FIG. 120A is an illustration of a perspective view of a second tray of the package, in accordance with at least one example embodiment;

FIG. 120B is an illustration of a perspective view of the second tray, in accordance with at least one example embodiment;

FIG. 120C is an illustration of a top view of the second tray, in accordance with at least one example embodiment;

FIG. 120D is an illustration of a bottom view of the second tray, in accordance with at least one example embodiment;

FIG. 120E is an illustration of a bottom, perspective view of the second tray, in accordance with at least one example embodiment;

Figure 120A:
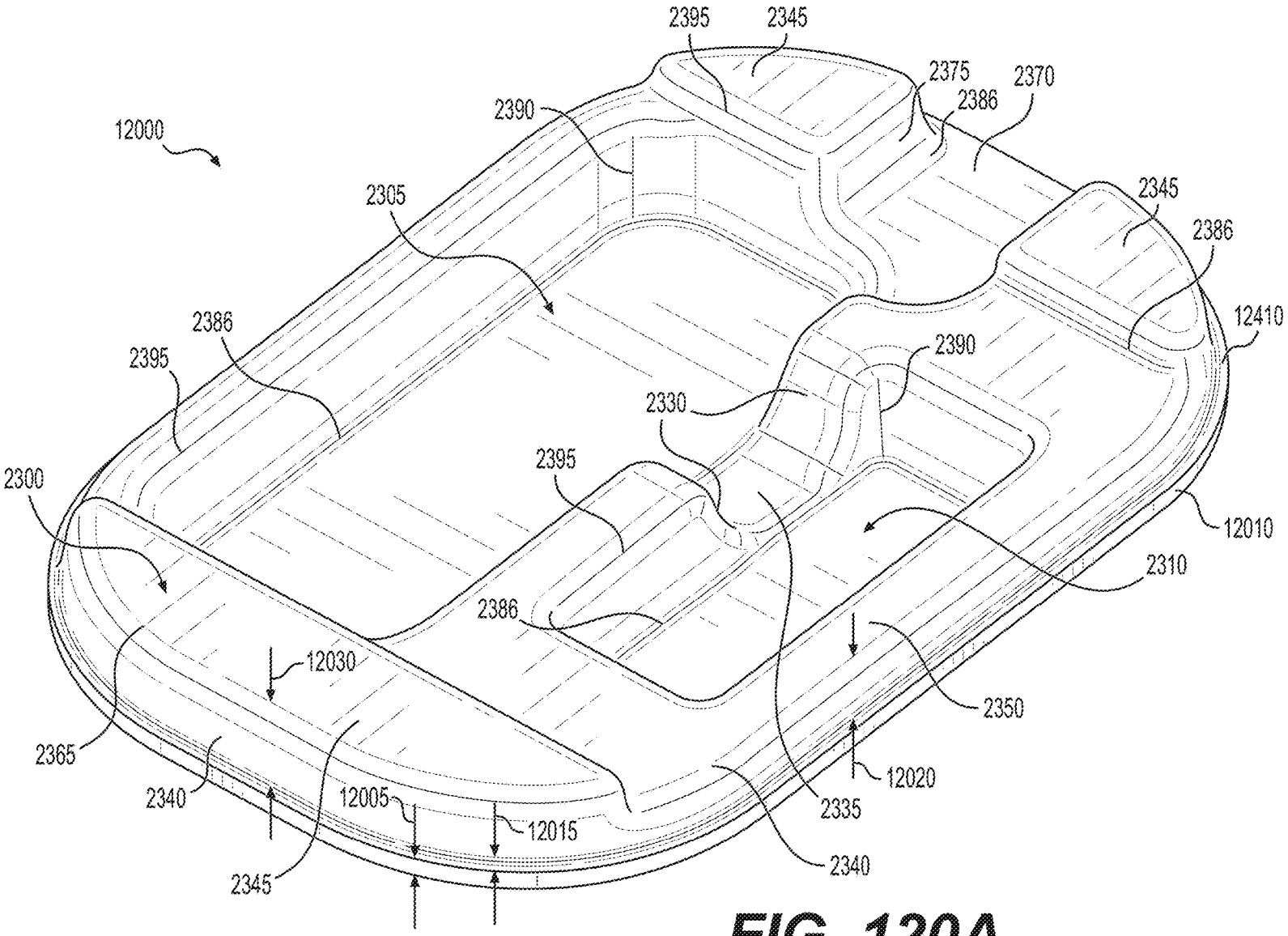
Figure 120B:
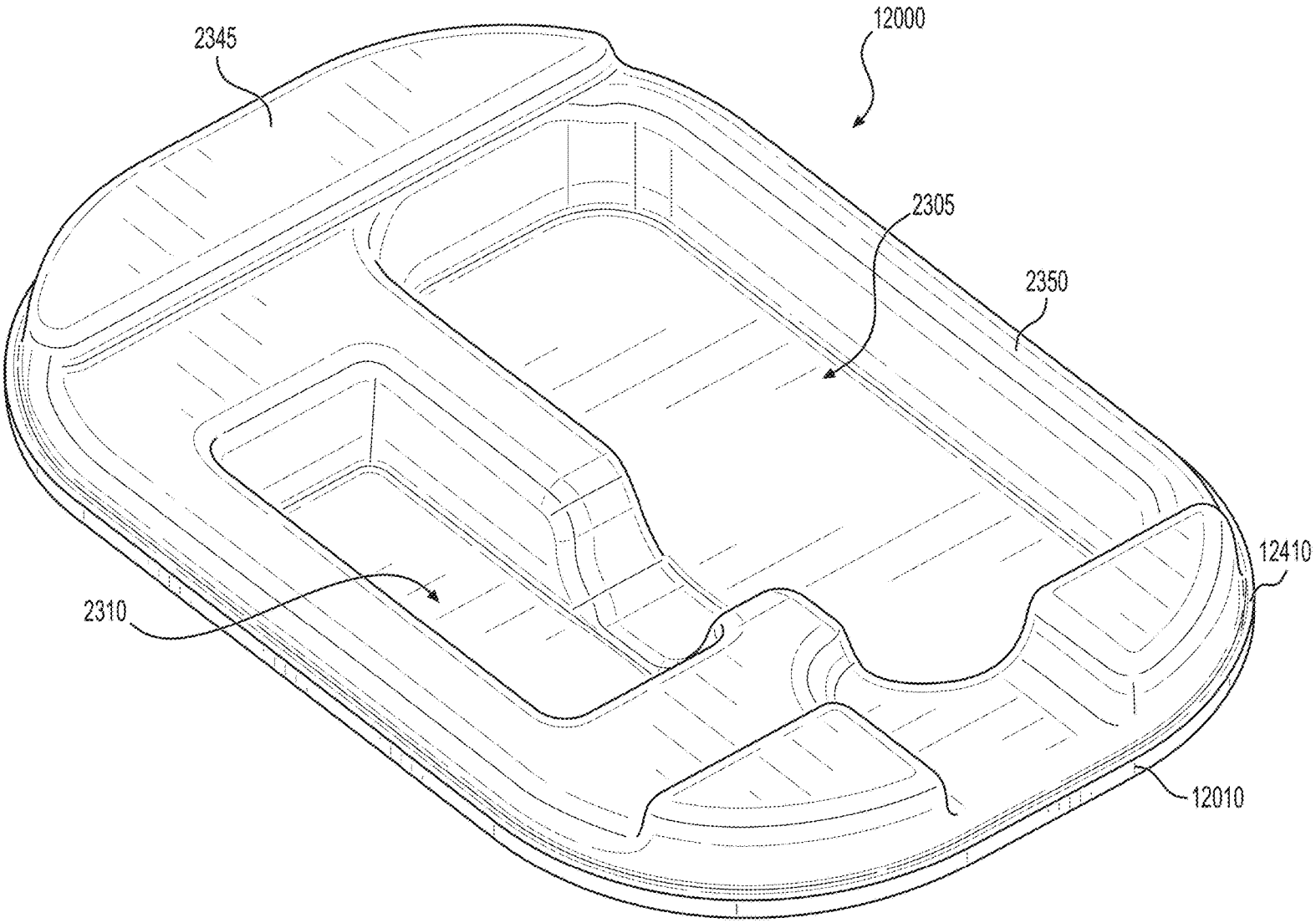
Figure 120C:
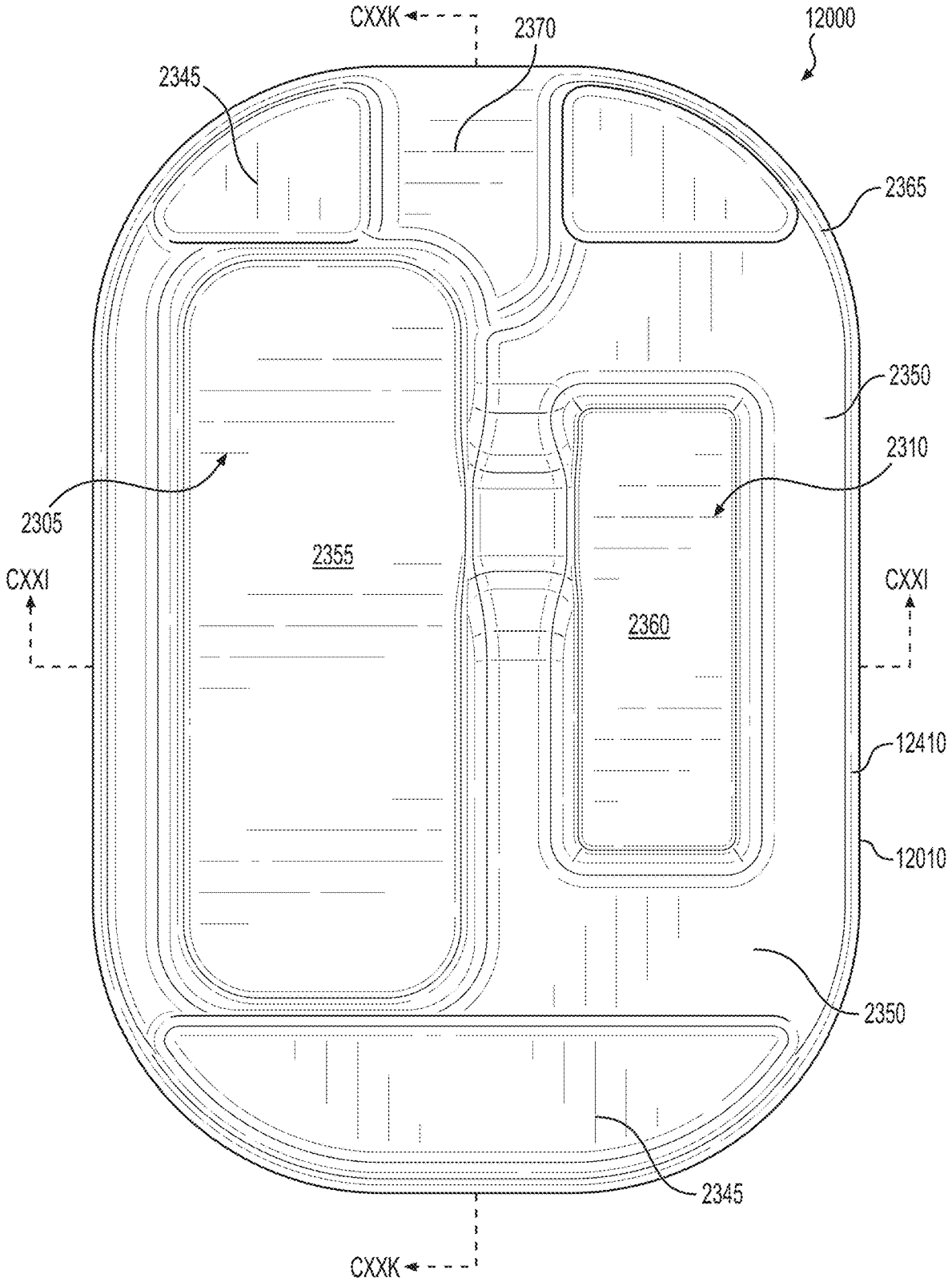
Figure 120D:
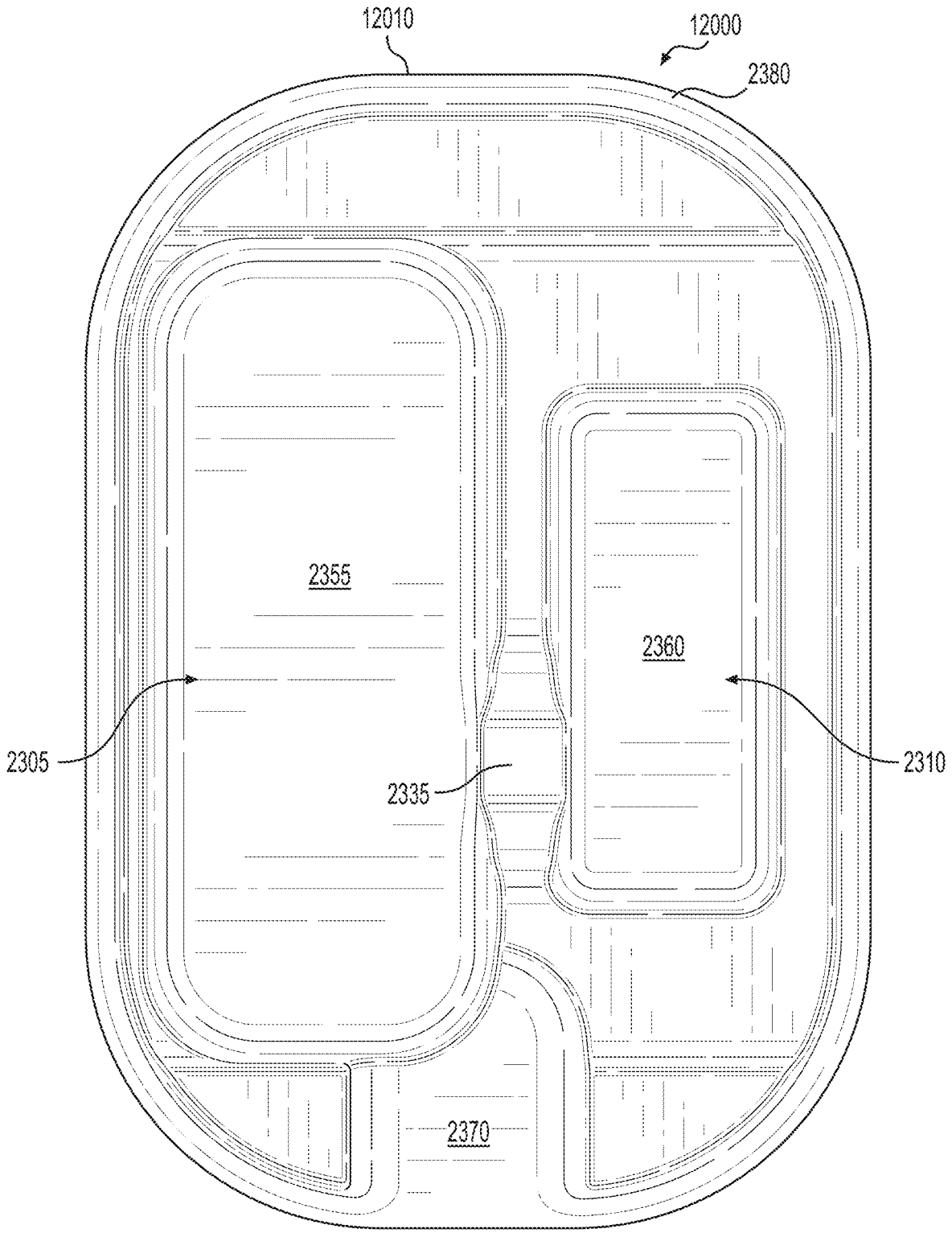
Figure 120E:
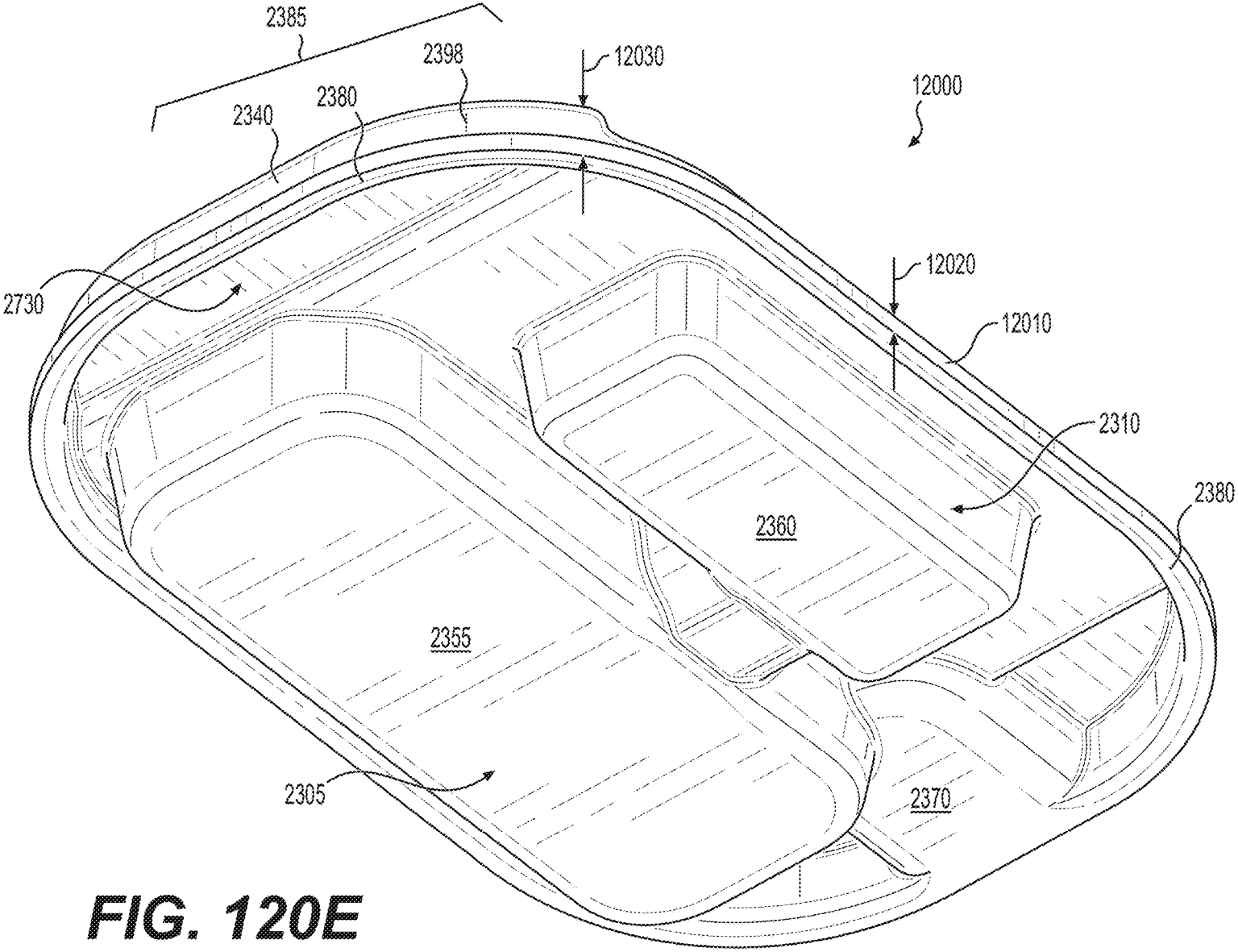
Figure 120F:
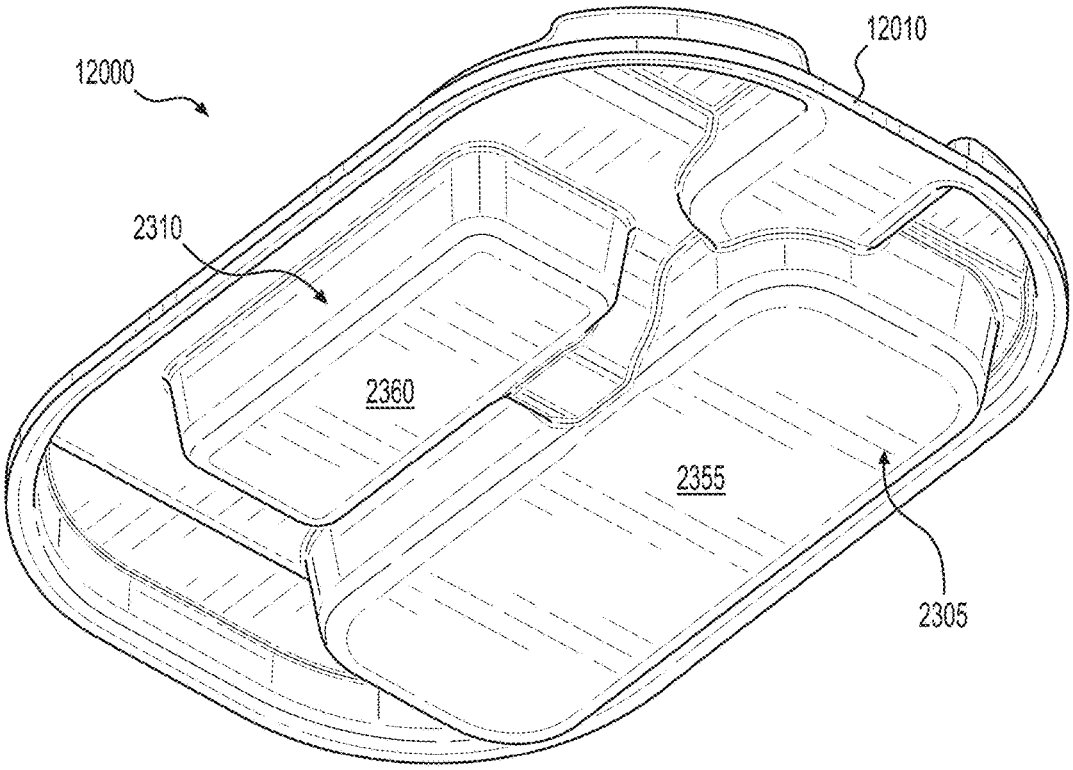
Figure 120G:
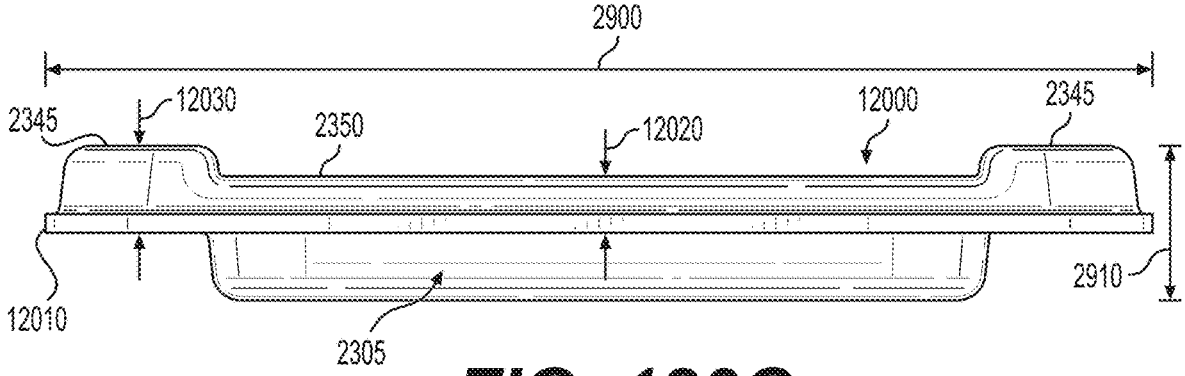
Figure 120H:
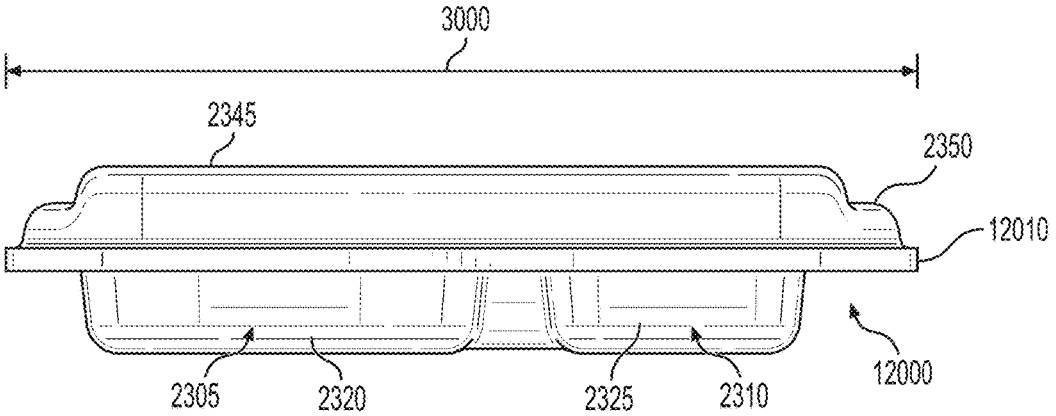
Figure 120I:
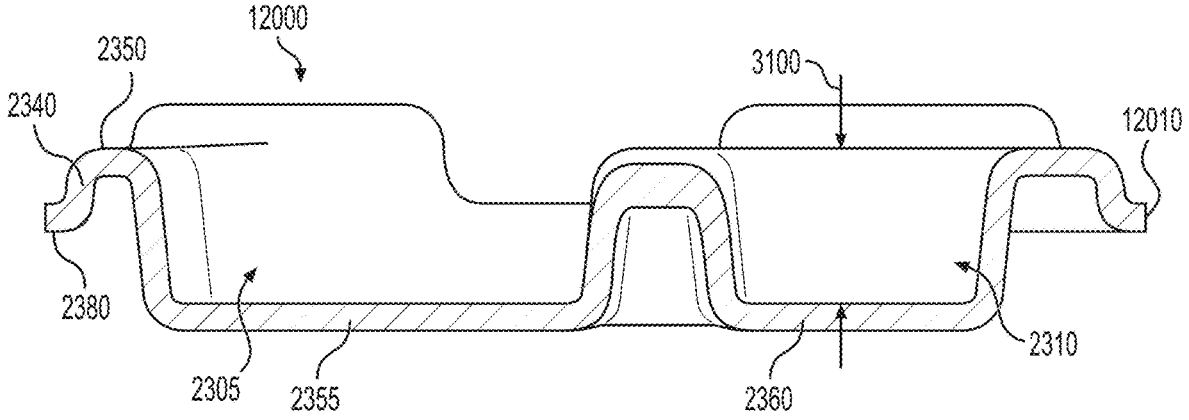
Figure 120J:
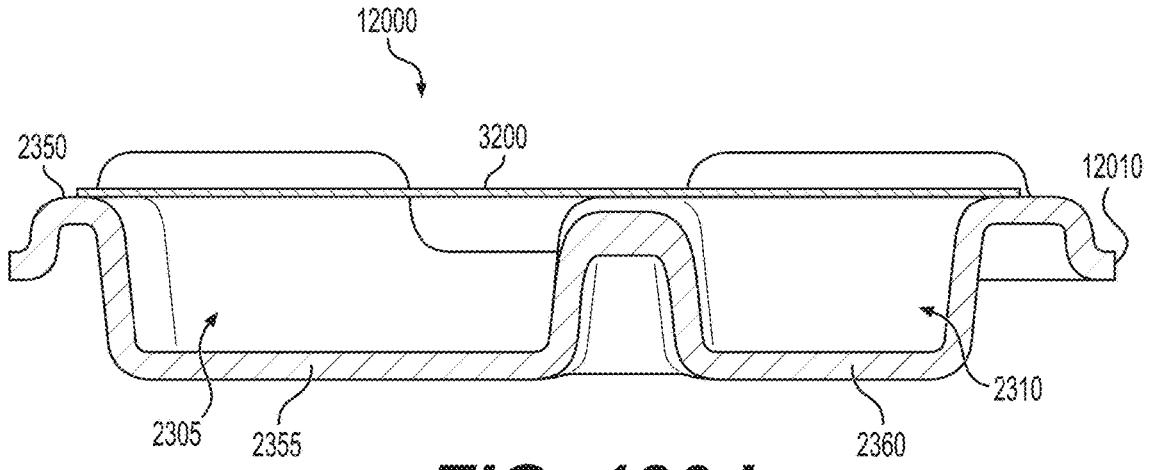
Figure 120K:
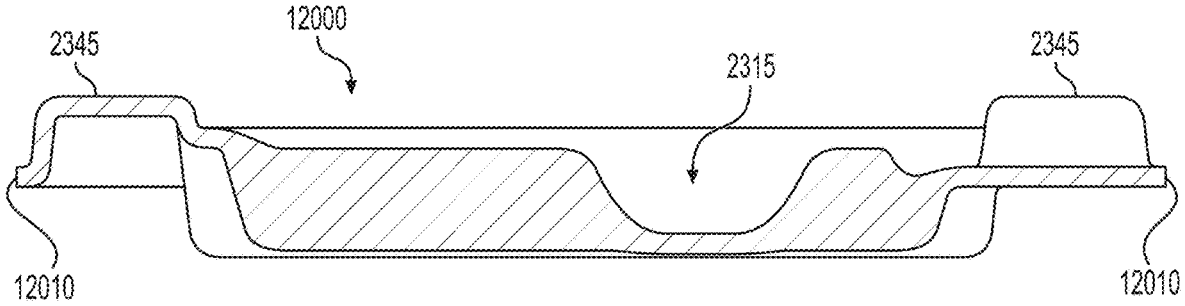
Figure 120L:
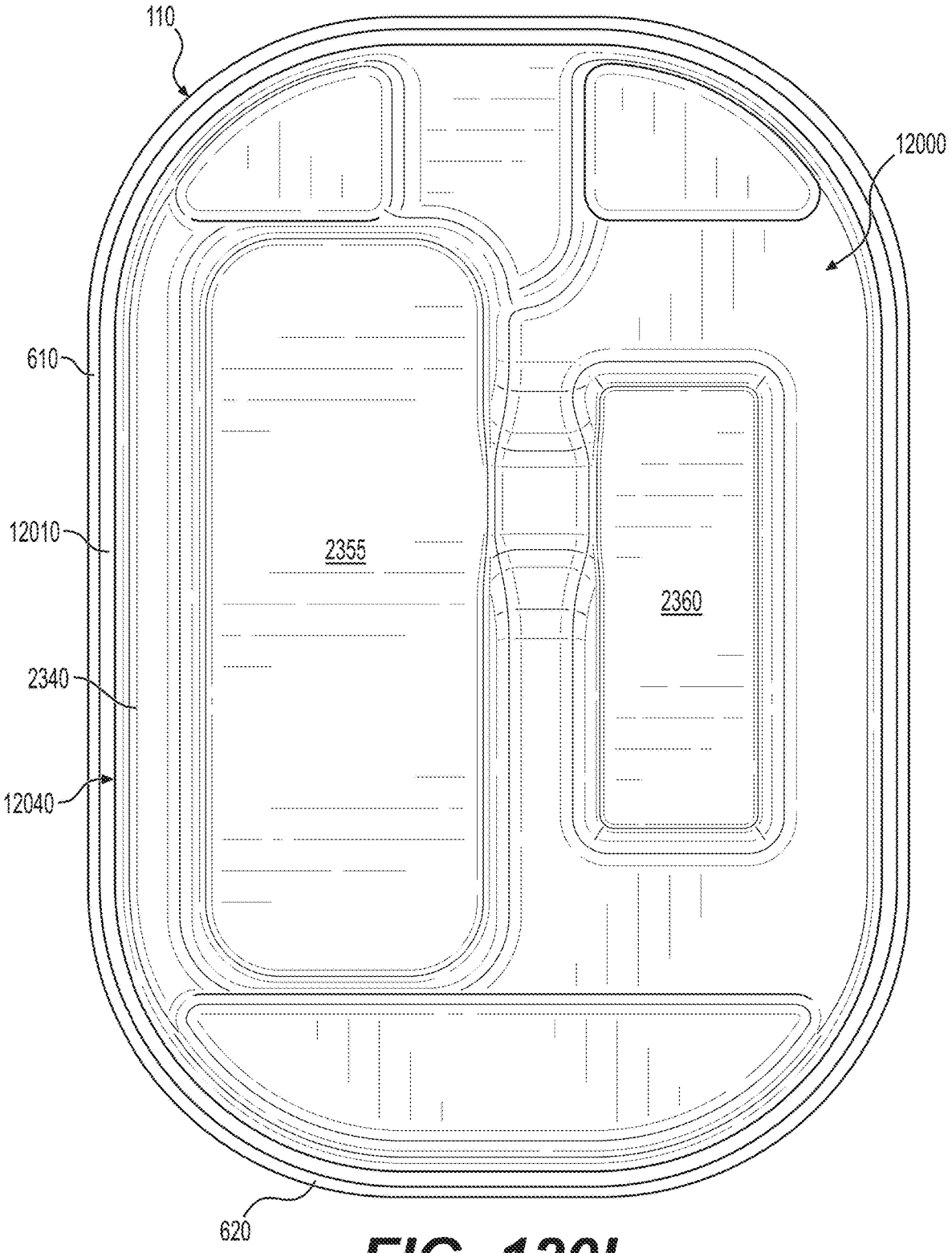
Figure 121A:
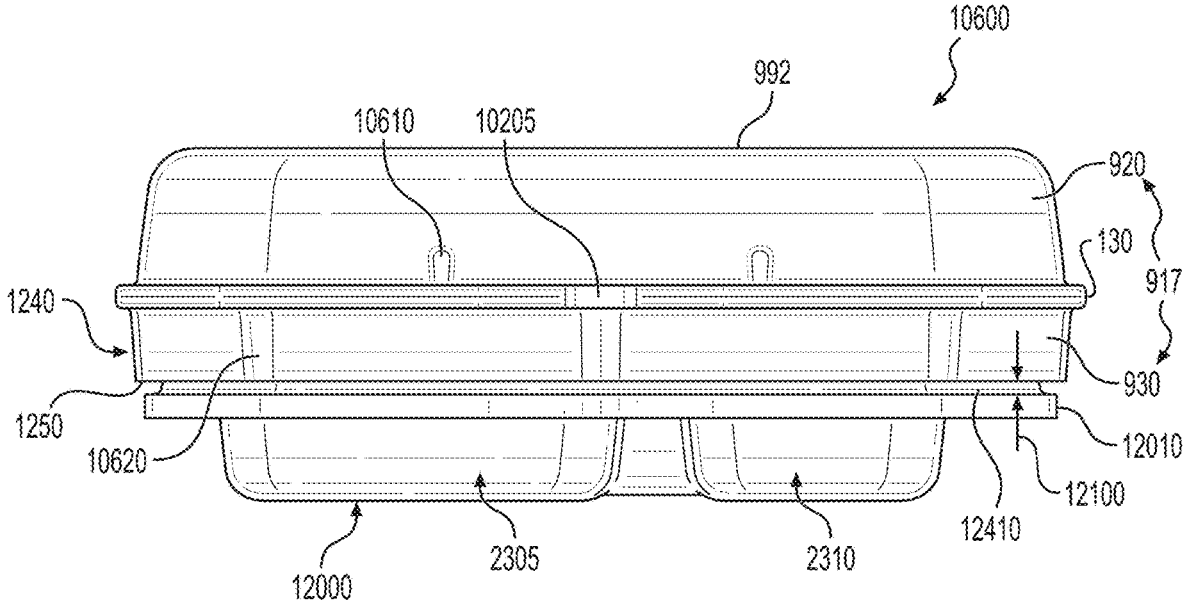
Figure 121B:
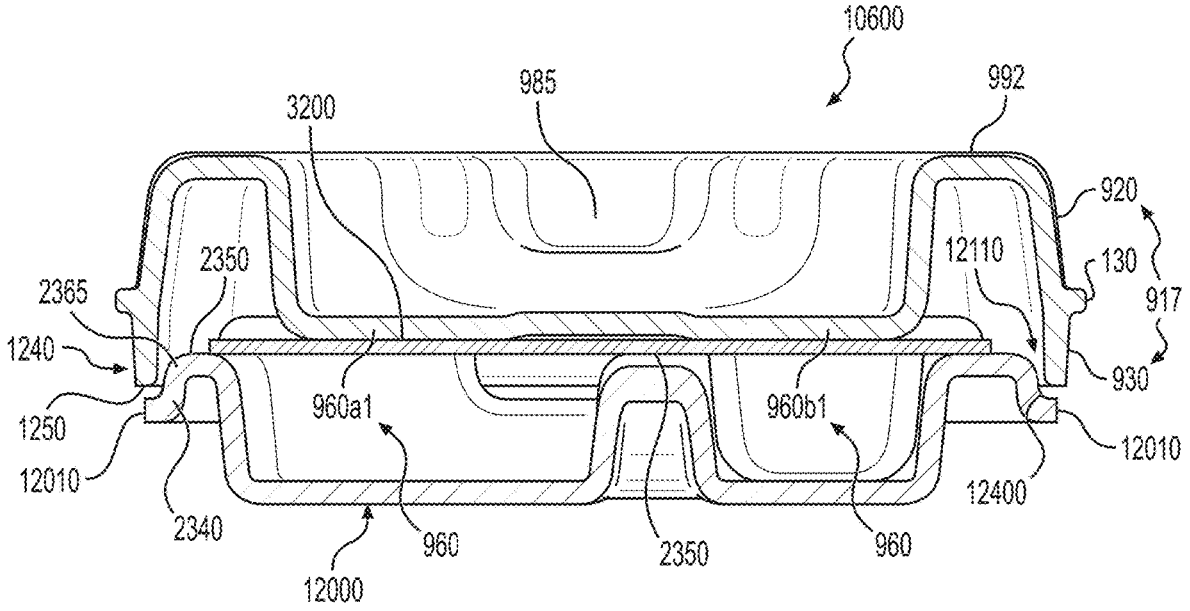
Figure 122:
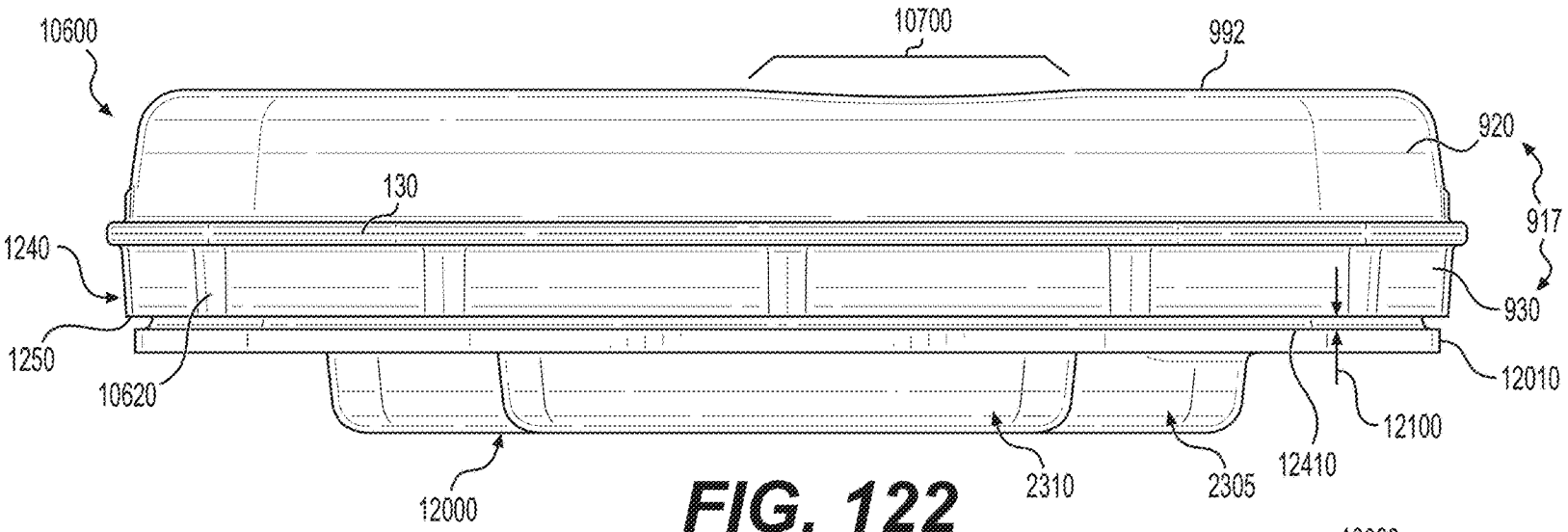
Figure 123:
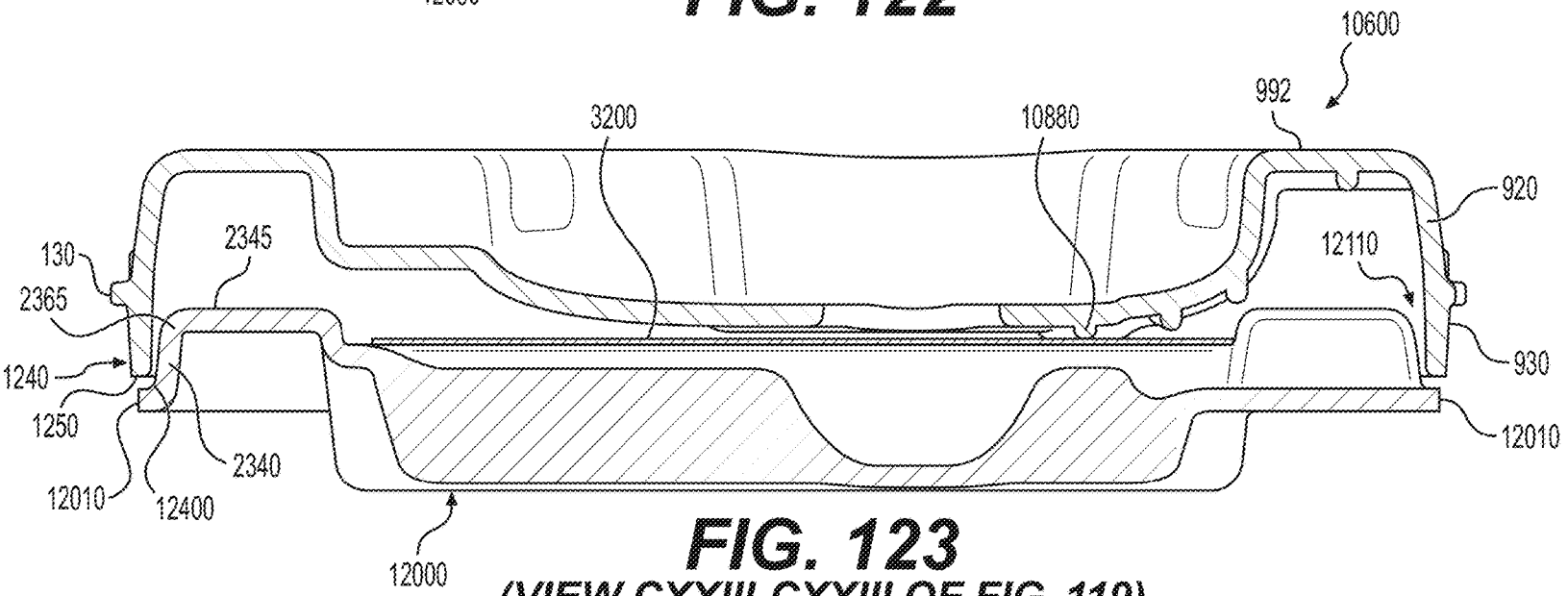
Figure 124:
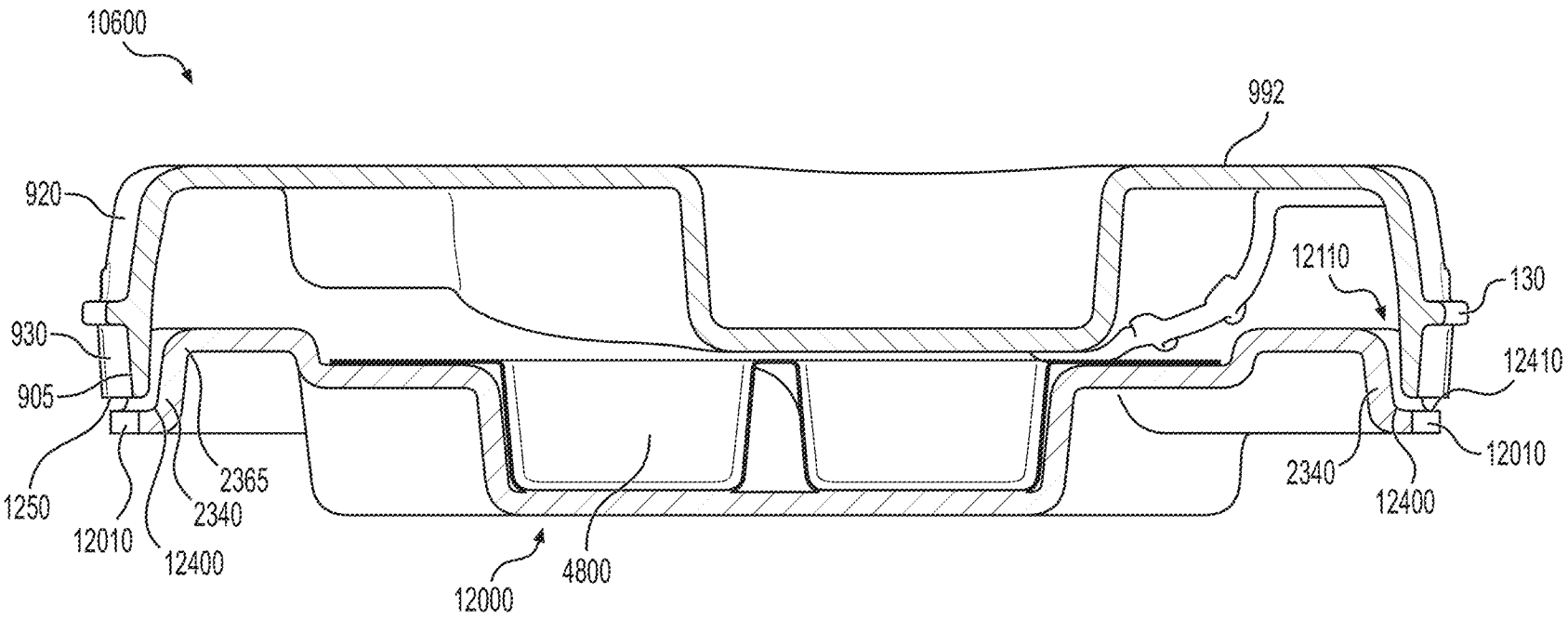
Figure 125:
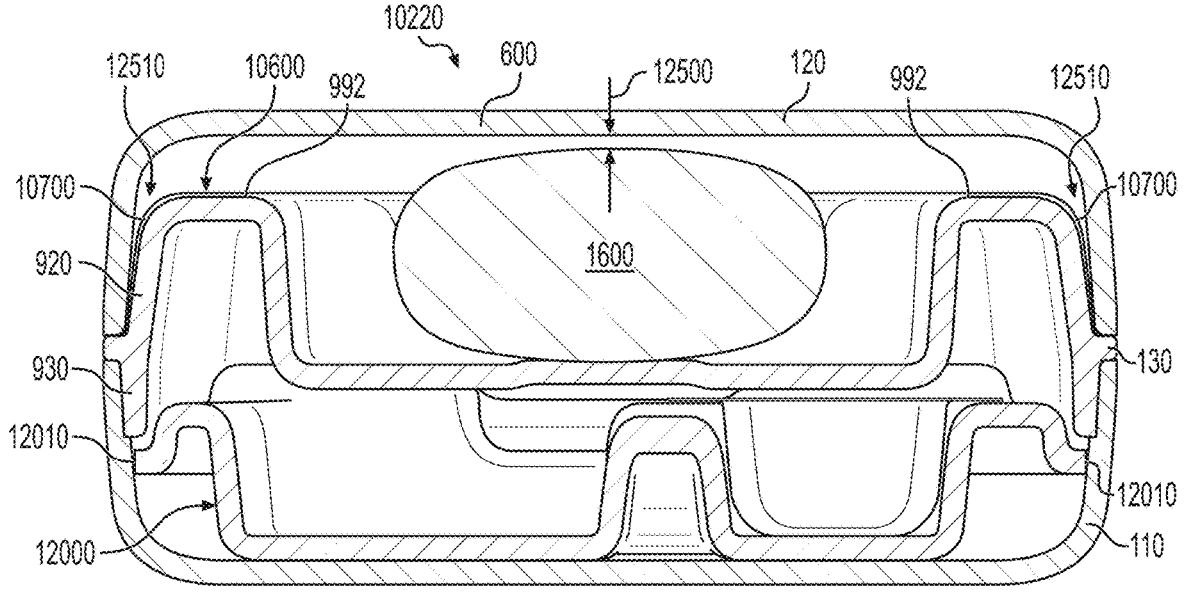
Figure 126:
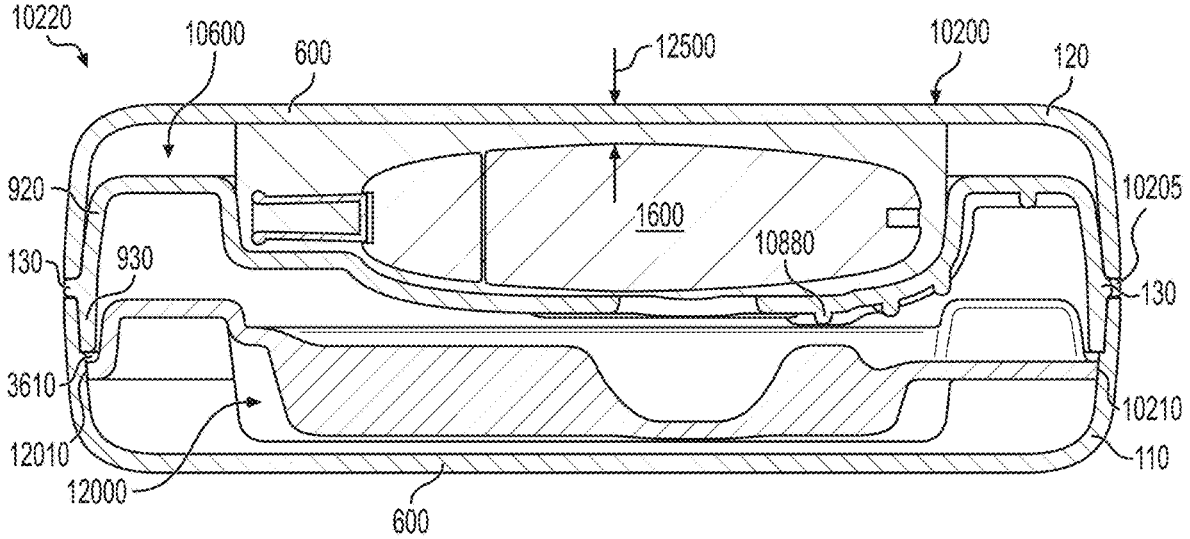
Figure 127:
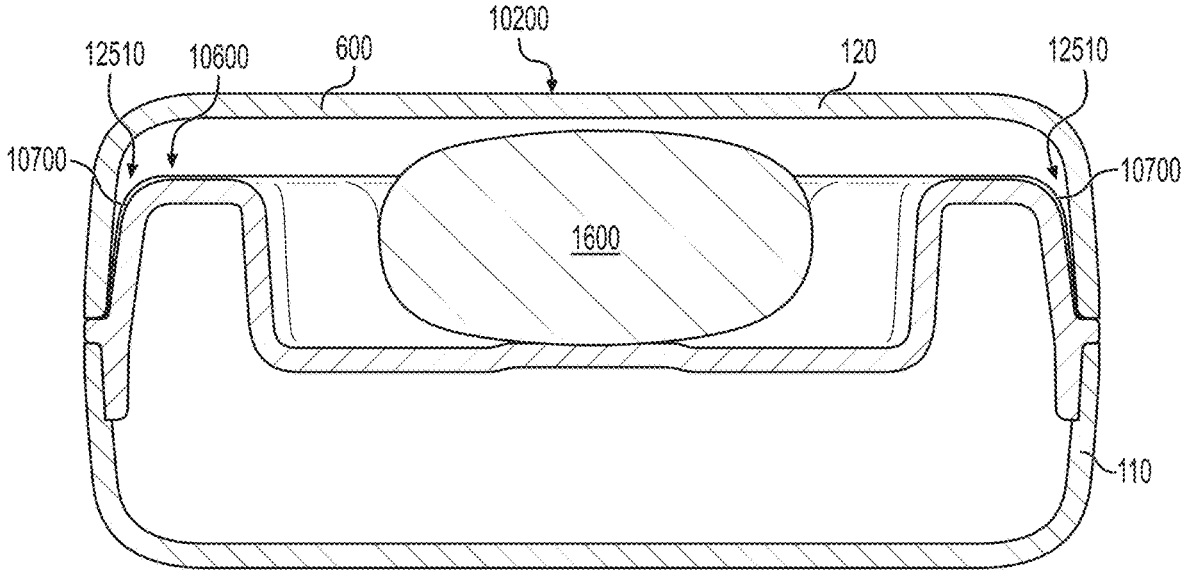
Figure 128:
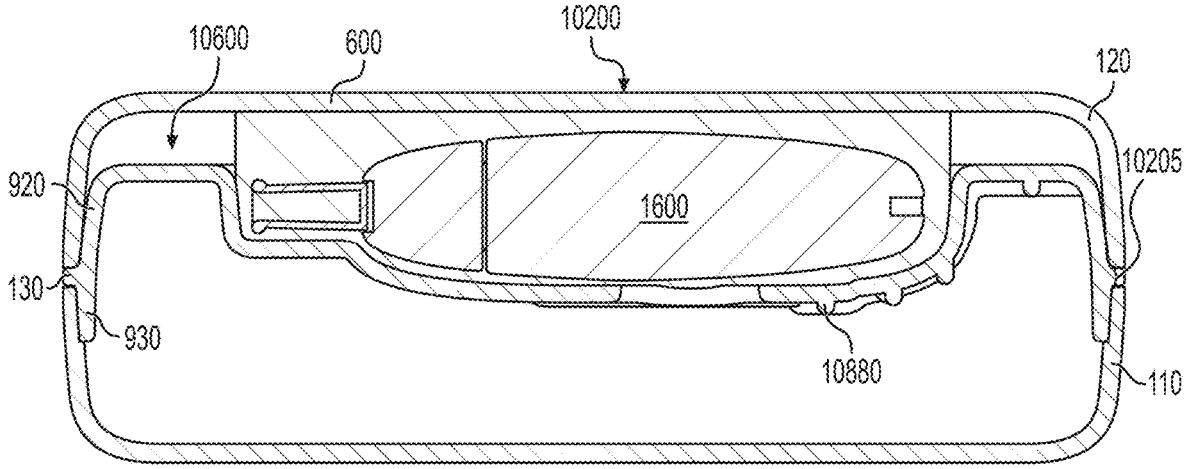

FIG. 120F is an illustration of another bottom, perspective view of the second tray, in accordance with at least one example embodiment;

FIG. 120G is an illustration of a side view of the second tray, in accordance with at least one example embodiment;

FIG. 120H is an illustration of another side view of the second tray, in accordance with at least one example embodiment;

FIG. 120I is an illustration of a cross-sectional view (view CXXI-CXXI of FIG. 120C) of the second tray, in accordance with at least one example embodiment;

FIG. 120J is an illustration of another cross-sectional view (view CXXI-CXXI of FIG. 120C) of the second tray, where the second tray is holding consumer information material, in accordance with at least one example embodiment;

FIG. 120K is an illustration of another cross-sectional view (view CXXK-CXXK of FIG. 120C) of the second tray, in accordance with at least one example embodiment;

FIG. 120L is an illustration of an overhead view of the second tray within the first section of the outer container, in accordance with at least one example embodiment;

FIG. 121A is an illustration of the first tray on top of to the second tray, in accordance with at least one example embodiment;

FIG. 121B is an illustration of a cross-sectional view (view CXXI-CXXI of FIG. 119) of the first tray on top of the second tray, in accordance with at least one example embodiment;

FIG. 122 is an illustration of the first tray on top of the second tray, in accordance with at least one example embodiment;

FIG. 123 is an illustration of a cross-sectional view (view CXXIII-CXXIII of FIG. 119) of the first tray on top of the second tray, in accordance with at least one example embodiment;

FIG. 124 is an illustration of another cross-sectional view (view CXXIV-CXXIV of FIG. 119) of the first tray on top of the second tray, in accordance with at least one example embodiment;

FIG. 125 is an illustration of a cross-sectional view (view CXXV-CXXV of FIG. 102) of the outer container containing the first tray and the second tray, in accordance with at least one example embodiment;

FIG. 126 is an illustration of another cross-sectional view (view CXXVI-CXXVI of FIG. 102) of the outer container containing the first tray and the second tray, in accordance with at least one example embodiment;

FIG. 127 is an illustration of a cross-sectional view (view CXXV-CXXV of FIG. 102) of the outer container containing the first tray and not the second tray, in accordance with at least one example embodiment; and FIG. 128 is an illustration of another cross-sectional view (view CXXVI-CXXVI of FIG. 102) of the outer container containing the first tray and not the second tray, in accordance with at least one example embodiment.

DETAILED DESCRIPTION

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Package

Figure 1:
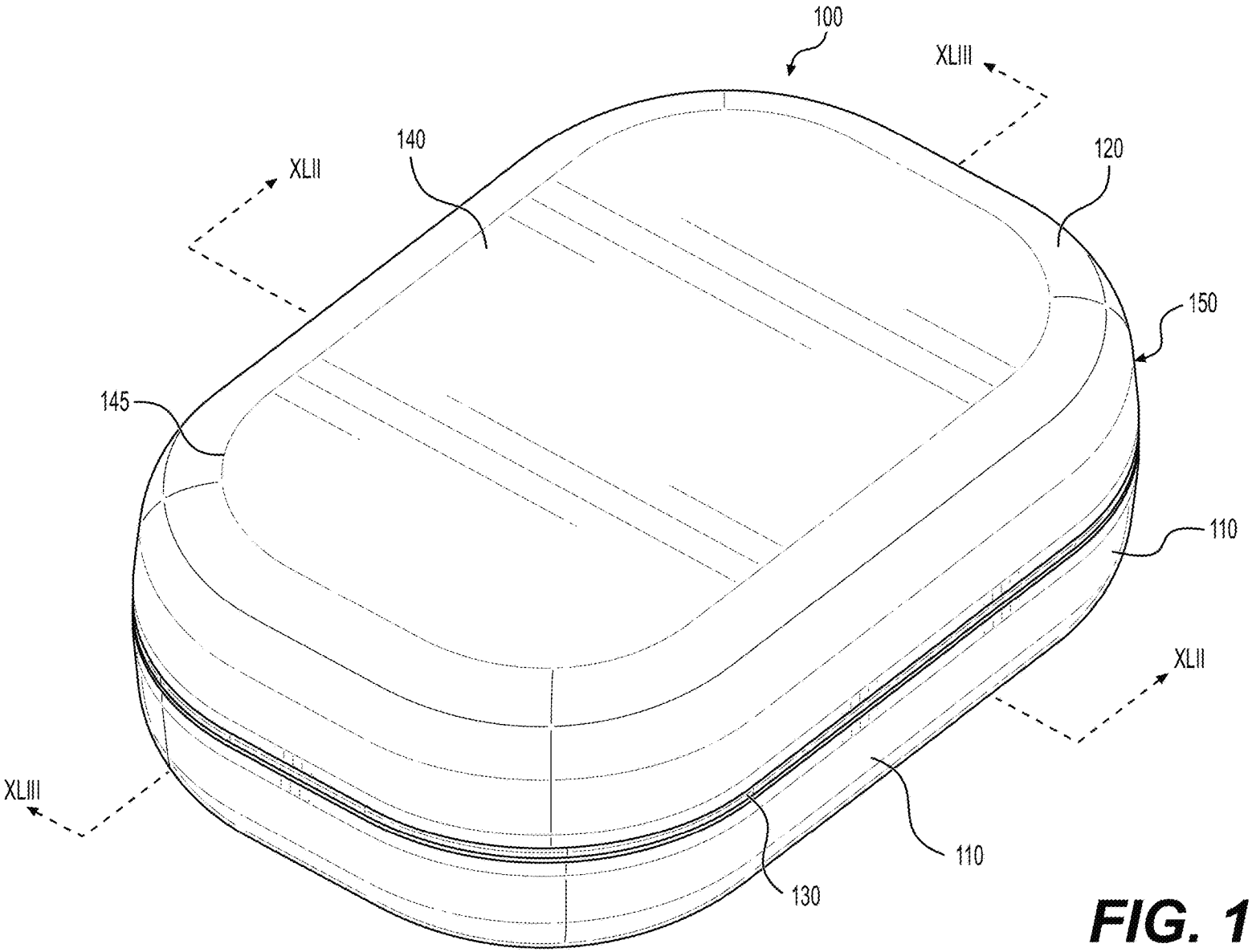
FIG. 1 is an illustration of a perspective view of an outer container for a package, in accordance with at least one example embodiment.
Figure 2:
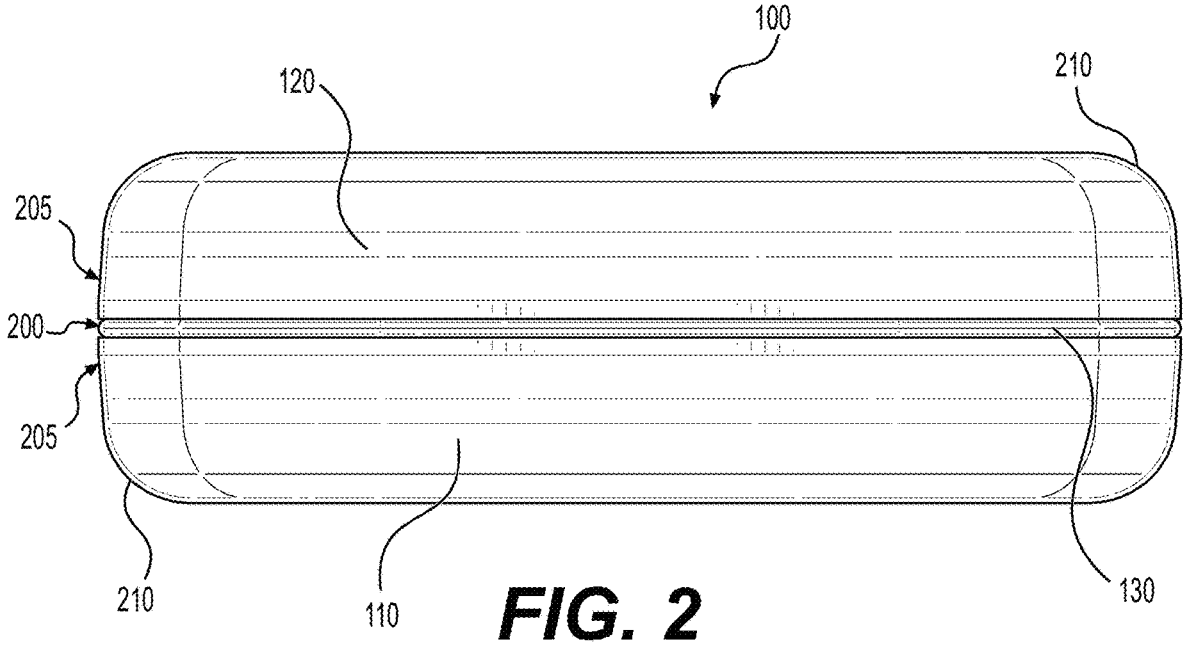
FIG. 2 is an illustration of a side view of the outer container, in accordance with at least one example embodiment.
Figure 3:
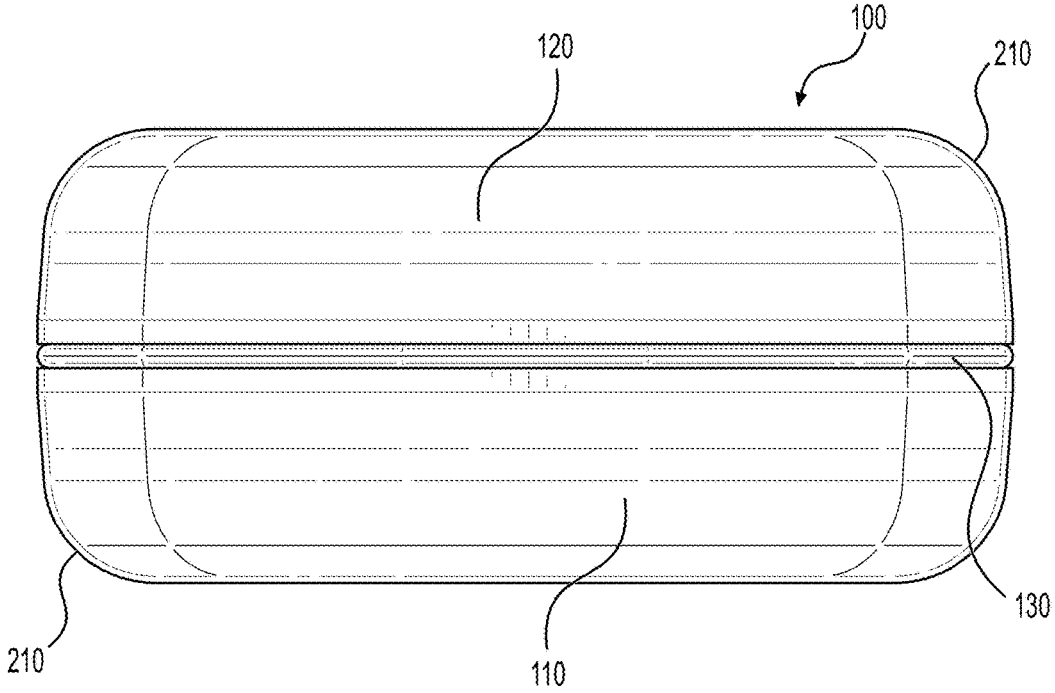
FIG. 3 is an illustration of a front view of the outer container, in accordance with at least one example embodiment.
Figure 4:
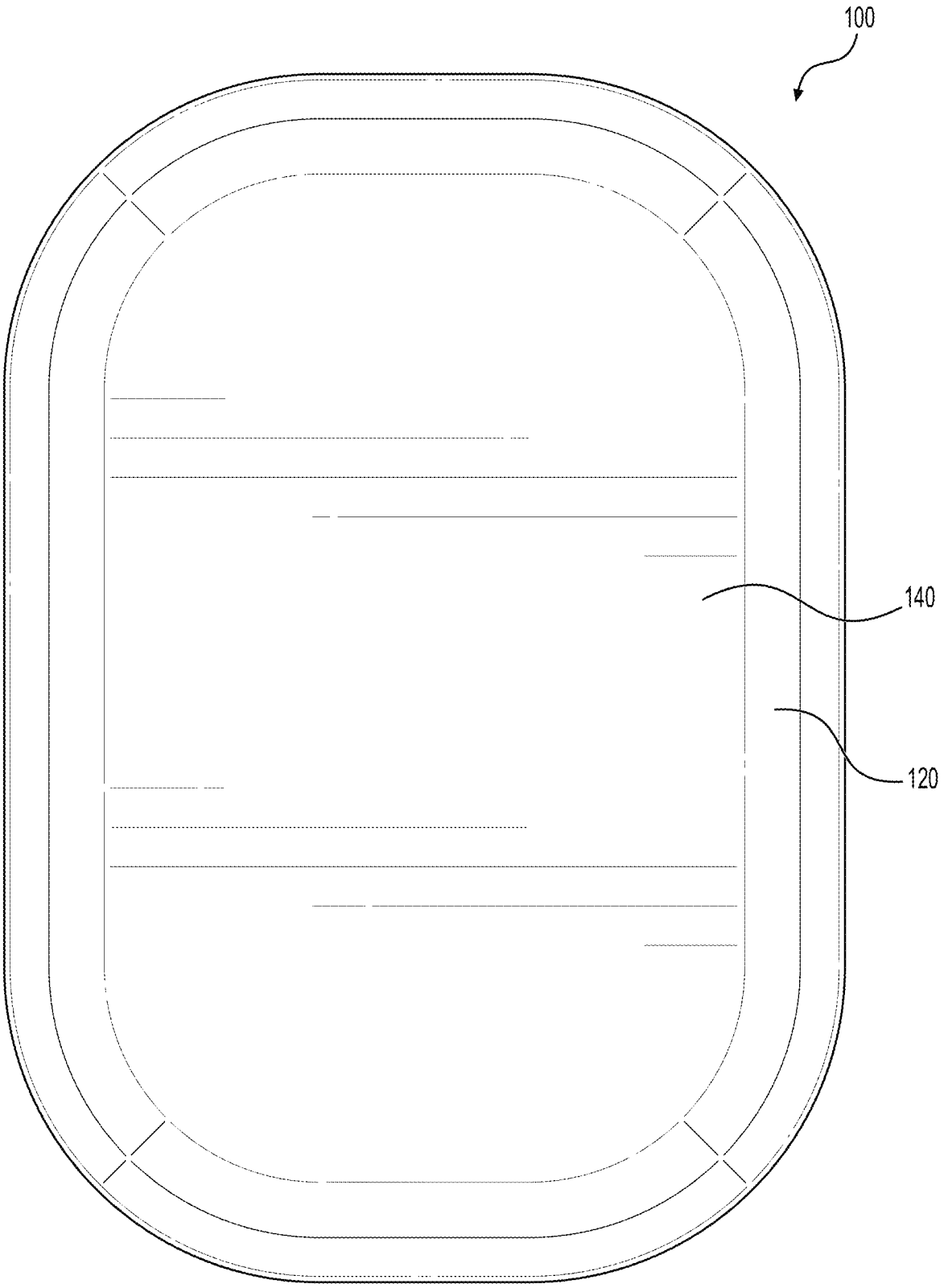
FIG. 4 is an illustration of a top view of the outer container, in accordance with at least one example embodiment.

FIG. 1 is an illustration of a perspective view of an outer container 100, in accordance with at least one example embodiment. FIG. 2 is an illustration of a side view of the outer container 100, in accordance with at least one example embodiment. FIG. 3 is an illustration of a front view of the outer container 100, in accordance with at least one example embodiment. FIG. 4 is an illustration of a top view of the outer container 100, in accordance with at least one example embodiment.

In at least one example embodiment, the outer container 100 includes a first section 110 and a second section 120. In at least one example embodiment, the first section 110 is a lower section of the outer container 100 and the second section 120 is an upper section of the outer container 100. In at least one example embodiment, the first section 110 and the second section 120 combine to form a "clam shell" type configuration for the outer container 100. In at least one example embodiment, the first section 110 and the second section 120 are identical to each other and are therefore interchangeable with each other.

In at least one example embodiment, a ridge 130 of a first tray 500 (see at least FIG. 9) extends between the first section 110 and the second section 120 when the outer container 100 is in a "closed" configuration and the outer container 100 contains the first tray 500 (see FIGS. 1-3). In at least one example embodiment, the ridge 130 helps form part of an outer surface 150 of a package 4600 that includes the outer container 100 (see FIG. 47), and an outer surface 200 of the ridge 130 is therefore substantially visible, when the outer container 100 is in the "closed" configuration and the outer container 100 contains the first tray 500. In at least one example embodiment, the outer surface 200 of the ridge 130 is flush with an outer surface 205 of the first section 110 and the second section 120, when the outer container 100 is in the "closed" configuration (see FIG. 2).

In at least one example embodiment, the outer surfaces 205 of the first section 110 and the second section 120 each have a flat major surface 140 (FIG. 1). In at least one example embodiment, the flat major surface 140 of the first section 110 and the second section 120 are parallel to each other and oppose each other on the outer container 100. In at least one example embodiment, the flat major surface 140 has a rectangular shape with rounded corners 145. In at least one example embodiment, the outer surface 205 of the first section 110 and the second section 120 have rounded side edges 210 (see FIGS. 2 and 3).

Figure 5:
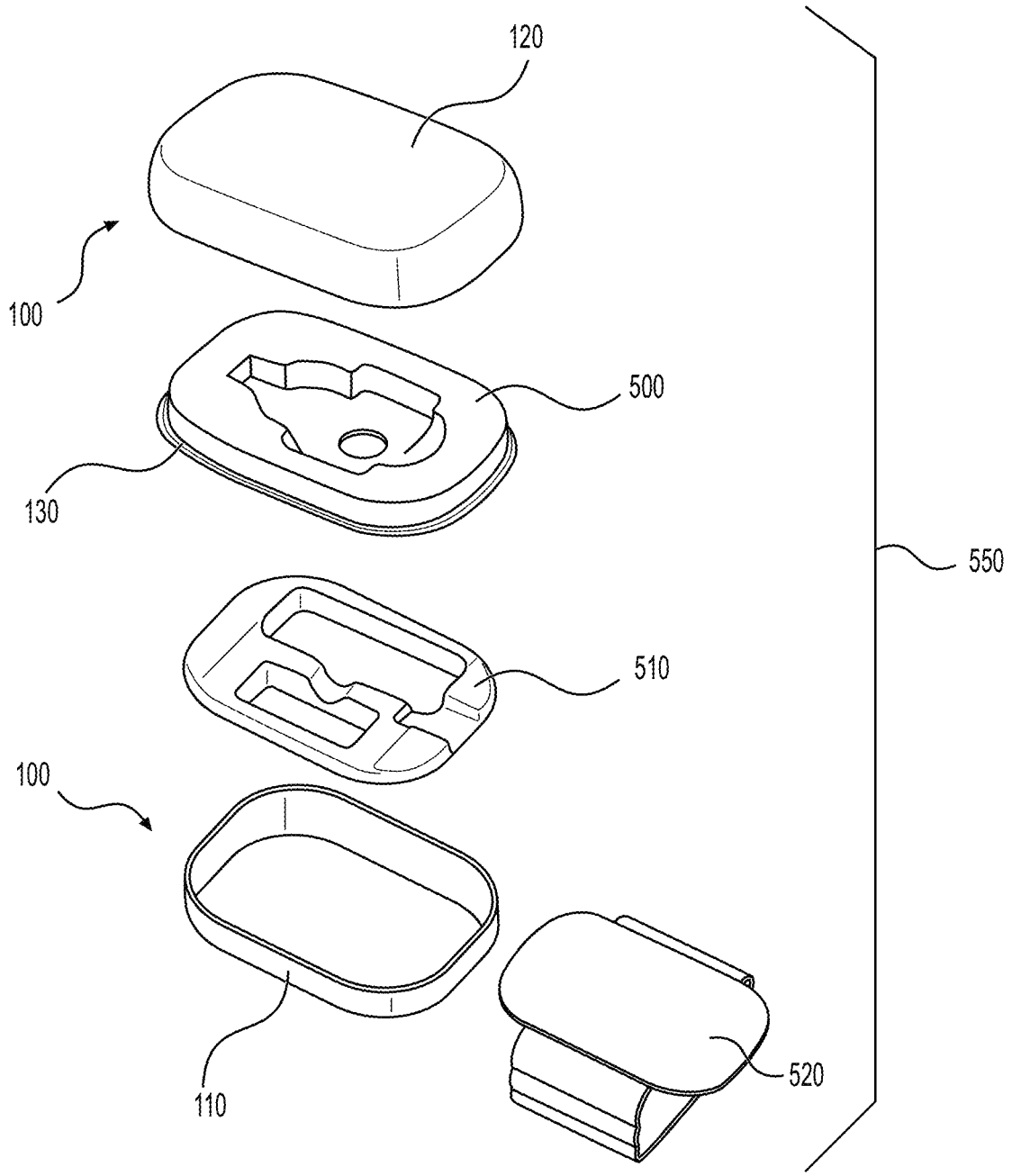
FIG. 5 is an illustration of an exploded view of elements of the package, in accordance with at least one example embodiment.

FIG. 5 is an illustration of an exploded view of major elements 550 of the package 4600 (see FIG. 47), in accordance with at least one example embodiment.

In at least one example embodiment, the major elements 550 include the outer container 100 (the first section 110 and the second section 120), the first tray 500, a second tray 510 and a band 520. In at least one example embodiment, when the outer container 100 is in the "closed" configuration, the outer container 100 can contain both the first tray 500 and the second tray 510. In at least one example embodiment, the first tray 500 and the second tray 510 are removable from the outer container 100, and the first tray 500 and the second tray 510 are able to be inserted back into the outer container 100 after being removed from the outer container 100. In at least one example embodiment, the band 520 circumscribes at least a portion of the outer container 100 to form the package 4600 (see FIG. 47). In at least one example embodiment, the band 520 is a "belly band" that circumscribes at least a portion of a mid-section of the outer container 100 (as shown in at least FIG. 47).

In at least one example embodiment, the outer container 100, the first tray 500 and the second tray 510 are made from a same material. In at least one example embodiment, the outer container 100, the first tray 500 and the second tray 510 are made from a recyclable material. In at least one example embodiment, the outer container 100, the first tray 500 and the second tray 510 are made from a cardboard material or a cardboard composite, PaperFoam®, industrial starch including potatoes or tapioca mixed with cellulose fibers, wood pulp, biopolymers, other suitable packaging materials, or combinations thereof. In at least one example embodiment, the outer container 100, the first tray 500 and the second tray 510 are made from different materials.

Figure 6:
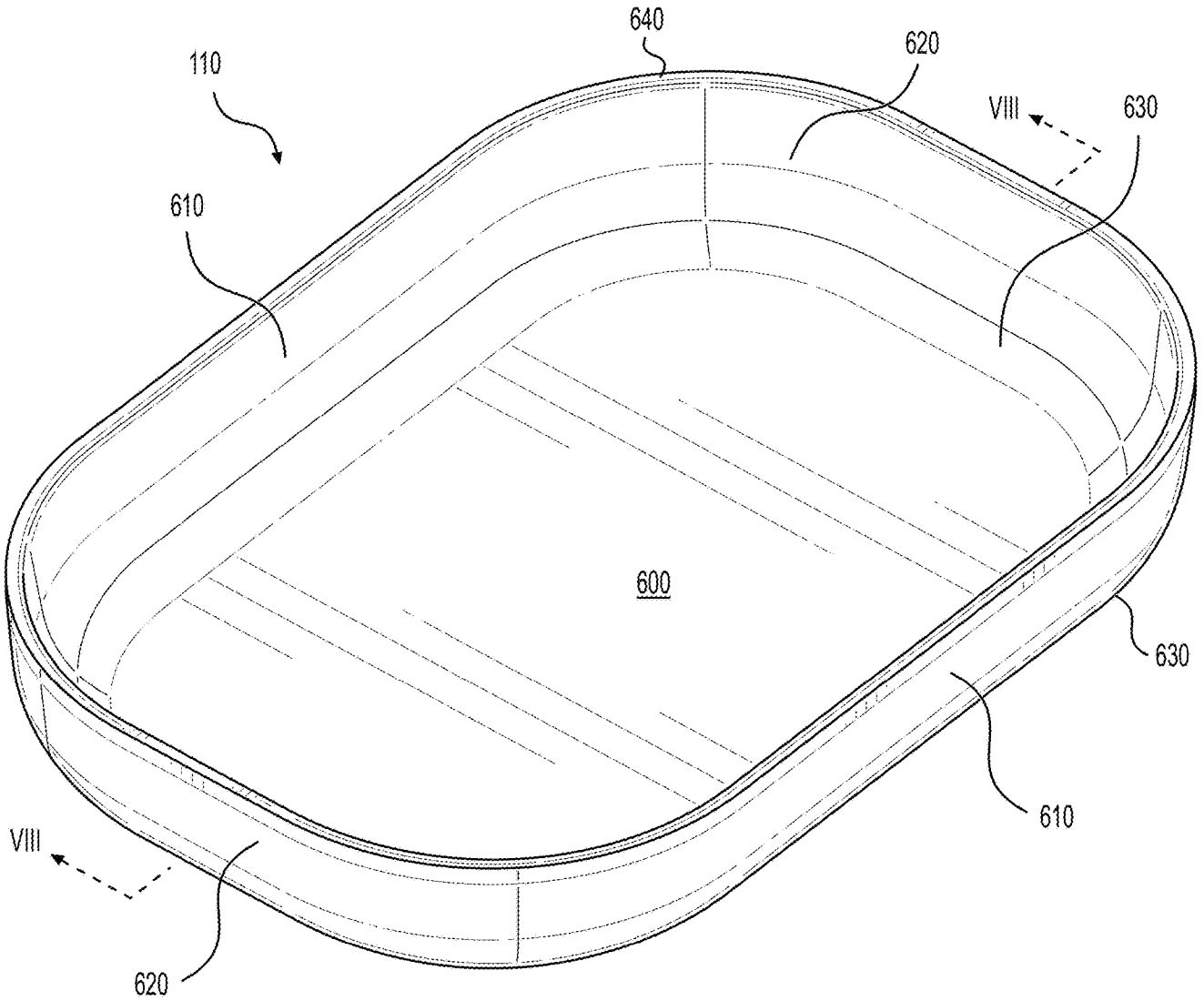
FIG. 6 is an illustration of a perspective view of a first section of an outer container of the package, in accordance with at least one example embodiment.
Figure 7:
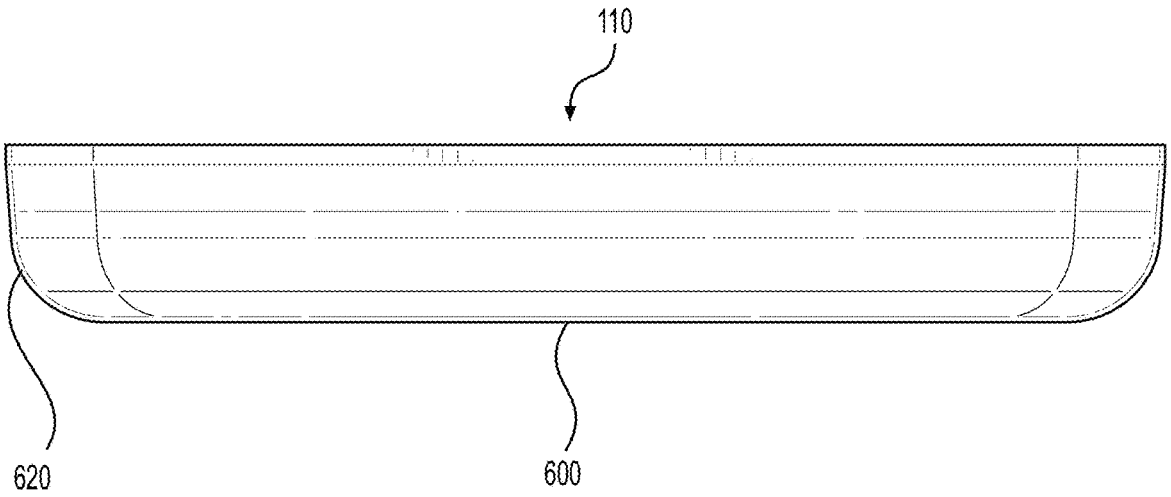
FIG. 7 is an illustration of a side view of the first section of the outer container, in accordance with at least one example embodiment.
Figure 8:
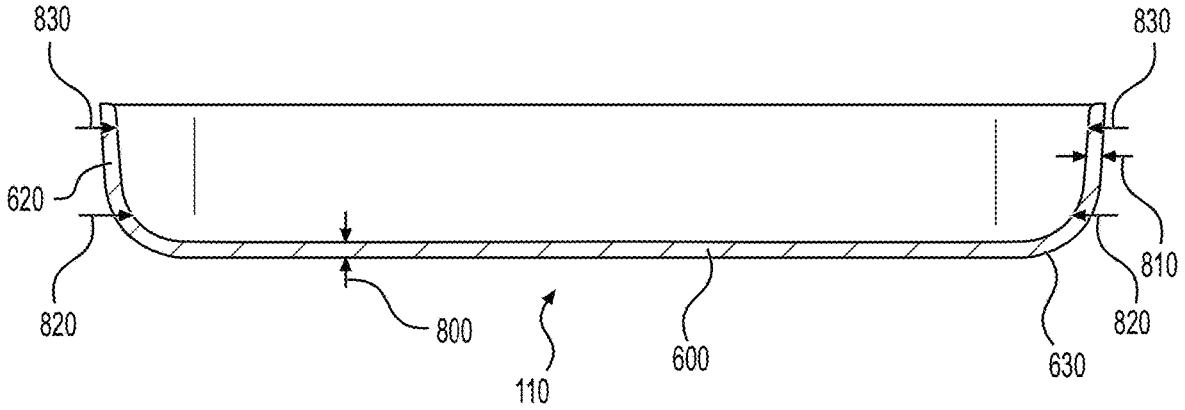
FIG. 8 is an illustration of a cross-sectional view (view VIII-VIII of FIG. 6) of the first section of the outer container, in accordance with at least one example embodiment.

FIG. 6 is an illustration of a perspective view of the first section 110, in accordance with at least one example embodiment. FIG. 7 is an illustration of a side view of the first section 110, in accordance with at least one example embodiment. FIG. 8 is an illustration of a cross-sectional view (view VIII-VIII of FIG. 6) of the first section 110, in accordance with at least one example embodiment. In one embodiment, the first section 110 and the second section 120 are identical. Accordingly, the following description of the first section 110 equally applies to the second section 120.

In at least one example embodiment, the first section 110 includes an end wall (floor) 600, first sidewalls 610 and second sidewalls 620. In at least one example embodiment, the first sidewalls 610 have a longer longitudinal length relative to the second sidewalls 620 (as shown in FIG. 6), thereby giving the outer container 100 a rectangular shape from an overhead perspective (see FIG. 4). In another example embodiment, the first sidewalls 610 and the second sidewalls 620 are a same longitudinal length, thereby giving the outer container 100 a square shape from an overhead perspective (not shown). Other shapes of the outer container 100 are contemplated.

In at least one example embodiment, the first section 110 includes rounded corners 630 where the end wall 600 meets the first sidewalls 610 and the second sidewalls 620. In at least one example embodiment, the first sidewalls 610 and the second sidewalls 620 have a peripheral edge 640 that is a distal-most end of the first sidewalls 610 and the second sidewalls 620. In at least one example embodiment, the peripheral edge 640 of the first section 110 and the second section 120 grip the ridge 130 of the first tray 500 when the outer container 100 is in the closed position and contain the first tray 500 (see at least FIGS. 1 and 42-43).

In at least one example embodiment, a first thickness 800 of the end wall 600 is the same as a second thickness 810 of the second sidewalls 620 and/or the first sidewalls 610, such that the first section 110 has a uniform thickness. In at least one example embodiment, the second sidewalls 620 and the first sidewalls 610 are the same second thickness 810. In at least one example embodiment, the first thickness 800 is larger than the second thickness 810. In at least one example embodiment, the first thickness 800 and the second thickness 810 are both in the range of about 1.5 mm to 3.5 mm, or about 2.0 mm to 3.0 mm, or about 2 mm.

In at least one example embodiment, the second sidewalls 620 (and likewise the first sidewalls 610) are slightly flared outward, such that a first distance 820 across an interior longitudinal length of the first section 110 is smaller than a second distance 830 across the interior longitudinal length of the first section 110.

Figure 9:
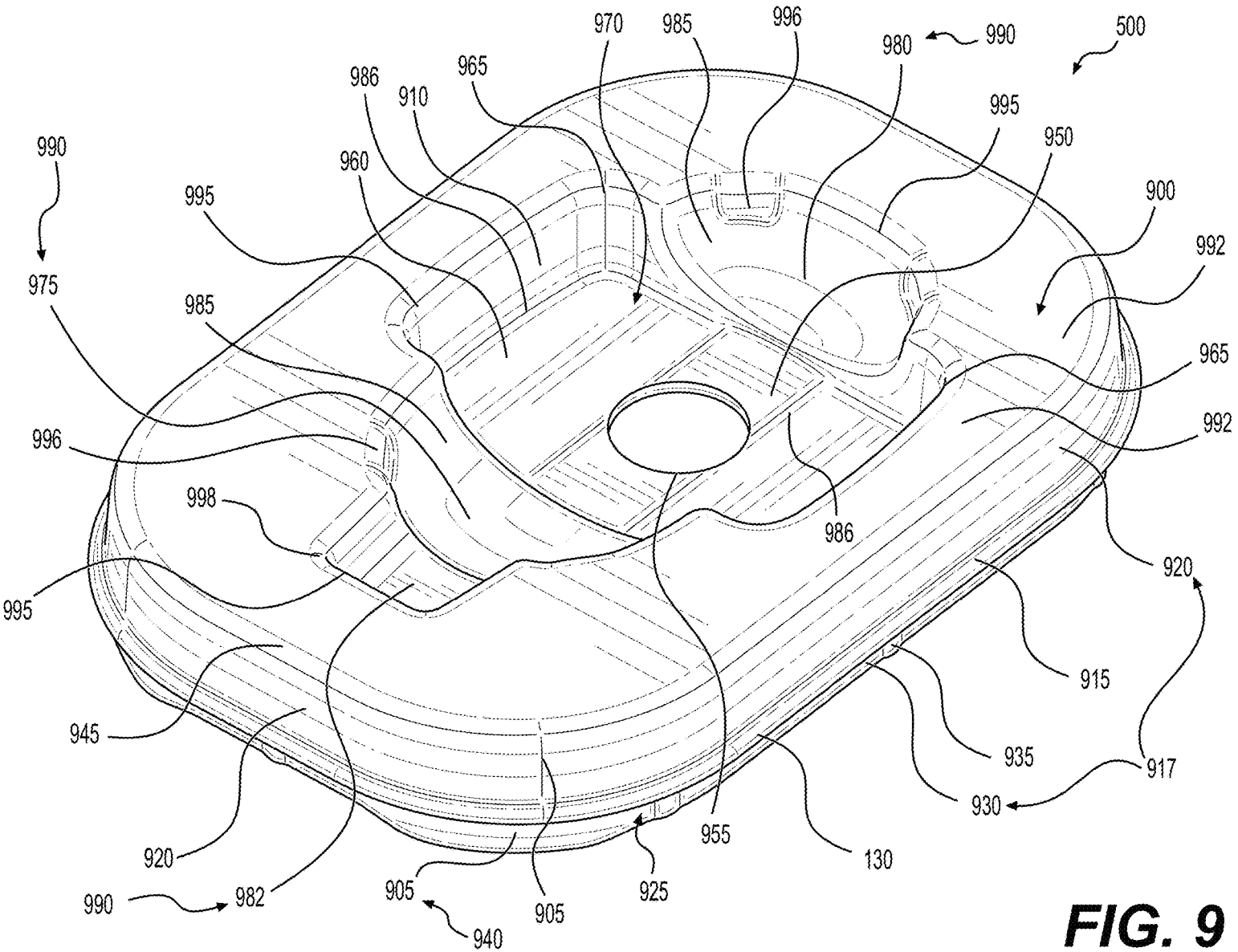
FIG. 9 is an illustration of a perspective view of a first tray of the package, in accordance with at least one example embodiment.
Figure 10:
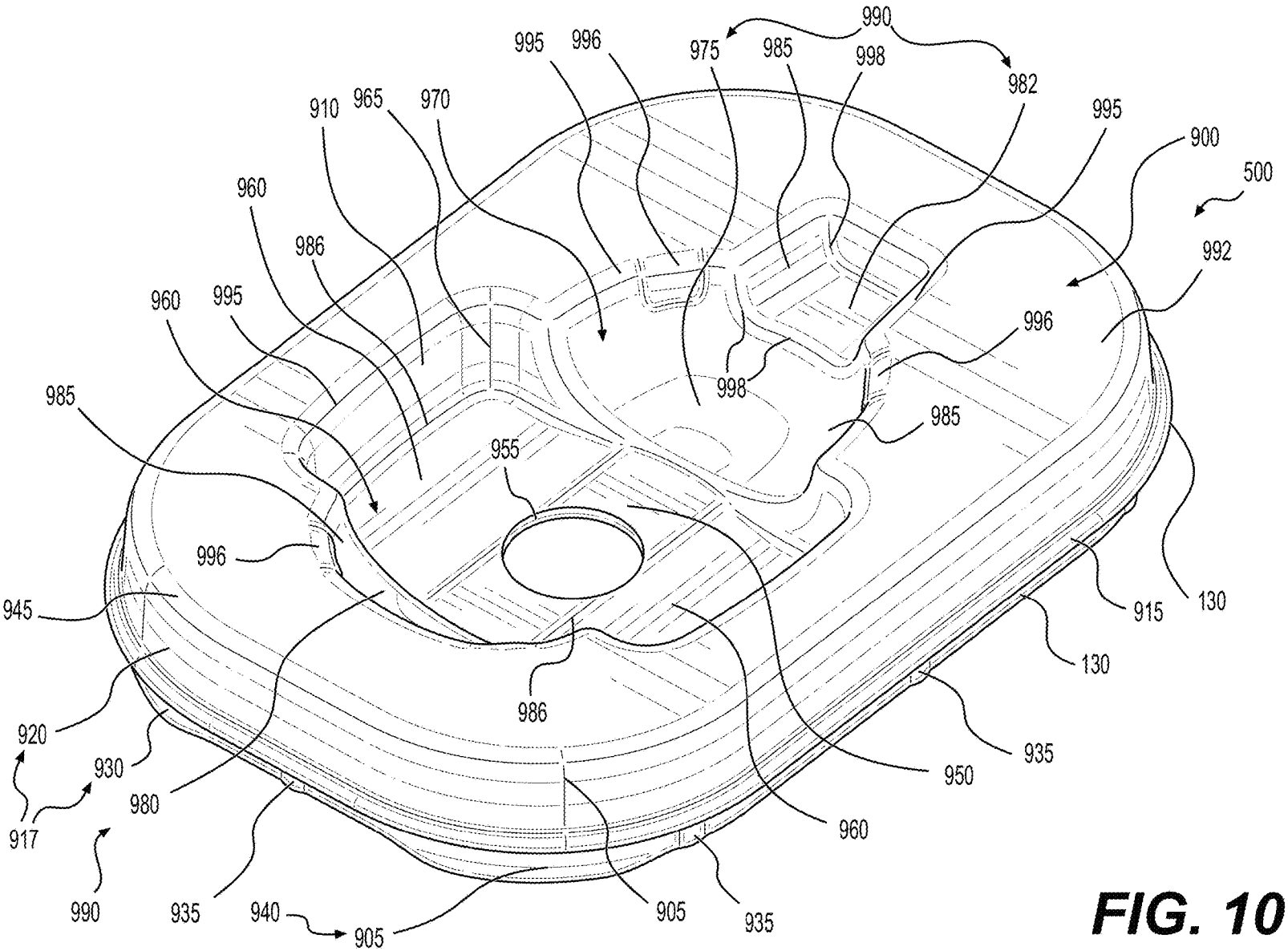
FIG. 10 is an illustration of another perspective view of the first tray, in accordance with at least one example embodiment.
Figure 11:
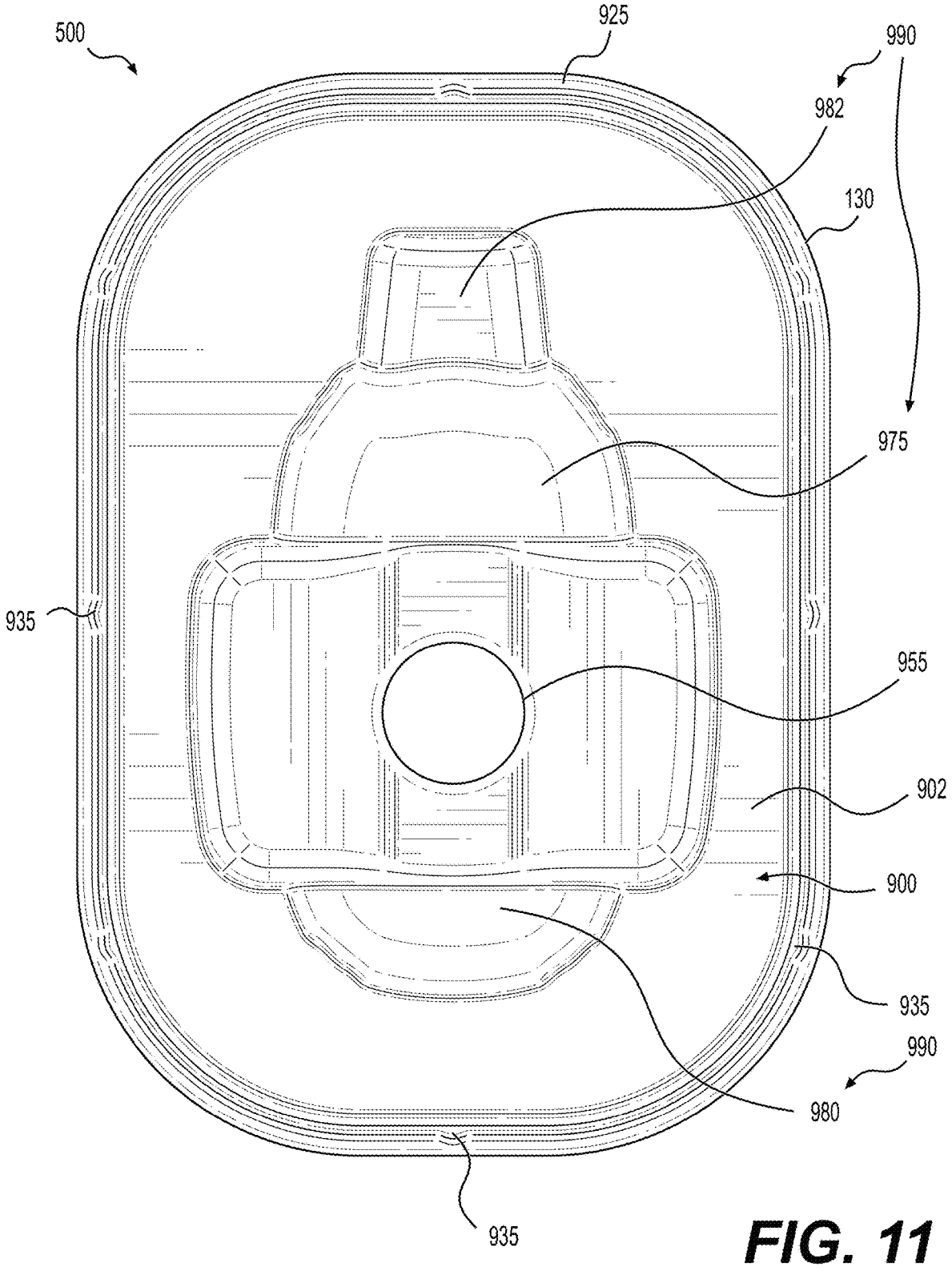
FIG. 11 is an illustration of a bottom view of the first tray, in accordance with at least one example embodiment.

FIGS. 9-10 are illustrations of perspective views of the first tray 500, in accordance with at least one example embodiment. FIG. 11 is an illustration of a bottom view of the first tray 500.

In at least one example embodiment, the first tray 500 includes an upper wall 900. In at least one example embodiment, the first tray 500 includes sidewalls 917 that circumscribe a periphery of an upper portion of the first tray 500. In at least one example embodiment, the ridge 130 divides the sidewalls 917 into upper sidewalls 920 and lower sidewalls 930. In at least one example embodiment, an upper ledge 915 and a lower ledge 925 are upper and lower surfaces that are defined by the ridge 130. In at least one example embodiment, the upper wall 900 defines rounded edges 945 where the sidewalls 917 meet an upper (top) surface 992 of the first tray 500 along a periphery of the first tray 500. In at least one example embodiment, the sidewalls 917 define rounded corners 905 on four corners of the first tray 500. In at least one example embodiment, the lower portion 940 of the rounded corners 905 In at least one example embodiment, the lower sidewalls 930 define lugs 935. In at least one example embodiment, the lugs 935 are substantially equally spaced along the lower sidewall 930 of the first tray 500, where the lugs are oriented vertically along the lower sidewall 930 (see at least FIGS. 12 and 13). In at least one example embodiment, the lugs 935 are defined by the lower sidewalls 930 to include at least one lug on each of four sides of the first tray 500. In at least one example embodiment, the lugs 935 are positioned on the lower sidewalls 930 to keep the lower sidewalls 930 separated from the first sidewalls 610 and the second sidewalls 620 of the first section 110 (FIG. 6) when the first tray 500 is held in the first section 110, in order to allow the first tray 500 to be more easily extracted from the first section 110 of the outer container 100 and to ensure moisture does not otherwise collect between the lower sidewalls 930 and the first sidewalls 610 or the second sidewalls 620.

Figure 22:
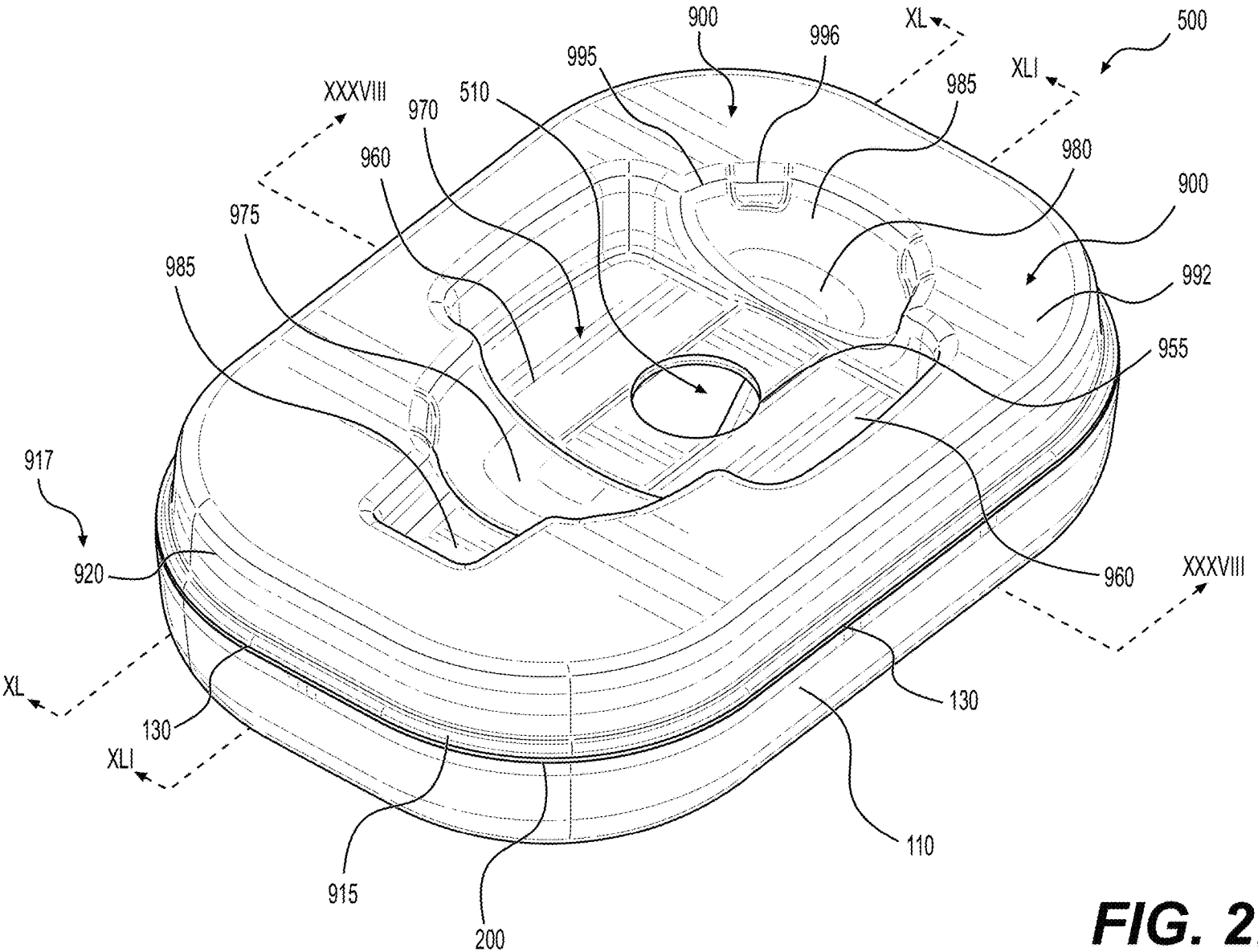
FIG. 22 is an illustration of a perspective view of the first tray and a second tray being held in the first section, in accordance with at least one example embodiment.
Figure 23:
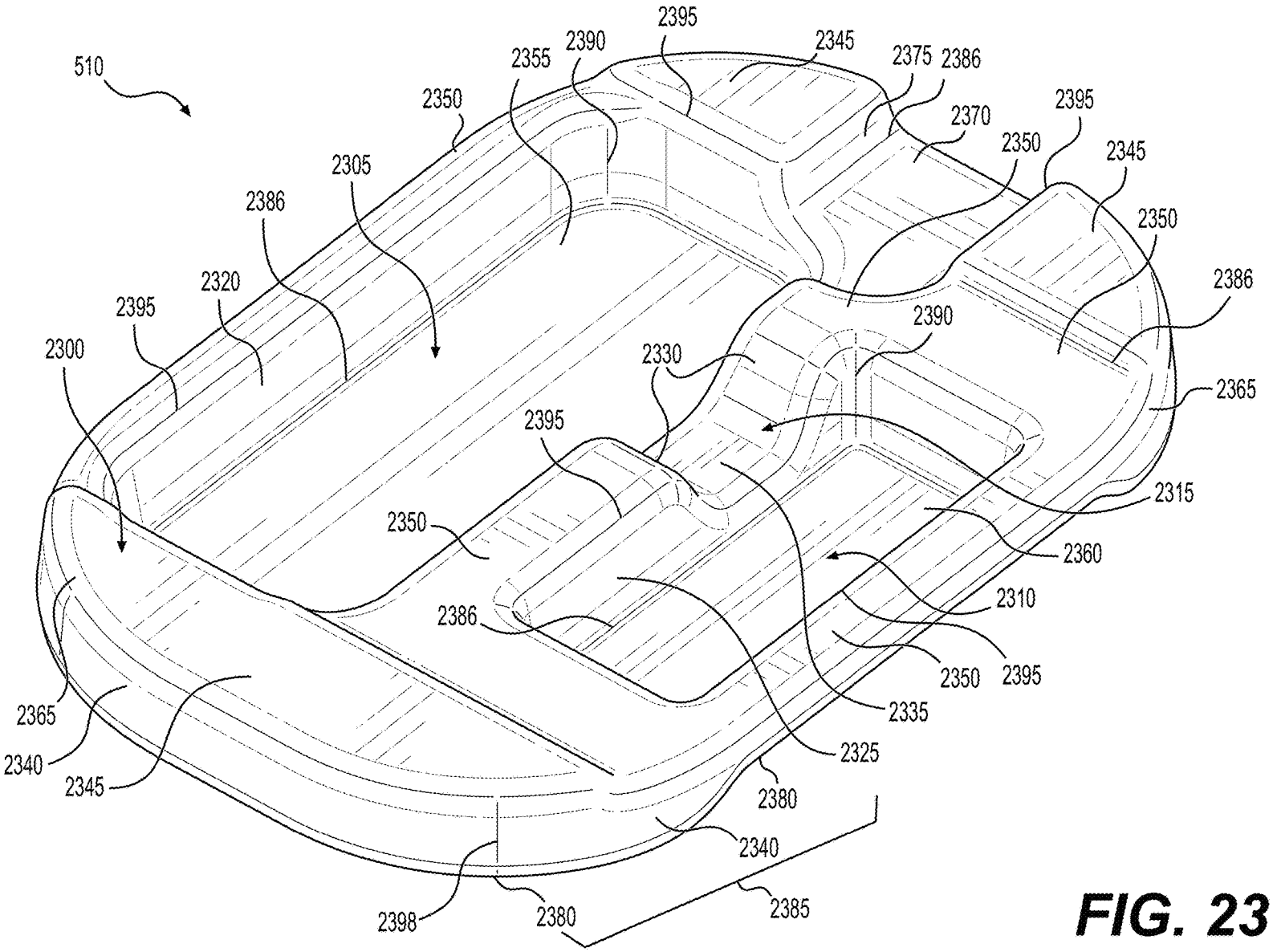
FIG. 23 is an illustration of a perspective view of the second tray, in accordance with at least one example embodiment.
Figure 24:
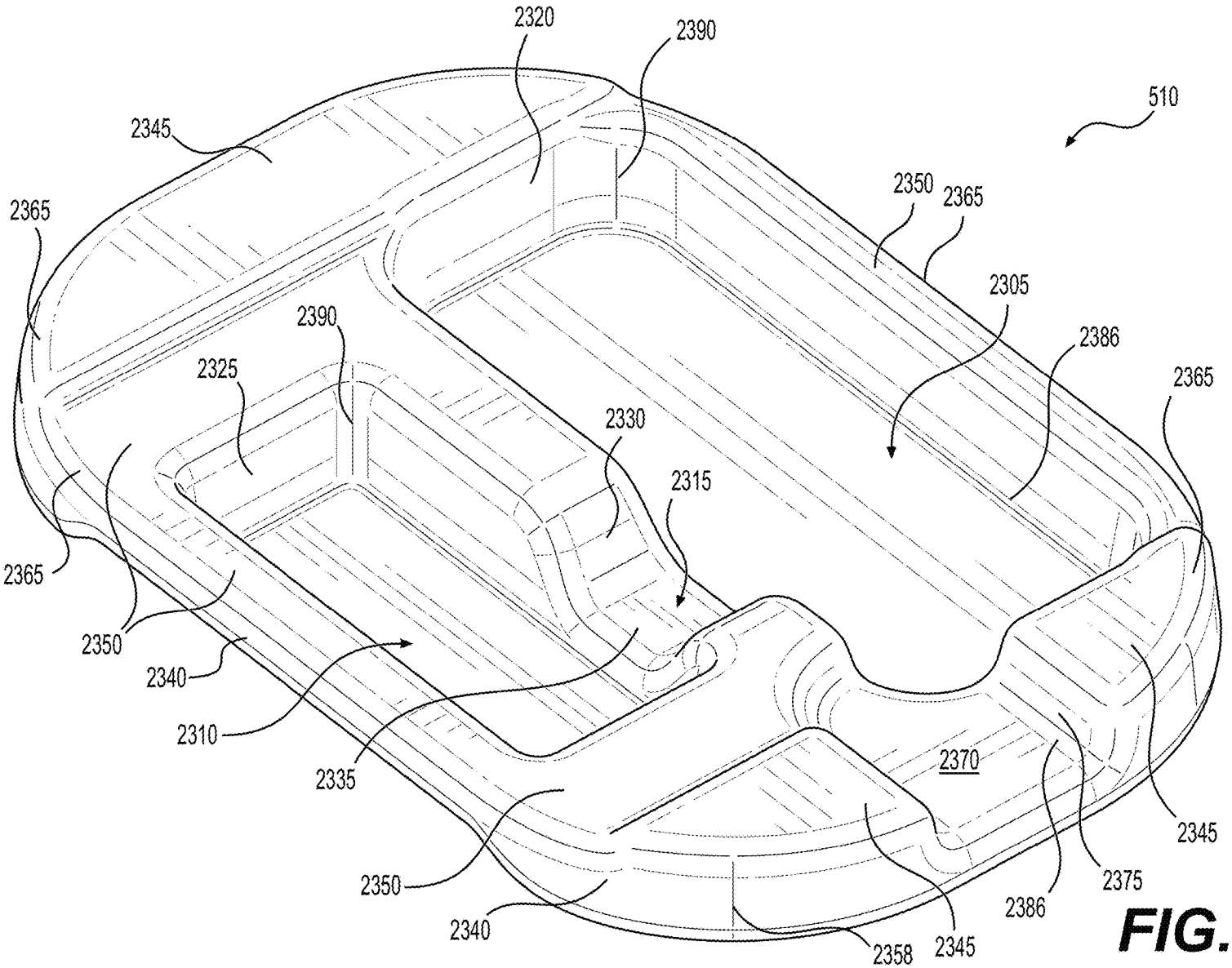
FIG. 24 is an illustration of a perspective view of the second tray, in accordance with at least one example embodiment.

In at least one example embodiment, the upper wall 900 defines a depression 970. In at least one example embodiment, the depression 970 is a partial "impression" of a consumer product 1600 (see at least FIG. 16). In at least one example embodiment, the depression 970 defines a cavity for holding the consumer product 1600. In at least one example embodiment, the depression 970 includes a floor 960. In at least one example embodiment, the floor 960 defines a raised ridge 950. In at least one example embodiment, the floor 960 defines an opening (aperture) 955. In at least one example embodiment, the opening 955 can be used to assist in disconnecting the first tray 500 from the second tray 510, or for disconnecting the first tray 500 from the first section 110 of the outer container 100 (see at least FIG. 22, showing the first tray 500 connected to both the second tray 510 and the first section 110), where the opening 955 can be gripped for instance by a finger or a simple tool.

In at least one example embodiment, the depression 970 includes sidewalls 910 that are substantially vertical. In at least one example embodiment, the sidewalls 910 included rounded corners 965. In at least one example embodiment, the depression 970 includes three minor depressions 990 which include: a first half-bowl 975, a second half-bowl 980 and a shelf 982. In at least one example embodiment, the first half-bowl 975 and the second half-bowl 980 have a half-oval footprint (see at least FIGS. 9-11). In at least one example embodiment, each of the minor depressions 990 include sloped sidewalls 985 that are flared outward from a floor of the minor depressions 990 up to the upper surface 992 of the upper wall 900. In at least one example embodiment, the depression 970 includes rounded edges 995 along an upper periphery of the depression 970, where the sidewalls 910/985 meet the upper surface 992 of the upper wall 900. In at least one example embodiment, the depression 970 includes rounded lower corners 986 along lower corner edges of the depression 970, and at a transition between the raised ridge 950 and the floor 960. In at least one example embodiment, the shelf 982 includes rounded corners 998 to reduce "pinch points" for the consumer product 1600 and allow the consumer product 1600 to be more easily grasped and handled when removing the consumer product 1600 from the first tray 500 and/or when setting the consumer product 1600 back into the first tray 500 (see FIGS. 9-10 and 16).

In at least one example embodiment, the first half-bowl 975 includes a pair of lugs 996 on upper side edges of the first half-bowl 975 (on an end of the first half-bowl 975 that is near the shelf 982). In at least one example embodiment, lugs 996 extend slightly from the sloped sidewalls 985 of the first half-bowl 975 and the second half-bowl 980 (see FIGS. 9-10). In at least one example embodiment, the lugs 996 can make gentle contact with the consumer product 1600 to assist in cradling the consumer product 1600 while allowing for a gap between the sloped sidewalls 985 and an edge of the consumer product 1600 (as explained in more detail in relation to FIGS. 16 and 17). In at least one example embodiment, the lugs 996 further assist in allowing the consumer product 1600 to be more easily removed from the first tray 500.

Figure 12:
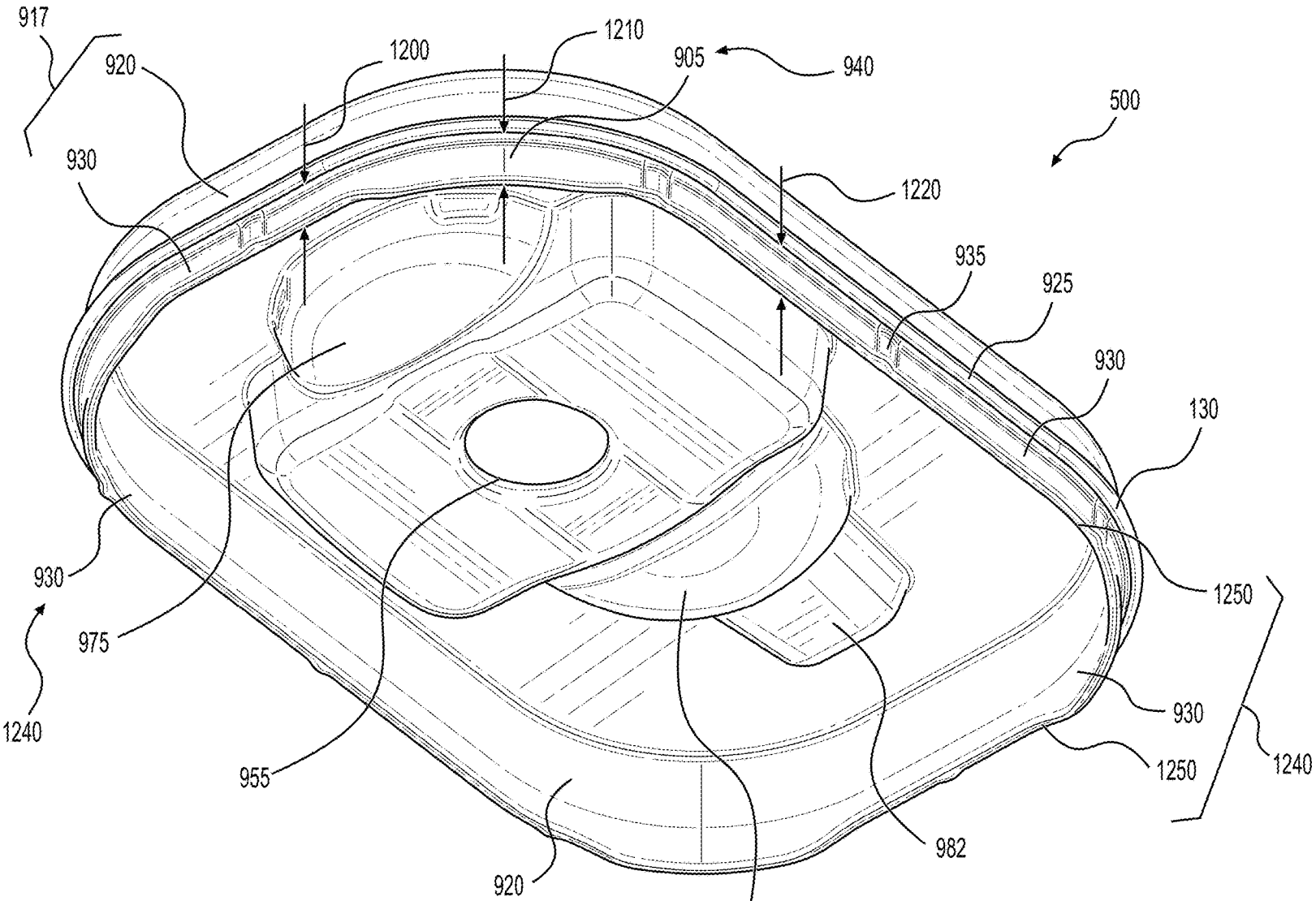
FIG. 12 is an illustration of a bottom, perspective view of the first tray, in accordance with at least one example embodiment.
Figure 13:
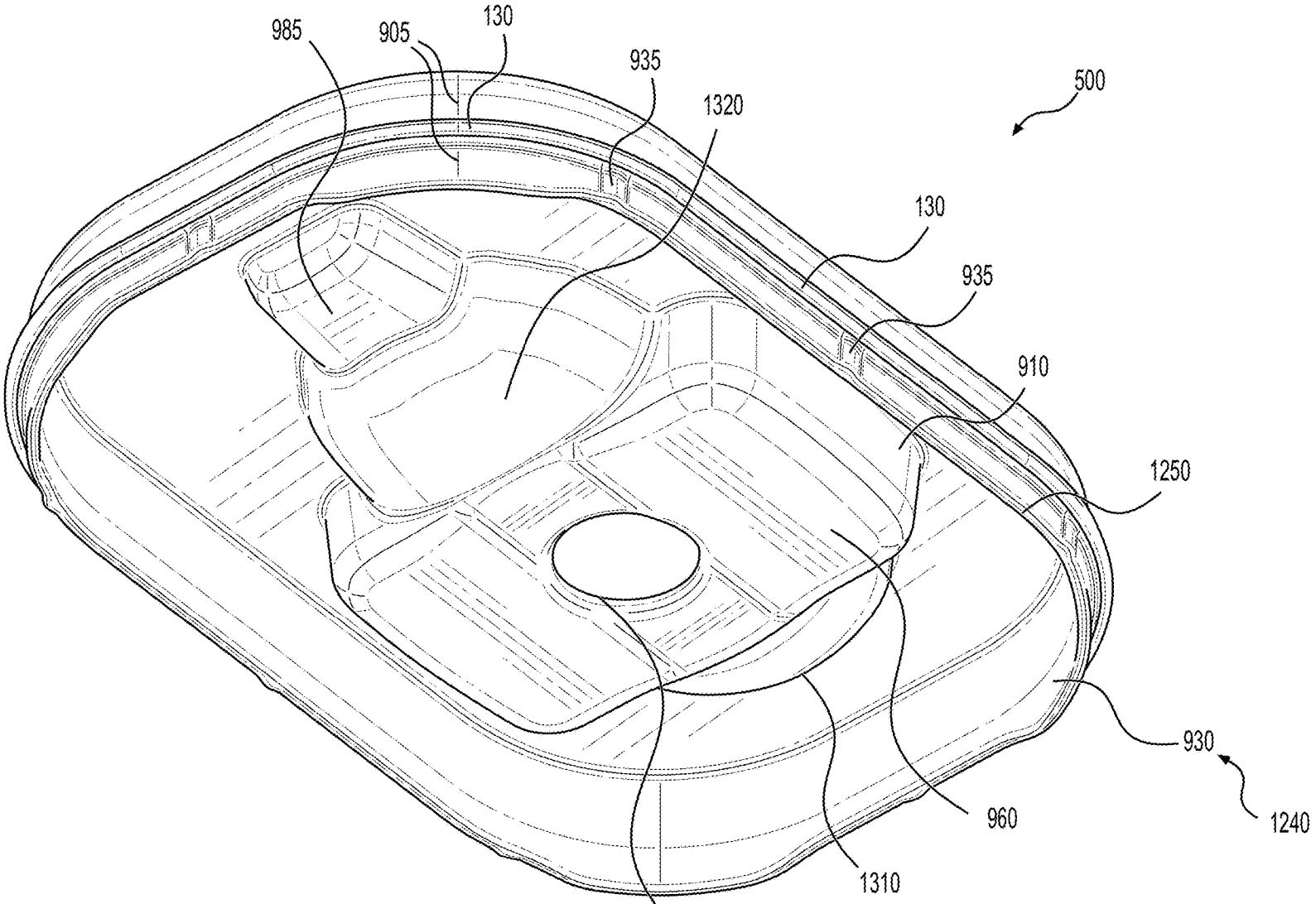
FIG. 13 is an illustration of another bottom, perspective view of the first tray, in accordance with at least one example embodiment.
Figure 14:
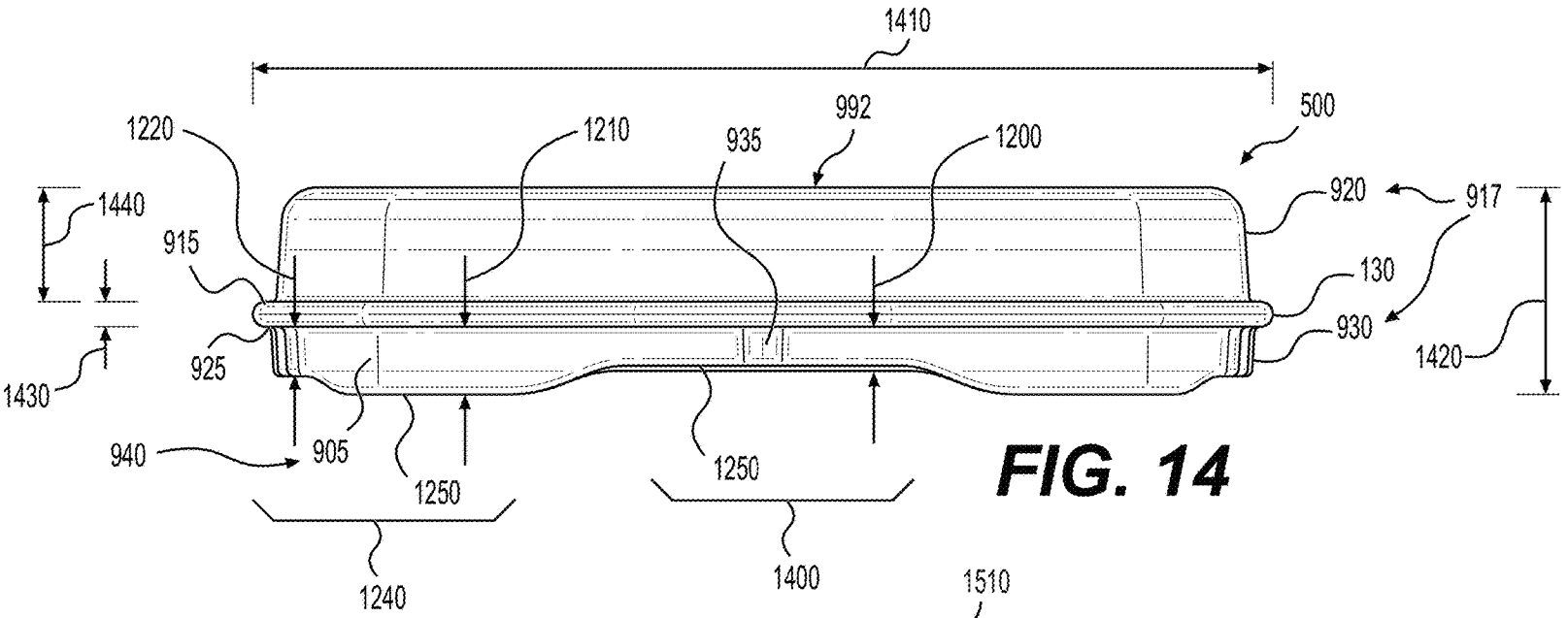
FIG. 14 is an illustration of a front view of the first tray, in accordance with at least one example embodiment.
Figure 15:
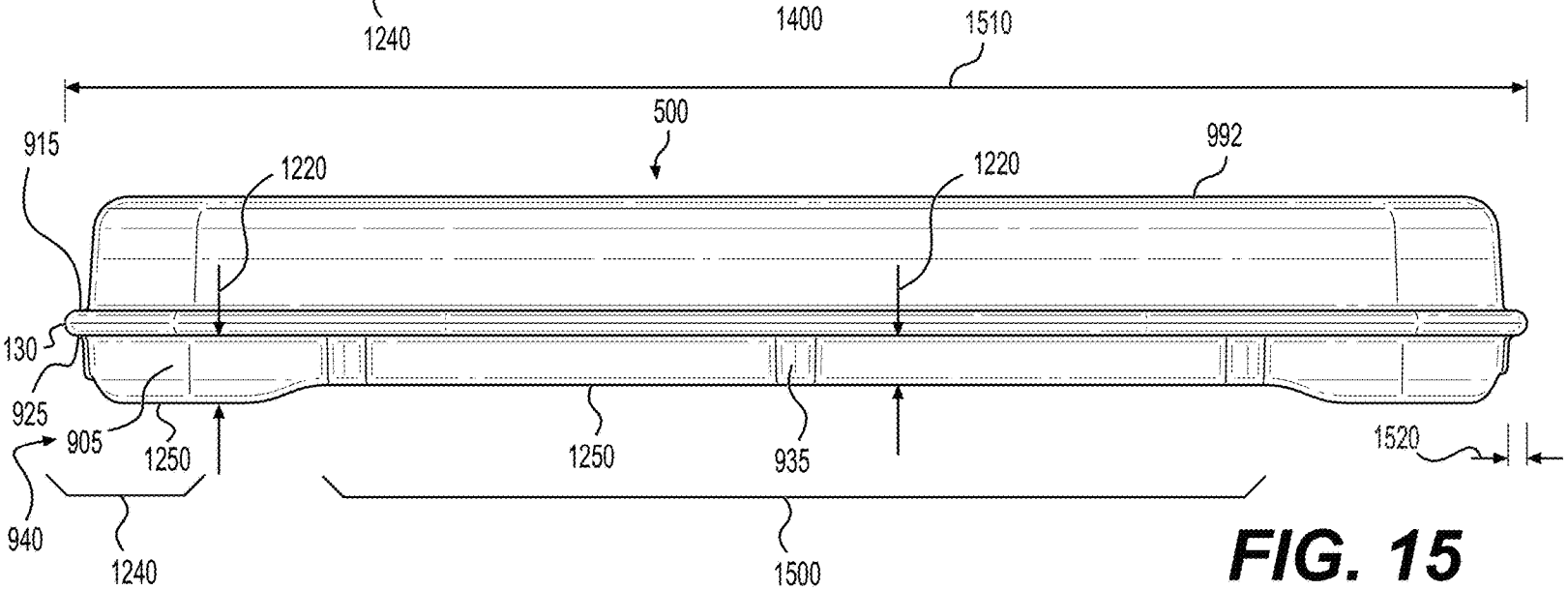
FIG. 15 is an illustration of a side view of the first tray, in accordance with at least one example embodiment.

FIGS. 12-13 are illustrations of bottom perspective views of the first tray 500, in accordance with at least one example embodiment. FIGS. 14-15 are illustrations of front and side views of the first tray 500, in accordance with at least one example embodiment.

In at least one example embodiment, the lower sidewalls 930 extend vertically downward to form a skirt 1240 at a lower portion of the first tray 500. In at least one example embodiment, the skirt 1240 has a varying depth, such that a distal end 1250 of the skirt 1240 extends to different elevations. In at least one example embodiment, the skirt 1240 has a first depth 1200 along end sections 1400 of the first tray 500 (see FIG. 14), a second depth 1210 along the rounded corners 905 and a third depth 1220 along side sections 1500 of the first tray 500 (see FIG. 15). In at least one example embodiment, the first depth 1200 and the third depth 1220 are shorter than the second depth 1210. In at least one example embodiment, the second depth 1210 is longer than the first depth 1200 and the third depth 1220 to allow the lower portion 940 of the rounded corners 905 to gently grip onto the second tray 510, as discussed in more detail in relation to FIGS. 40-41. In at least one example embodiment, the first depth 1200 and the third depth 1220 are a same depth.

In at least one example embodiment, and as shown in FIGS. 14 and 15, the ridge 130 extends horizontally from the sidewalls 917, such that surfaces of the upper ledge 915 and the lower ledge 925 are parallel with the upper surface 992 of the first tray 500.

As shown in FIGS. 14 and 15, in at least one example embodiment, a width of the first tray 500 is in the range of about 95 mm to 115 mm, or about 100 mm to 110 mm, or about 106 mm. In at least one example embodiment, a length 1510 of the first tray 500 is in the range of about 140 mm to 160 mm, or about 105 mm to 155 mm, or about 153 mm. In at least one example embodiment, a height 1420 of the first tray 500 is in the range of about 15 mm to 30 mm, or about 18 mm to 25 mm, or about 21 mm. In at least one example embodiment, a height 1430 of the ridge 130 is in the range of about 1 mm to 5 mm or about 2 mm to 4 mm, or about 3 mm. In at least one example embodiment, a depth 1520 of the ridge 130 is in the range of about 1.5 mm to 3.5 mm, or about 2.0 mm to 3.0 mm, or about 2.5 mm. In at least one example embodiment, a height 1440 of the upper sidewalls 920 is in the range of about 7 mm to 15 mm, or about 10 mm to 12 mm, or about 11 mm.

Figure 16:
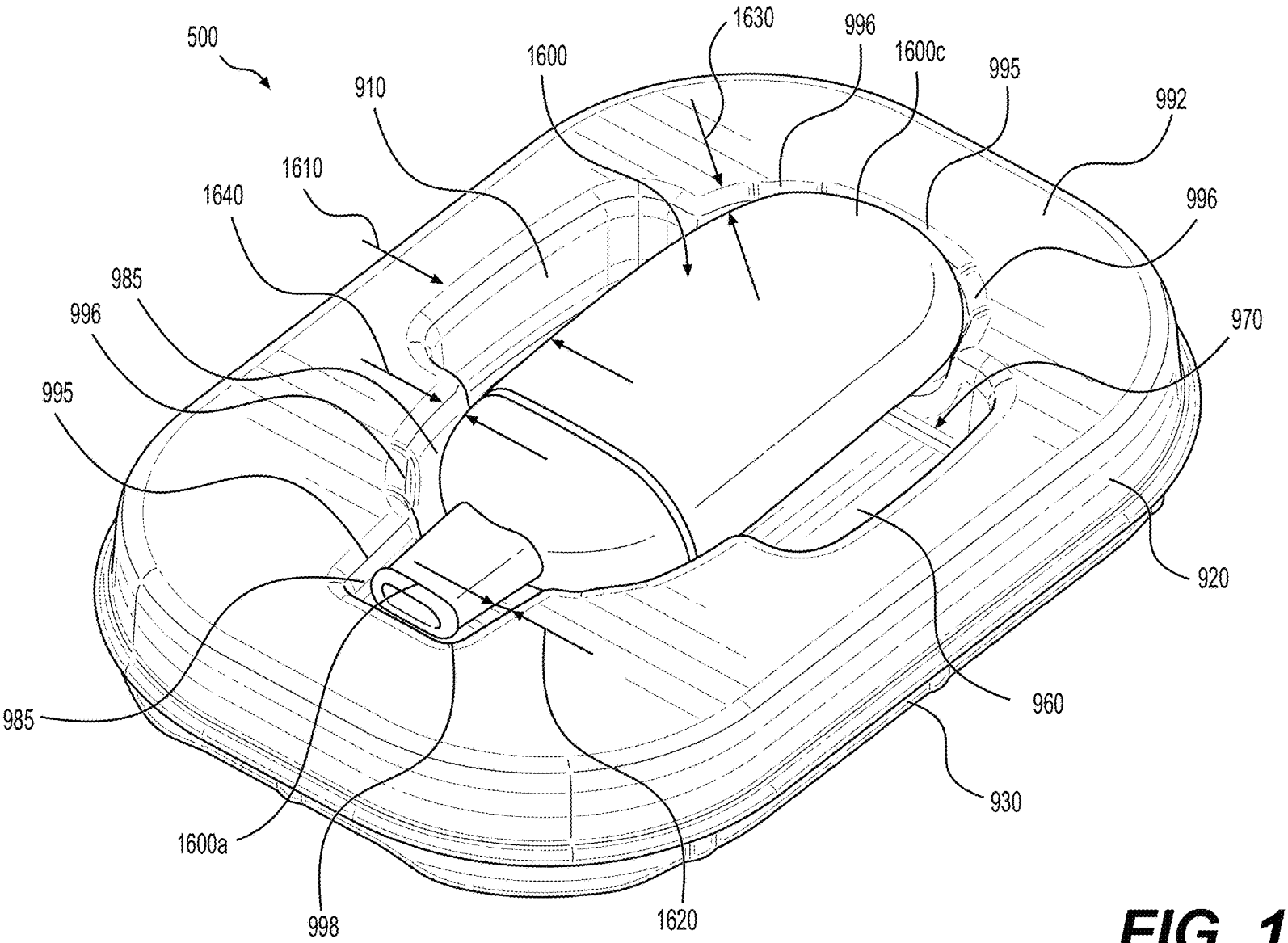
FIG. 16 is an illustration of a perspective view of the first tray holding a consumer product, in accordance with at least one example embodiment.
Figure 17:
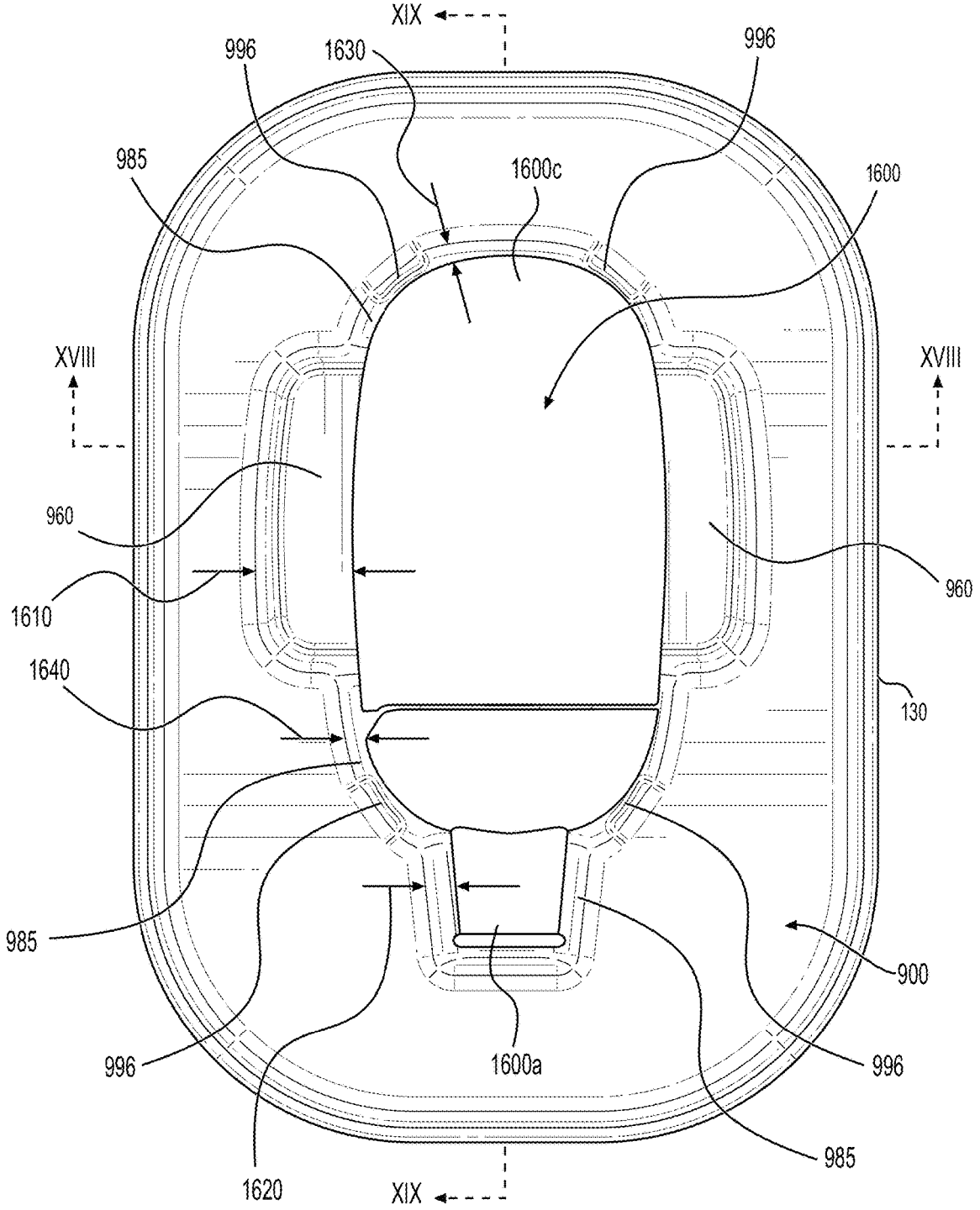
FIG. 17 is an illustration of a top view of the first tray holding the consumer product, in accordance with at least one example embodiment.

FIGS. 16-17 are illustrations of perspective and top views of the first tray 500 holding the consumer product 1600, in accordance with at least one example embodiment. FIGS. 18-21 are illustrations of cross-sectional views of the first tray 500 (views XVIII-XVIII and XIX-XIX of FIG. 17), in accordance with at least one example embodiment.

In at least one example embodiment, and as shown in FIGS. 16 and 17, when the consumer product 1600 is contained in the first tray 500, upper surfaces of the consumer product 1660 are visible from at least an overhead view of the first tray 500. In at least one example embodiment, a first gap 1610 exists between sides of the consumer product 1600 and the sidewalls 910 of the depression 970. In at least one example embodiment, the first gap 1610 is large enough that significant portions of the floor 960 of the depression 970 are visible from a top view of the first tray 500 (see at least FIG. 17). In at least one example embodiment, the first gap 1610 allows ample room for the consumer product 1600 to be easily grasped and removed from the first tray 500.

In at least one example embodiment, a second gap 1620 exists between a first end 1600*a* of the consumer product 1600 and the sloped sidewalls 985 of the shelf 982. In at least one example embodiment, a third gap 1630 and a fourth gap 1640 exist between the sloped sidewalls 985 of the second half-bowl 980 and first half-bowl 975, respectively, due in part to the placement of the lugs 996 (see FIG. 17), where the lugs 996 gently grasp sides of the consumer product 1600. In at least one example embodiment, the first gap 1610, the second gap 1620, the third gap 1630 and/or the fourth gap 1640 assist in allowing the consumer product 1600 to more easily be removed from the first tray 500. In at least one example embodiment, the rounded edges 995 along a periphery of the depression 970, and the sloped sidewalls 985 of the minor depressions 990 also assist in allowing the consumer product 1600 to more easily be removed from the first tray 500.

In at least one example embodiment, the sidewalls 917 are flared outward, such that a first internal width 1820 of the first tray 500 is smaller than a second interior width 1830 of the first tray 500. In at least one example embodiment, the sidewalls 917 are flared outward at a gradual angle 1800 that is about 1-2 degrees, relative to a vertical plane 1810 (i.e., relative to a direction that is plum with gravity when the first tray 500 is on a flat surface that is perpendicular with gravity).

In at least one example embodiment, the consumer product 1600 is an electronic device, and more particularly, a heat-not burn device (or alternatively an e-vaping device). In at least one example embodiment, the consumer product 1600 is an accessory or an element of an electronic device, and more particularly, a heat-not burn device (or alternatively an e-vaping device).

In at least one example embodiment, some electronic devices are configured to heat a plant material to a temperature that is sufficient to release constituents of the plant material while keeping the temperature below its ignition temperature so as to avoid a self-sustaining burning or a self-sustaining combustion of the plant material (i.e., in contrast to where a plant material is lit, such as lit-end cigarettes). Such devices may be characterized as generating an aerosol of constituents released by heating, and may be referred to as heat-not-burn aerosol-generating devices, or heat-not-burn devices.

It is understood that heating of a plant material below its ignition temperature may, in some circumstances, produce incidental and insubstantial levels of oxidized or other thermal decomposition byproducts. However, in some embodiments, the heating in aerosol-generating devices is below the pyrolysis temperature of the plant material so as to produce an aerosol having no or insubstantial levels of thermal decomposition byproducts of the plant material. Thus, in an example embodiment, pyrolysis of the plant material does not occur during the heating and resulting production of aerosol. In other instances, there may be incidental pyrolysis, with production of oxidized or other thermal decomposition byproducts at levels that are insignificant relative to the primary constituents released by heating of the plant material.

Figure 18:
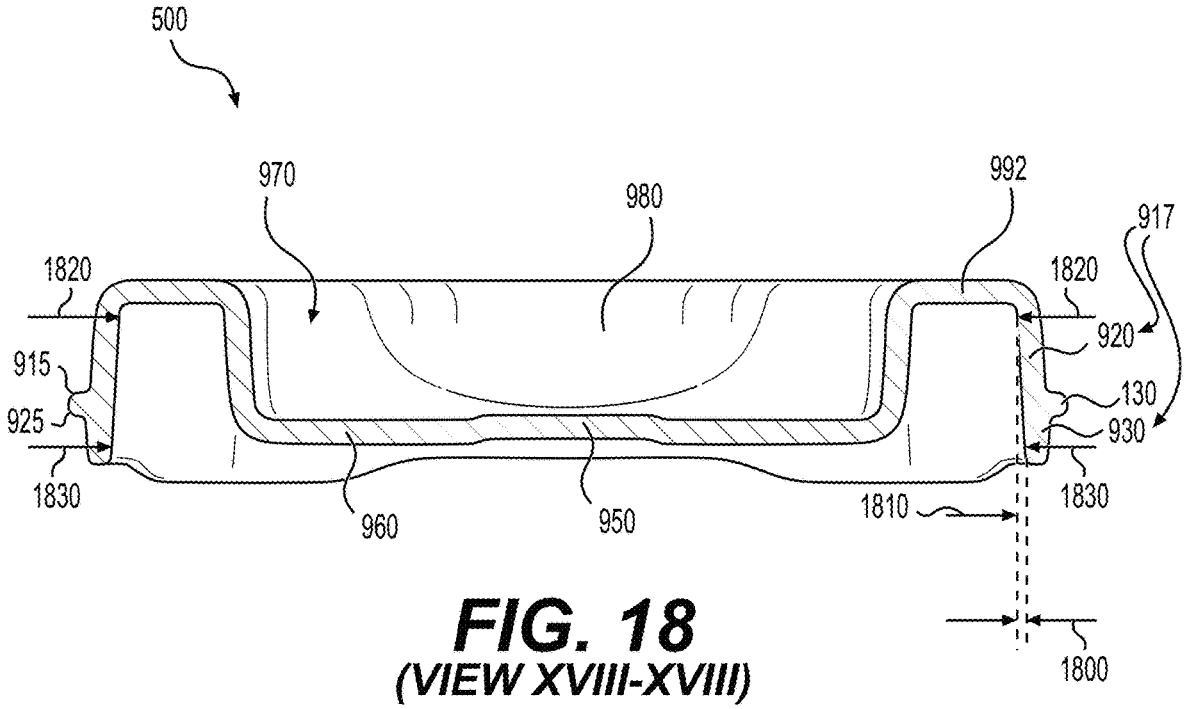
FIG. 18 is an illustration of a cross-section view of the first tray (view XVIII-XVIII of FIG. 17), in accordance with at least one example embodiment.
Figure 19:
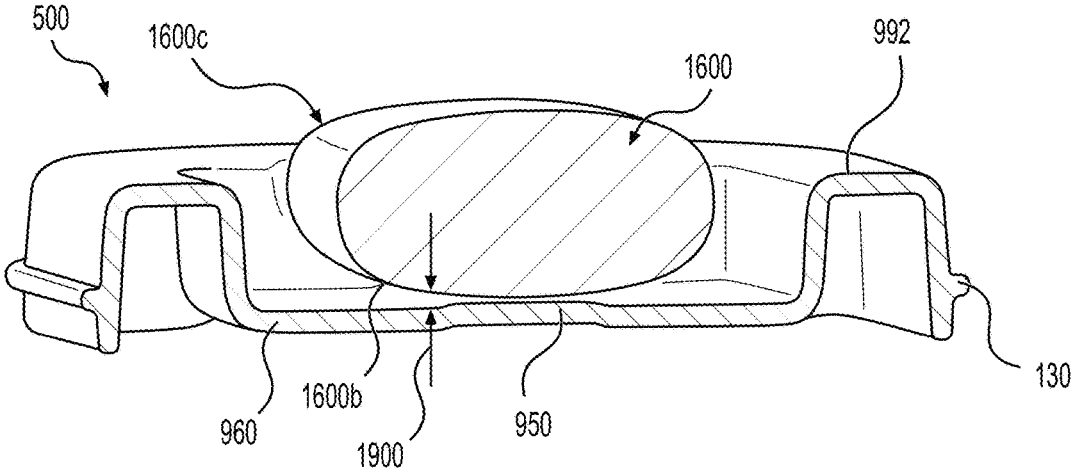
FIG. 19 is an illustration of a cross-section view of the first tray holding the consumer product (view XVIII-XVIII of FIG. 17), in accordance with at least one example embodiment.
Figure 20:
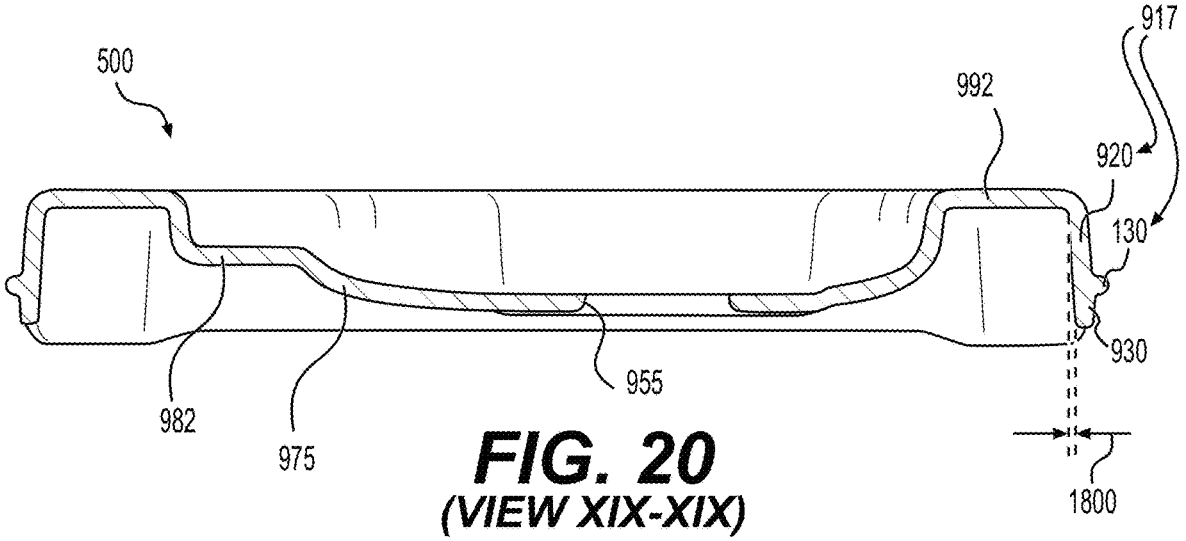
FIG. 20 is an illustration of a cross-section view of the first tray (view XIX-XIX of FIG. 17), in accordance with at least one example embodiment.

In at least one example embodiment, the raised ridge 950 holds a side/rear surface 1600*b* of the consumer product 1600 away from the floor 960 of the first tray 500, such that a gap 1900 exists between the side/rear surface 1600*b* and the floor 960 (see FIG. 19). In this embodiment, and as shown in FIGS. 18-19, when a second end 1600*c* of the consumer product 1600 fits into the second half-bowl 980, the gap 1900 allows the consumer product 1600 to more easily be grasped to remove the consumer product 1600 from the first tray 500.

Figure 21:
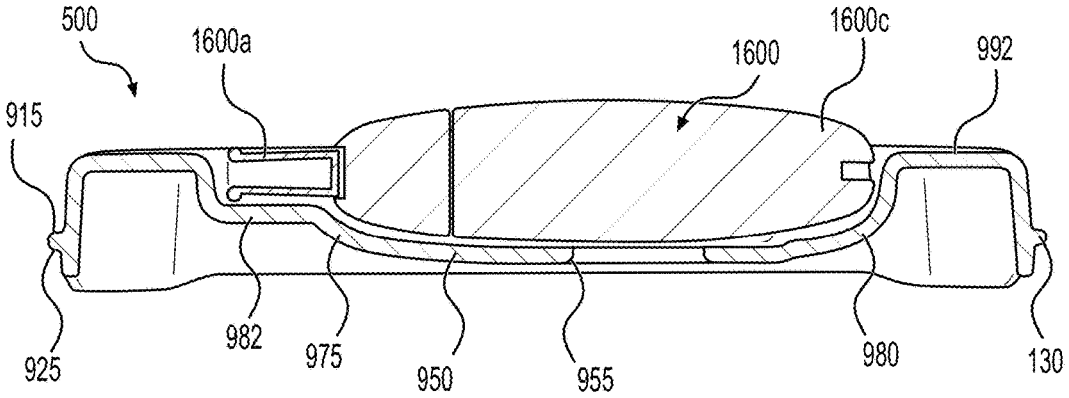
FIG. 21 is an illustration of a cross-section view of the first tray holding the consumer product (view XIX-XIX of FIG. 17), in accordance with at least one example embodiment.

In at least one example embodiment, portion of the depression 970 hug back surfaces of the consumer product 1600 along a longitudinal length of the consumer product 1600 (see FIG. 21). In this example embodiment, the first end 1600*a* of the consumer product 1600 is directly contacted by major surfaces of the shelf 982 and the first half-bowl 975. In at least one example embodiment, back surfaces of the consumer product 1600 are directly contacted by the raised ridge 950. In at least one example embodiment, the second end 1600*c* of the consumer product 1600 is directly contacted by the second half-bowl 980.

In at least one example embodiment, the first end 1600*a* of the consumer product 1600 is a mouth-piece end of a heat-not-burn device (or, alternatively an e-vaping device) and the second end 1600*c* is a base end (wide end) of the heat-not-burn device (or, alternatively e-vaping device).

FIG. 22 is an illustration of a perspective view of the first tray 500 and the second tray 510 being held in the first section 110, in accordance with at least one example embodiment.

Figure 42:
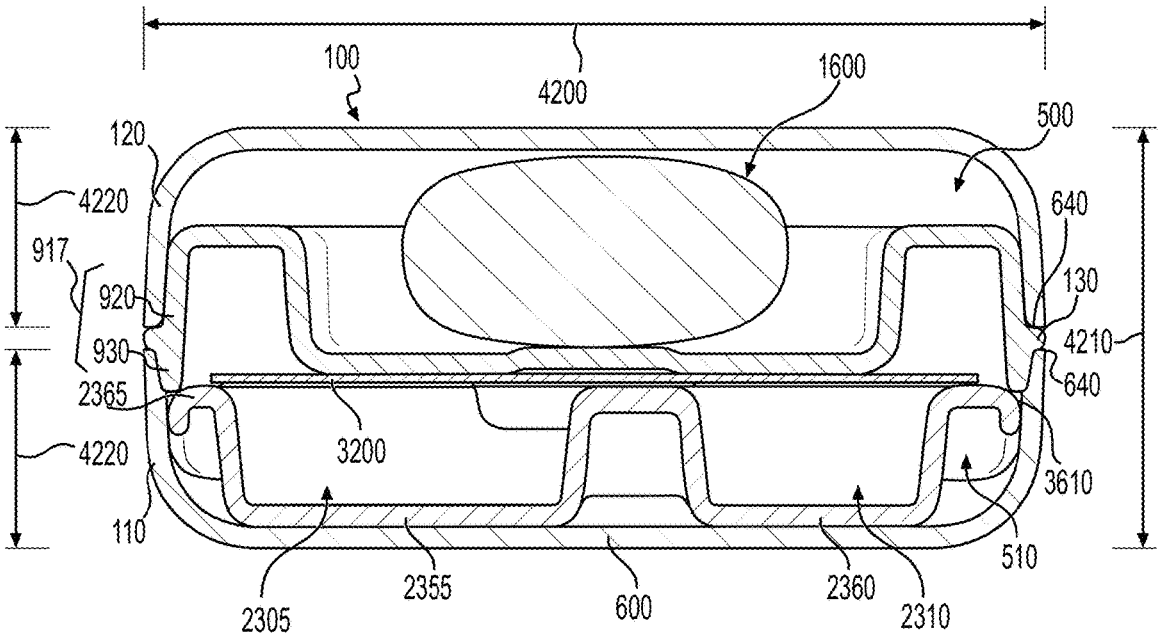
FIG. 42 is an illustration of a cross-sectional view (view XLII-XLII of FIG. 1) of the outer container containing the first tray and the second tray, in accordance with at least one example embodiment.

In at least one example embodiment, the lower ledge 925 of the ridge 130 of the first tray 500 (see at least FIG. 14) contacts the peripheral edge 640 of the first section 110 (see at least FIG. 6) to help support the first tray 500 within the first section 110. In at least one example embodiment, the ridge 130 supports the first tray 500 within the first section 110, independent of whether the second tray 510 is also contained within the first section 110 (also see FIG. 42). In particular, and in at least one example embodiment, the lower ledge 925 of the first tray 500 (FIG. 12) sits on and is supported by the peripheral edge 640 of the first section 110 (FIG. 6), as shown in FIGS. 22 and 42.

In at least one example embodiment, the opening 955 of the first tray 500 allows the second tray 510 to be partially viewable when the first tray 500 and the second tray 510 are in the outer container 100 and the second section 120 has been removed from the outer container 100 (as shown in FIG. 22).

In at least one example embodiment, and as shown in FIG. 22, when the first tray 500 and the second tray 510 are in the first section 110, and the second section 120 is not on the outer container, the upper surface 992, the upper sidewall 920, and the upper ledge 915 and the outer surface 200 of the ridge 130 are directly visible. That is to say, the upper surface 992, the upper sidewall 920, and the upper ledge 915 and the outer surface 200 of the ridge 130 form a visible outer surface of the package 4600 once the second section 120 is initially removed from the package 4600.

FIGS. 23-28 are illustrations of perspective, top and bottom views of the second tray 510, in accordance with at least one example embodiment.

In at least one example embodiment, an upper wall 2300 of the second tray 510 defines major upper surfaces 2345, first (upper) inset surfaces 2350, second (lower) inset surfaces 2370, a first depression 2305 and a second depression 2310. In at least one example embodiment, the major upper surfaces 2345 constitute top-most (highest elevation) surfaces of the second tray 510. In at least one example embodiment, the first inset surfaces 2350 are at an elevation (vertical height) of the second tray 510 that is between the major upper surfaces 2345 and the second inset surfaces 2370.

In at least one example embodiment, opposing sidewalls 2375 bracket sides of the second inset surfaces 2370. In at least one example embodiment, the first depression 2305 is defined by sidewalls 2320 and a floor 2355. In at least one example embodiment, the second depression 2310 is defined by sidewalls 2325 and a floor 2360. In at least one example embodiment, the first depression 2305 and/or the second depression 2310 have a footprint that is substantially rectangular in shape (see an overhead view in FIG. 25). In at least one example embodiment, the first depression 2305 and the second depression 2310 have rounded corners 2390. In at least one example embodiment, the second tray 510 includes rounded lower corners 2386 along a periphery of the first inset surfaces 2350, the second inset surfaces 2370, the floor 2355 of the first depression 2305 and the floor 2360 of the second depression 2310. In at least one example embodiment, the first depression 2305 and the second depression 2310 have rounded upper edges 2395. In at least one example embodiment, the second tray 510 has rounded edges 2365 along an upper periphery of the upper wall 2300.

Figure 25:
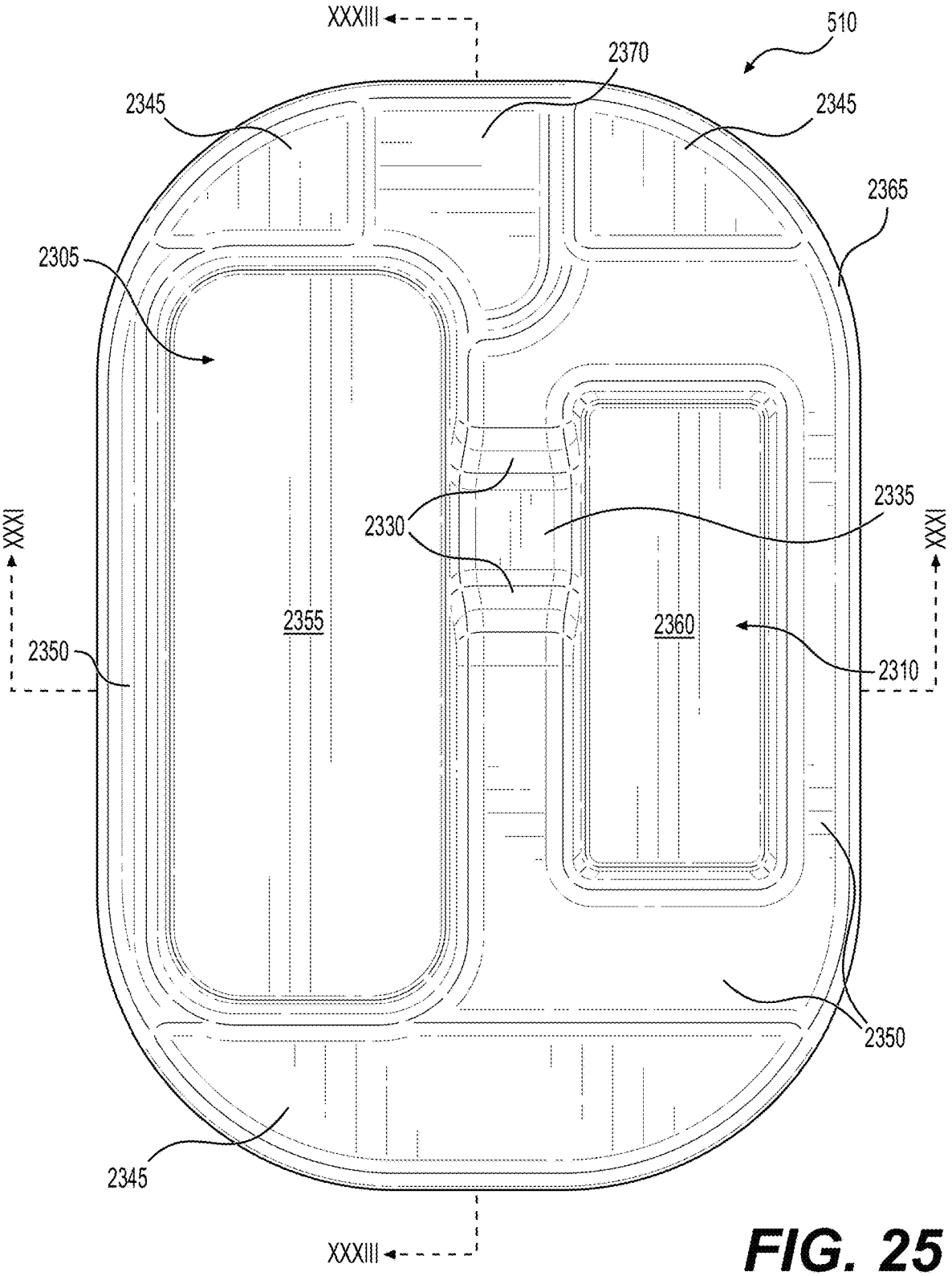
FIG. 25 is an illustration of a top view of the second tray, in accordance with at least one example embodiment.
Figure 26:
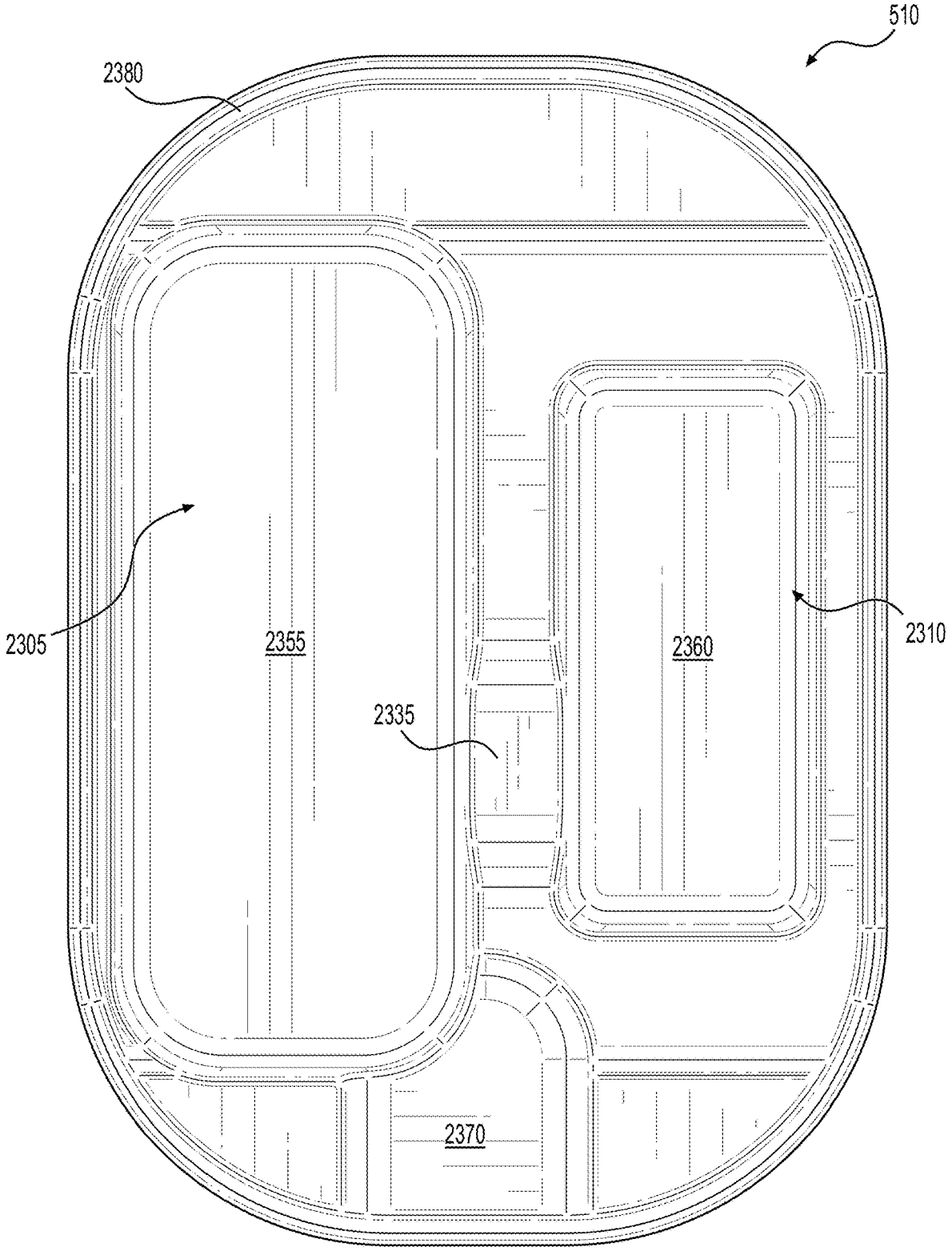
FIG. 26 is an illustration of a bottom view of the second tray, in accordance with at least one example embodiment.
Figure 27:
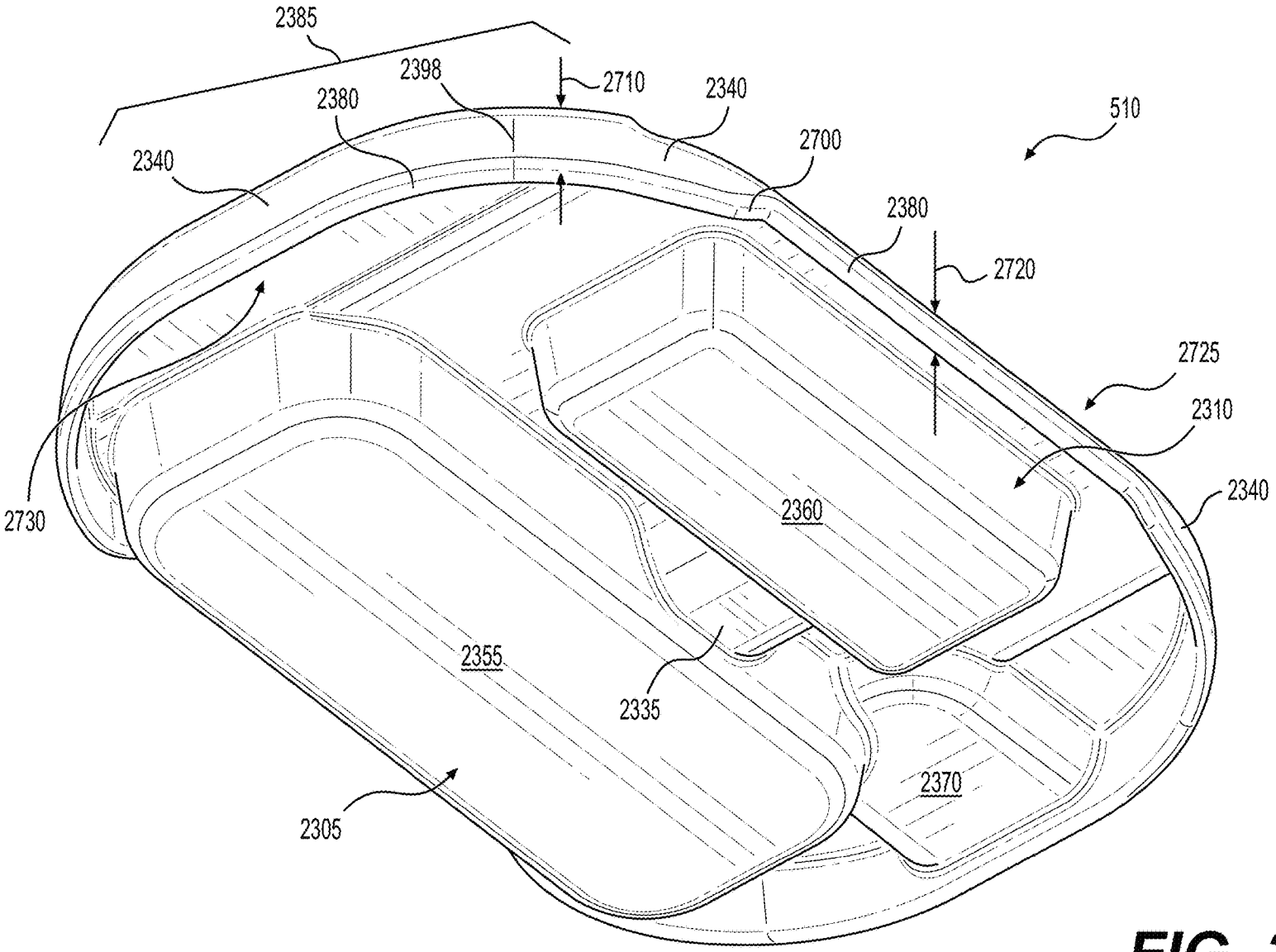
FIG. 27 is an illustration of a bottom, perspective view of the second tray, in accordance with at least one example embodiment.
Figure 28:
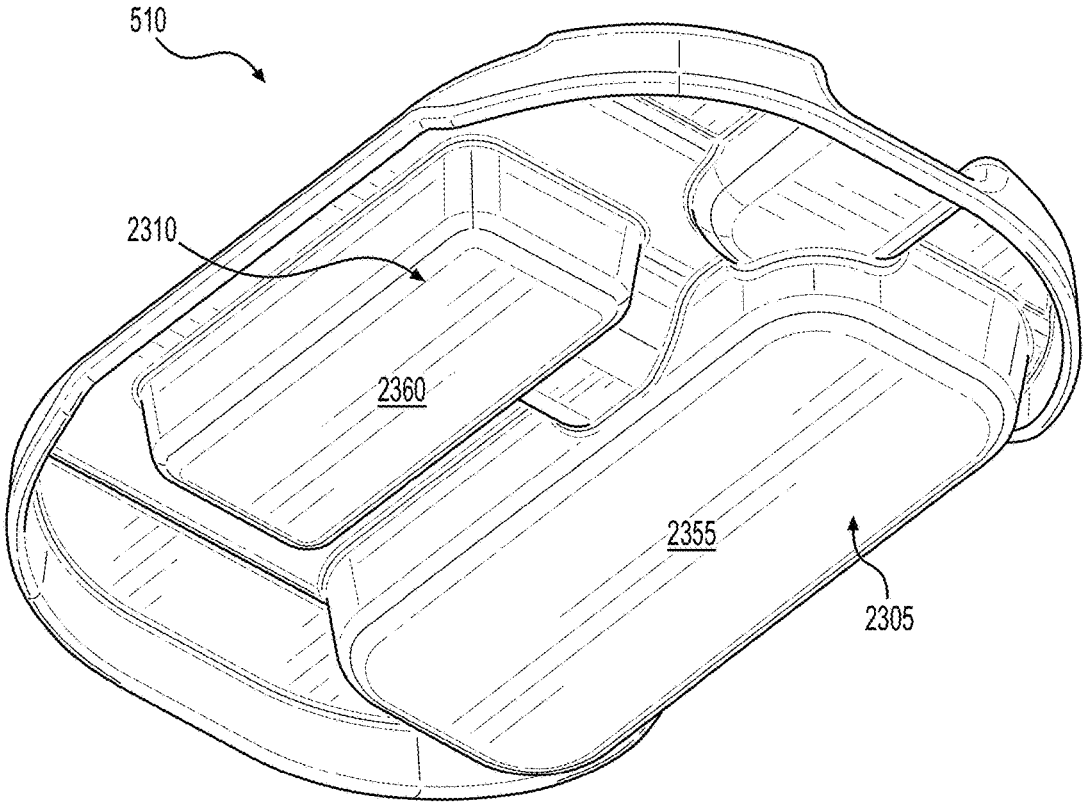
FIG. 28 is an illustration of another bottom, perspective view of the second tray, in accordance with at least one example embodiment.

In at least one example embodiment, the first depression 2305 and/or the second depression 2310 have a footprint that is substantially square in shape (see at least FIG. 25). Other shapes for the first depression 2305 and/or the second depression 2310 are contemplated. In at least one example embodiment, the first depression 2305 is a larger size (footprint), relative to the second depression 2310 (see FIG. 25).

In at least one example embodiment, the upper wall 2300 of the second tray 510 defines a cut-out 2315 with a lower surface (valley) 2335 that is between opposing sloped walls 2330. In at least one example embodiment, when the first tray 500 and the second tray 510 are in the first section 110 (see FIG. 22), the cut-out 2315 of the second tray 510 is substantially below the opening 955 of the first tray 500, so that a finger or an object can more easily be inserted through the opening 955 to grip and pull the first tray 500 out of the first section 110.

In at least one example embodiment, sidewalls 2340 extend vertically and downwardly from the upper wall 2300 to form a skirt 2385 along a lower periphery of the second tray 510. In at least one example embodiment, the skirt 2385 has a varying depth, such that a distal end 2380 of the skirt 2385 extends to different elevations. In at least one example embodiment, the skirt 2385 has a first depth 2720 along side sections 2725 of the second tray 510 and a second depth 2710 along rounded corners 2398 of the second tray 510 (see at least FIGS. 27 and 29). In at least one example embodiment, the second depth 2710 is larger than the first depth 2720. In at least one example embodiment, the distal end 2380 of the skirt 2385 includes sloped distal end surfaces 2700 at a transition between the side sections 2725 (with a first depth 2720) and end sections 2730 (with a second depth 2710) of the lower sidewalls 2340.

Figure 29:
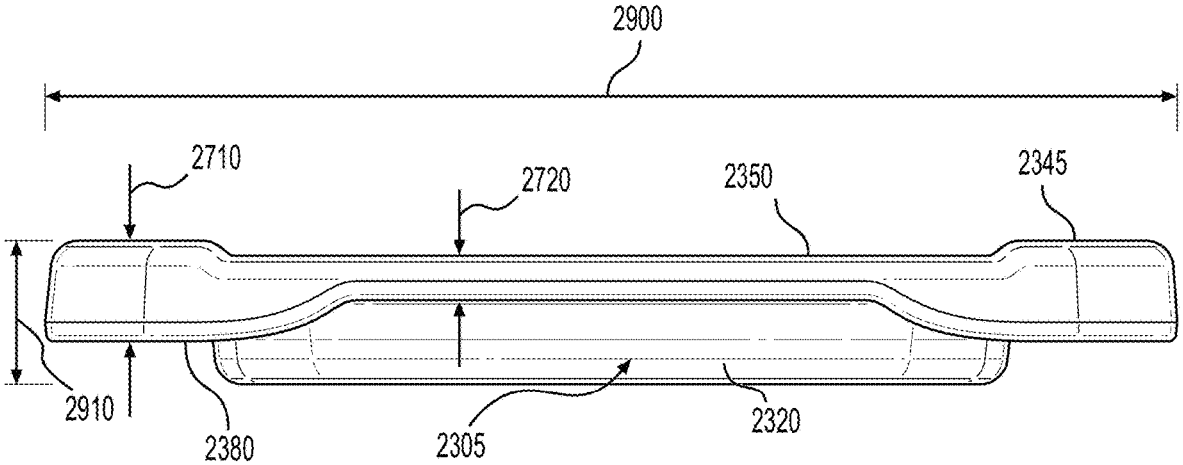
FIG. 29 is an illustration of a side view of the second tray, in accordance with at least one example embodiment.
Figure 30:
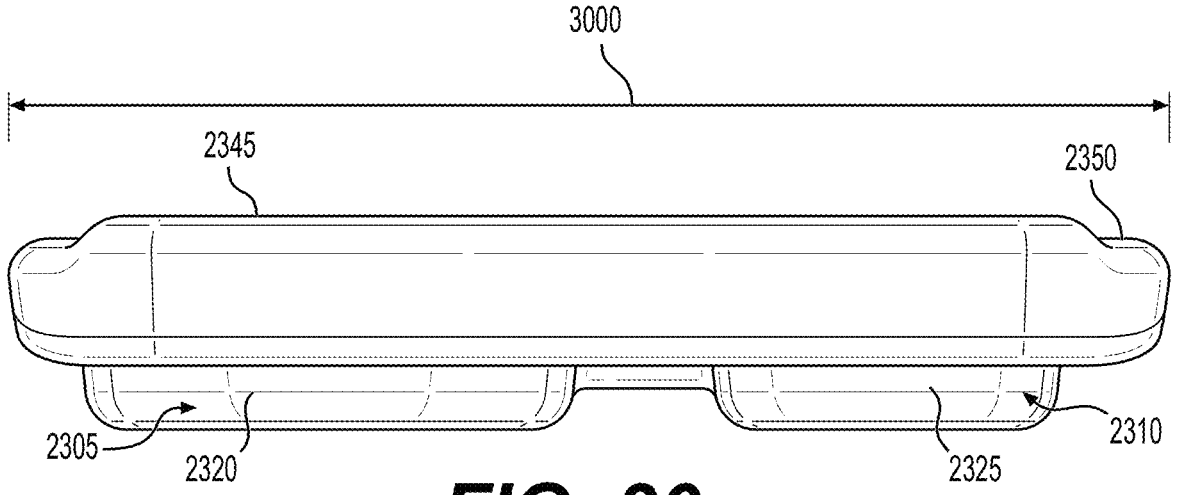
FIG. 30 is an illustration of another side view of the second tray, in accordance with at least one example embodiment.
Figure 31:
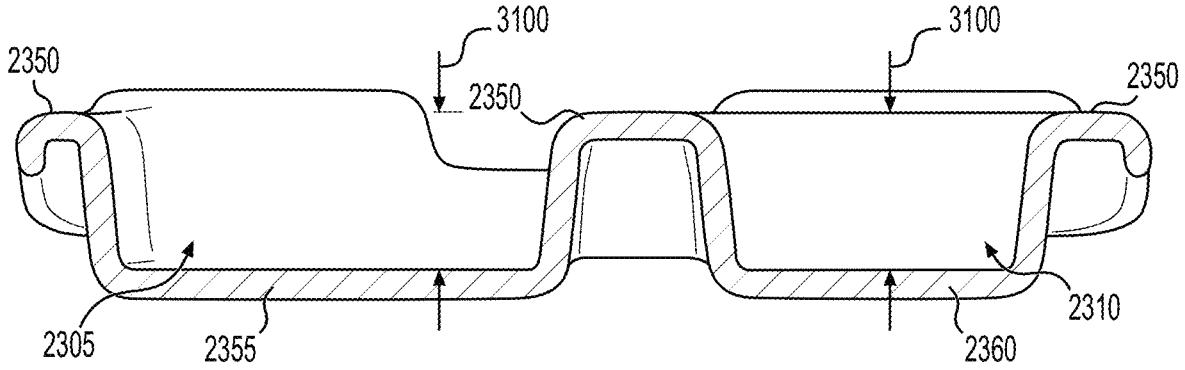
FIG. 31 is an illustration of a cross-sectional view (view XXXI-XXXI of FIG. 25) of the second tray, in accordance with at least one example embodiment.
Figure 32:
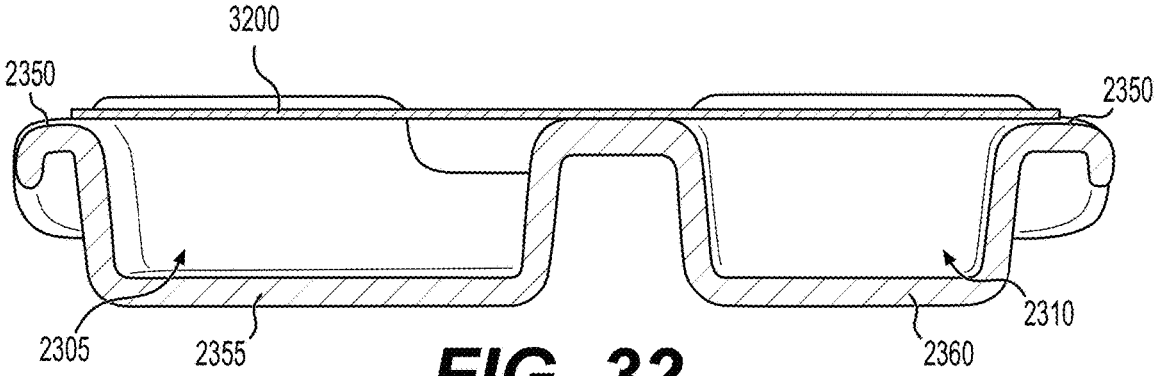
FIG. 32 is an illustration of another cross-sectional view (view XXXI-XXXI of FIG. 25) of the second tray, where the second tray is holding consumer information material, in accordance with at least one example embodiment.
Figure 33:
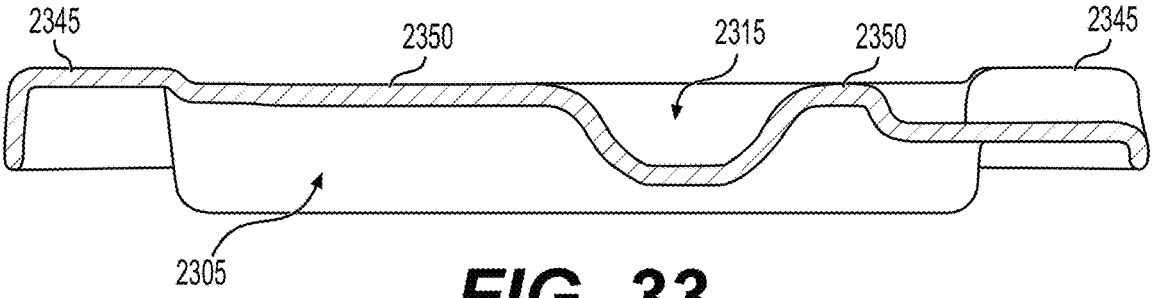
FIG. 33 is an illustration of another cross-sectional view (view XXXIII-XXXIII of FIG. 25) of the second tray, in accordance with at least one example embodiment.

FIGS. 29-30 are illustrations of side views of the second tray 510, in accordance with at least one example embodiment. FIG. 31 is an illustration of a cross-sectional view (view XXXI-XXXI of FIG. 25) of the second tray 510, in accordance with at least one example embodiment. FIG. 32 is an illustration of another cross-sectional view (view XXXI-XXXI of FIG. 25) of the second tray 510 holding consumer information material 3200, in accordance with at least one example embodiment. FIG. 33 is an illustration of another cross-sectional view (view XXXIII-XXXIII of FIG. 25) of the second tray 510, in accordance with at least one example embodiment.

In at least one example embodiment, the first inset surfaces 2350 of the second tray 510 can support and retain consumer products or accessories for consumer products. In at least one example embodiment, the first inset surfaces 2350 support and retain the consumer information material 3200 (see at least FIGS. 32 and 36). In at least one example embodiment, edges 3600 of the major upper surfaces 2345 contact and hold the consumer information material 3200 in position over a top portion of the second tray 510 (see FIG. 36). In at least one example embodiment, the consumer information material 3200 is material associated with the consumer product 1600. In at least one example embodiment, the edges 3600 of the major upper surfaces 2345 are on opposing sides of the consumer information material 3200 in order to stably hold the consumer information material 3200 on an upper portion of the second tray 510.

In at least one example embodiment, a length 2900 of the second tray 510 is in the range of about 135 mm to 155 mm, or about 140 mm to 150 mm, or about 146 mm. In at least one example embodiment, a height 2910 of the second tray 510 is in the range of about 10 mm to 20 mm, or about 14 mm to 18 mm, about 16 mm. In at least one example embodiment, a width 3000 of the second tray 510 is in the range of about 90 mm to 110 mm, or about 95 mm to 105 mm, or about 101 mm. In at least one example embodiment, an internal depth 3100 of the 2305 and 2310, from the first inset surfaces 2350 to the respective floors 2355/2360 is in the range of about 10 mm to 20 mm, or about 12 mm to 18 mm, or about 15 mm.

Figure 34:
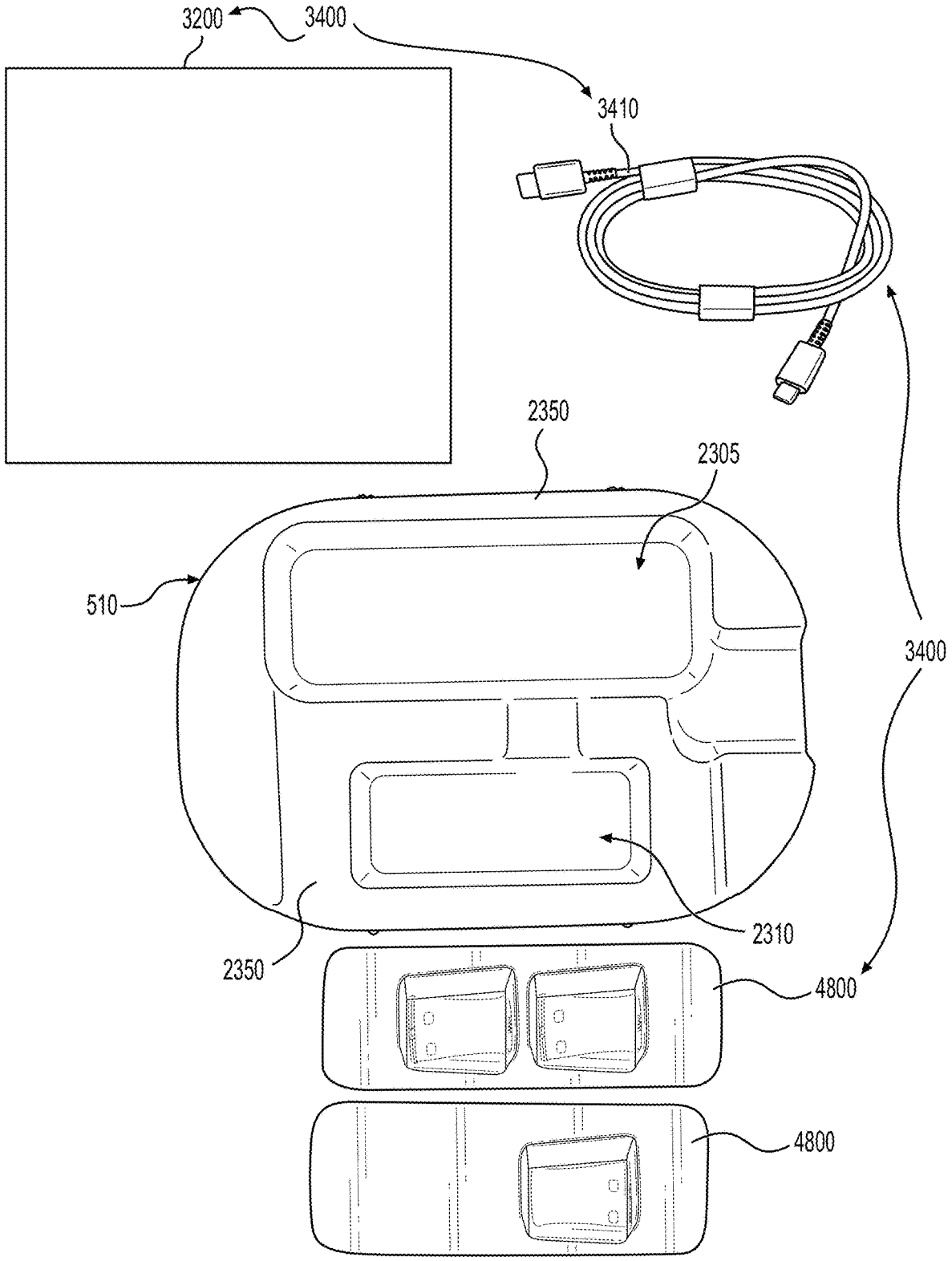
FIG. 34 is an illustration of consumer products and the second tray, in accordance with at least one example embodiment.
Figure 35:
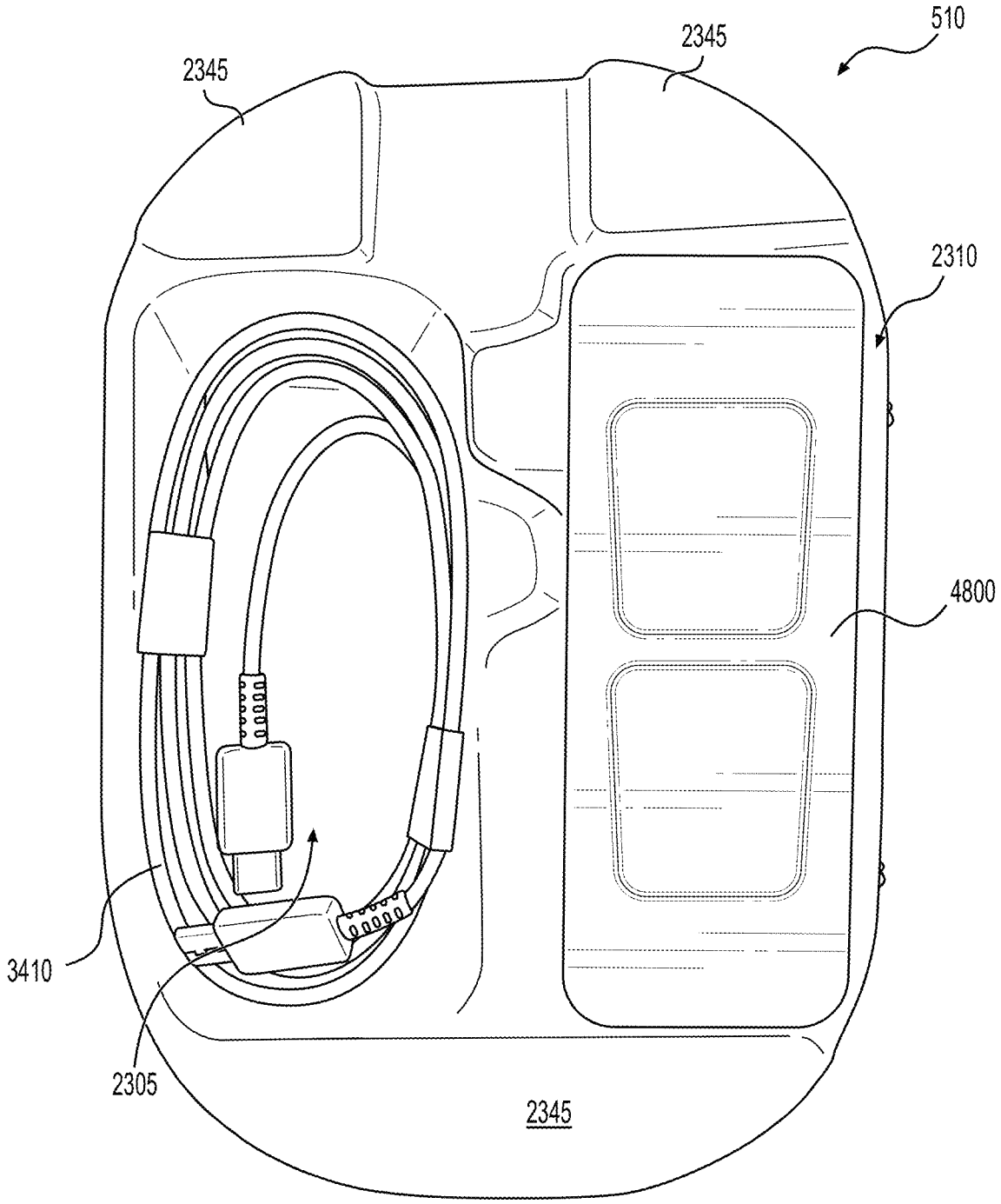
FIG. 35 is an illustration of the consumer products in the second tray, in accordance with at least one example embodiment.
Figure 36:
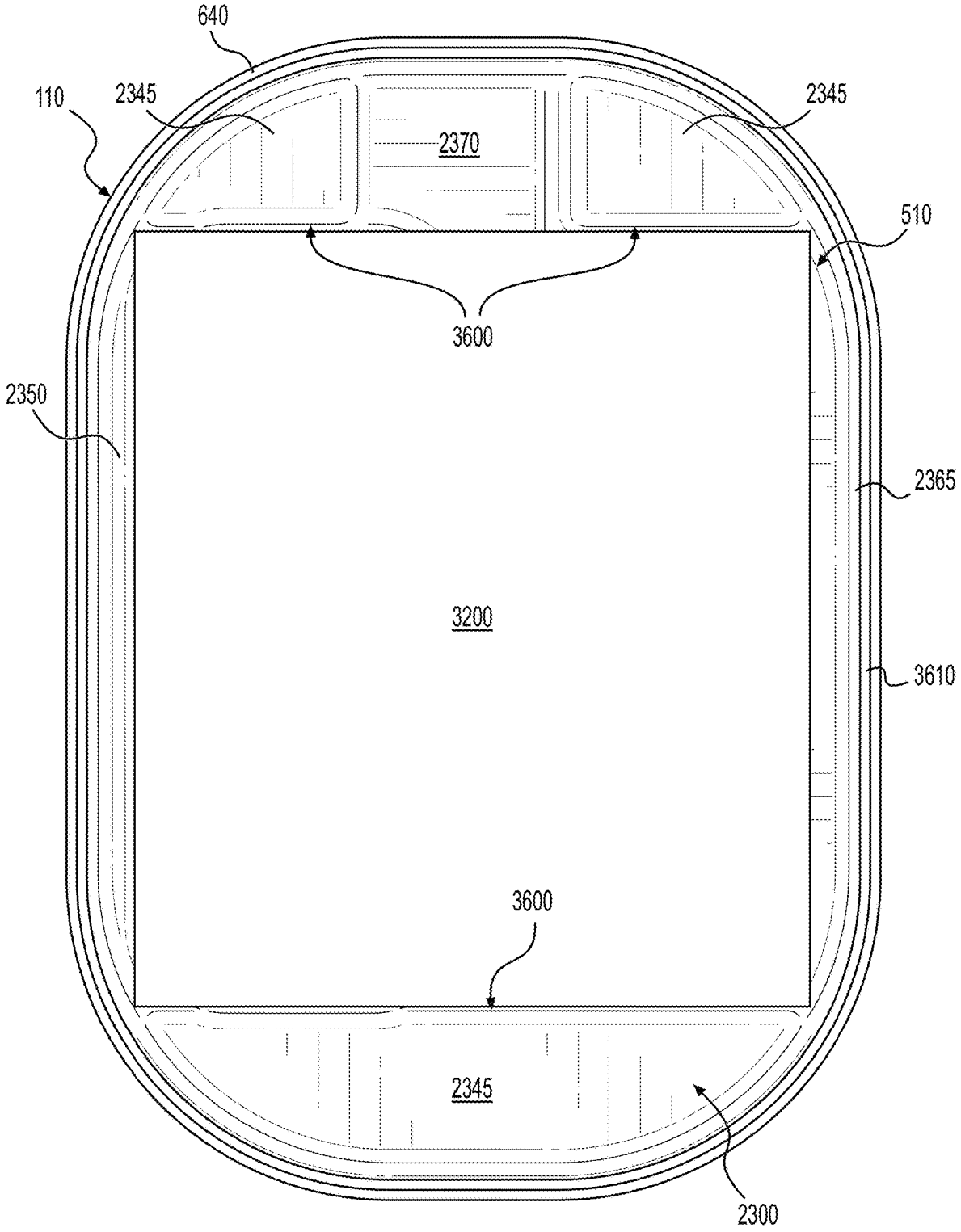
FIG. 36 is an illustration of the consumer product information being retained in the second tray, in accordance with at least one example embodiment.

FIGS. 34-36 are illustrations of added consumer products 3400 being retained in the second tray 510, in accordance with at least one example embodiment.

In at least one example embodiment, second tray 510 retains the added consumer products 3400. In at least one example embodiment, the added consumer products 3400 include the consumer information material 3200, a universal serial bus (USB) charger 3410 and an insert 4800. In at least one example embodiment, first depression 2305 is sized to contain the USB charger 3410 and the second depression 2310 is sized to contain the insert 4800. In at least one example embodiment, the first depression 2305 and the second depression 2310 are sized to contain one or more of the added consumer products 3400, while allowing the consumer information material 3200 to remain supported and lie flush on the first inset surfaces 2350. In at least one example embodiment, the added consumer products 3400 are accessories and/or replacement items for the consumer product 1600. In at least one example embodiment, the insert 4800 includes items, or replacement items, for the consumer product 1600, as described herein in more detail. In at least one example embodiment, the consumer product 1600 is a mouthpiece as disclosed in U.S. application Ser. No. 17/979,103 ("Replaceable Mouthpieces for Aerosol-Generating Devices"), filed Nov. 2, 2022, which is hereby incorporated by reference in its entirety.

Figure 43:
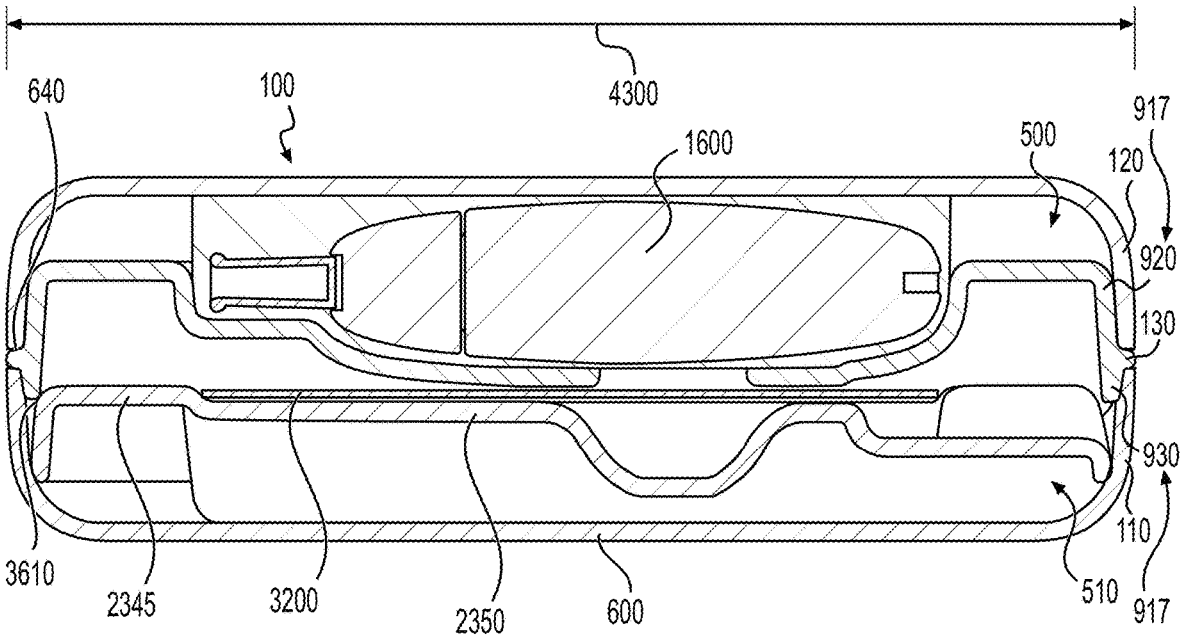
FIG. 43 is an illustration of another cross-sectional view (view XLIII-XLIII of FIG. 1) of the outer container containing the first tray and the second tray, in accordance with at least one example embodiment.

In at least one example embodiment, an outer periphery of the second tray 510 is conformed to an interior of the first section 110, so that the second tray 510 fits fully inside the first section 110 (see FIGS. 36 and 42-43). In at least one example embodiment, the upper wall 2300 and the sidewalls 2340 of the second tray 510, and the sidewalls 610/620 of the first section 110, combine to define a ravine 3610 around a periphery of the second tray 510 when the second tray 510 is in the first section 110 (see FIGS. 36 and 42-43). In at least one example embodiment, when the first tray 500 is placed on top of the second tray 510 within the first section 110, the sidewalls 917 of the first tray 500 fit into the ravine 3610 to stably hold the first tray 500 (see FIGS. 42 and 43 in particular).

Figure 37:
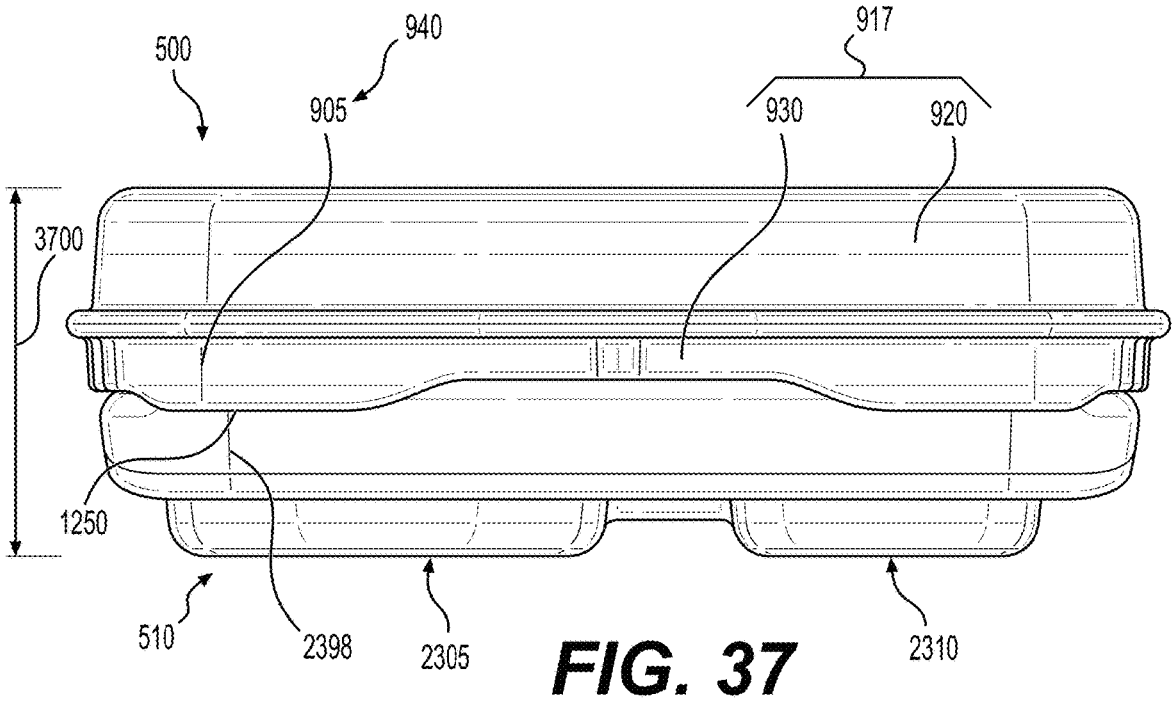
FIG. 37 is an illustration of the first tray connected to the second tray, in accordance with at least one example embodiment.
Figure 38:
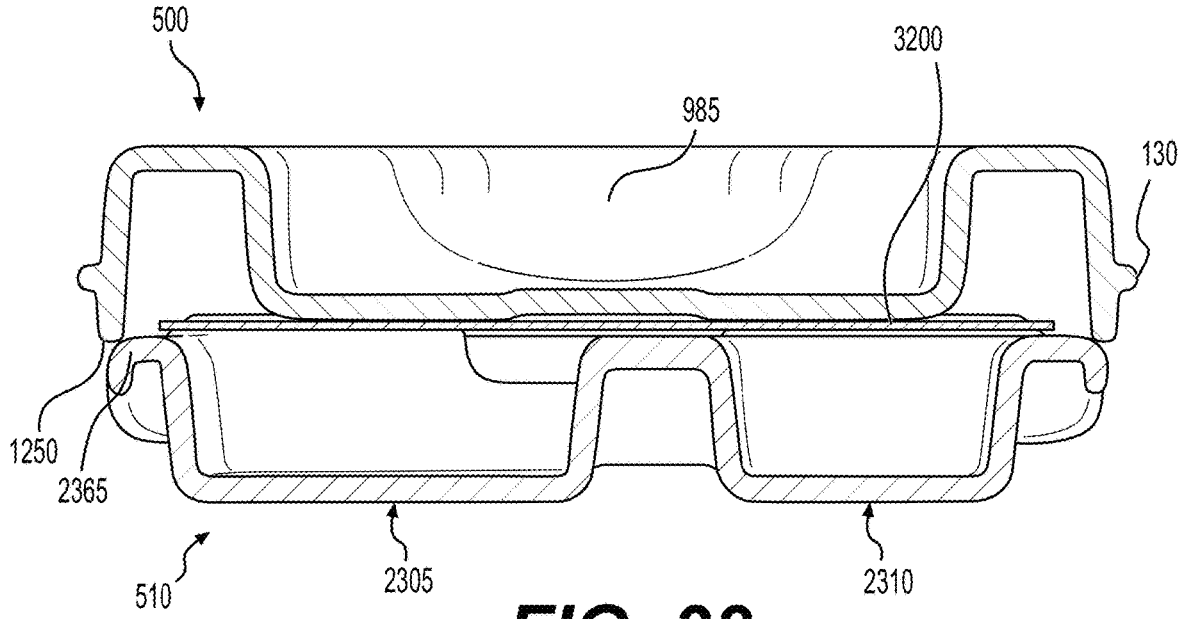
FIG. 38 is an illustration of a cross-sectional view (view XXXVIII-XXXVIII of FIG. 22) of the first tray connected to the second tray, in accordance with at least one example embodiment.
Figure 39:
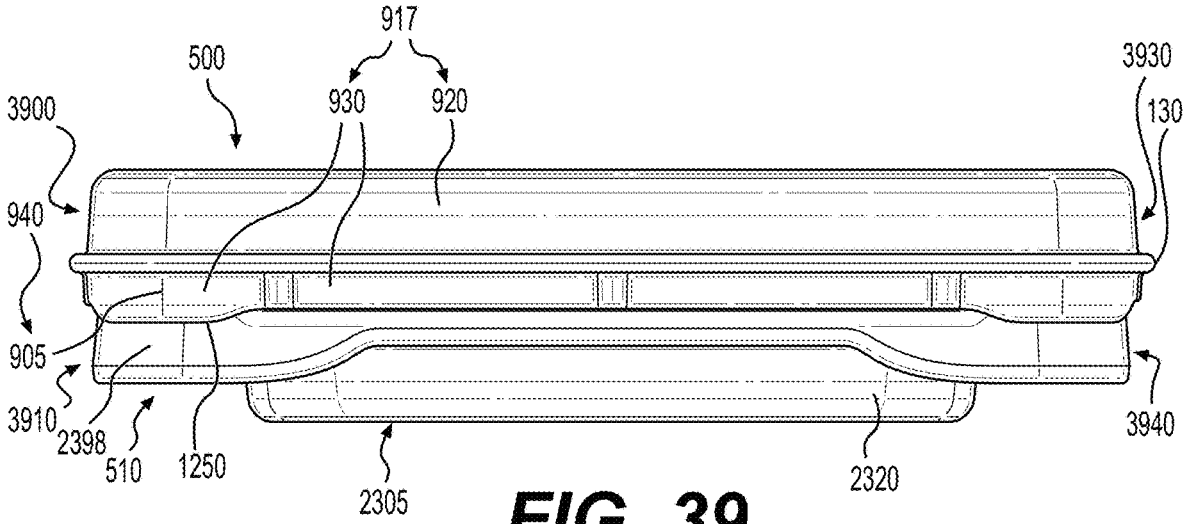
FIG. 39 is an illustration of the first tray connected to the second tray, in accordance with at least one example embodiment.
Figure 40:
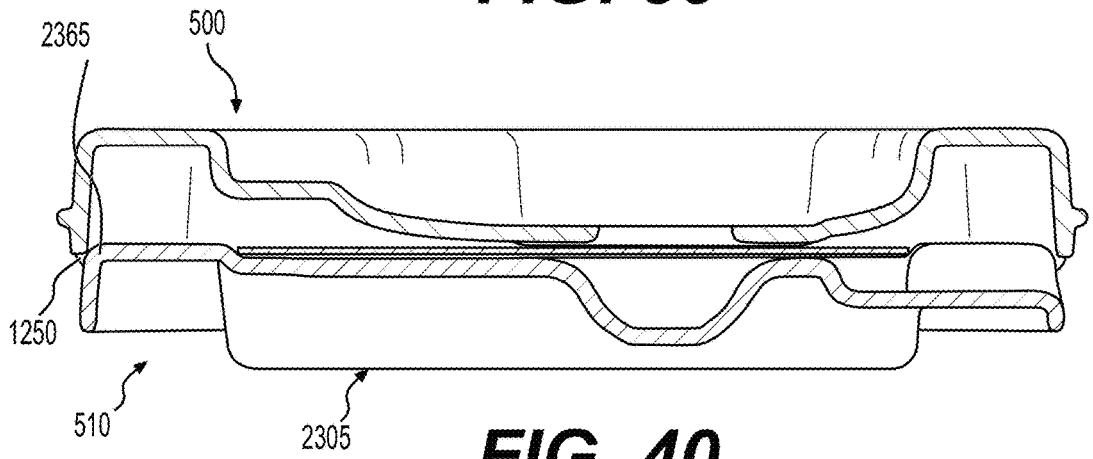
FIG. 40 is an illustration of a cross-sectional view (view XL-XL of FIG. 22) of the first tray connected to the second tray, in accordance with at least one example embodiment.
Figure 41:
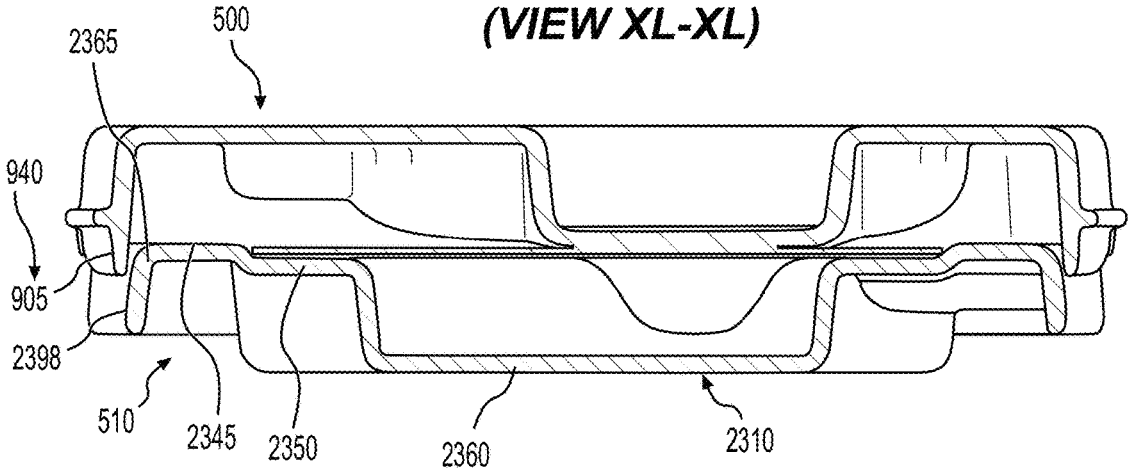
FIG. 41 is an illustration of another cross-sectional view (view XLI-XLI of FIG. 22) of the first tray connected to the second tray, in accordance with at least one example embodiment.

FIG. 37 is an illustration of the first tray 500 connected to the second tray 510, in accordance with at least one example embodiment. FIG. 38 is an illustration of a cross-sectional view (view XXXVIII-XXXVIII of FIG. 22) of the first tray 500 connected to the second tray 510, in accordance with at least one example embodiment. FIG. 39 is an illustration of the first tray 500 connected to the second tray 510, in accordance with at least one example embodiment. FIG. 40 is an illustration of a cross-sectional view (view XL-XL of FIG. 22) of the first tray 500 connected to the second tray 510, in accordance with at least one example embodiment. FIG. 41 is an illustration of another cross-sectional view (view XLI-XLI of FIG. 22) of the first tray 500 connected to the second tray 510, in accordance with at least one example embodiment.

In at least one example embodiment, and as shown in at least FIGS. 37 and 39, the lower portion 940 of the rounded corners 905 of the first tray 500 overhang and are able to grip onto the rounded corners 2398 of the second tray 510. In at least one example embodiment, the ability of the rounded corners 905 to grip the second tray 510 can allow the first tray 500 and the second tray 510 to remain connected together when the second section 120 is removed from a top portion of the outer container 100 (as shown for instance in FIG. 22). In at least one example embodiment, with the sidewalls 917 of the first tray 500 being flared outward (see FIGS. 18 and 20), the lower portion 940 of the rounded corners 905 of the first tray 500 can more easily grip the second tray 510.

In at least one example embodiment, and as shown in FIG. 39, either the first tray 500 or the second tray 510 can be rotated (specifically, rotated 180 degree), while the first tray 500 and the second tray 510 are still able to be connected to each other. That is to say, in at least one example embodiment, a first end 3900 and a second end 3910 of the first tray 500 and second tray 510 can be respectively connected to each other, while a third end 3930 and a fourth end 3940 of the first tray 500 and the second tray 510 are respectively connected to each other. Or, the first tray 500 can be rotated (as an example), where the first end 3900 and the fourth end 3940 of the first tray 500 and the second tray 510 are respectively connected to each other, as the third end 3930 and the second end 3910 of the first tray 500 and the second tray 510 are respectively connected to each other.

In at least one example embodiment, a total height (stackable height) 3700 of the first tray 500 and the second tray 510 connected together, as shown in FIG. 37, is in the range of about 25 mm to 40 mm, or about 30 mm to 35 mm, or about 33 mm.

FIG. 42 is an illustration of a cross-sectional view (view XLII-XLII of FIG. 1) of the outer container 100 containing the first tray 500 and the second tray 510, where the second tray 510 is supporting the consumer information material 3200, in accordance with at least one example embodiment. FIG. 43 is an illustration of another cross-sectional view (view XLIII-XLIII of FIG. 1) of the outer container 100 containing the first tray 500 and the second tray 510, where the first tray 500 contains the consumer product 1600, in accordance with at least one example embodiment.

In at least one example embodiment, the floor 2355 of the first depression 2305 and the floor 2360 of the second depression 2310 of the second tray 510 of the second tray 510 contact the end wall 600 of the first section 110 of the outer container 100 (see FIG. 42). In at least one example embodiment, the floor 2355 of the first depression 2305 and the floor 2360 of the second depression 2310 of the second tray 510 are a lowest surface (lowest vertical elevation) of the second tray 510.

In at least one example embodiment, a general shape of the first tray 500 is conformed to a general shape of the first section 110 and the second section 120. In particular, and in at least one example embodiment, the sidewalls 917 of the first tray 500 are conformed to an interior surface of the first section 110 and the second section 120. In at least one example embodiment, and as described above, the sidewalls 917 of the first tray 500 fit into the ravine 3610 that is defined by the first section 110 and the second tray 510, while the ridge 130 of the first tray 500 is gripped by the peripheral edges 640 of the first section 110 and the second section 120.

In at least one example embodiment, the outer container 100 holding the first tray 500 and the second tray 510 has a width 4200 in the range of about 95 mm to 115 mm, or about 100 mm to 110 mm, or about 107 mm, with a height 4210 in the range of about 40 mm to 60 mm, or about 45 mm to 55 mm, or about 51 mm, and a length 4300 in the range of about 145 mm to 165 mm, or about 150 mm to 160 mm, or about 153 mm. In at least one example embodiment, a height 4220 of the first section 110 and the second section 120 is in the range of about 15 mm to 30 mm, or about 20 mm to 25 mm, or about 22 mm.

Figure 44:
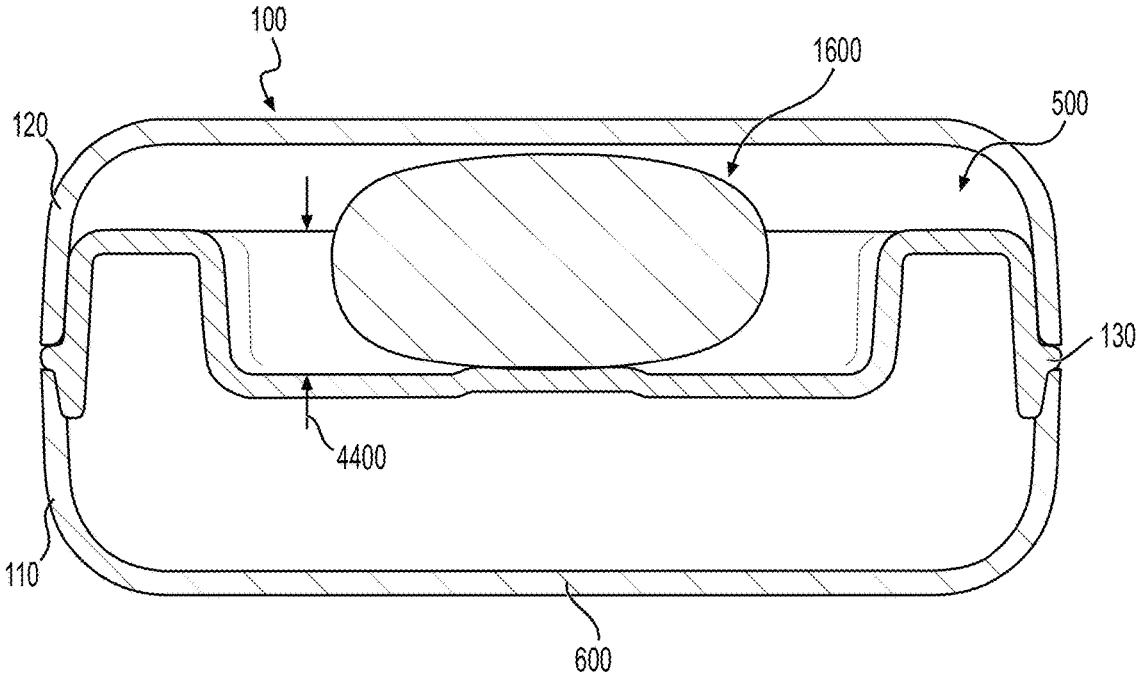
FIG. 44 is an illustration of a cross-sectional view (view XLII-XLII of FIG. 1) of the outer container containing the first tray and not the second tray, in accordance with at least one example embodiment.
Figure 45:
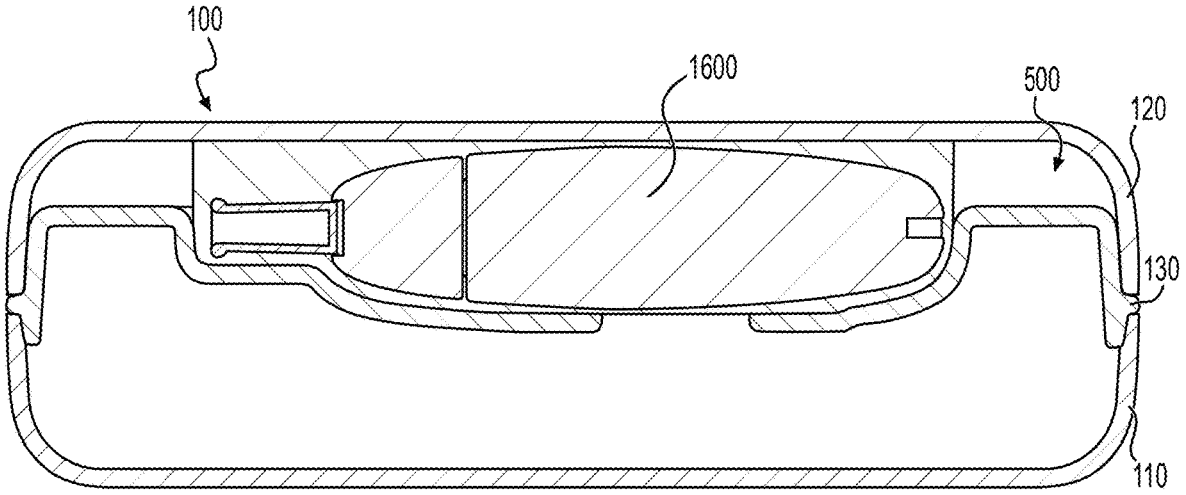
FIG. 45 is an illustration of another cross-sectional view (view XLIII-XLIII of FIG. 1) of the outer container containing the first tray and not the second tray, in accordance with at least one example embodiment.

FIG. 44 is an illustration of a cross-sectional view (view XLII-XLII of FIG. 1) of the outer container 100 containing the first tray 500, in accordance with at least one example embodiment. FIG. 45 is an illustration of another cross-sectional view (view XLIII-XLIII of FIG. 1) of the outer container 100 containing the first tray 500, in accordance with at least one example embodiment.

In at least one example embodiment, and as shown in FIGS. 44-45, the outer container 100 can hold only the first tray 500 and not the second tray 510. In this configuration, and in at least one example embodiment, the second tray 510 is "suspended" within the outer container 100, When the second tray 510 is not in the outer container 100 to support the first tray 500.

In at least one example embodiment, an internal depth 4400 of the first tray 500 is in the range of about 10 mm to 20 mm or about 12.5 mm to about 17.5 mm, or about 15 mm.

Figure 46:
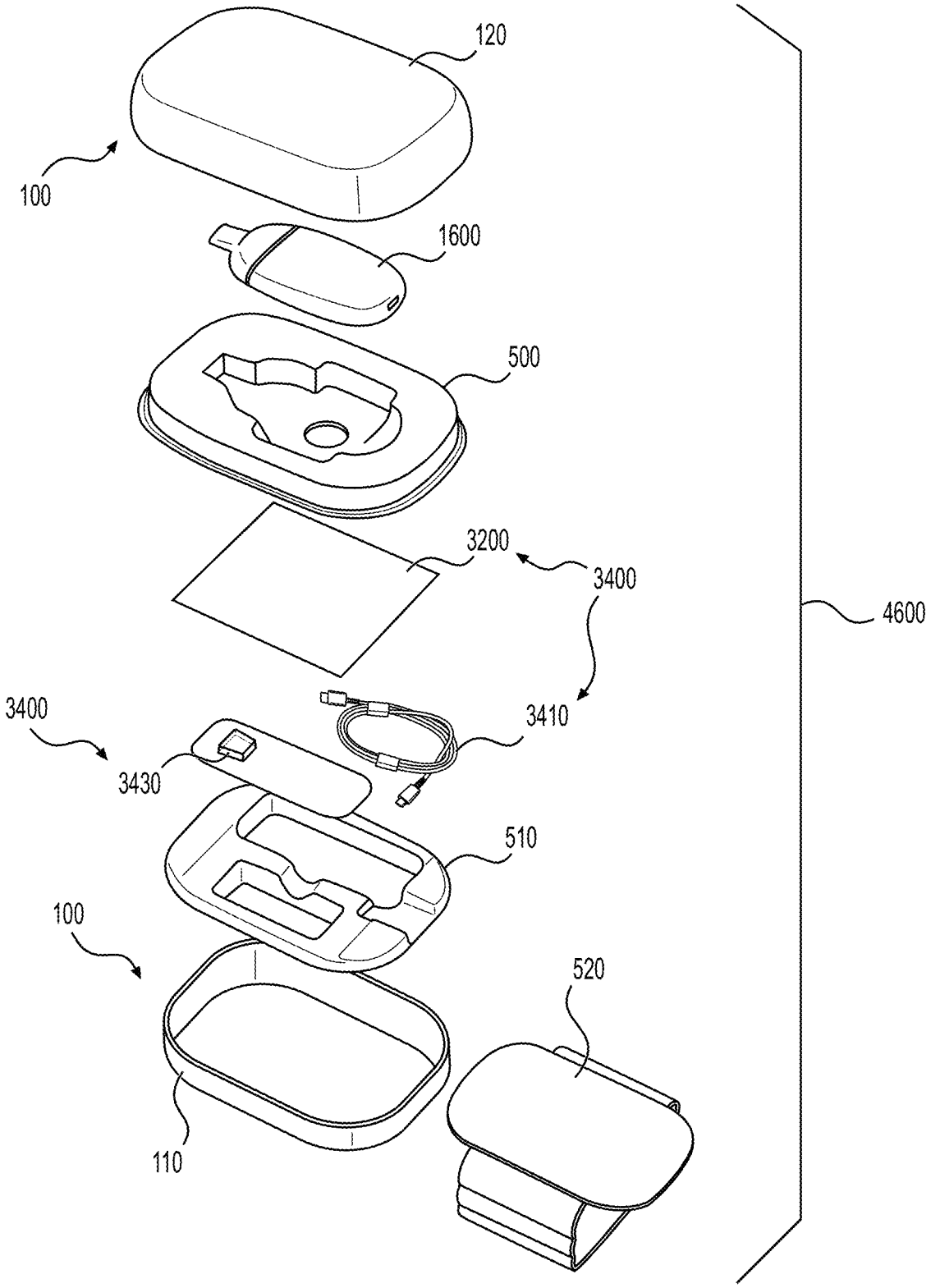
FIG. 46 is an illustration of an exploded view of the package, in accordance with at least one example embodiment.
Figure 47:
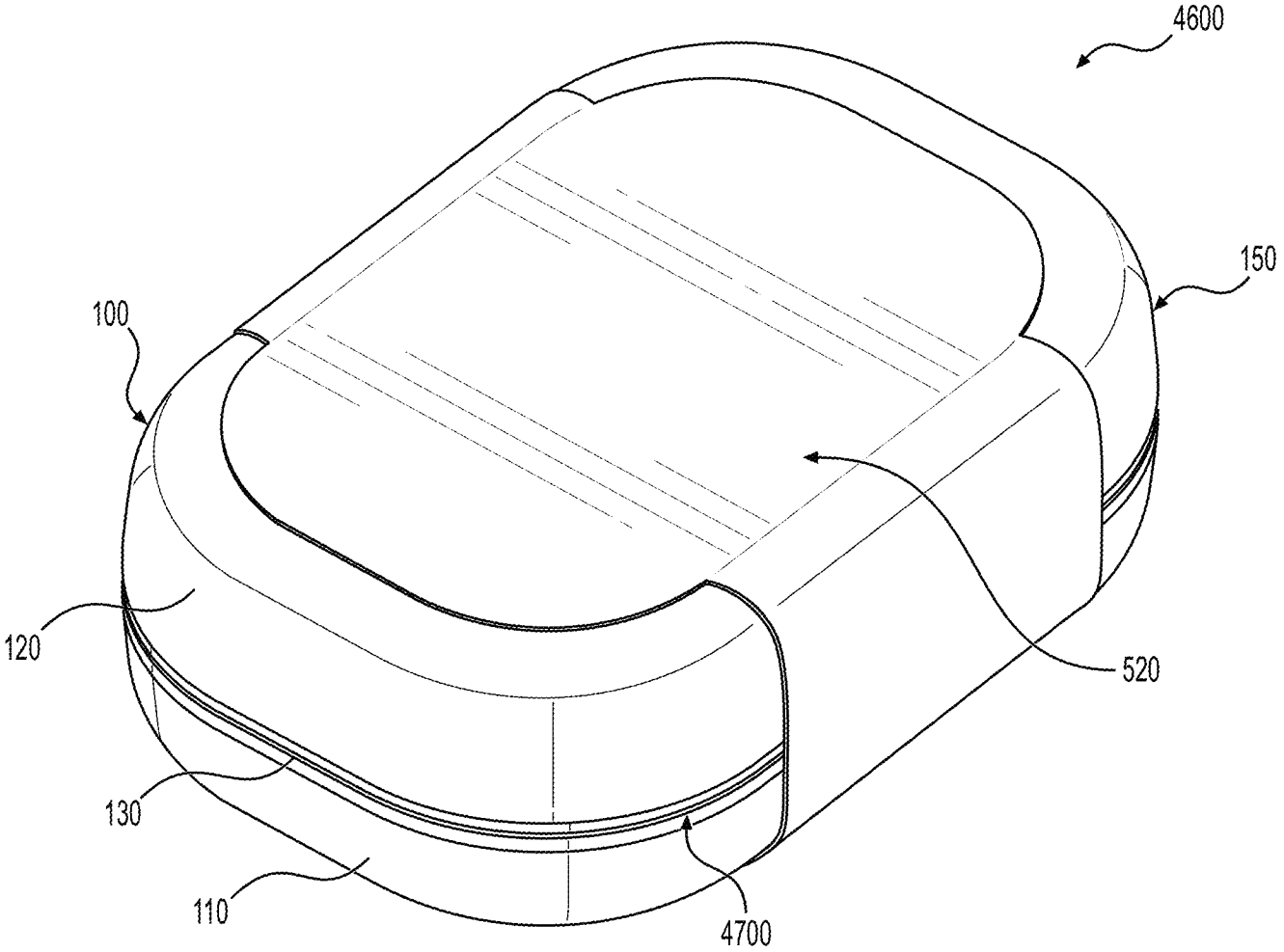
FIG. 47 is an illustration of a perspective view a package, in accordance with at least one example embodiment.

FIG. 46 is an illustration of an exploded view of the package 4600, in accordance with at least one example embodiment. FIG. 47 is an illustration of a perspective view the package 4600 that is sealed "closed" using the band 520, in accordance with at least one example embodiment.

In at least one example embodiment, the package 4600 includes the outer container 100 with the first tray 500 and the second tray 510 (see FIG. 46). In at least one example embodiment, the first tray 500 of the package 4600 contains the consumer product 1600, and the second tray 510 contains the added consumer products 3400. In at least one example embodiment, the band 520 is connected to, or at least partially encompasses, the outer container 100 to help seal the package 4600 (see FIG. 47). In at least one example embodiment, the band 520 is connected to the outer container 100 so that the band 520 maintains the outer container 100 in a closed position by disallowing the outer container 100 from being pried open at a seam 4700 between the first section 110 and the second section 120, thereby offering tamper resistance for the package 4600.

Insert

Figure 48:
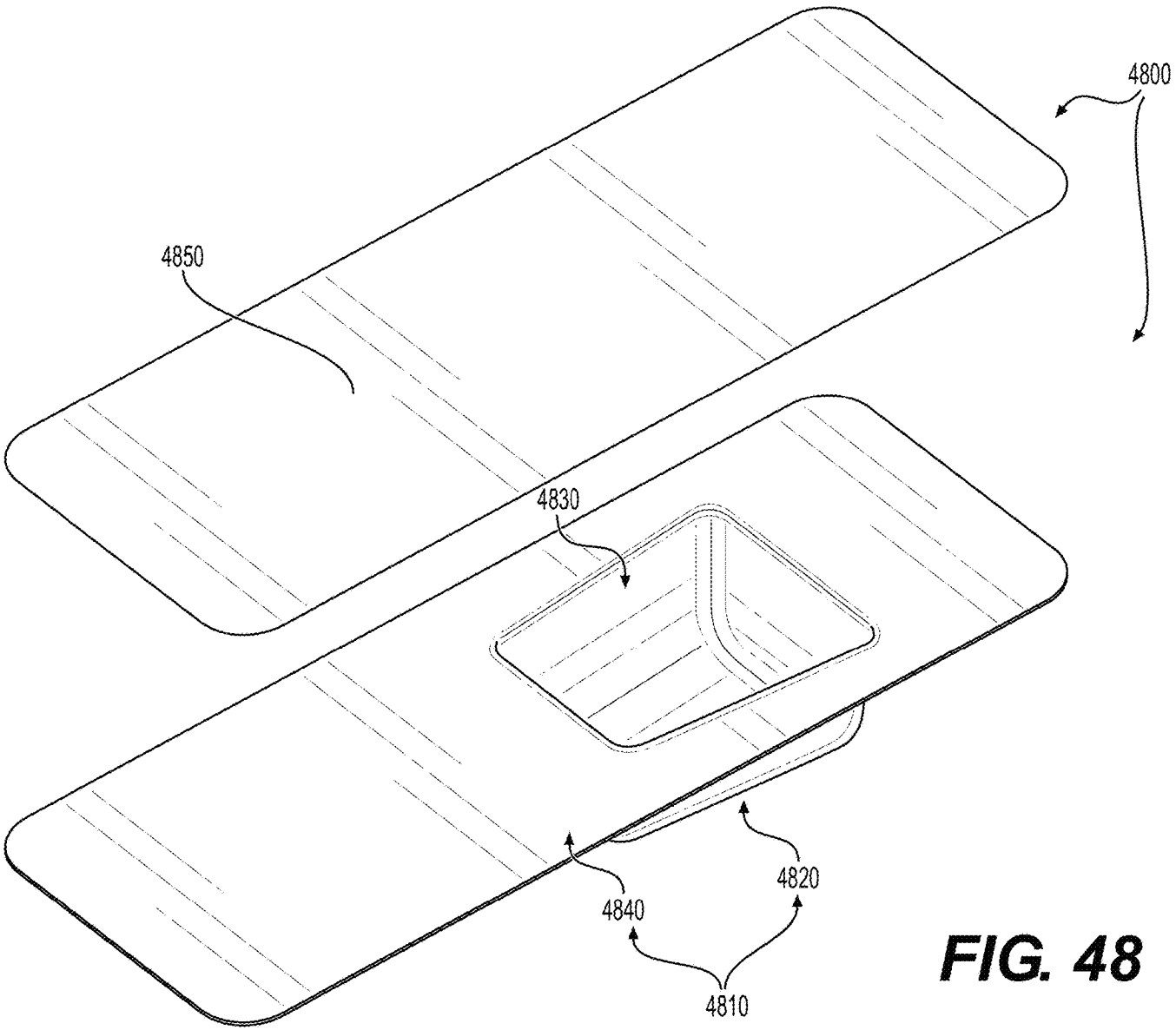
FIG. 48 is an illustration of an upper perspective view of an insert, in accordance with at least one example embodiment.
Figure 49:
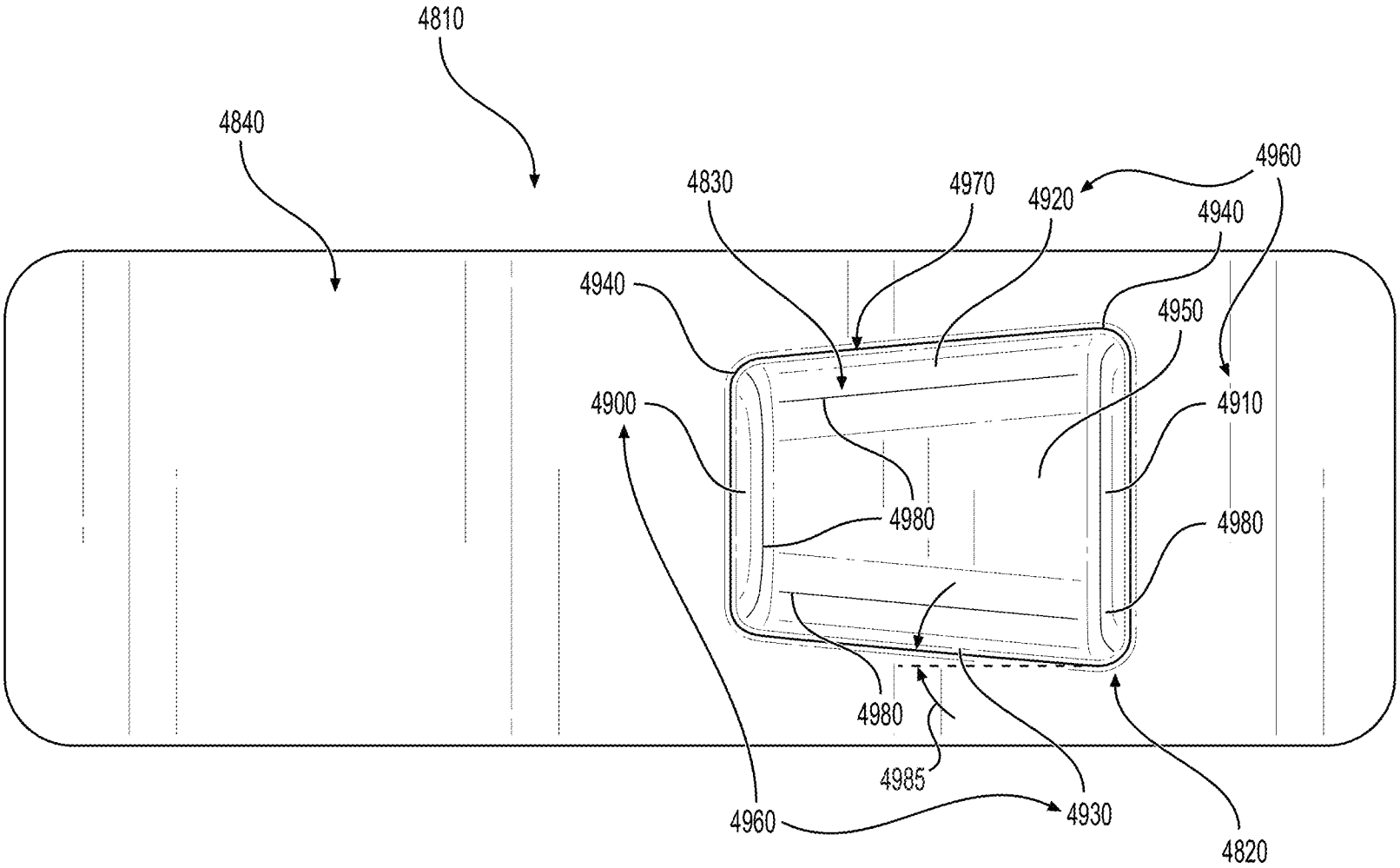
FIG. 49 is an illustration of a top view of a base of the insert, in accordance with at least one example embodiment.
Figure 50:
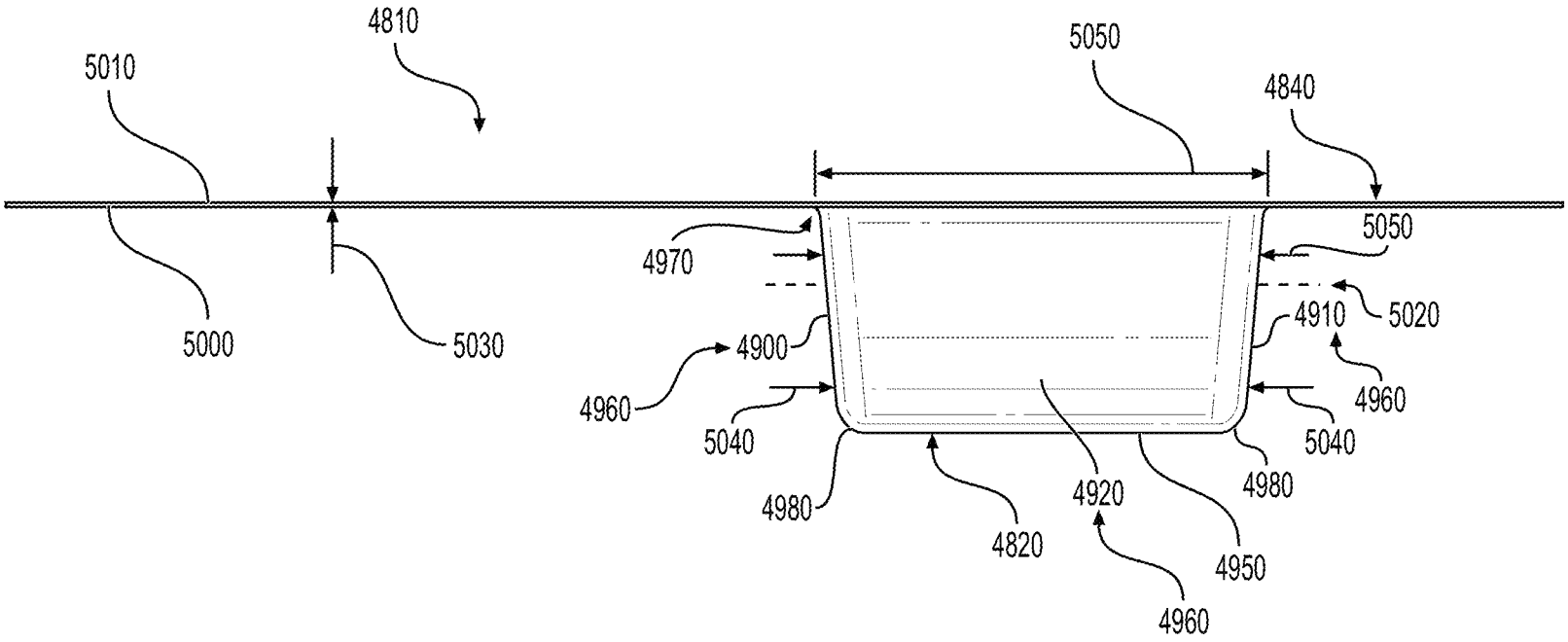
FIG. 50 is an illustration of a side view of the base of the insert, in accordance with at least one example embodiment.
Figure 51:
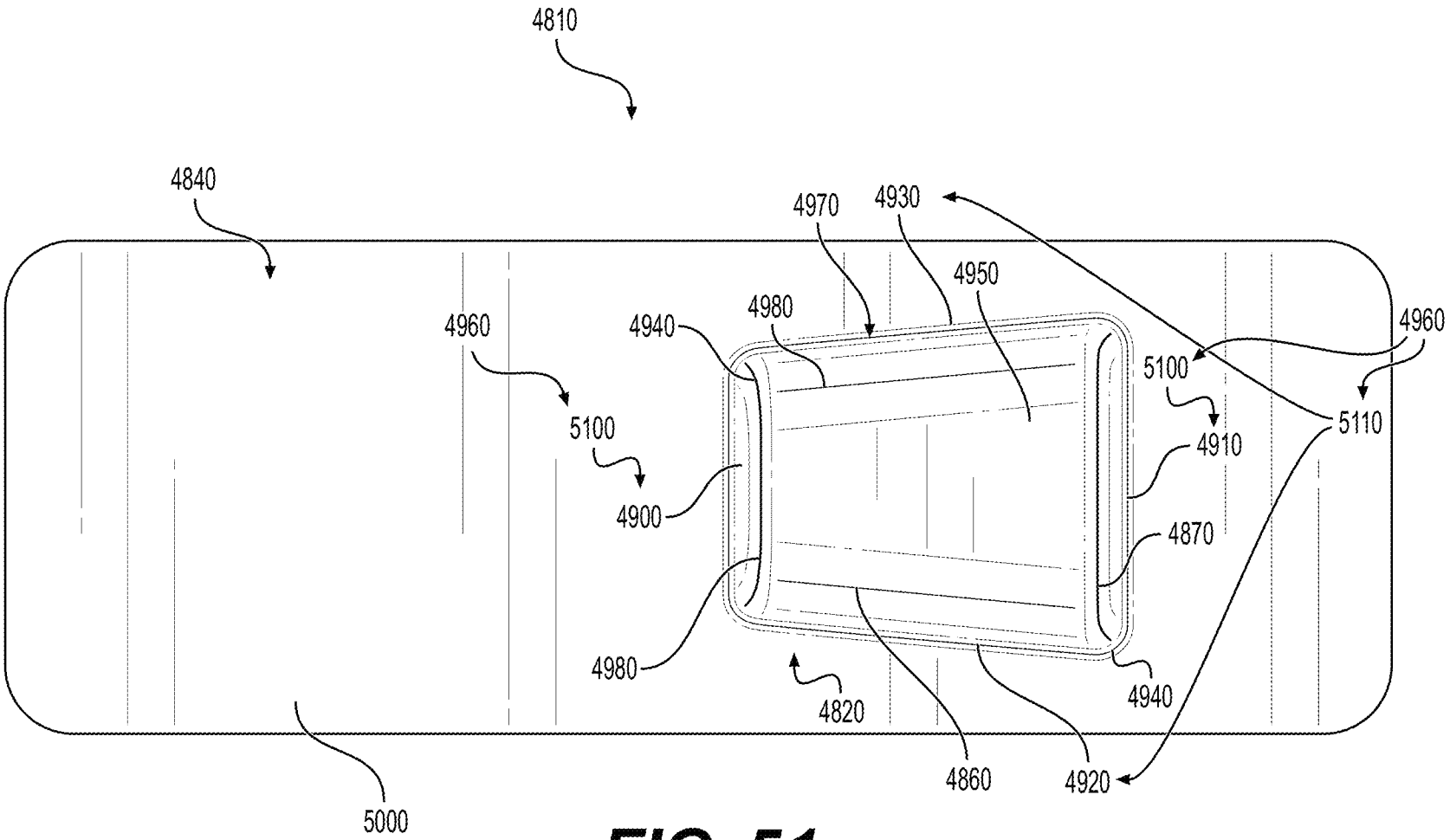
FIG. 51 is an illustration of a bottom view of the base of the insert, in accordance with at least one example embodiment.
Figure 53:
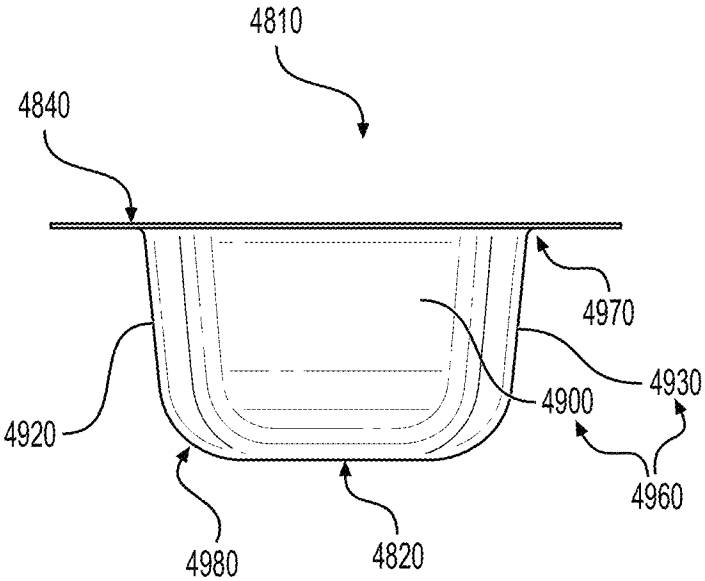
FIG. 53 is an illustration of a front view of the base insert, in accordance with at least one example embodiment.
Figure 52:
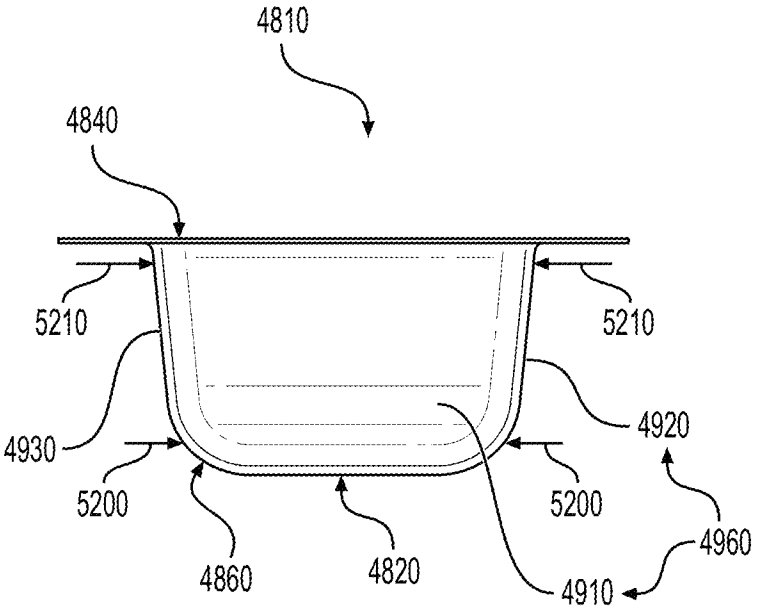
FIG. 52 is an illustration of a back view of the base insert, in accordance with at least one example embodiment.

FIG. 48 is an illustration of an upper perspective view of the insert 4800, in accordance with at least one example embodiment. FIG. 49 is an illustration of a top view of a base 4810 of the insert 4800, in accordance with at least one example embodiment. FIG. 50 is an illustration of a side view of the base 4810 of the insert 4800, in accordance with at least one example embodiment. FIG. 51 is an illustration of a bottom view of the base 4810 of the insert 4800, in accordance with at least one example embodiment. FIG. 52 is an illustration of a back view of the base 4810 of the insert 4800, in accordance with at least one example embodiment. FIG. 53 is an illustration of a front view of the base 4810 of the insert 4800, in accordance with at least one example embodiment.

Figure 54:
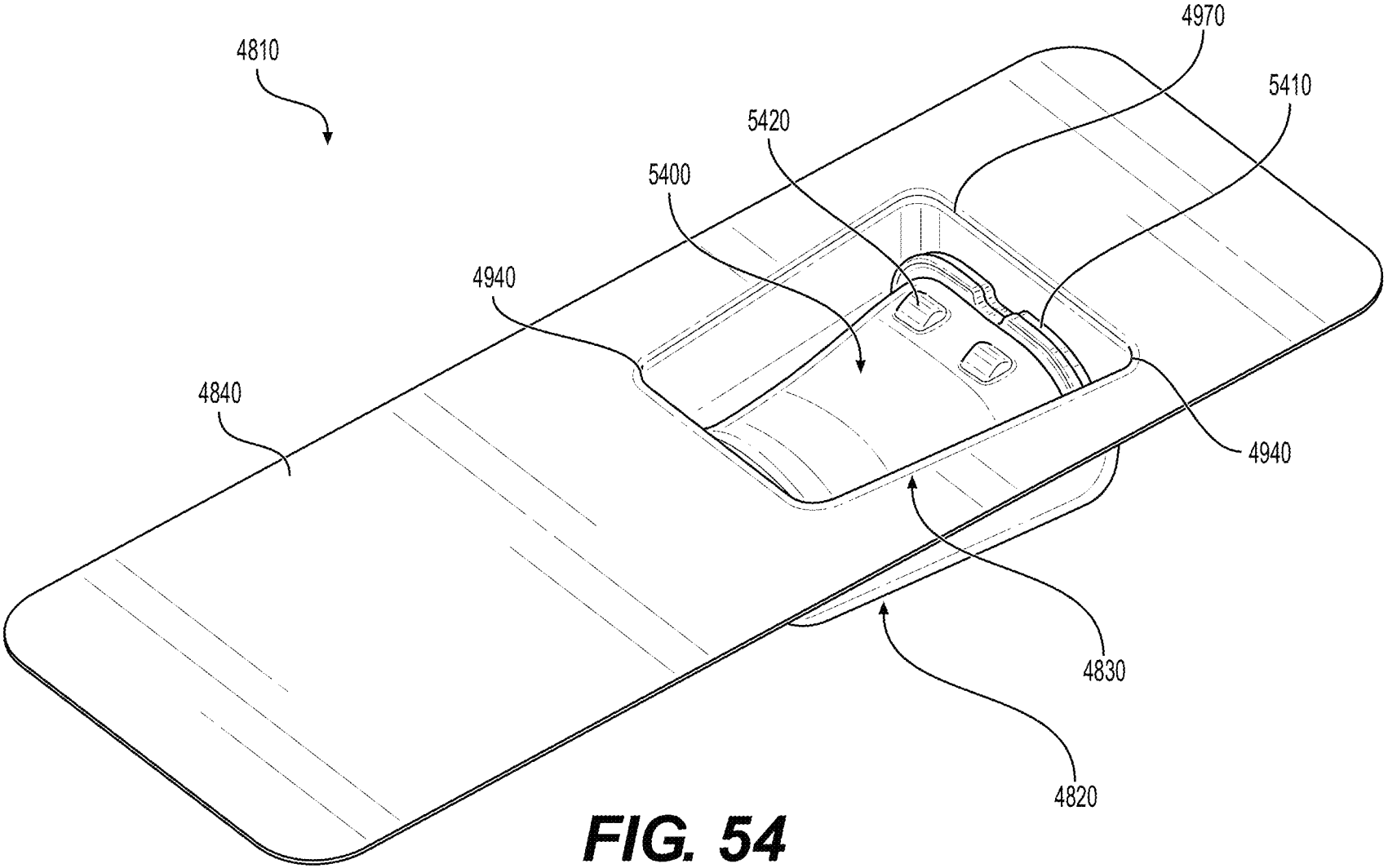
FIG. 54 is an illustration of an upper perspective view of the base containing a consumer product, in accordance with at least one example embodiment.

In at least one example embodiment, the insert 4800 includes the base 4810 and a lid 4850. In at least one example embodiment, the lid 4850 is connected to a brim 4840 of the base 4810. In at least one example embodiment, the lid 4850 covers a top end of the base 4810. In at least one example embodiment, the base 4810 includes a depression 4820 that defines a cavity 4830. In at least one example embodiment, the depression 4820 extends from a lower surface 5000 of the brim 4840 (FIG. 50). In at least one example embodiment, and as shown in FIG. 54, the insert 4800 contains a consumer product 5400. In at least one example embodiment, the depression 4820 includes a floor (lower surface) 4950 and walls 4960 (see FIG. 49). In at least one example embodiment, the walls 4960 include a first end wall 4900, a second end wall 4910, a first sidewall 4920 and a second sidewall 4930. In at least one example embodiment, the first end wall 4900 and the second end wall 4910 are a first pair of opposing walls 5100 that are substantially parallel to each other (see FIG. 51). In particular, and in at least one example embodiment, the first end wall 4900 and the second end wall 4910 are parallel with each other within an imaginary horizontal plane that traverse through any elevation of the depression 4820 (see an example of an imaginary horizontal plane 5020 in FIG. 50). In at least one example embodiment, the first sidewall 4920 and the second sidewall 4930 are a second pair of opposing walls 5110 (see FIG. 51) that taper toward each other along a longitudinal length of the depression from a first end (at the second end wall 4910) to a second end (at the first end wall 4900) of the depression 4820. In at least one example embodiment, the first sidewall 4920 and the second sidewall 4930 taper toward each other with a common (same) angle of convergence 4985 that is between about 1° and 15°, or between about 1° and 10°, or between about 1° and 5°. In at least one example embodiment, the depression 4820 has a trapezoidal shape from an overhead perspective view (as shown in FIG. 49).

In at least one example embodiment, the depression 4820 includes corners 4940 where the walls 4960 are joined (FIG. 49), where the corners 4940 are rounded. In at least one example embodiment, the depression 4820 includes corners 4980 at a transition where the floor 4950 meets the walls 4960, where the corners 4980 are rounded (see at least FIGS. 49-50). In at least one example embodiment, a seam 4970 between the brim 4840 and the depression 4820 is rounded (beveled), such that the walls 4960 are flared outward as the depression 4820 meets the brim 4840 (see at least FIGS. 49-50 and 52-53).

In at least one example embodiment, the brim 4840 includes an upper surface 5010 and the lower surface 5000 (see FIG. 50). In at least one example embodiment, the lid 4850 (FIG. 48) connects to at least a portion of the upper surface 5010. In at least one example embodiment, the lid 4850 covers the upper surface 5010. In at least one example embodiment, the depression 4820 extends from the lower surface 5000.

In at least one example embodiment, the walls 4960 are flared outward, from a lower elevation to an upper elevation of the depression 4820 (see at least FIGS. 50 and 52-53). Therefore, in this example embodiment, a first longitudinal length 5040 of the depression 4820 is smaller than a second longitudinal length 5050 of the depression 4820 at an upper elevation of the depression 4820 (FIG. 50)— just as a first width 5200 of the depression 4820 at a lower elevation is smaller than a second width 5210 at an upper elevation of the depression 4820 (FIG. 52). In at least one example embodiment, the walls 4960 have major surfaces with a trapezoidal shape, with corners 4980 on a lower portion of the trapezoid that are rounded, as shown in at least FIGS. 50, 52 and 53.

In at least one example embodiment, the base 4810 and/or the lid 4850 are made from a thermoform plastic that is heated and then molded or extruded during a manufacturing process. In at least one example embodiment, the base 4810 and/or the lid 4850 are made from high density polyethylene (HDPE), low density polyethylene (LDPE), polyethylene terephthalate (PET), polypropylene (PP), or combinations thereof. In at least one example embodiment, the base 4810 and/or the lid 4850 are made from a material that is recyclable.

In at least one example embodiment, and as shown in FIG. 50, a thickness 5030 of the base 4810 is a uniform thickness for the brim 4840 and the depression 4820. In at least one example embodiment, the thickness 5030 is about 0.1 mm to 1 mm, or about 0.2 mm to 0.7 mm, or about 0.3 mm to 0.5 mm, or about 0.4 mm. In at least one example embodiment, the thickness 5030 of the base 4810, or at least a thickness of the floor 4950 and the walls 4960 of the depression 4820, is about 0.1 mm to 1 mm, or about 0.2 mm to 0.7 mm, or about 0.3 mm to 0.5 mm, or about 0.4 mm, and the base 4810 is made from polyethylene terephthalate (PET) or amorphous polyethylene terephthalate (APET). In at least one example embodiment, the thickness 5030 of the base 4810, or at least a thickness of the floor 4950 and the walls 4960 of the depression 4820, impact a performance of the base 4810 from a manufacturing and a resiliency standpoint, as the thickness 5030 should not be too thin to avoid holes forming in the base 4810 during a thermoform manufacturing process, and the thickness 5030 should not be too large to ensure the base 4810 is malleable and resilient during a use of the base 4810. In at least one example embodiment, the base 4810, or at least the walls 4960 of the base 4810, should be thin enough that the depression 4820 is able to be crumpled as the floor 4950 of the depression 4820 is pressed toward the lid 4850 in order to press the consumer product 5400 through the lid 4850, or a weakened area 6800 of the lid 4850 (see the discussion of FIG. 68). In at least one example embodiment, a thickness of the brim 4840 and a thickness of the depression 4820, or portions of the depression 4820, are different from each other.

Figure 55:
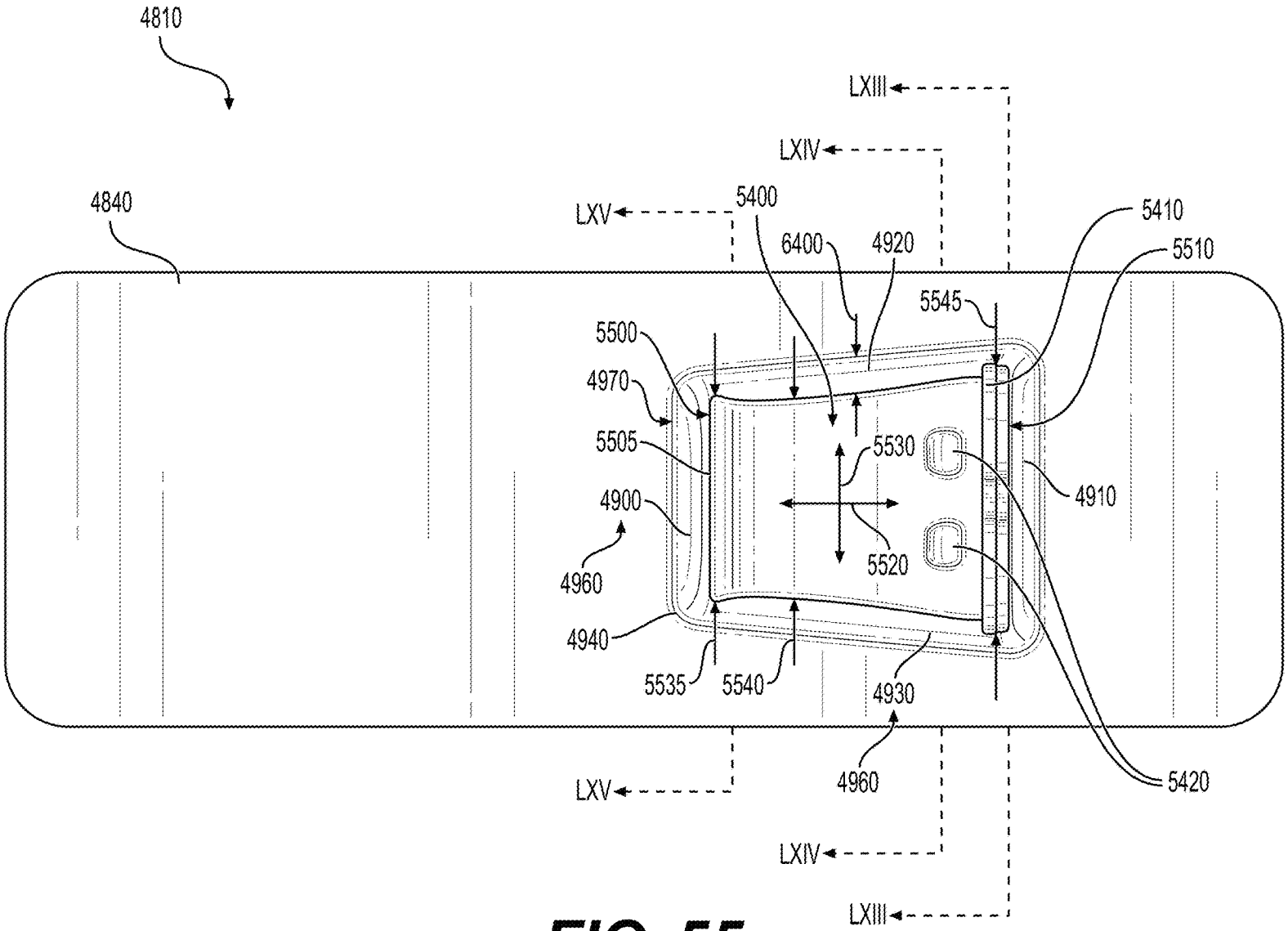
FIG. 55 is an illustration of a top view of the base containing the consumer product, in accordance with at least one example embodiment.
Figure 57:
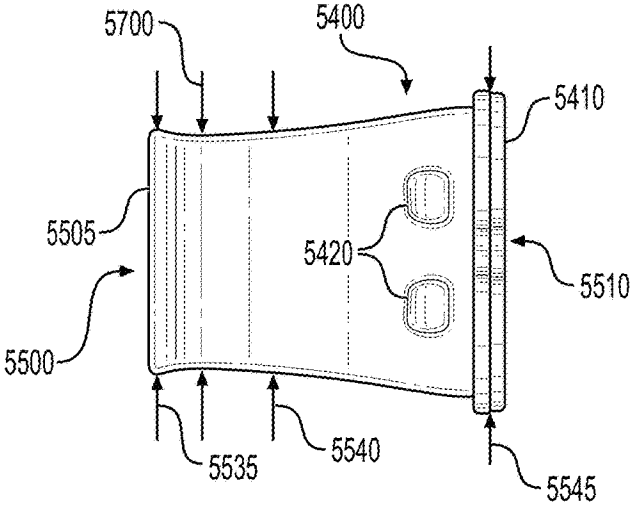
FIG. 57 is a top view of the consumer product, in accordance with at least one example embodiment.
Figure 60:
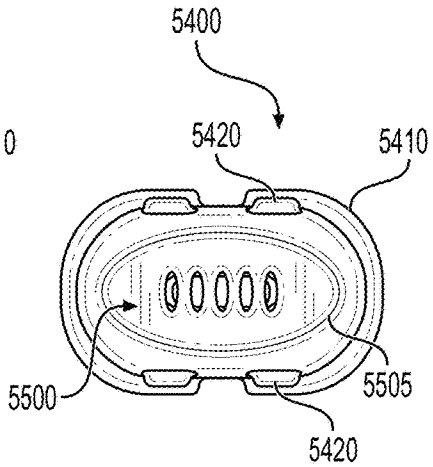
FIG. 60 is a front view of the consumer product, in accordance with at least one example embodiment.
Figure 59:
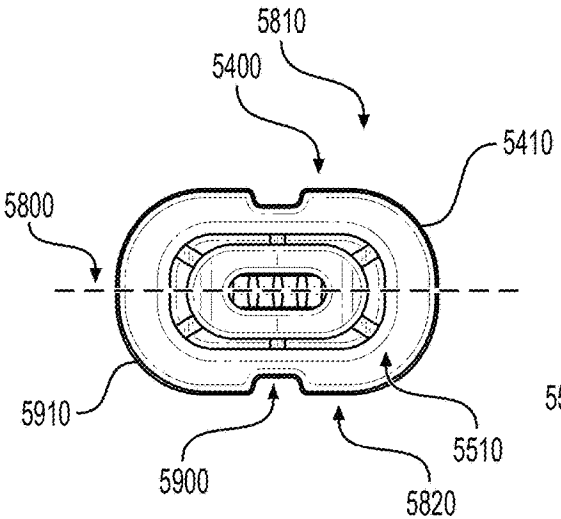
FIG. 59 is a back view of the consumer product, in accordance with at least one example embodiment.
Figure 56:
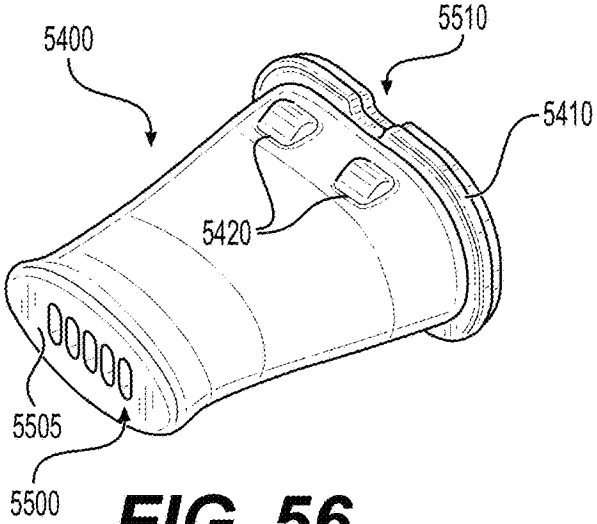
FIG. 56 is an upper, front perspective view of a consumer product, in accordance with at least one example embodiment.
Figure 58:
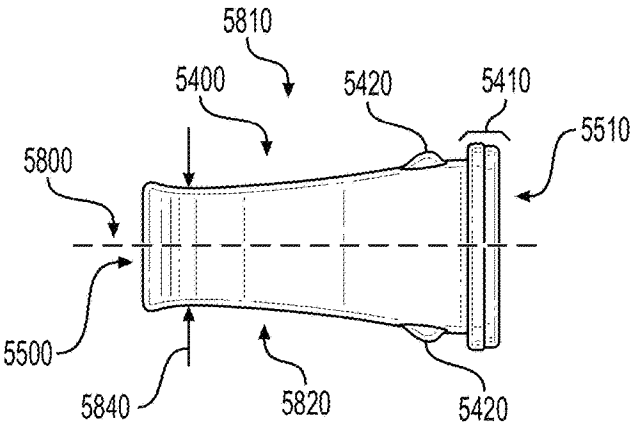
FIG. 58 is a side view of the consumer product, in accordance with at least one example embodiment.
Figure 62:
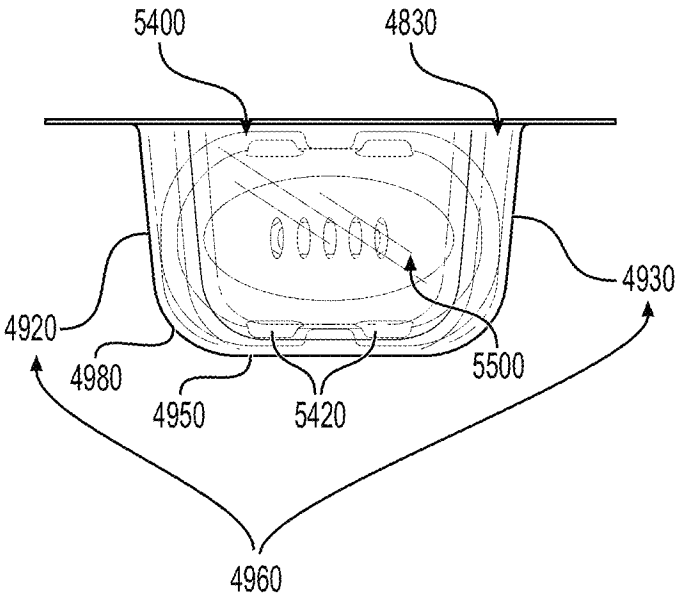
FIG. 62 is a front view of the consumer product in the base, in accordance with at least one example embodiment.
Figure 61:
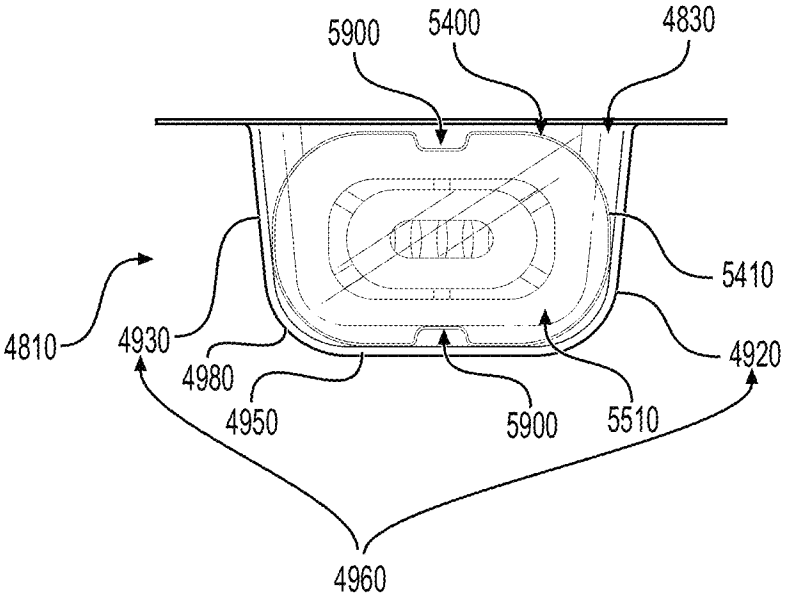
FIG. 61 is a back view of the consumer product in the base, in accordance with at least one example embodiment.
Figure 63:
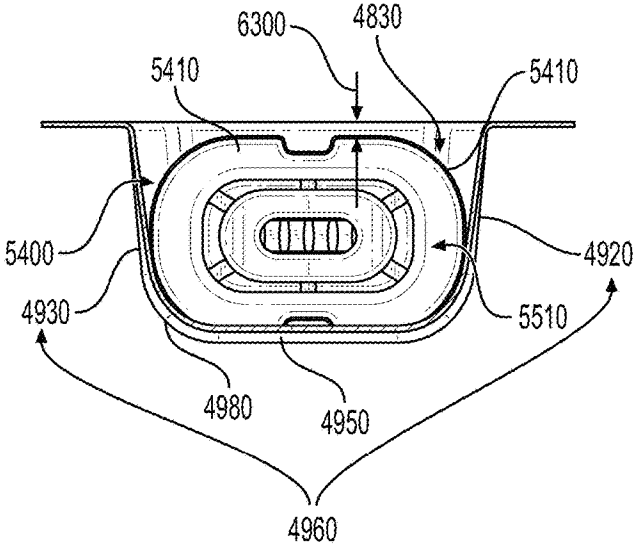
FIG. 63 is an illustration of a cross-sectional view (view LXIII-LXIII of FIG. 55), in accordance with at least one example embodiment.
Figure 64:
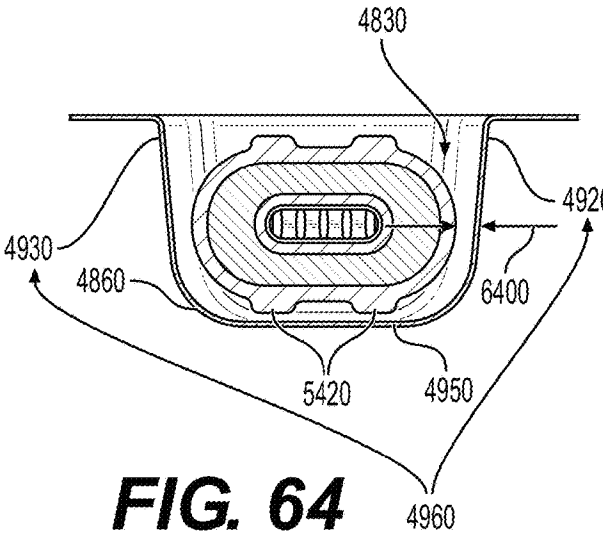
FIG. 64 is an illustration of a cross-sectional view (view LXIV-LXIV of FIG. 55), in accordance with at least one example embodiment.
Figure 65:
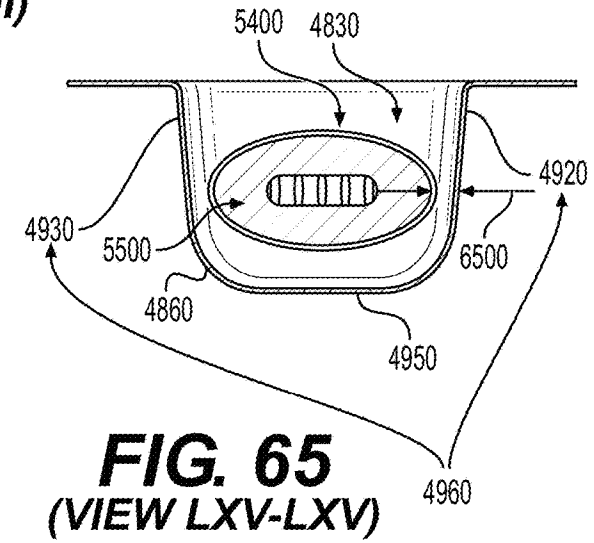
FIG. 65 is an illustration of a cross-sectional view (view LXV-LXV of FIG. 55), in accordance with at least one example embodiment.

FIGS. 54-55 are illustrations of perspective and top views of the base 4810 containing the consumer product 5400, in accordance with at least one example embodiment. FIGS. 56-60 are perspective and orthogonal views of the consumer product 5400, in accordance with at least one example embodiment. FIGS. 61-62 are illustrations of orthogonal views of the consumer product 5400 in the cavity 4830 of the base 4810, in accordance with at least one example embodiment. FIG. 63 is an illustration of a cross-sectional view of the base (view LXIII-LXIII of FIG. 55), in accordance with at least one example embodiment. FIG. 64 is an illustration of a cross-sectional view of the base (view LXIV-LXIV of FIG. 55), in accordance with at least one example embodiment. FIG. 65 is an illustration of a cross-sectional view of the base (view LXV-LXV of FIG. 55), in accordance with at least one example embodiment.

In at least one example embodiment, the cavity 4830 of the insert 4800 contains the consumer product 5400. In at least one example embodiment, the consumer product 5400 is a single consumer product. In at least one example embodiment, the consumer product 5400 is more than one consumer product, or an element or an accessory for a consumer product. In at least one example embodiment, the consumer product 5400 is an accessory for the consumer product 1600 (FIG. 16). In at least one example embodiment, the consumer product 5400 is a mouthpiece, or a replacement mouthpiece, for the consumer product 1600 (FIG. 16).

In at least one example embodiment, the depression 4820 defines the cavity 4830 so that the cavity 4830 is conformed to an outer shape of the consumer product 5400. In at least one example embodiment, the consumer product 5400 includes a nose 5500 with a first width 5535 that is flared out at a distal end 5505 of the nose 5500 (see FIGS. 55 and 57, in particular), such that the first width 5535 is wider than a second width 5540 near a midsection of the consumer product 5400. In at least one example embodiment, the distal end 5505 of the nose 5500 has an oval-shaped major surface (see at least FIG. 60). In at least one example embodiment, the consumer product 5400 includes a frame 5410 at a rear 5510 of the consumer product 5400. In at least one example embodiment, the frame 5410 includes a third width 5545 that is wider than the first width 5535 and the second width 5540 (see FIGS. 55 and 57). In at least one example embodiment, the frame 5410 includes cut-outs 5900 that oppose each other (see FIG. 59). In at least one example embodiment, the rear 5510 of the frame 5410 has a substantially rectangular-shaped major surface with corners 5910 that are rounded (see at least FIG. 59). In at least one example embodiment, the rear 5510 of the frame 5410 has a surface area that is larger than a surface area of the distal end 5505 of the nose 5500. In at least one example embodiment, the consumer product 5400 has a minimum width 5700 and a minimum thickness 5840 at a location that is closer to the nose 5500 of the consumer product 5400 (see FIGS. 57 and 58).

In at least one example embodiment, the consumer product 5400 includes feet 5420 on a top portion and a bottom portion of the consumer product 5400 (see FIGS. 54 and 56-58). In at least one example embodiment, the feet 5420 are a pair of feet. In at least one example embodiment, the feet 5420 include a single foot, or more than two feet. In at least one example embodiment, the consumer product 5400 has an outer shape with a first half (upper portion) 5810 that is a mirror image of a second half (lower portion) 5820, where the first half 5810 and the second half 5820 are divided by an imaginary horizontal plane 5800 that bisects the consumer product 5400 (see FIGS. 58 and 59).

In at least one example embodiment, the walls 4960 of the depression 4820 cradle and protect the consumer product 5400 so that the consumer product 5400 is shielded from movement or vigorous incidental shaking (see FIGS. 55 and 61-62). In at least one example embodiment, the first end wall 4900 contacts the nose 5500 of the consumer product 5400 and the second end wall 4910 contacts the rear 5510 of the consumer product 5400 to restrain movement of the consumer product 5400 in a first direction 5520 along a longitudinal length of the base 4810 (see FIG. 55). In at least one example embodiment, the first sidewall 4920 and the second sidewall 4930 contact side surfaces of the nose 5500 and the frame 5410 of the consumer product 5400 to restrain movement of the consumer product 5400 in a second direction 5530 along a width of the longitudinal length of the base 4810 (see FIGS. 55 and 61-62).

In at least one example embodiment, the frame 5410 of the consumer product 5400 is at least partially cradled by the floor 4950, the corners 4980, the first sidewall 4920 and the second wall 4930 (see FIG. 63, which is view LXIII-LXIII of FIG. 55), in order to hold the frame 5410 in a "stabilized" position within the cavity 4830. In at least one example embodiment, a first gap 6300 (see FIGS. 63 and 67A) exists between a top of the frame 5410 and a top of the depression (where the lid 4850 would be located, as shown in FIG. 68). In at least one example embodiment, the first gap 6300 is reduced and/or nearly negligible, in order to further stabilize the frame 5410 within the cavity 4830. In at least one example embodiment, the feet 5420 contact the floor 4950 to further support the consumer product 5400 in the cavity 4830 (see at least FIG. 64, which is view LXIV-LXIV of FIG. 55). In at least one example embodiment, a second gap 6400 exists between outer side surfaces of the consumer product 5400 and the sidewalls 4920/4930 (see FIGS. 55 and 64), where the second gap 6400 allows the consumer product 5400 to more easily be grasped by a midsection and removed from the cavity 4830. In at least one example embodiment, a third gap 6500 exists between the nose 5500 of the consumer product 5400 and the sidewalls 4920/4930 (see FIG. 65, which is view LXV-LXV of FIG. 55), such that the nose 5500 can slightly shift (in the second direction 5530, as shown in FIG. 55).

Figure 66:
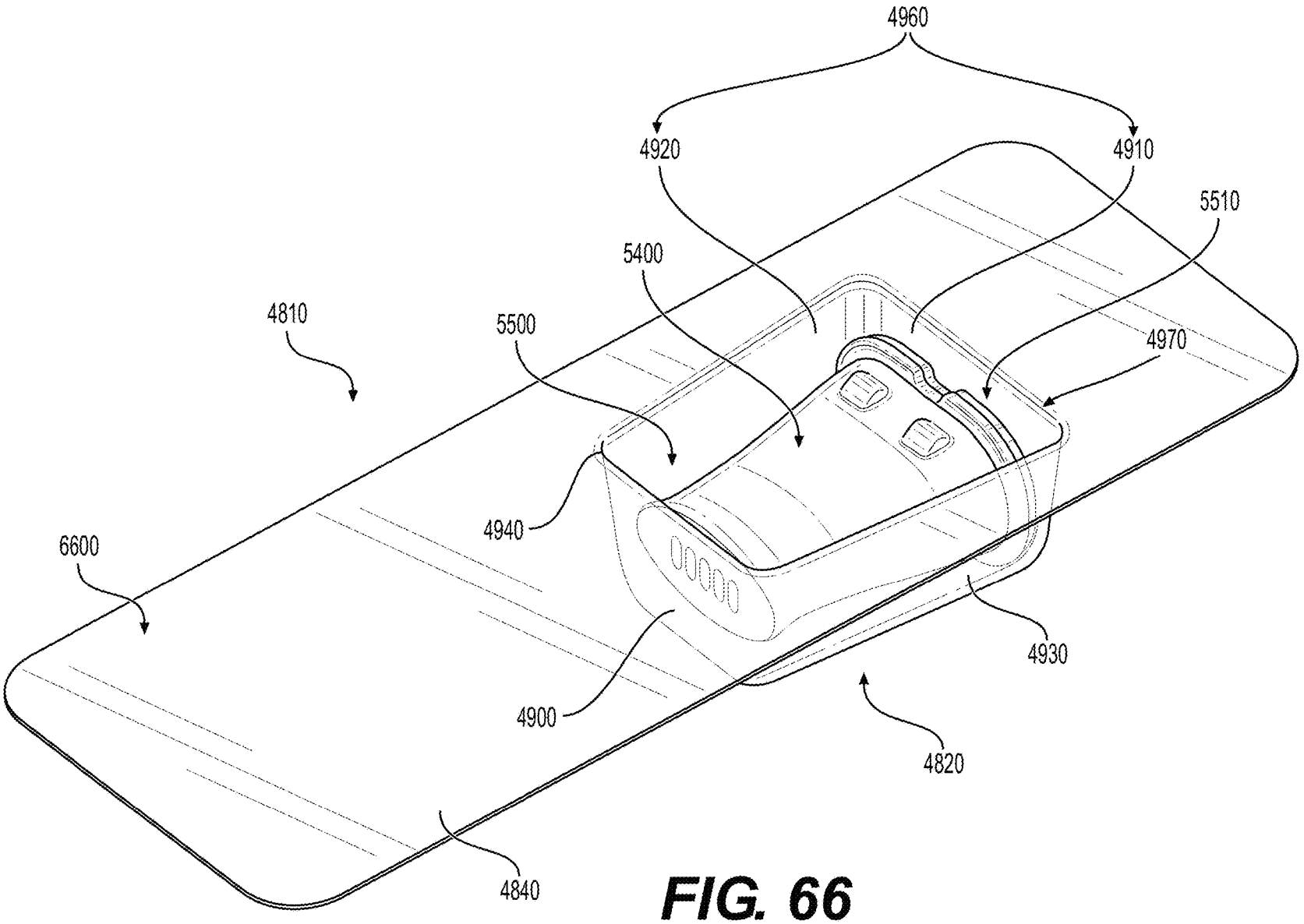
FIG. 66 is an illustration of an upper perspective view of the base containing the consumer product, in accordance with at least one example embodiment.
Figure 67A:
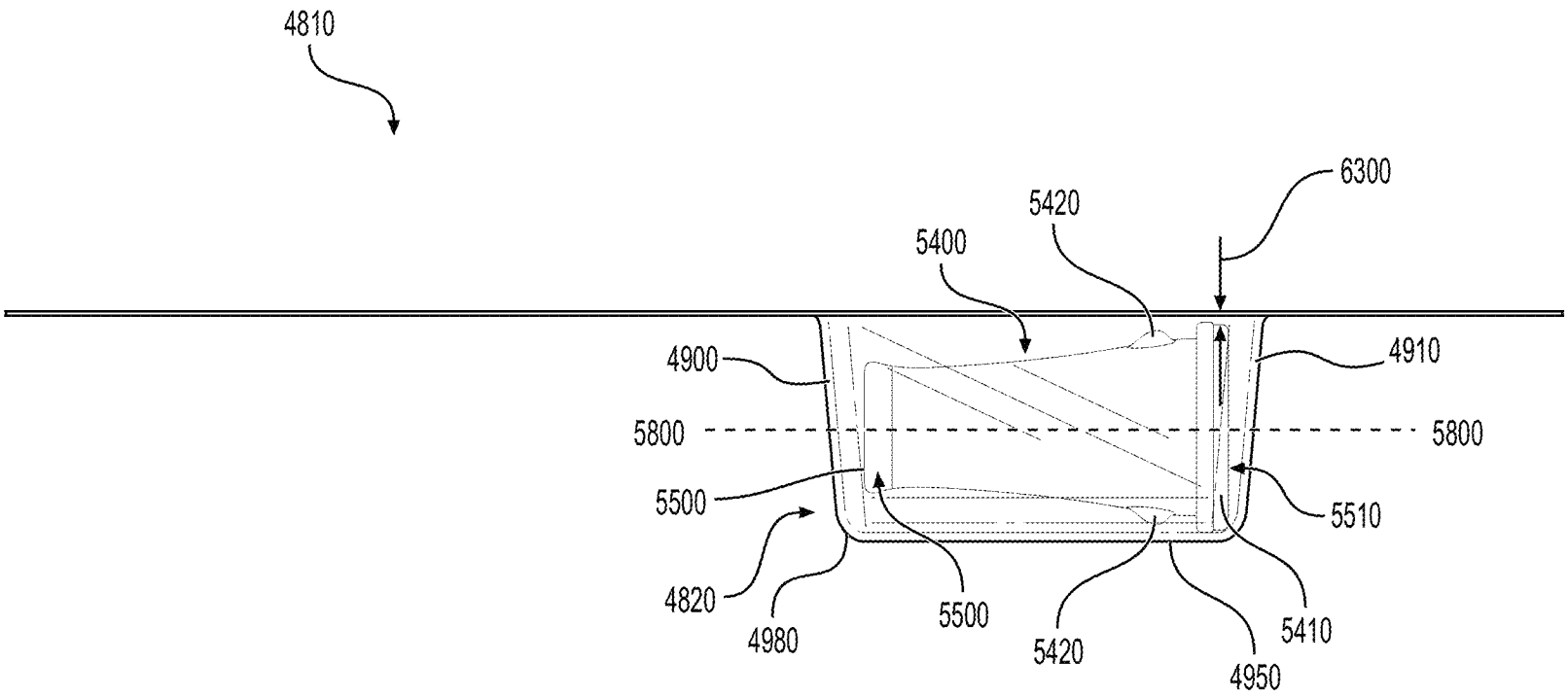
FIG. 67A is an illustration of a side view of the base containing the consumer product, in accordance with at least one example embodiment.
Figure 67B:
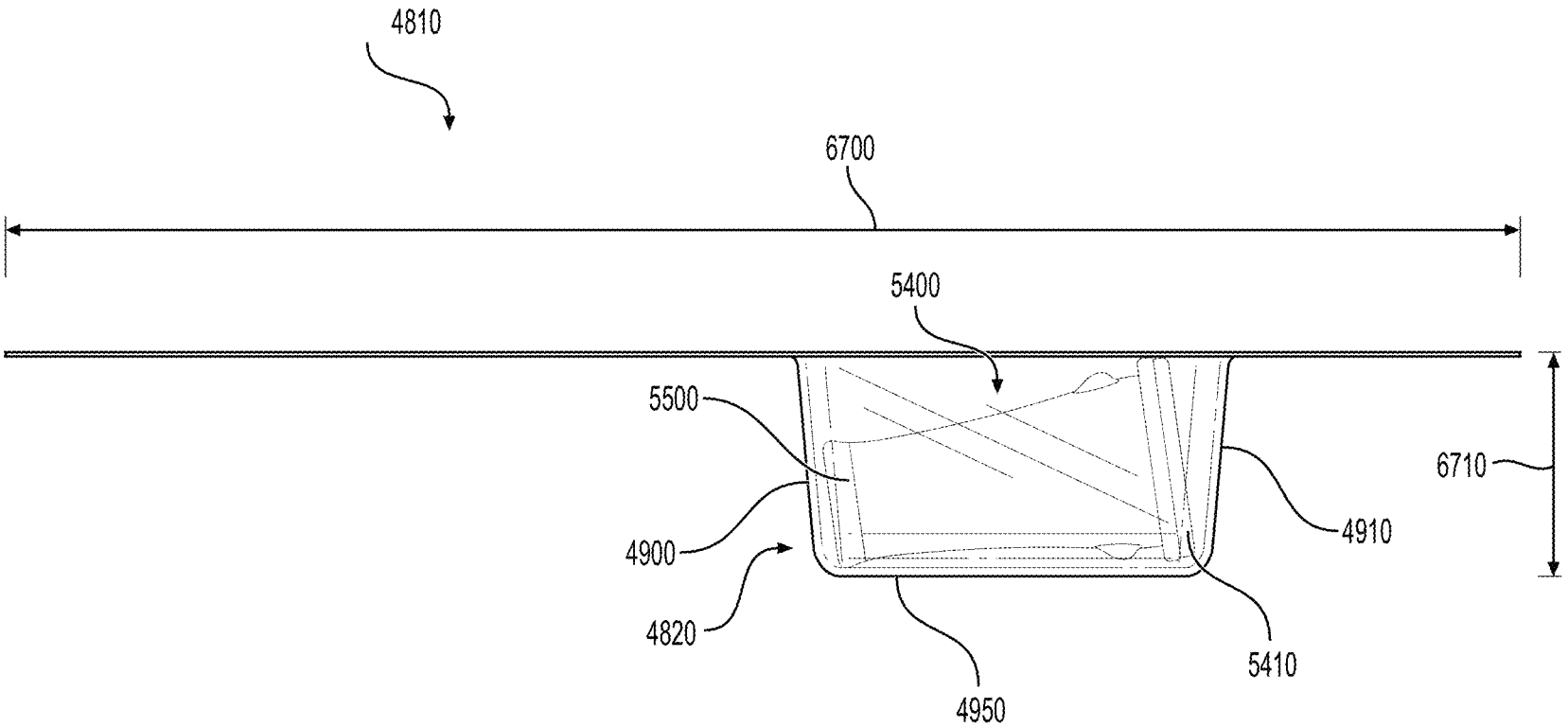
FIG. 67B is an illustration of another side view of the base containing the consumer product, in accordance with at least one example embodiment.
Figure 68:
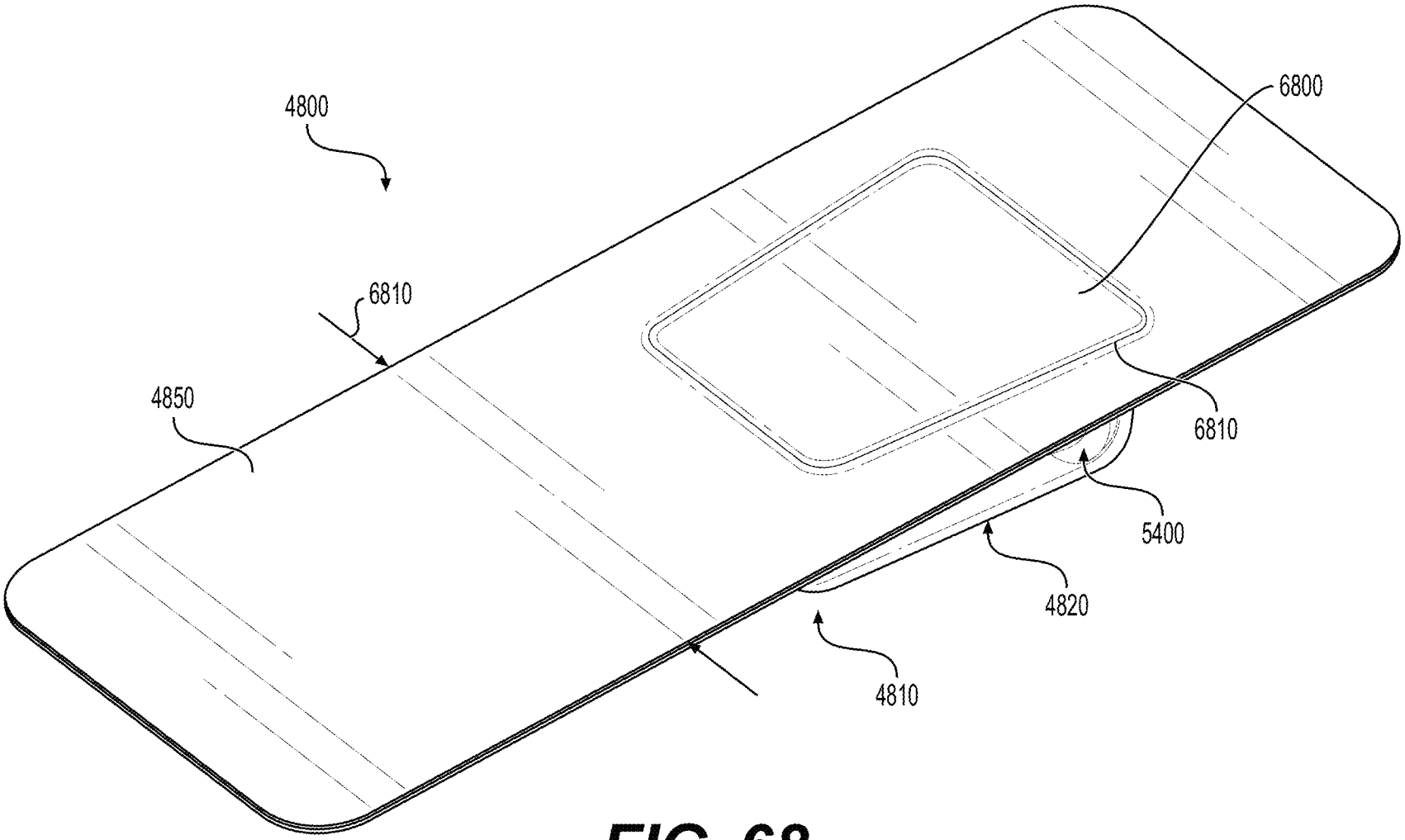
FIG. 68 is an illustration of an upper perspective view of the insert containing the consumer product, in accordance with at least one example embodiment.

FIGS. 66, 67A and 67B are illustrations of perspective and orthogonal views of the base 4810 containing the consumer product 5400, in at least one example embodiment.

In at least one example embodiment, the nose 5500 of the consumer product 5400 remains in a horizontal (level) position with the imaginary horizontal plane 5800 being substantially parallel to the floor 4950 of the depression 4820, such that the nose 5500 appears to be "floating" within the cavity 4830, due at least due to the frame 5410 being held in a "stabilized" position (as described above), with the feet 5420 contacting the floor 4950 and the first end wall 4900 and the second end wall 4910 contacting the nose 5500 and the frame 5410 (see at least FIG. 67A showing the nose "floating" as the consumer product 5400 is held in a stabilized horizontal position). In at least one example embodiment, the third gap 6500 can be negligible or non-existent in order to further support the nose 5500 and hold the consumer product 5400 in a stabilized horizontal position (as shown in FIG. 67A).

In at least one example embodiment, the base 4810 is made from a transparent or translucent material 6600. In this example embodiment, the consumer product 5400 can be seen through the walls 4960 of the depression 4820. In at least one example embodiment, the transparent material is polyethylene terephthalate (PET) or amorphous polyethylene terephthalate (APET).

In at least one example embodiment, and as shown in FIG. 67B, the frame 5410 of the consumer product 5400 can be held less firmly (e.g., the first gap 6300 in FIGS. 63 and 67A is at least large enough to allow the frame 5410 to shift towards or away from the first end wall 4900 and the second end wall 4910), such that a bottom of the nose 5500 contacts the floor 4950 of the depression 4820.

In at least one example embodiment, a length 6700 of the insert 4800 is in the range of about 90 mm to 110 mm, or about 95 mm to 100 mm, or about 97 mm. In at least one example embodiment, a depth 6710 of the depression 4820 is in the range of about or about 8 mm to 17 mm, or about 10 mm to 15 mm, or about 13 mm. In at least one example embodiment, a width 6850 of the insert 4800 is in the range of about 30 mm to 40 mm, or about 35 mm to 37.5 mm, or about 36 mm.

Figure 69:
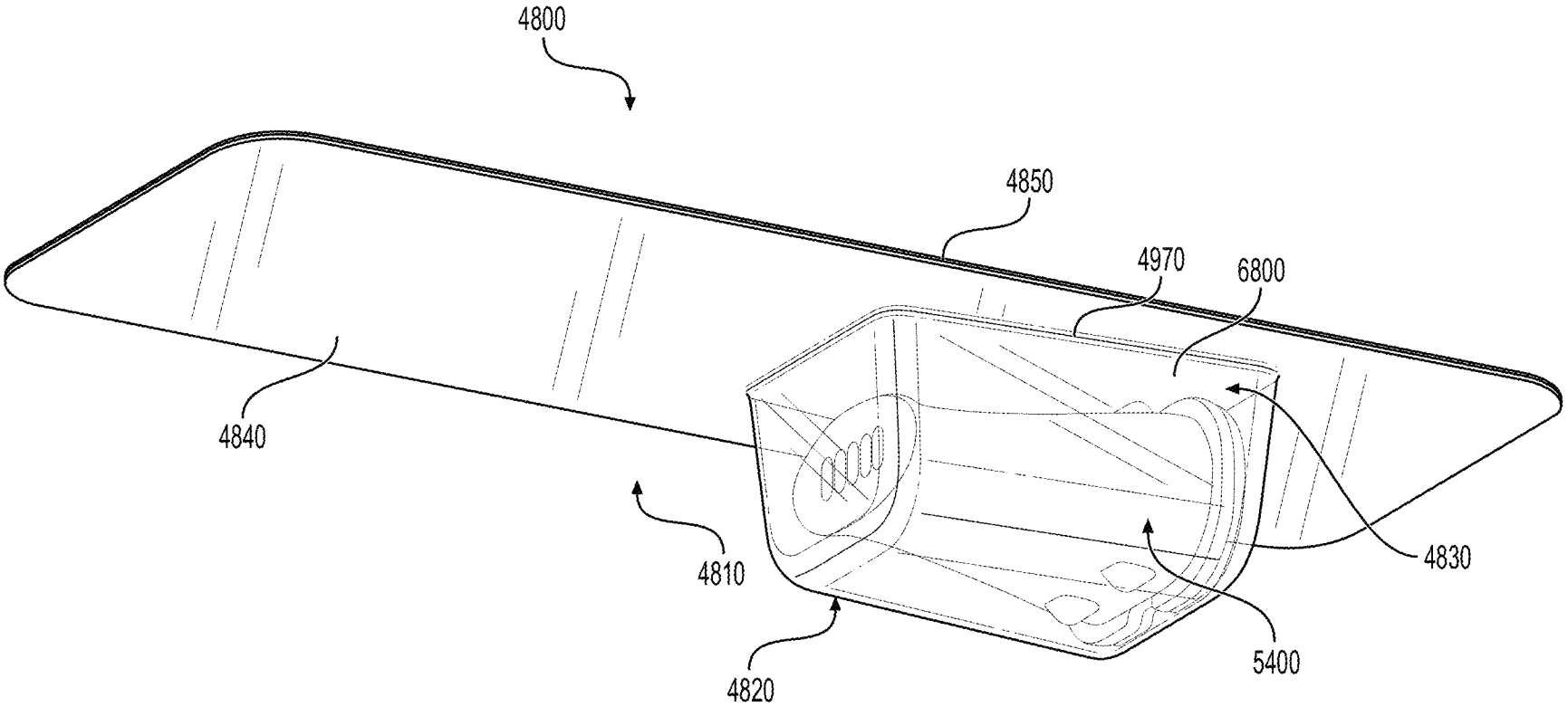
FIG. 69 is an illustration of a lower perspective view of the insert containing the consumer product, in accordance with at least one example embodiment.

FIGS. 68 and 69 are illustrations of perspective views of the insert 4800 containing the consumer product 5400, in accordance with at least one example embodiment.

In at least one example embodiment, the lid 4850 is bonded onto the upper surface 5010 (see FIG. 50) of the brim 4840 of the base 4810, so that the consumer product 5400 is sealed within the insert 4800 (see FIG. 69). In at least one example embodiment, the lid 4850 protects the consumer product 5400 from dust, oxygen, moisture and other environmental elements that may otherwise degrade the consumer product 5400, or degrade consumable material in the consumer product 5400.

In at least one example embodiment, the lid 4850 covers the upper surface 5010, as shown in FIGS. 68 and 69. In at least one example embodiment, the lid 4850 includes the weakened area 6800 that is at least partially above the cavity 4830. In at least one example embodiment, the weakened area 6800 is delineated by a border 6810. In at least one example embodiment, the border 6810 is a scored, embossed, perforated or otherwise weakened line that causes the lid 4850 to be more easily torn along the border 6810 to allow the consumer product 5400 to be freed from the cavity 4830. In at least one example embodiment, the weakened area 6800 is a thinned area of the lid 4850 that is easier to tear or puncture than a remainder of the lid 4850, whether or not the weakened area 6800 includes a border 6810 that is also a weakened line. In at least one example embodiment, the weakened area 6800 and/or the border 6810 of the weakened area 6800 allows the consumer product 5400 to be pressed through the lid 4850 to remove the consumer product 5400 from the cavity 4830. In at least one example embodiment, the lid 4850 is made from a foil, a paper foil (composite of paper connected to foil), paper, cardboard, a cardboard composite, industrial starch, wood pulp, biopolymers, other suitable packaging materials, or combinations thereof. In at least one example embodiment, the lid 4850 is made of a paper foil, and a thickness of the lid 4850, or at least a thickness of the weakened area 6800 of the lid 4850, is about 0.02 mm to 0.1 mm, or about 0.03 mm to 0.9 mm, or about 0.4 mm to 0.7 mm, or about 0.06 mm.

Figure 70:
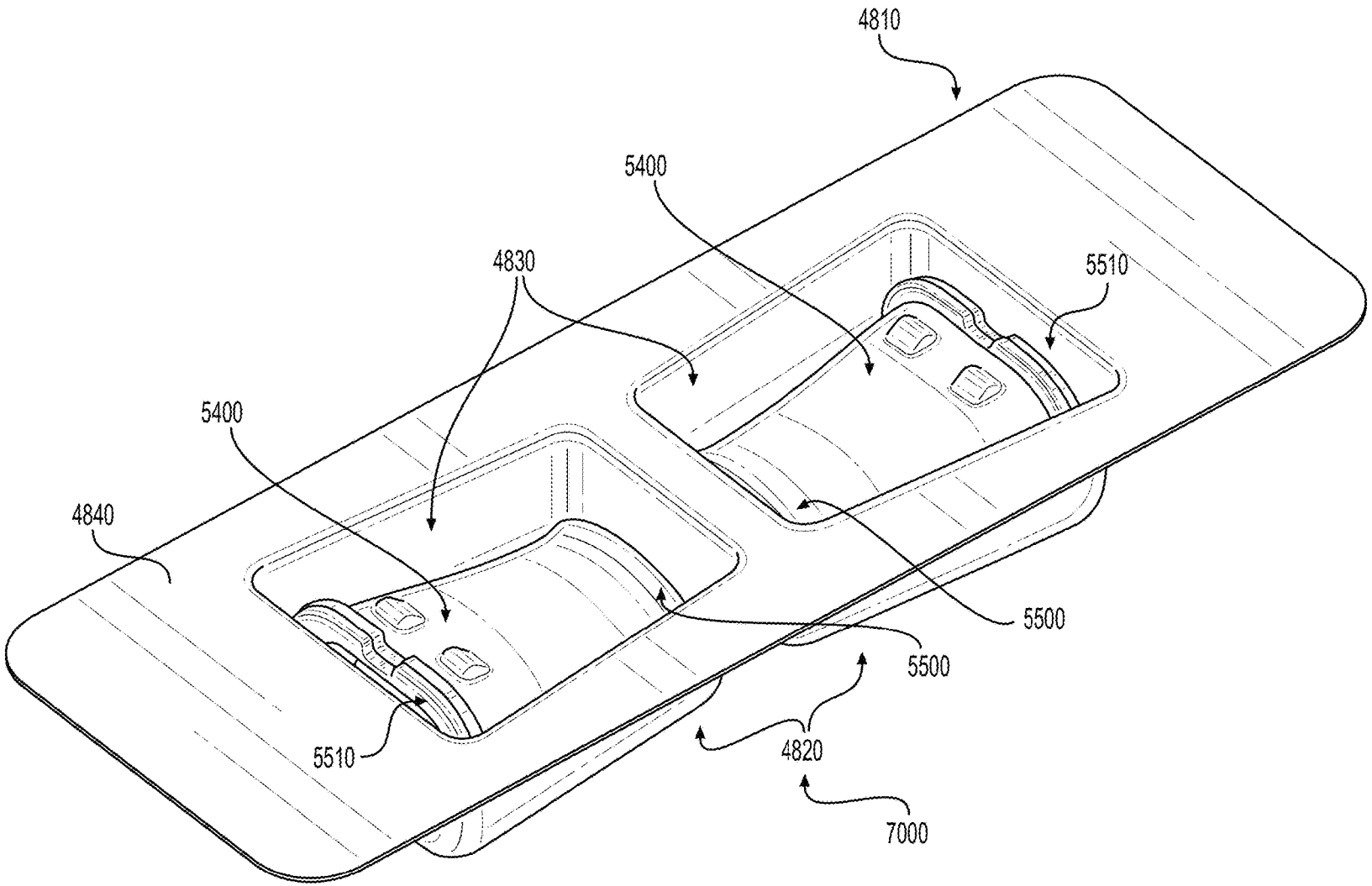
FIG. 70 is a perspective view of a base containing consumer products, in accordance with at least one example embodiment.
Figure 71:
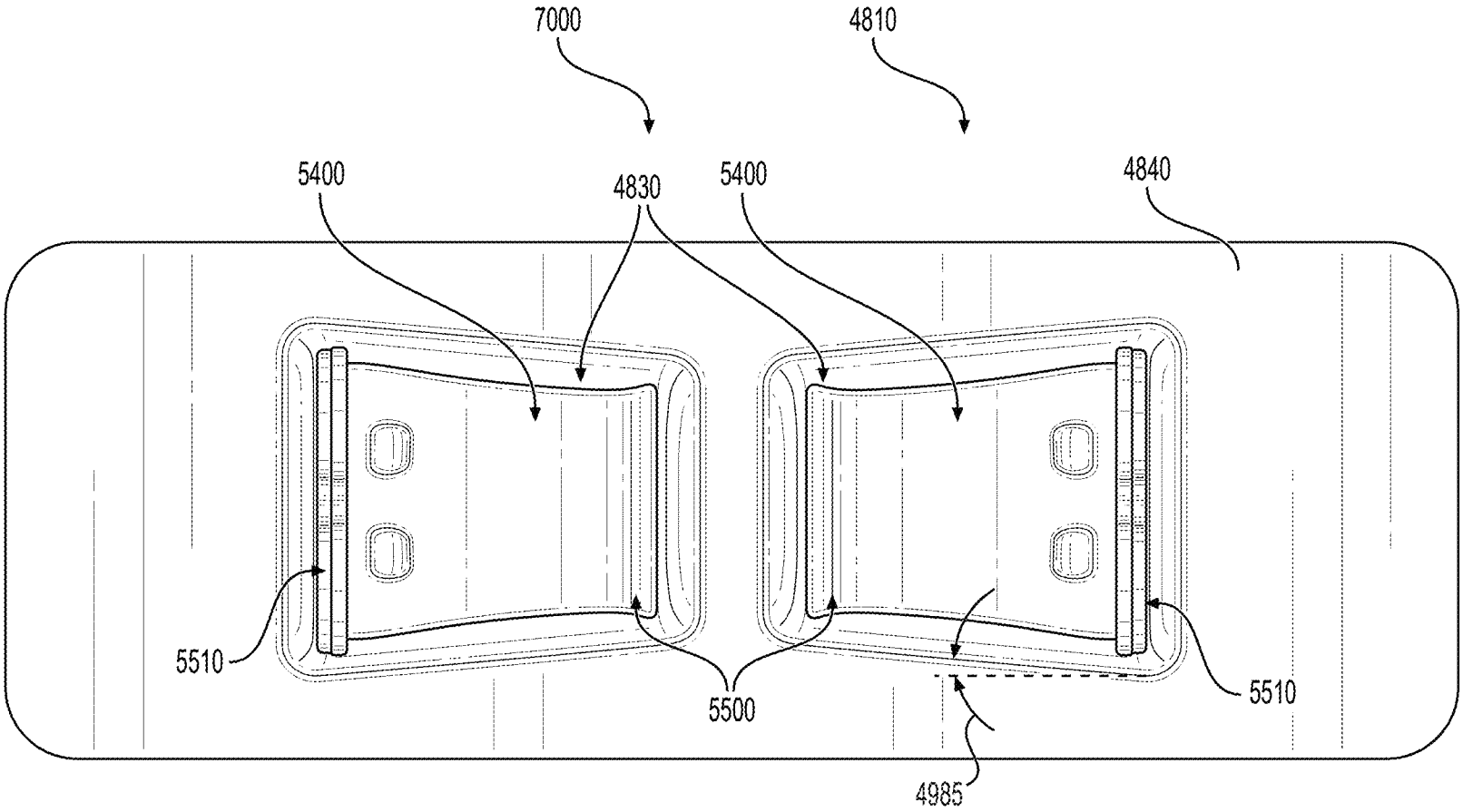
FIG. 71 is a top view of the base containing the consumer products, in accordance with at least one example embodiment.
Figure 72:
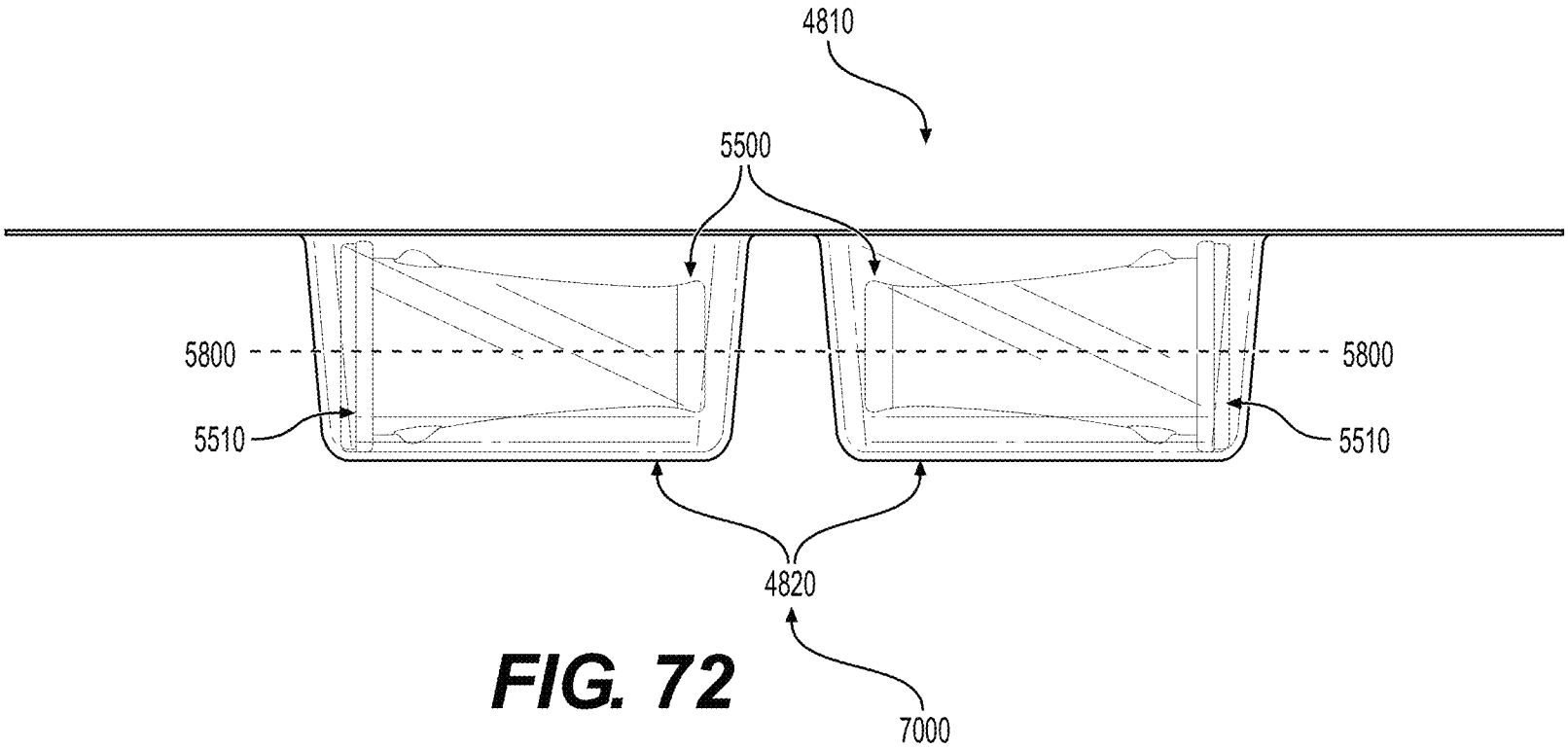
FIG. 72 is a side view of the base containing the consumer products, in accordance with at least one example embodiment.

FIGS. 70-72 are illustrations of perspective and orthogonal views of the base 4810 containing the consumer products 5400, in accordance with at least one example embodiment.

In at least one example embodiment, the base 4810 includes two depressions 4820. In at least one example embodiment, the depressions 4820 are in an "opposing configuration" 7000 (as shown in FIGS. 70-72), such that the nose 5500 of each one of the consumer products 5400 is facing each other. In at least one example embodiment, the opposing configuration 7000 instead has the rear 5510 of each of the consumer products 5400 facing each other (not shown).

Figure 73:
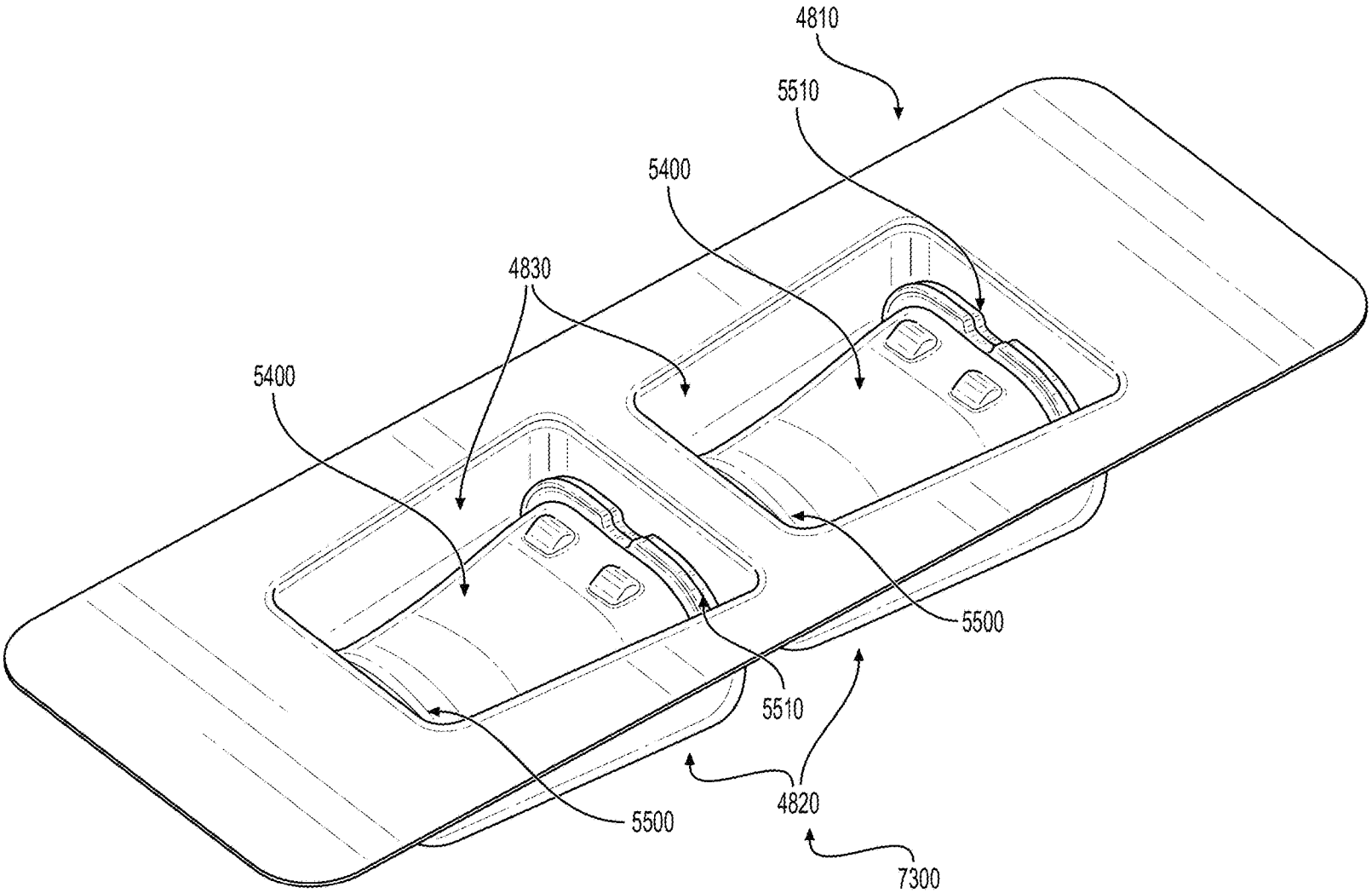
FIG. 73 is a perspective view of a base containing consumer products, in accordance with at least one example embodiment.
Figure 74:
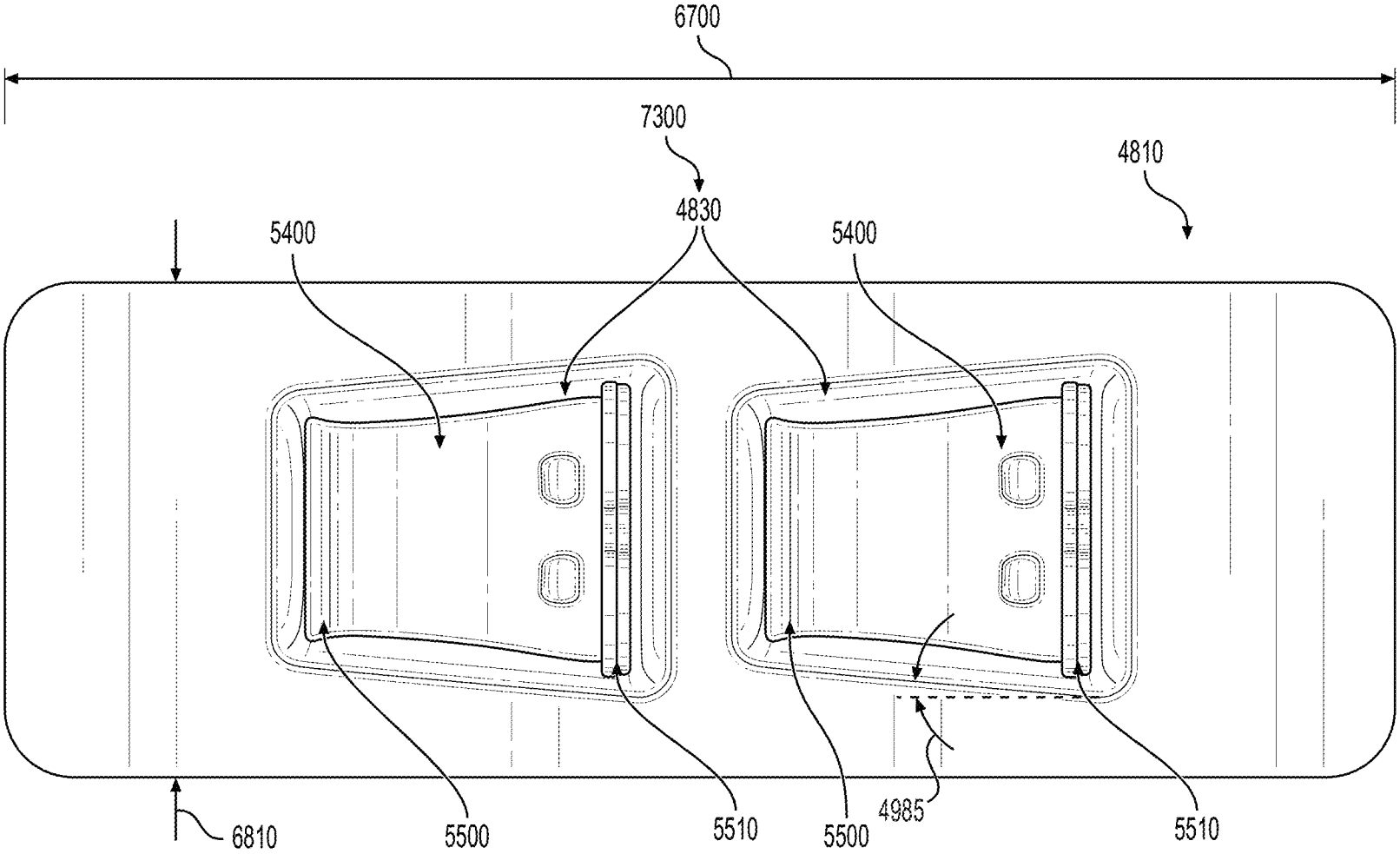
FIG. 74 is a top view of the base containing the consumer products, in accordance with at least one example embodiment.
Figure 75:
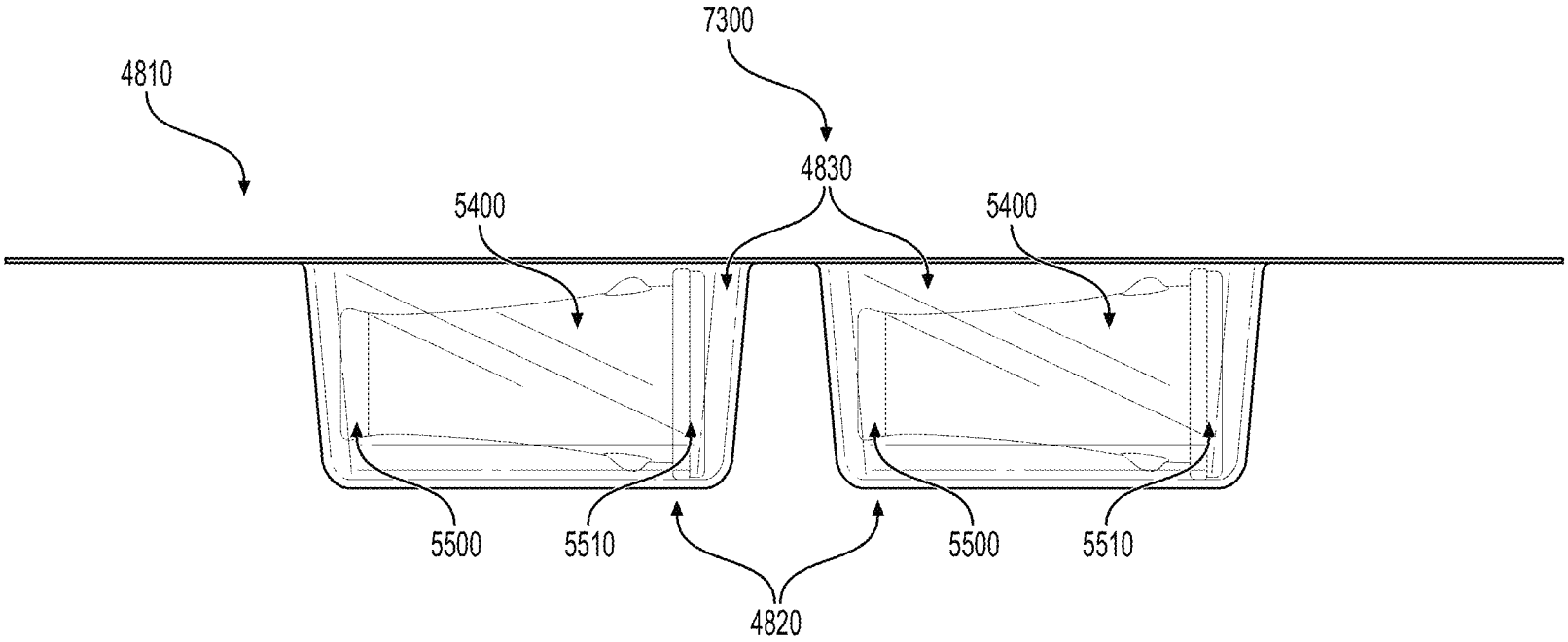
FIG. 75 is a side view of the base containing the consumer products, in accordance with at least one example embodiment.

FIGS. 73-75 are illustrations of perspective and orthogonal views of the base 4810 containing the consumer products 5400, in accordance with at least one example embodiment.

In at least one example embodiment, the base 4810 includes two depressions 4820. In at least one example embodiment, the depressions 4820 are in a "non-opposing configuration" 7300 (as shown in FIGS. 73-75), such that the nose 5500 of one of the consumer products 5400 faces the rear 5510 of the other consumer product 5400.

Figure 76:
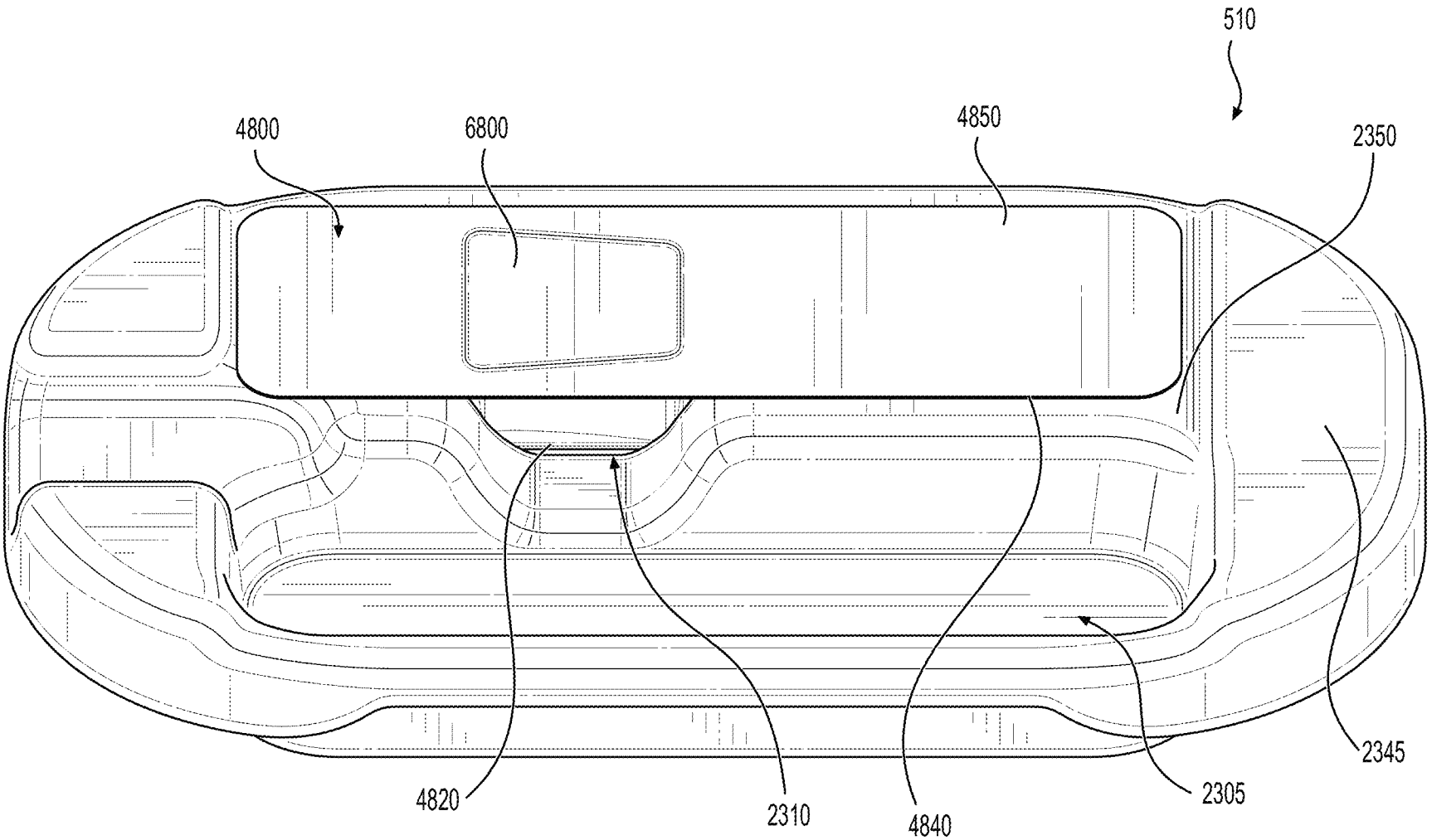
FIG. 76 is a perspective view of the insert being held in the second tray, in accordance with at least one example embodiment.

FIG. 76 is an illustration of a perspective view of the insert 4800 being held in the second tray 510, in accordance with at least one example embodiment.

In at least one example embodiment, and as shown in FIG. 76, the insert 4800 is capable of being partially contained within the second depression 2310 of the second tray 510. In at least one example embodiment, and as shown in FIG. 76, the depression 4820 of the insert 4800 is able to be contained within the second depression 2310, while the lid 4850 and the brim 4840 of the insert 4800 are at least partially supported by the first inset surfaces 2350 of the second tray 510.

Band for Package

Figure 77A:
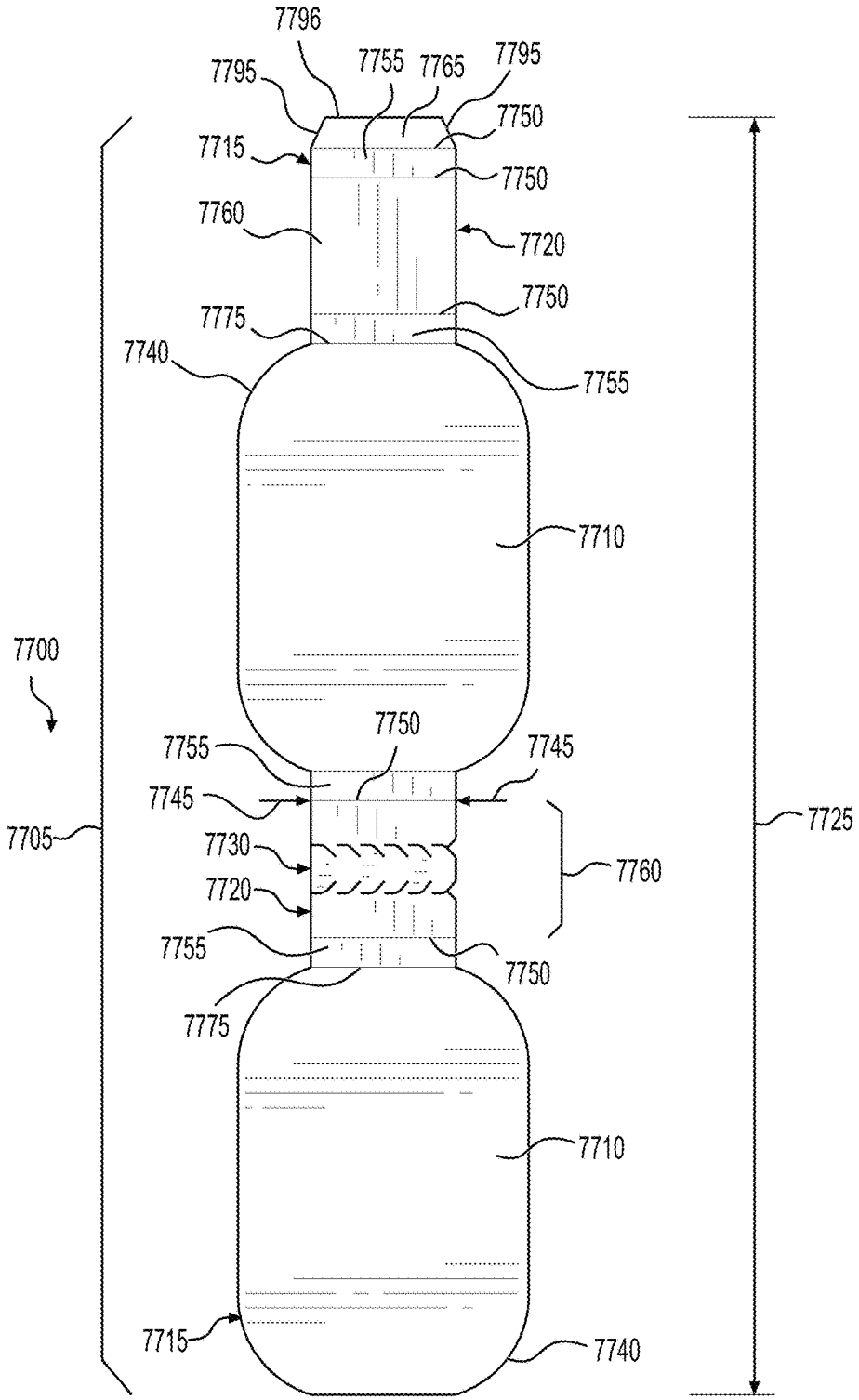
FIG. 77A is an illustration of a blank for a band, in accordance with at least one example embodiment.
Figure 77B:
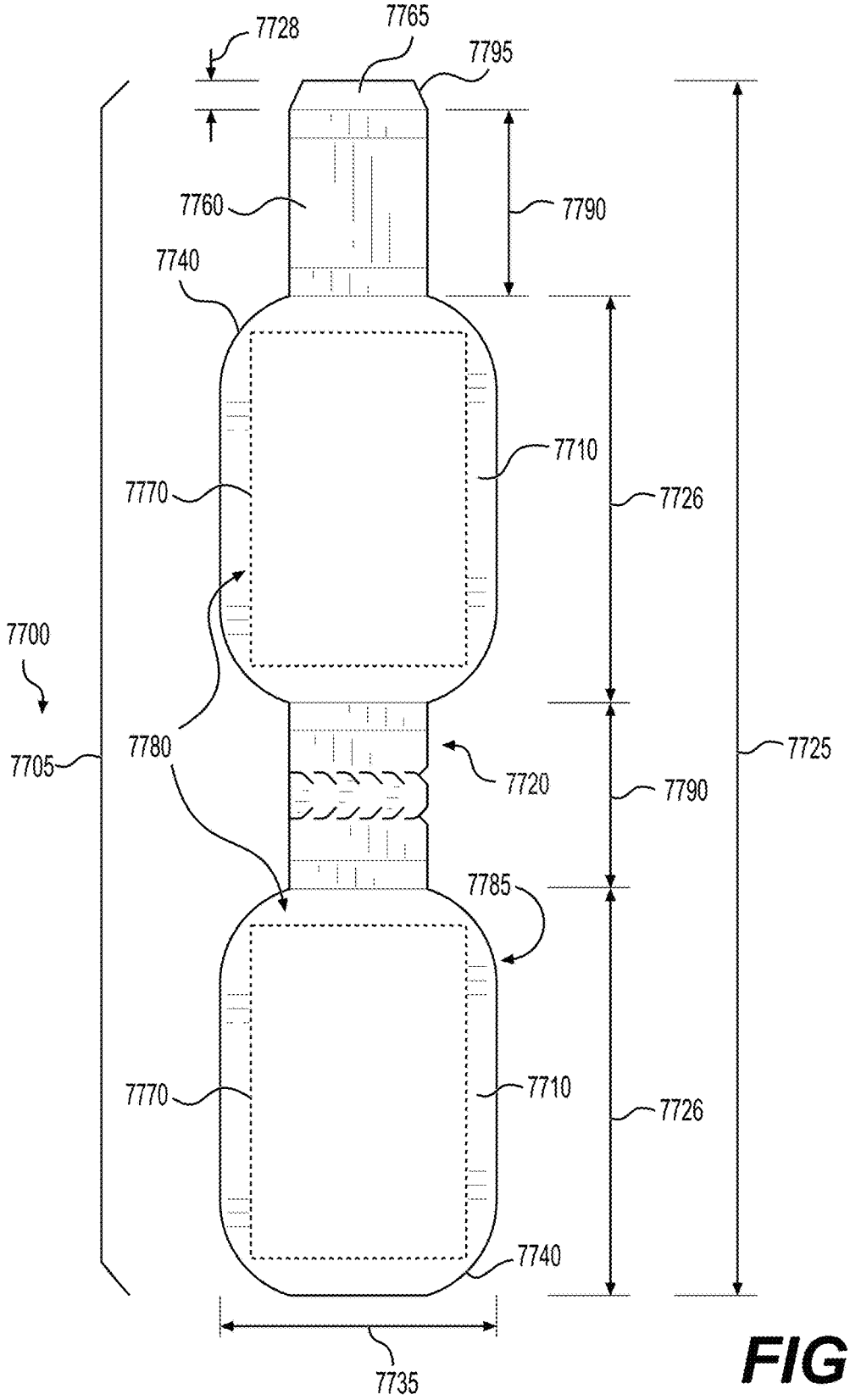
FIG. 77B is an illustration of a blank for a band, in accordance with at least one example embodiment.

FIGS. 77A and 77B are illustrations of a blank 7705 for a band 7700, in accordance with at least one example embodiment.

In at least one example embodiment, the band 520 (as shown in at least FIGS. 5 and 45) is the band 7700 (FIG. 77A), a band 7800 (FIG. 78A) and/or a band 7900 (FIG.

79A). That is to say, in at least one example embodiment, the band 7700 (FIG. 77A), the band 7800 (FIG. 78A) and/or the band 7900 (FIG. 79A) are used to at least partially encircle the outer container 100 to form the package 4600 (see at least FIGS. 47, 83, 90 and 97), as described herein in more detail.

In at least one example embodiment, the blank 7705 is a single strip (web) of material. In at least one example embodiment, the blank 7705 includes wide panels 7710 that are connected to each other. In at least one example embodiment, the wide panels 7710 are connected together by narrow panels 7720. In at least one example embodiment, each of the wide panels 7710 is separated from each other by at least one of the narrow panels 7720. In at least one example embodiment, the wide panels 7710 have a first width 7735 that are wider than a second width 7745 of the narrow panels 7720.

In at least one example embodiment, the blank 7705 includes two of the wide panels 7710. In at least one example embodiment, one of the narrow panels 7720 of the blank 7705 is between the wide panels 7710 and connects the wide panels 7710 together. In at least one example embodiment, terminal panels 7715 are on opposing distal ends of the blank 7705. In at least one example embodiment, the terminal panels 7715 include one of the narrow panels 7720 and one of the wide panels 7710 (as shown in FIG. 77A). In at least one example embodiment, the terminal panels 7715 include two wide panels 7710 or two narrow panels 7720. Other configurations of the wide panels 7710 and the narrow panels 7720 are contemplated.

In at least one example embodiment, first fold lines 7775 separate the wide panels 7710 from the narrow panels 7720. In at least one example embodiment, second fold lines 7750 run along a width of some or all of the narrow panels 7720, where the second fold lines 7750 are perpendicular to a longitudinal length 7725 of the blank 7705. In at least one example embodiment, the first fold lines 7775 and the second fold lines 7750 can be creases, embossed lines, scored lines, etc. In at least one example embodiment, the first fold lines 7775 and the second fold lines 7750 define (subdivide) the narrow panels 7720 into a center panel 7760 and side panels 7755. In at least one example embodiment, the first fold lines 7775 and the second fold lines 7750 allow the band 7700 to more easily be wrapped around the outer container 100 to form the package 4600 that is sealed by the band 7700 (see at least FIG. 83). In at least one example embodiment, the side panels 7755 form chamfered sections of the narrow panels 7720 that conform a shape of the band 7700 to the outer container 100 (as described in more detail in relation to FIGS. 81, 83 and 87).

In at least one example embodiment, the blank 7705 defines a tear strip 7730. In at least one example embodiment, the tear strip 7730 runs perpendicular to the longitudinal length 7725 of the blank 7705. In at least one example embodiment, the blank 7705 defines more than one tear strip 7730. In at least one example embodiment, the tear strip 7730 is defined by at least one of the narrow panels 7720. In at least one example embodiment, the tear strip 7730 is defined by the center panel 7760 of at least one of the narrow panels 7720. In at least one example embodiment, the tear strip 7730 is defined by at least one of the wide panels 7710.

In at least one example embodiment, the blank 7705 includes indicia 7770 (see FIG. 77B) on at least one major surface of the blank 7705. In at least one example embodiment, the indicia 7770 are on surfaces of the blank 7705 that allows the indicia 7770 to be viewed at least on opposing surfaces of a container once the band 7700 is connected to the container. In at least one example embodiment, the band 7700 is connected to the outer container 100, where the indicia 7770 can be viewed over the flat major surfaces 140 of the outer container 100, where the flat major surfaces 140 oppose each other on the outer container 100 (see at least FIGS. 1 and 83-84). In at least one example embodiment, the indicia 7770 is "billboard information." In at least one example embodiment, the billboard information includes advertising, consumer product information and/or warnings, sales or consumer brochure information, ingredients, required state and federal government information, etc.

Figure 83:
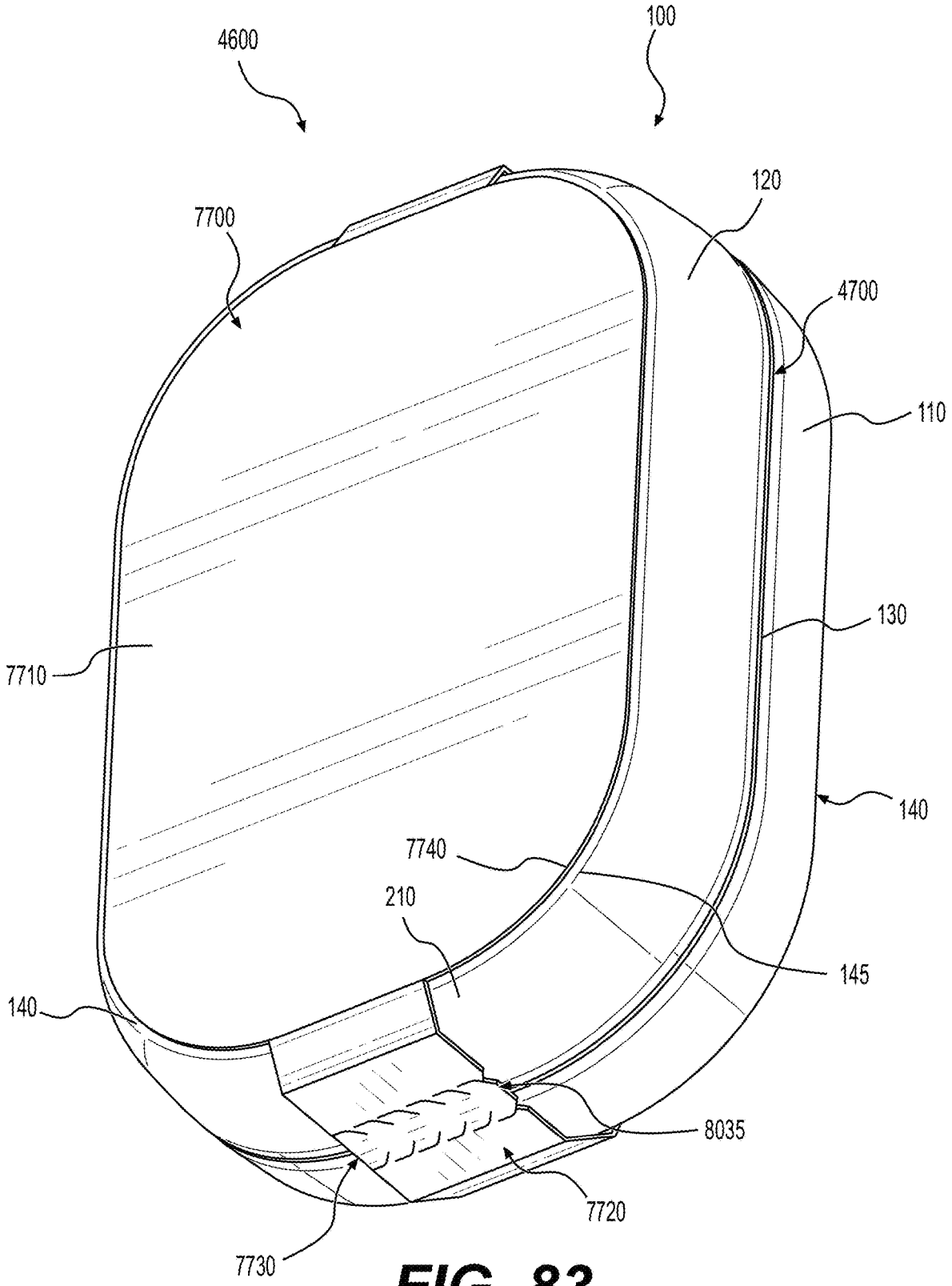
FIG. 83 is an illustration of a perspective view of a band on a package, in accordance with at least one example embodiment.
Figure 84:
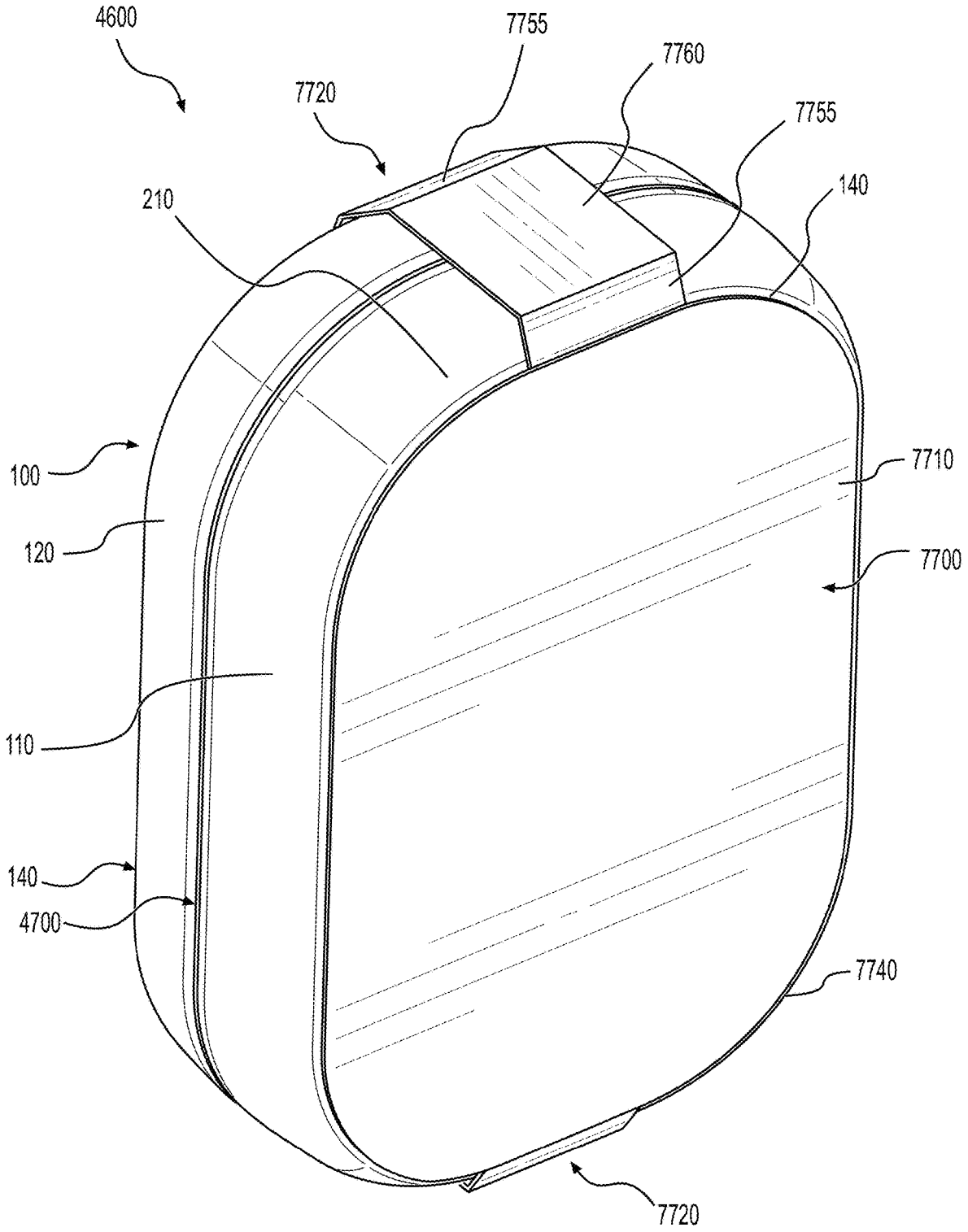
FIG. 84 is an illustration of a perspective view of a band on a package, in accordance with at least one example embodiment.

In at least one example embodiment, the indicia 7770 are on a first side (upper surface) 7780 of the blank 7705, where a second side (lower surface) 7785 of the blank 7705 is anticipated to be connected to the outer container 100 and would therefore be obscured (see FIGS. 77B and 83-84). In at least one example embodiment, the indicia 7770 are on both the first side 7780 and the second side 7785, thereby making the blank 7705 versatile and interchangeable when connected to the outer container 100. In at least one example embodiment, the indicia 7770 on both the first side 7780 and the second side 7785 is a same type of indicia, or the indicia 7770 is identical, for each of the sides 7780/7785 of the blank 7705. In at least one example embodiment, the indicia 7770 on the first side 7780 and the second side 7785 is a different type of indicia that includes different information. In at least one example embodiment, the indicia 7770 is on major surfaces of the wide panels 7710 of the band 7700. In at least one example embodiment, the indicia 7770 is on one or both of the wide panels 7710, and/or the indicia 7770 is on the narrow panels 7720. In at least one example embodiment, the indicia 7770 is on the narrow panels 7720 in order to provide instructions and/or call attention to an existence and/or a use of the tear strip 7730. In at least one example embodiment, the indicia 7770 is on each of the wide panels 7710, where the indicia 7770 may be the same (redundant) on each of the wide panels 7710, or the indicia 7770 may be different on each of the wide panels 7710 to provide flexibility or match the needs of a consumer product display (not shown) that displays and dispenses the package 4600 (see at least FIG. 83).

In at least one example embodiment, the blank 7705 is flexible and able to form the band 7700 into a shape that matches outer surfaces of the outer container 100 (see at least FIG. 83). To this end, and in at least one example embodiment, a shape of the wide panels 7710 and/or a shape of the narrow panels 7720 are conformed to a shape of the outer container 100, and/or conformed to a shape of portions of the outer container 100 that the wide panels 7710 and the narrow panels 7720 are to be connected to, once the band 7700 is connected to the outer container 100. In at least one example embodiment, the wide panels 7710 are conformed to a shape of the flat major surface 140 of the first section 110 and/or the second section 120 of the outer container 100 (see at least FIGS. 1 and 83). In at least one example embodiment, the wide panels 7710 have a rectangular shape with rounded corners 7740 (see FIGS. 77A and 77B). In another example embodiment, the wide panels 7710 have a square shape. Other sizes of the wide panels 7710 are contemplated.

In at least one example embodiment, a longitudinal length 7726 and a width 7735 of the wide panels 7710 is sized to conform the wide panels 7710 to a length and a width of the flat major surface 140 of the first section 110 and/or the second section 120 of the outer container 100 (see FIGS. 77B and 83). In at least one example embodiment, the rounded corners 7740 are conformed to a shape of the rounded corners 145 of the outer container 100, such that a shape of the wide panels 7710 better matches a shape of the flat major surfaces 140. In at least one example embodiment, the narrow panels 7720 have a longitudinal length 7790 (see FIG. 77B) that allows the wide panels 7710 to be properly positioned on the flat major surfaces 140 of the outer container 100, once the band 7700 is connected to the outer container 100 (see at least FIG. 83).

In at least one example embodiment, at least one of the terminal panels 7715 includes a tab 7765 on a distal end of the terminal panel 7715. In at least one example embodiment, one of the second fold lines 7750 divide the tab 7765 from the terminal panel 7715. In at least one example embodiment, the tab 7765 is on the distal end of the terminal panel 7715 that is the narrow panel 7720. In another example embodiment, the tab 7765 is on the distal end of the terminal panel 7715 that is the wide panel 7710 (not shown). In at least one example embodiment, the tab 7765 includes sides edges 7795 that are angled and taper toward each other as the side edges 7795 reach a distal-most end 7796 of the tab 7765.

In at least one example embodiment, the longitudinal length 7725 of the blank 7705 is in the range of about or about 390 mm to 410 mm, or about 395 mm to 405 mm, or about 397 mm. In at least one example embodiment, the length 7726 of the wide panels 7710 are about or about 120 mm to 140 mm, or about 125 mm to 135 mm, or about 128 mm. In at least one example embodiment, a length 7790 of the narrow panels 7720 is in the range of about 55 mm to 70 mm, or about 60 mm to 65 mm, or about 63 mm. In at least one example embodiment, a width 7735 of the wide panels 7710 is in the range of about 75 mm to 90 mm, or about 80 mm to 85 mm, or about 82 mm. In at least one example embodiment, a width 7745 of the narrow panels 7720 is in the range of about 30 mm to 45 mm, or about 35 mm to 40 mm, or about 38 mm. In at least one example embodiment, the width 7735 of the wide panels 7710 is about twice the width 7745 of the narrow panels 7720. In at least one example embodiment, each of the wide panels 7710 has the same width 7735 that is a common width, and each of the narrow panels 7720 has the same width 7745 that is a common width. In at least one example embodiment, a length 7728 of the tab 7765 is in the range of about 10 mm to 15 mm, or about 13 mm.

Figure 78A:
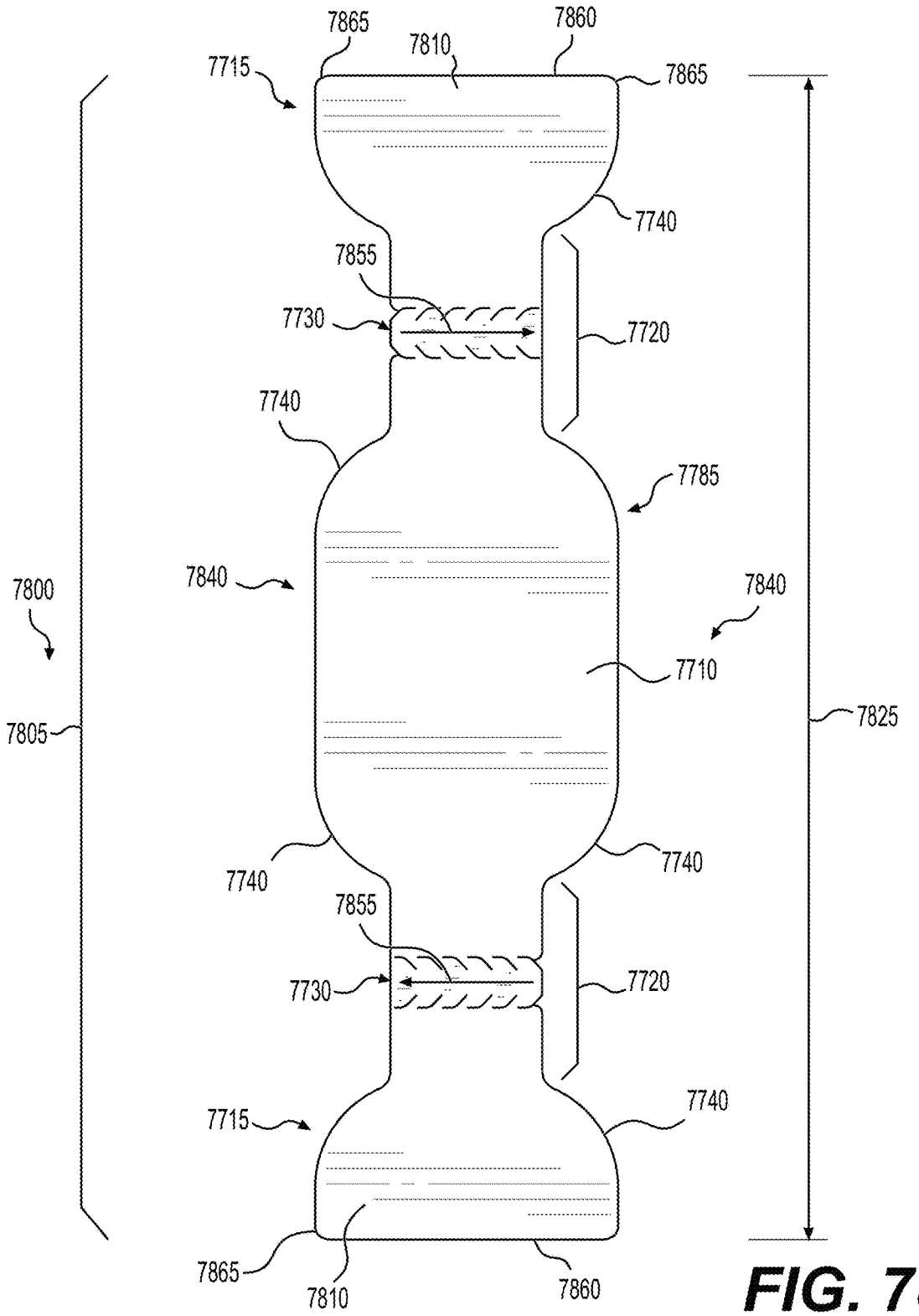
FIG. 78A is an illustration of a blank for a band, in accordance with at least one example embodiment.
Figure 78B:
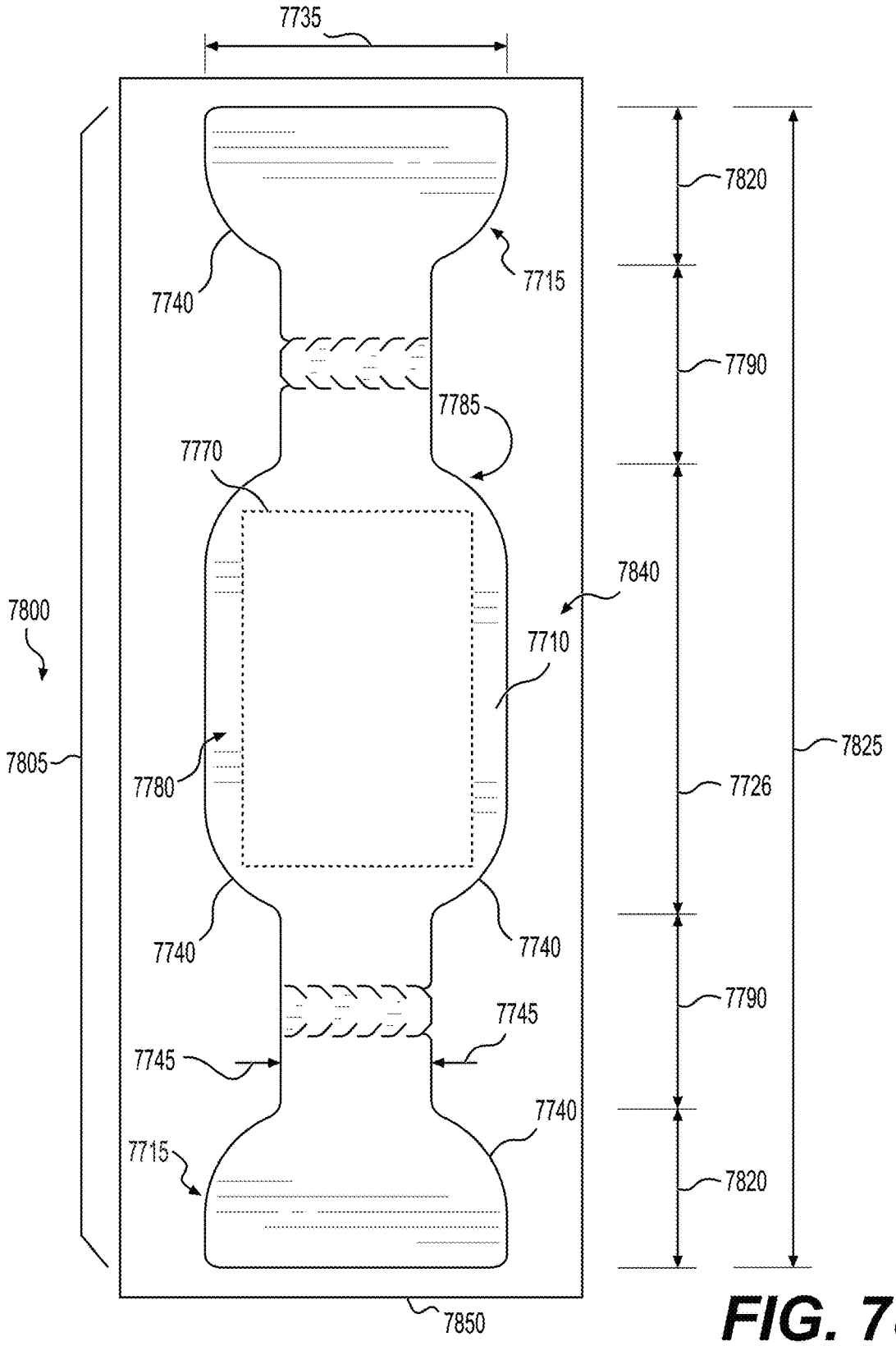
FIG. 78B is an illustration of a blank for a band, in accordance with at least one example embodiment.

FIGS. 78A and 78B are illustrations of a blank 7805 for the band 7800, in accordance with at least one example embodiment.

The blank 7805 of FIGS. 78A/B is the same as the blank 7705 of FIGS. 77A/B, with exceptions described herein. In at least one example embodiment, the blank 7805 includes terminal panels 7715 that are wide panels 7810. In at least one example embodiment, the blank 7805 includes a center panel 7840 that is the wide panel 7710. In at least one example embodiment, the center panel 7840 is between the terminal panels 7715. In at least one example embodiment, the wide panels 7810 that are the terminal panels 7715 are "truncated" panels. In at least one example embodiment, the wide panels 7810 have a longitudinal length 7820 that is shorter than a longitudinal length 7726 of the wide panel 7710 (see FIG. 78B). In at least one example embodiment, the blank 7805 includes end edges 7860 that are straight. In at least one example embodiment, the end edges 7860 include corners 7865 that are rounded. In at least one example embodiment, the rounded corners 7740 of the wide panels 7710 have a larger radius of curvature relative to the corners 7865 on ends of the end edges 7860.

In at least one example embodiment, the blank 7805 includes the tear strip 7730 on each one of the narrow panels 7720. In at least one example embodiment, a tear direction 7855 of the tear strip 7730 on each of the narrow panels 7720 is in a parallel and opposite direction relative to each other (as shown in FIG. 78A). In at least another example embodiment, the tear direction 7855 of the tear strip 7730 on each of the narrow panels 7720 is a same direction relative to each other.

Figure 91:
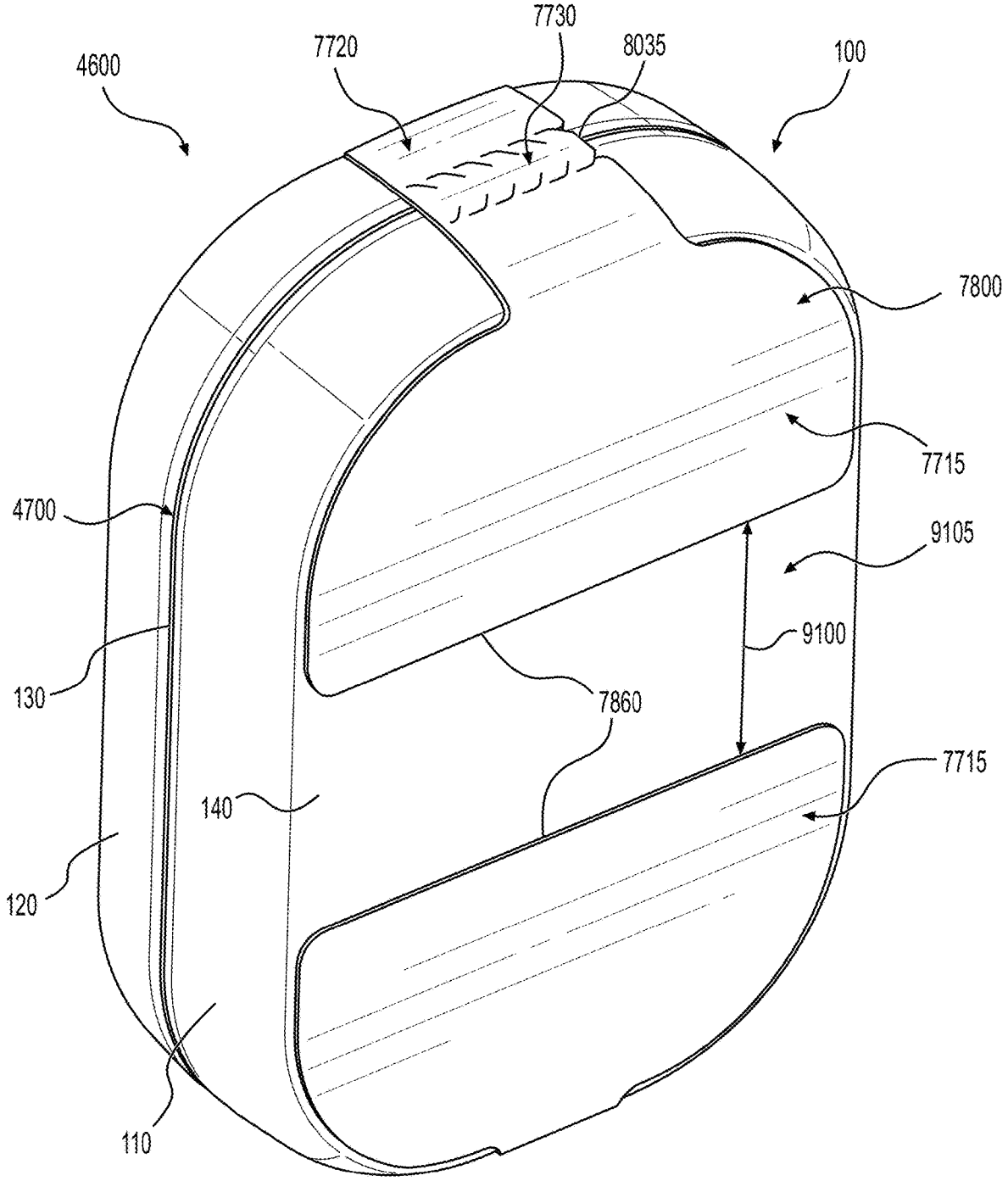
FIG. 91 is an illustration of a perspective view of a band on a package, in accordance with at least one example embodiment.
Figure 92:
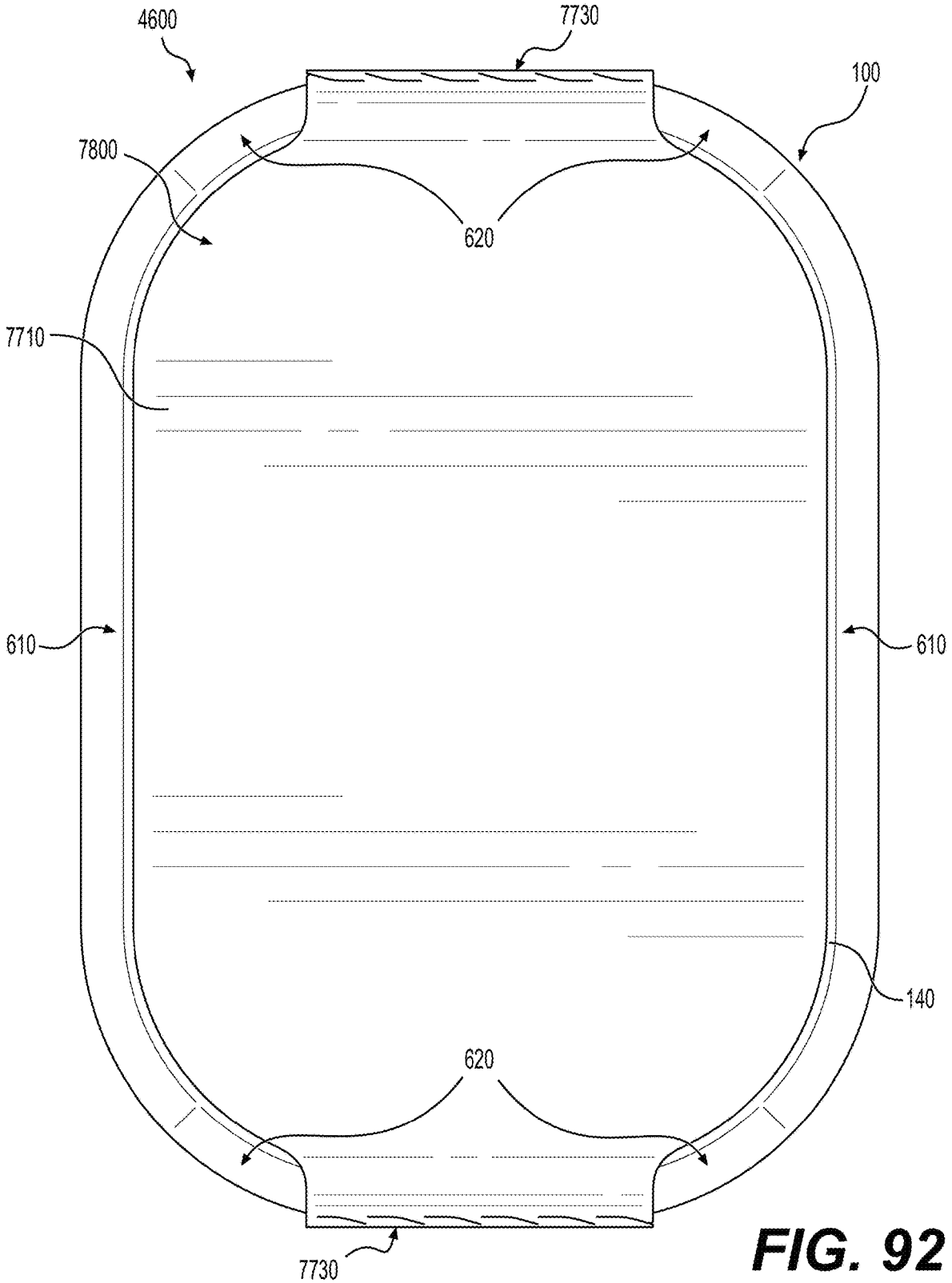
FIG. 92 is an illustration of a perspective view of a band on a package, in accordance with at least one example embodiment.
Figure 93:
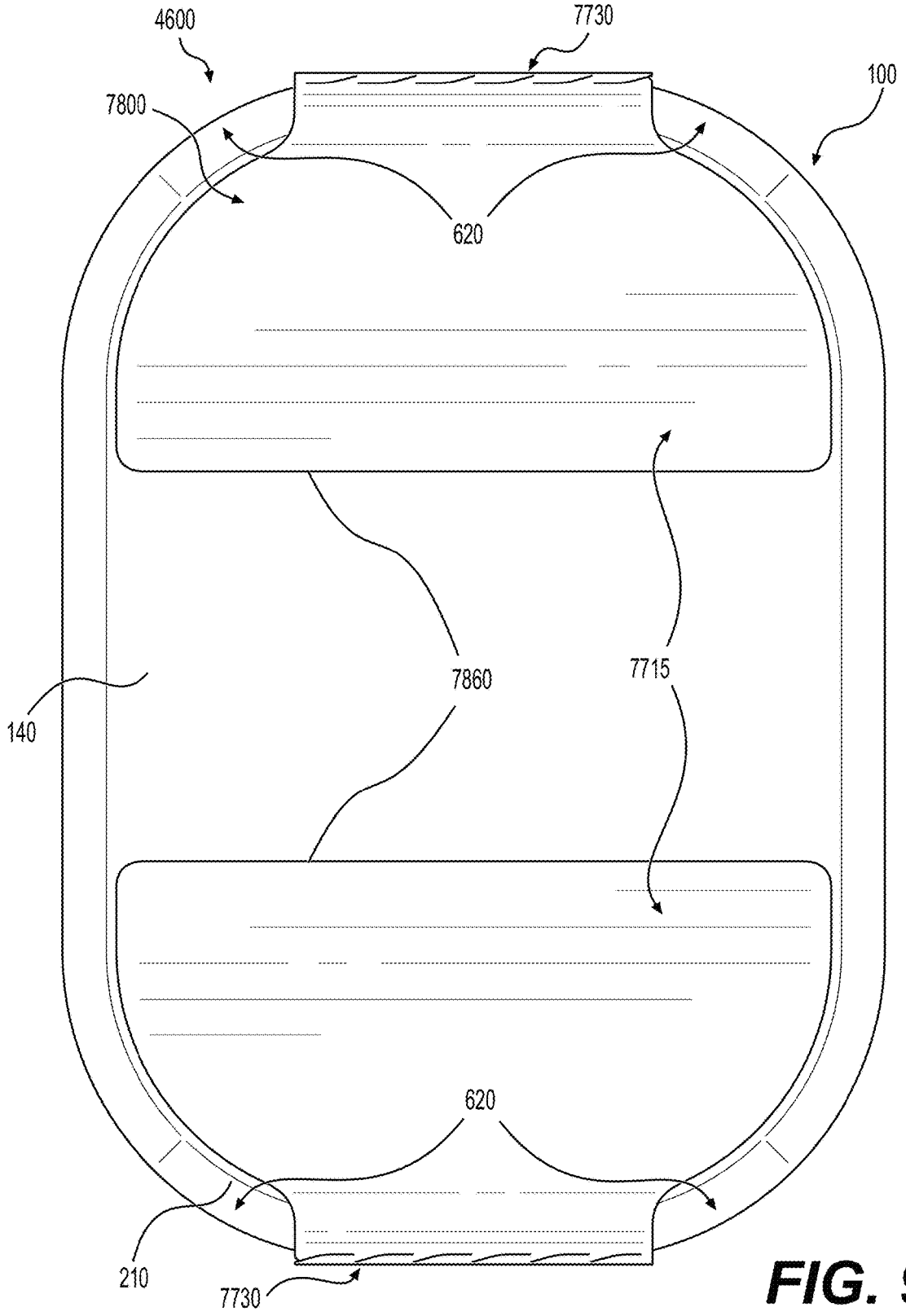
FIG. 93 is an illustration of a perspective view of a band on a package, in accordance with at least one example embodiment.
Figure 94:
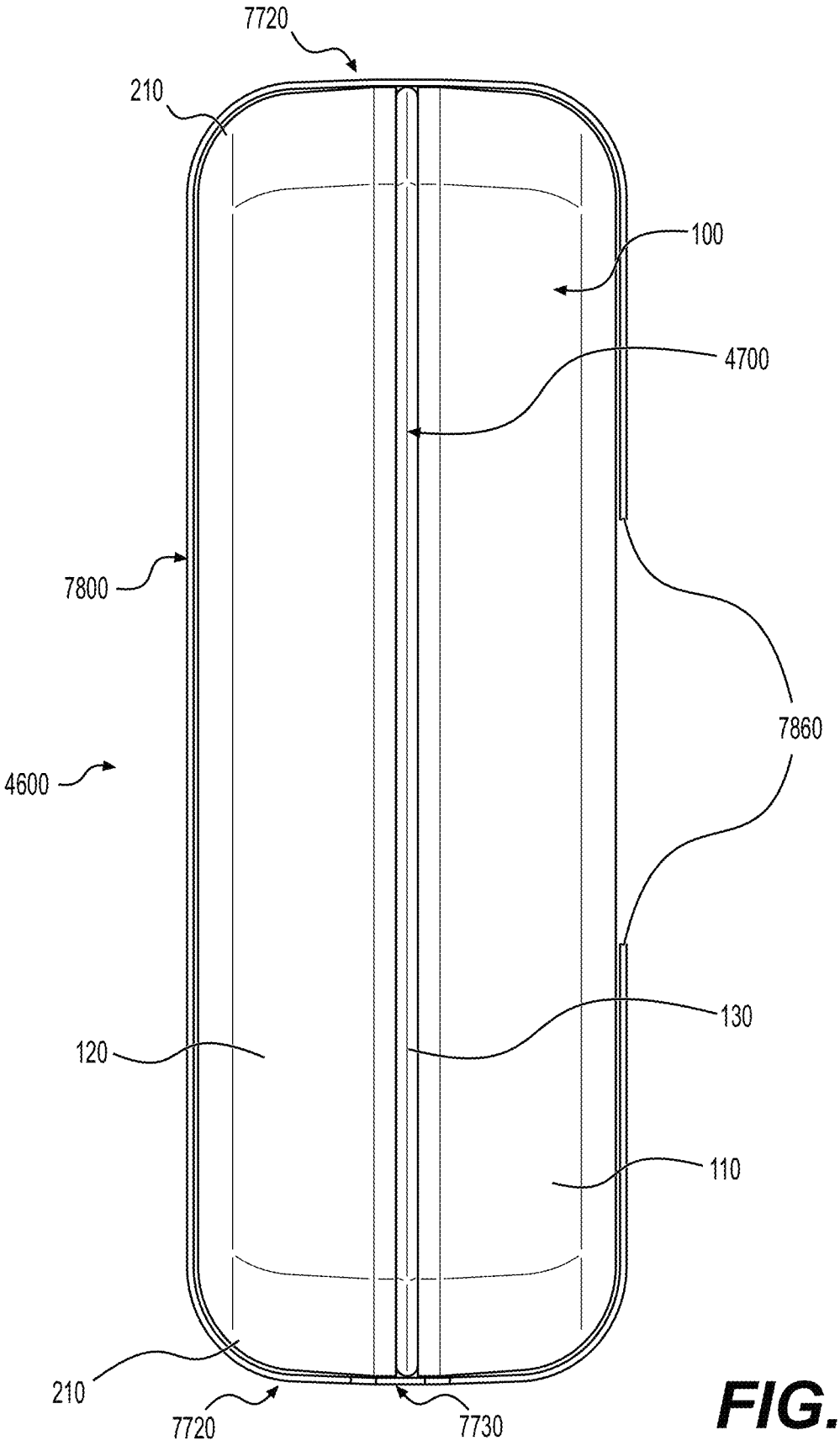
FIG. 94 is an illustration of a side view of a band on a package, in accordance with at least one example embodiment.

In at least one example embodiment, the blank 7805 is in the form of a "sticker" with a temporary adhesive on the second side 7785 of the blank 7805 (i.e., the side of the blank that is not visible in FIG. 78B). In at least one example embodiment, the blank 7805 is mounted on a backing 7850 (FIG. 78B), prior to use. In at least one example embodiment, the temporary adhesive allows the blank 7805 to be easily removed from the backing 7850. In at least one example embodiment, the temporary adhesive is a "fugitive" glue, a removable glue, a pressure sensitive adhesive, or combinations thereof. In at least one example embodiment, the temporary adhesive is an elastomer compound, such as an acrylic, with a "tacktifier" substance such as a rosin ester. In at least one example embodiment, when the blank 7805 is connected to the outer container 100 (as shown in at least FIGS. 90 and 91), the blank 7805 is peeled off of the backing 7850 and connected to the outer container 100 using the temporary adhesive, or using the temporary adhesive in combination with an added adhesive (sometimes referred to as "adhesive" in this document). In at least one example embodiment, the added adhesive has a higher bonding strength, relative to the temporary adhesive. In at least one example embodiment, the added adhesive includes a hot melt glue, a water-based glue, an epoxy, a two-component adhesive, a polyurethane laminating adhesive, or combinations thereof.

In at least one example embodiment, a longitudinal length 7825 of the blank 7805 is in the range of about 340 mm to 360 mm, or about 345 mm to 355 mm, or about 349 mm. In at least one example embodiment, the longitudinal length 7820 of the terminal panels 7715 (wide panels 7810) of the blank 7805 is in the range of about 40 mm to 55 mm, or about 45 mm to 50 mm, or about 47 mm. In at least one example embodiment, the longitudinal length 7820 of the terminal panels 7715 are half, or less than half, the longitudinal length 7726 of the wide panel 7710 that is the center panel 7840 of the blank 7805. In at least one example embodiment, the longitudinal length 7820 of the terminal panels 7715 are one third (33%) of the longitudinal length 7726 of the wide panel 7710 that is the center panel 7840 of the blank 7805.

Figure 79A:
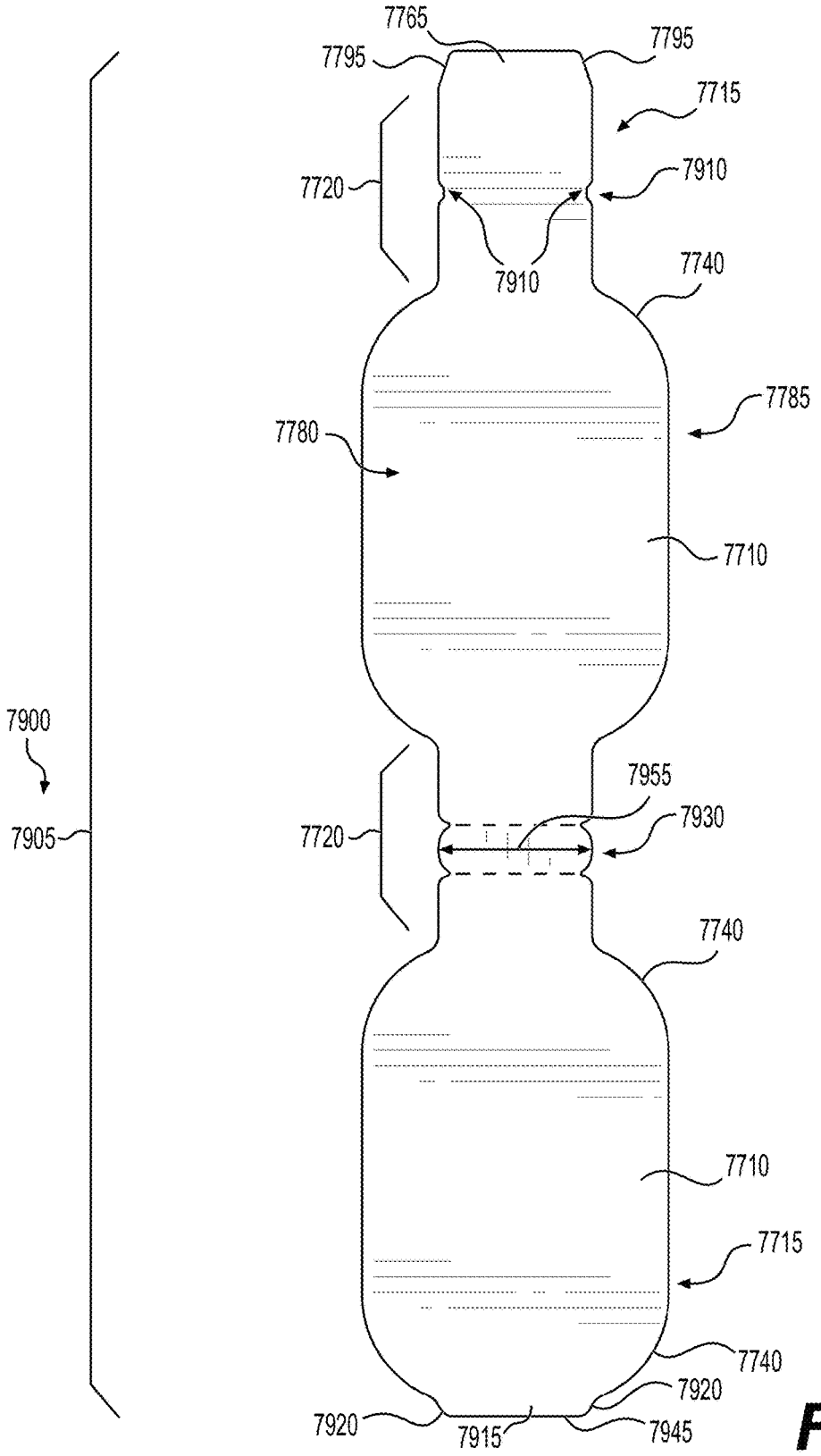
FIG. 79A is an illustration of a blank for a band, in accordance with at least one example embodiment.
Figure 79B:
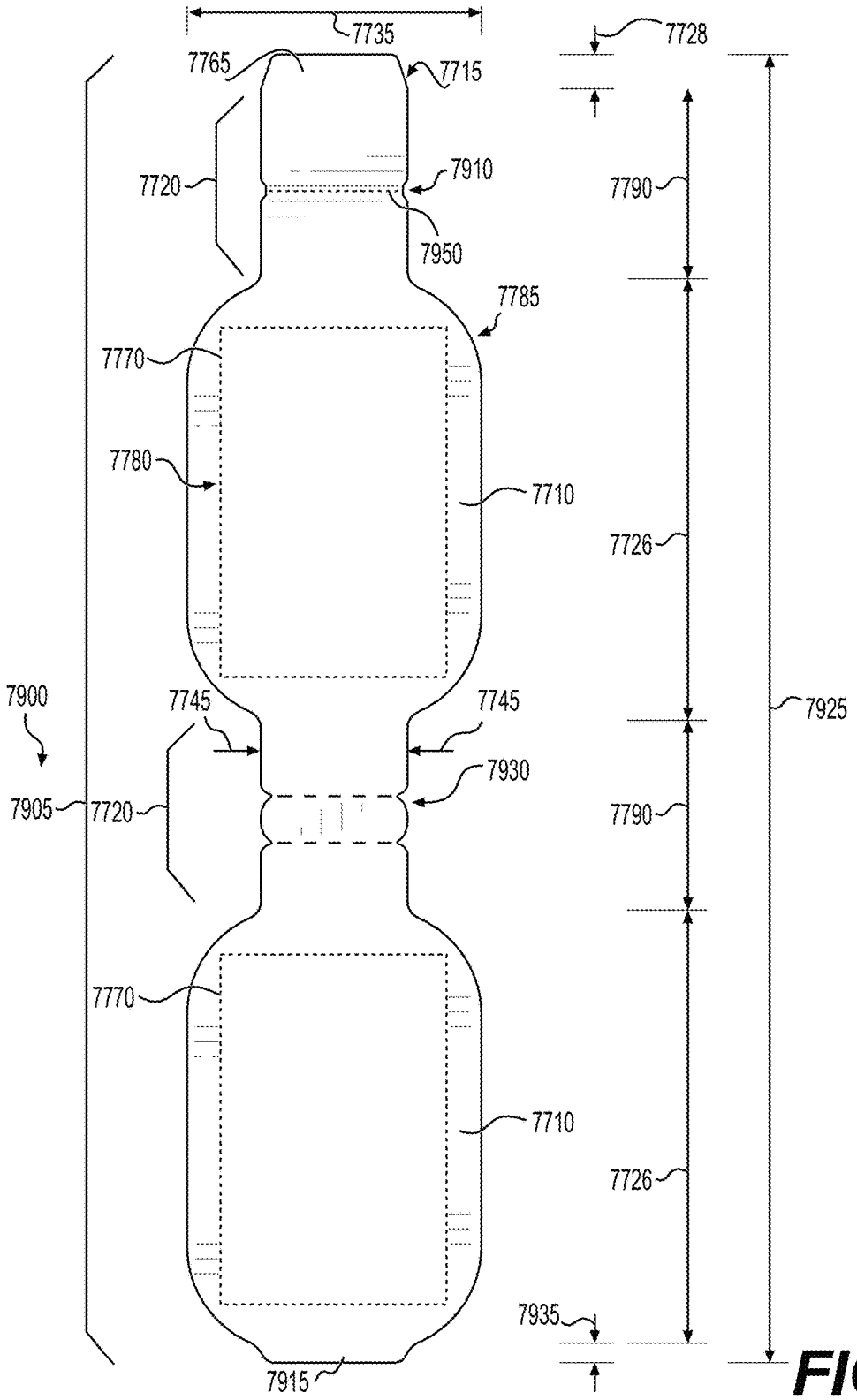
FIG. 79B is an illustration of a blank for a band, in accordance with at least one example embodiment.

FIGS. 79A and 79B are illustrations of a blank 7905 for the band 7900, in accordance with at least one example embodiment.

The blank 7905 of FIGS. 79A/B is the same as the blank 7705 of FIGS. 77A/B, with exceptions described herein. In at least one example embodiment, the blank 7905 includes terminal panels 7715 that include one of the narrow panels 7720 and one of the wide panels 7710. In at least one example embodiment, the terminal panel 7715 that is the wide panel 7710 includes a tab 7915 on a distal end of the wide panel 7710. In at least one example embodiment, the tab 7915 includes side edges 7920 that are angled and taper toward each other as the side edges 7920 reach a distal-most end 7945 of the tab 7915.

In at least one example embodiment, the blank 7905 defines a tear strip 7930. In at least one example embodiment, the tear strip 7930 runs perpendicular to the longitudinal length 7925 of the blank 7905. In at least one example embodiment, the blank 7905 defines more than one of the tear strips 7930. In at least one example embodiment, the tear strip 7930 is defined by at least one of the narrow panels 7720. In at least one example embodiment, the tear strip 7930 is defined by at least one of the wide panels 7710. In at least one example embodiment, a tear direction 7955 of the tear strip 7930 is bi-directional, such that the tear strip 7930 can be pulled open by starting on either side of the tear strip 7930.

Figure 98:
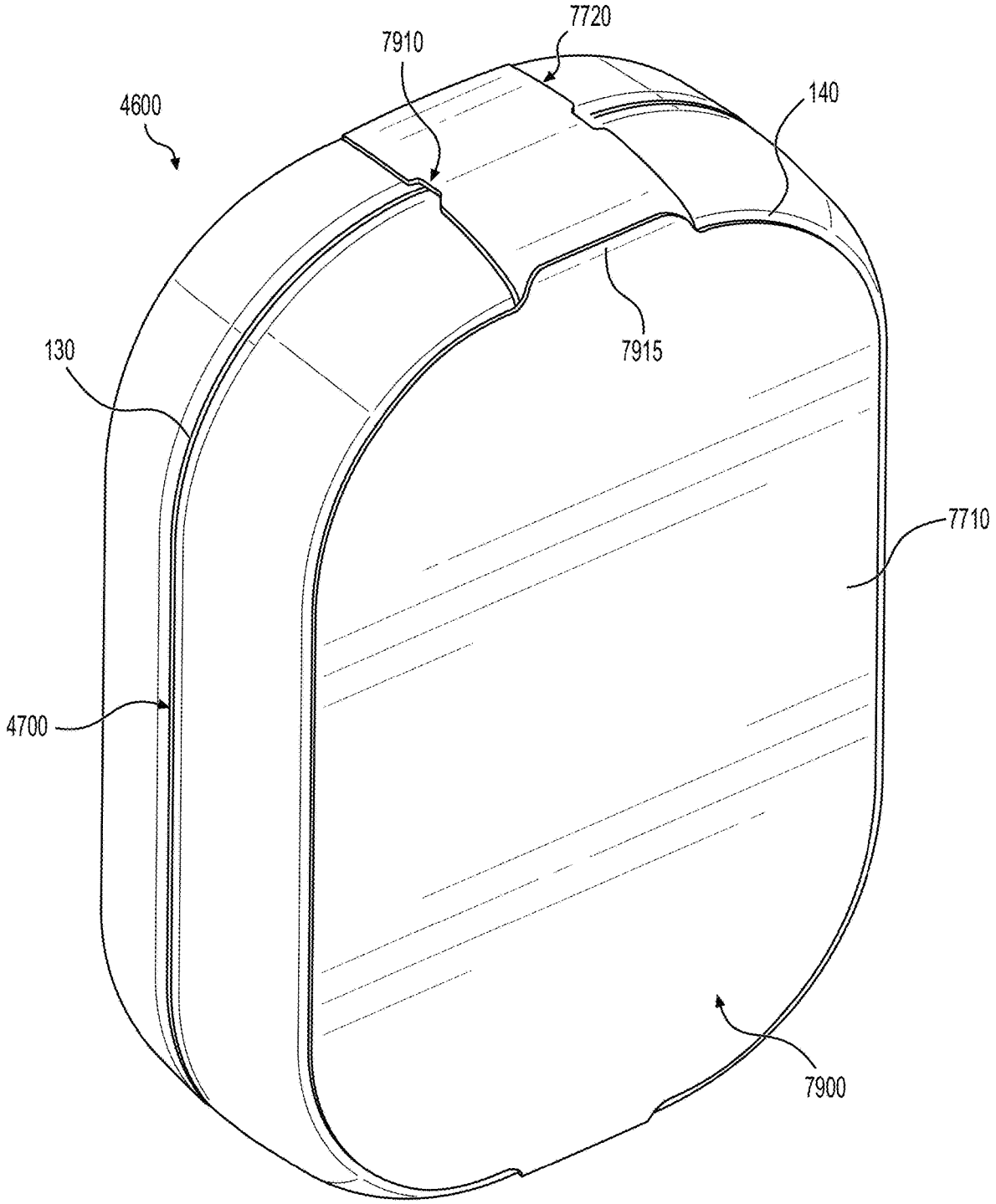
FIG. 98 is an illustration of a perspective view of a band on a package, in accordance with at least one example embodiment.
Figure 99:
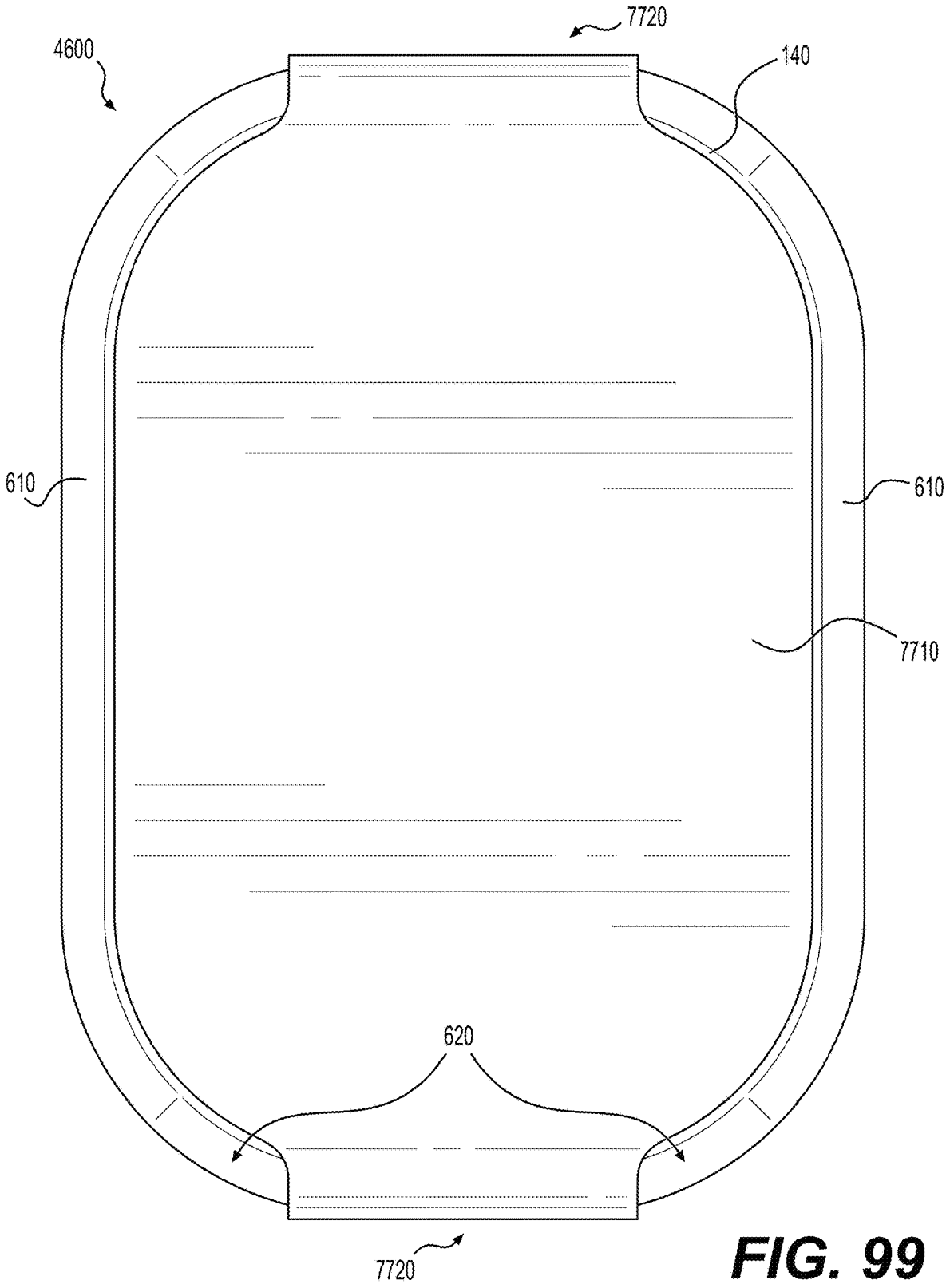
FIG. 99 is an illustration of a perspective view of a band on a package, in accordance with at least one example embodiment.
Figure 100:
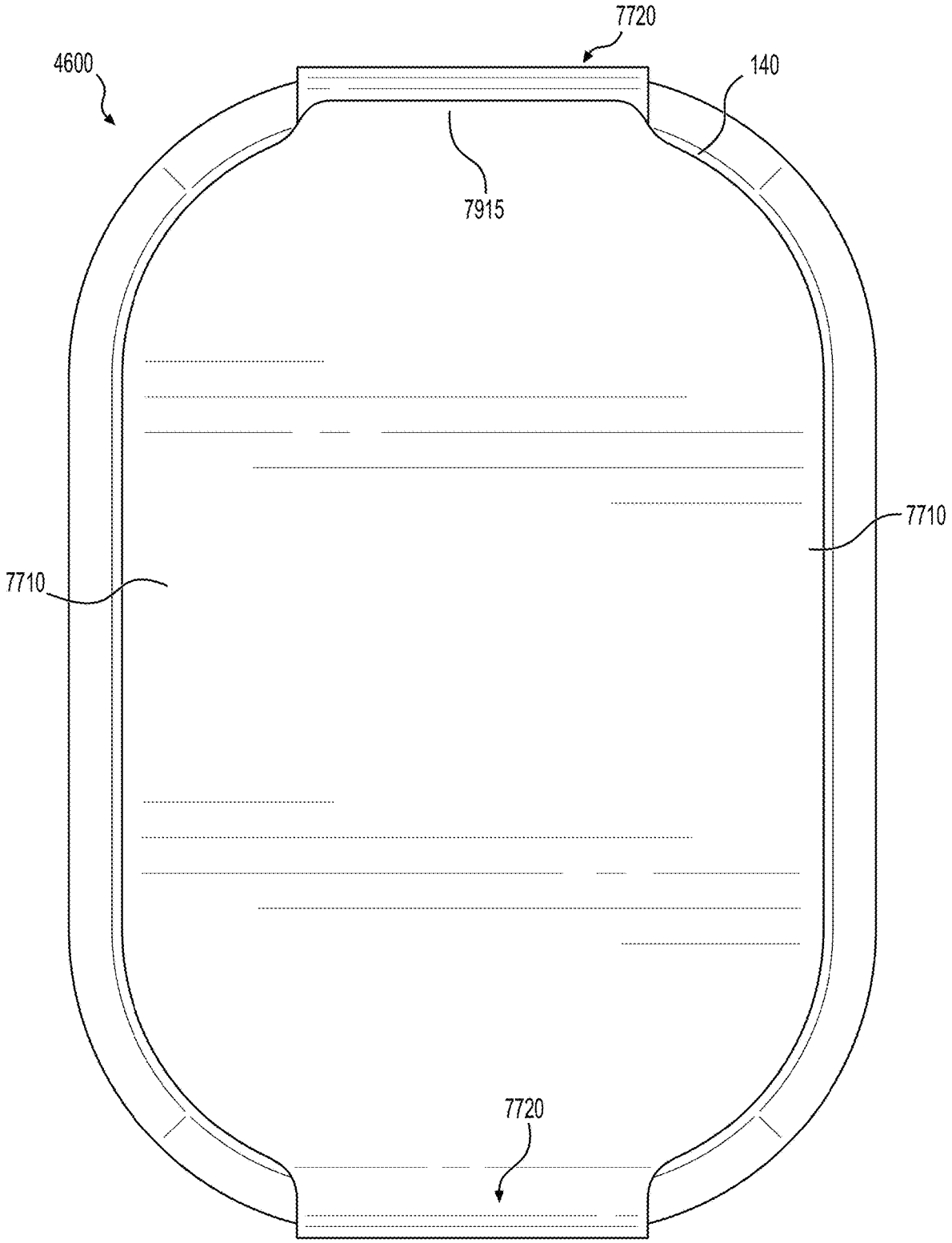
FIG. 100 is an illustration of a perspective view of a band on a package, in accordance with at least one example embodiment.
Figure 101:
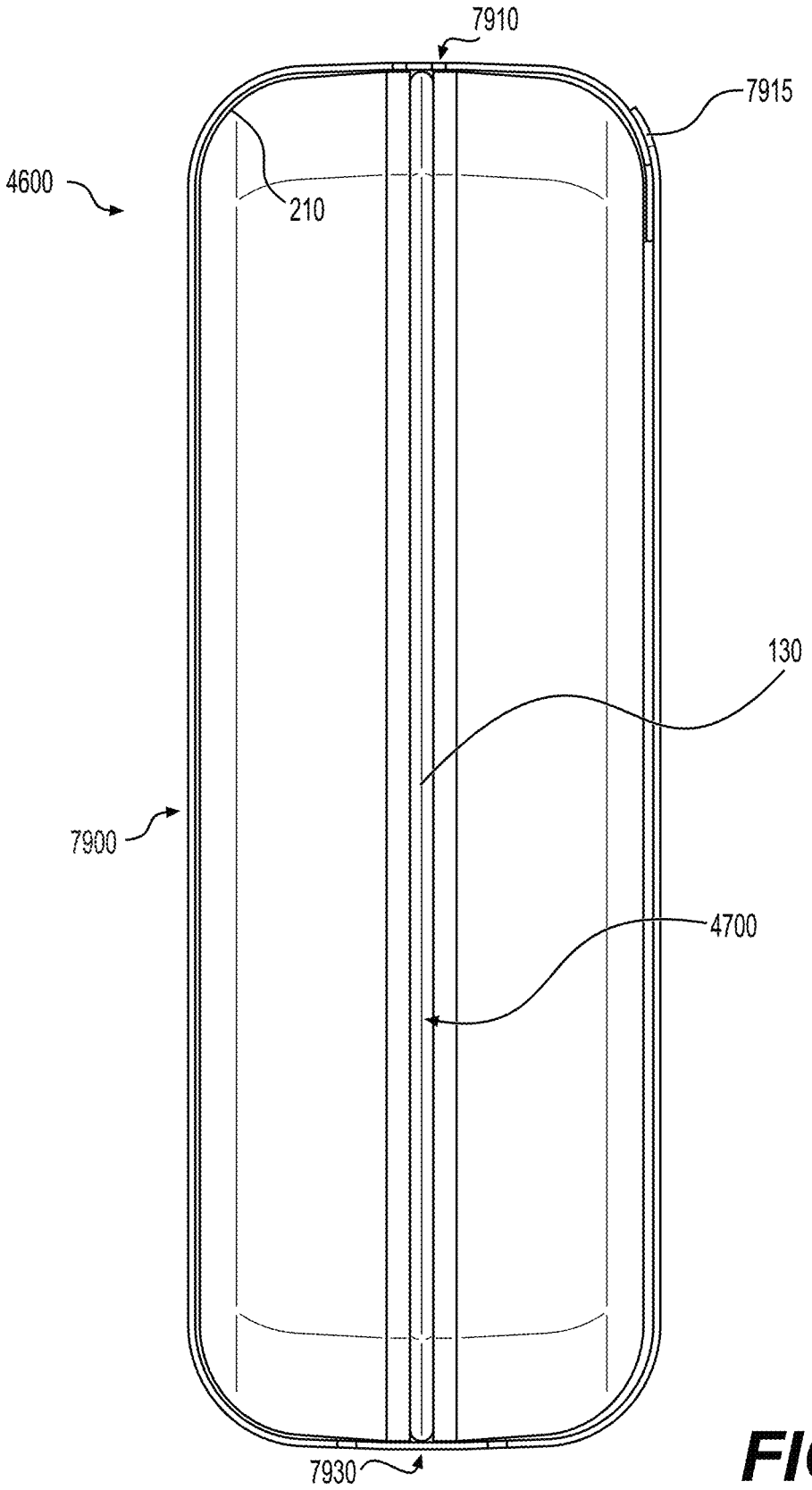
FIG. 101 is an illustration of a side view of a band on a package, in accordance with at least one example embodiment.

In at least one example embodiment, the terminal panel 7715 that is the narrow panel 7720 defines alignment notches on either side of the narrow panel 7720. As shown in FIG. 79B, the alignment notches 7910 are aligned with each other along a line 7950 that runs perpendicular to the longitudinal length 7925 of the blank 7905. In at least one example embodiment, the alignment notches 7910 are used in conjunction with the tear strip 7930 to position the band 7900 on the package 4600 (see at least FIGS. 97-98 and 101). That is to say, in at least one example embodiment, the alignment notches 7910 and the tear strip 7930 can be aligned along a portion of the seam 4700 of the outer container 100 (see at least FIGS. 97-98 and 101) to ensure that the band 7900 is correctly positioned on the outer container 100.

In at least one example embodiment, a length 7935 of the tab 7915 is in the range of about 3 mm to 5 mm, or about 4 mm.

In at least one example embodiment, the blanks 7705/7805/7905 are made from cardboard, paper, paperboard, other suitable packaging materials, or combinations thereof. In another example embodiment, the blanks 7705/7805/7905 are made from plastic, one or more polymer layers, a foil, polyethylene Terephtalate (PET), High-Density Polyethylene (HDPE), Low-Density Polyethylene (LDPE), Polyvinyl Chloride (PVC), Polypropylene (PP), or other layers or combinations of layers of material.

Figure 80A:
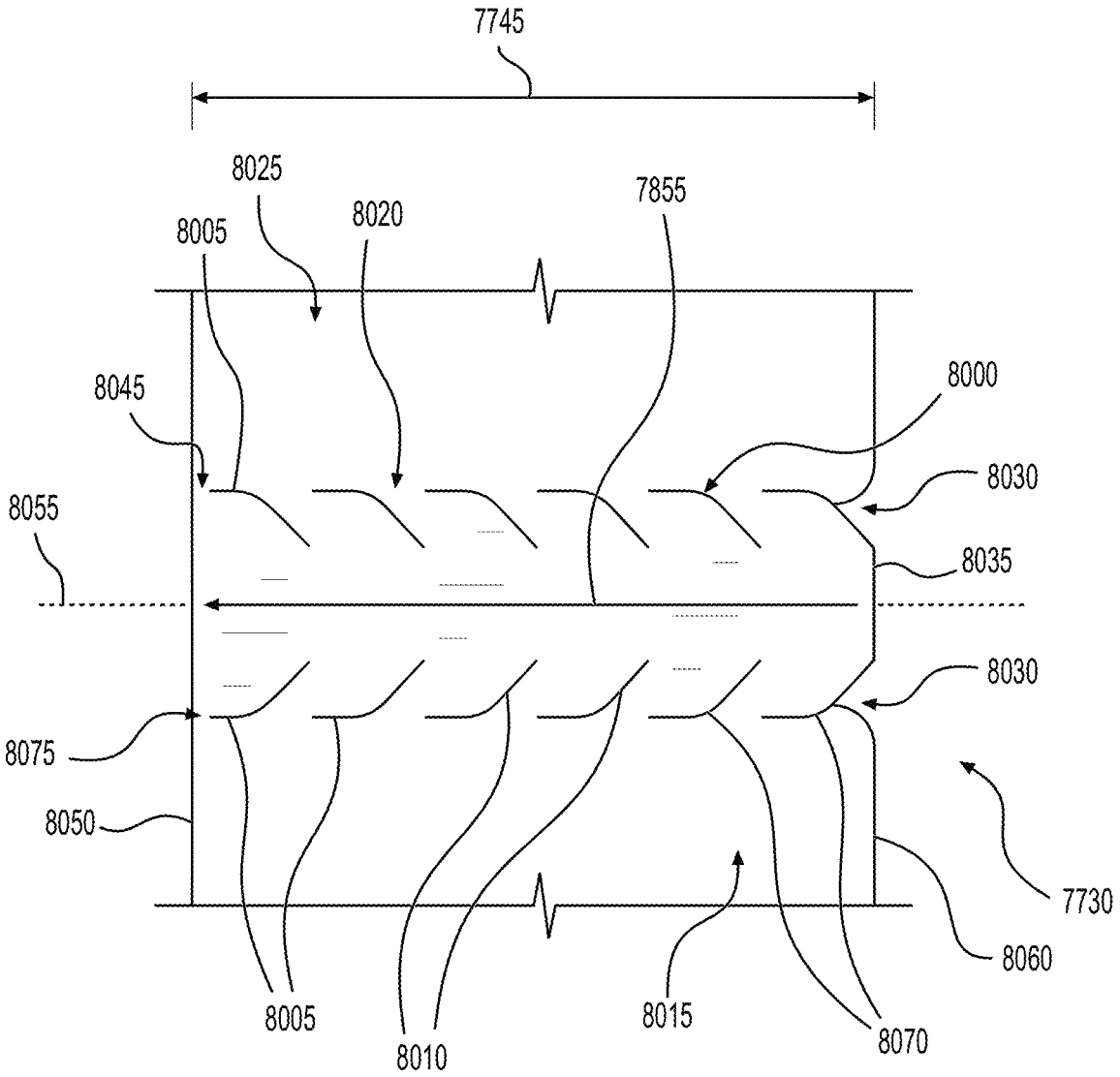
FIG. 80A is an illustration of a tear strip for a band, in accordance with at least one example embodiment.
Figure 80B:
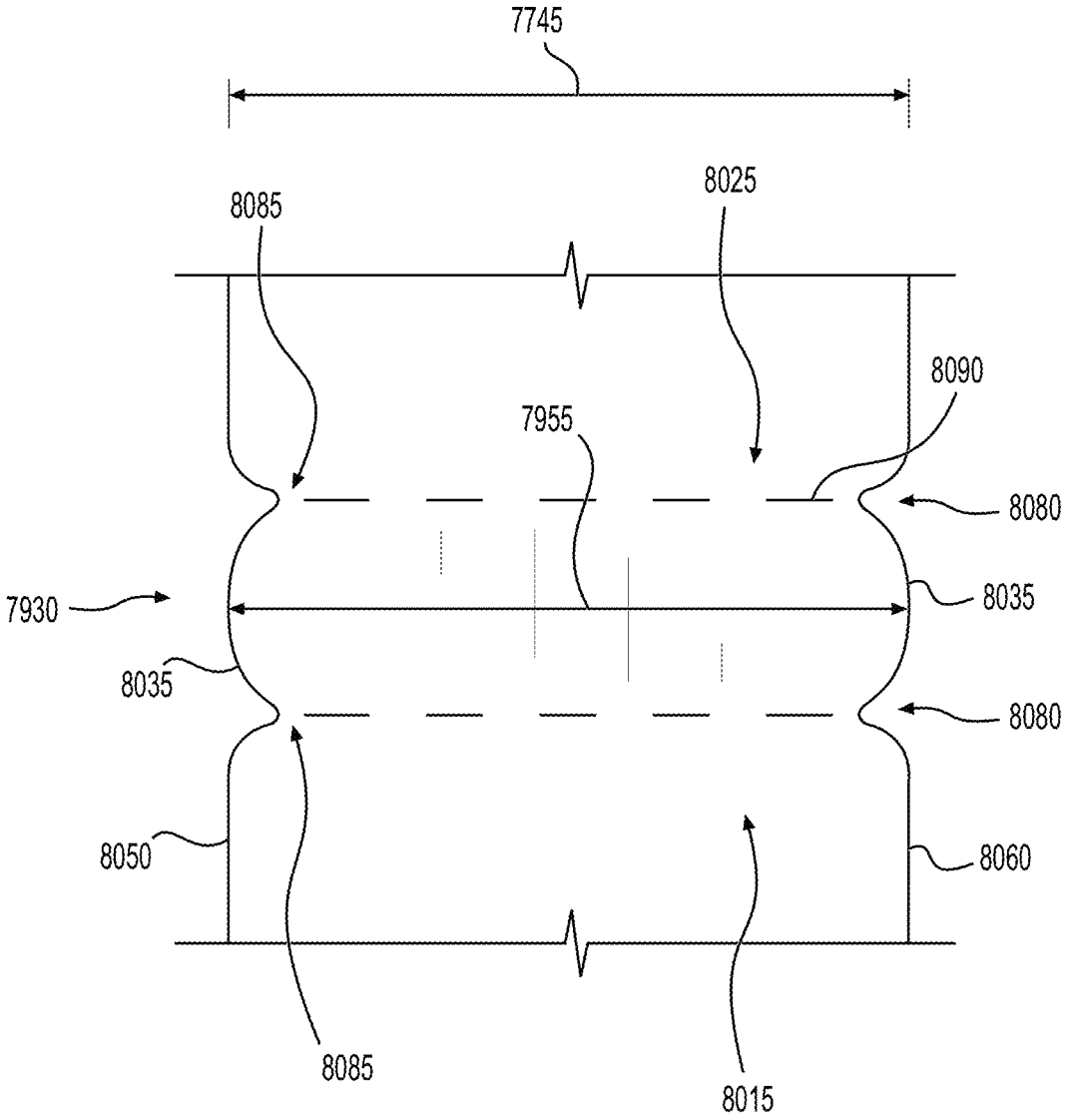
FIG. 80B is an illustration of a tear strip for a band, in accordance with at least one example embodiment.

FIGS. 80A and 80B are illustrations of the tear strips 7730/7930, in accordance with example embodiments.

In at least one example embodiment, and as shown in FIGS. 77A-78B and 80A, the tear strip 7730 extends across a width of a portion of the blanks 7705/7805. In at least one example embodiment, the tear strip 7730 extends across the width 7745 of one of the narrow panels 7720 of the blanks 7705/7805, from a first side edge 8050 to a second side edge 8060 of a portion of the blanks 7705/7805 (see FIGS. 77A-78B and 80A). In at least one example embodiment, tear strip 7730 extends across a width of one of the wide panels 7710 of the blank 7705/7805 in a direction that is perpendicular to the longitudinal lengths 7725/7825 of the blanks 7705/7805. In at least one example embodiment, the tear strip 7730 has a leading end 8035, where the tear strip 7730 is grasped and initially torn open along the tear direction 7855 to fully tear open the tear strip 7730.

In at least one example embodiment, the tear strip 7730 includes slits 8000 aligned in a row on a first side 8015 and a second side 8025 of the tear strip 7730. In at least one example embodiment, the slits 8000 are "V"-shaped. In at least one example embodiment, the slits 8000 include a first portion 8005 and a second portion 8010, where the first portion 8005 of each of the slits 8000 are aligned to be co-linear with each other on the first side 8015 and the second side 8025 of the tear strip 7730, and the second portion 8010 extends toward a centerline 8055 of the tear strip 7730. In at least one example embodiment, the first portions 8005 of each of the slits 8000 extend from an apex 8070 of the slits 8000 in a direction that is parallel with, and in a same direction as, the tear direction 7855 of the tear strip 7730. In at least one example embodiment, a gap 8020 exists between the first portion 8005 of each of the slits 8000. In at least one example embodiment, the slits 8000 are equally spaced apart, such that the gap 8020 is a uniform gap between each of the slits 8000. In at least one example embodiment, a gap 8045 may exist between the first side edge 8050 of the blanks 7705/7805 and an end 8075 of the first portion 8005 of the slits 8000. In at least one example embodiment, the gap 8045 does not exist for some of the blanks 7705/7805 (for example, see the blank 7705 in FIGS. 77A/B). In at least one example embodiment, for blanks that are the "sticker" embodiment (see for example the blank 7805 in FIGS. 78A/B), the gap 8045 may not exist, and therefore the end 8075 of the slits 8000 of the tear strip 7730 extend to the first side edge 8050 (see for example the blank 7705 in FIGS. 77A/B).

In at least one example embodiment, notches 8030 are defined by the second side edge 8060 of the blanks 7705/7805 on sides of the leading end 8035 of the tear strip 7730 to assist in initiating the tearing of the tear strip 7730.

In at least one example embodiment, the tear strip 7930 of the blank 7905 (FIGS. 79A/B) is a bi-directional tear strip 7930 that can be torn in the tear direction 7955 that starts at the leading end 8035 on either the first side edge 8050 or the second side edge 8060 of a portion of a blank 7905 (see FIGS. 79A/B and 80B). In this embodiment, the tear strip 7930 is defined by slits 8090 that are aligned in a row on the first side 8015 and the second side 8025 of the tear strip 7930. In at least one example embodiment, a gap 8085 exists between the slits 8090 and the first side edge 8050 and/or the second side edge 8060 of the tear strip 7930. In at least one example embodiment, notches 8080 are defined by the first side edge 8050 and the second side edge 8060 of the blanks 7705/7805 on sides of the tear strip 7930 to assist in initiating the tearing of the tear strip 7930.

Figure 81:
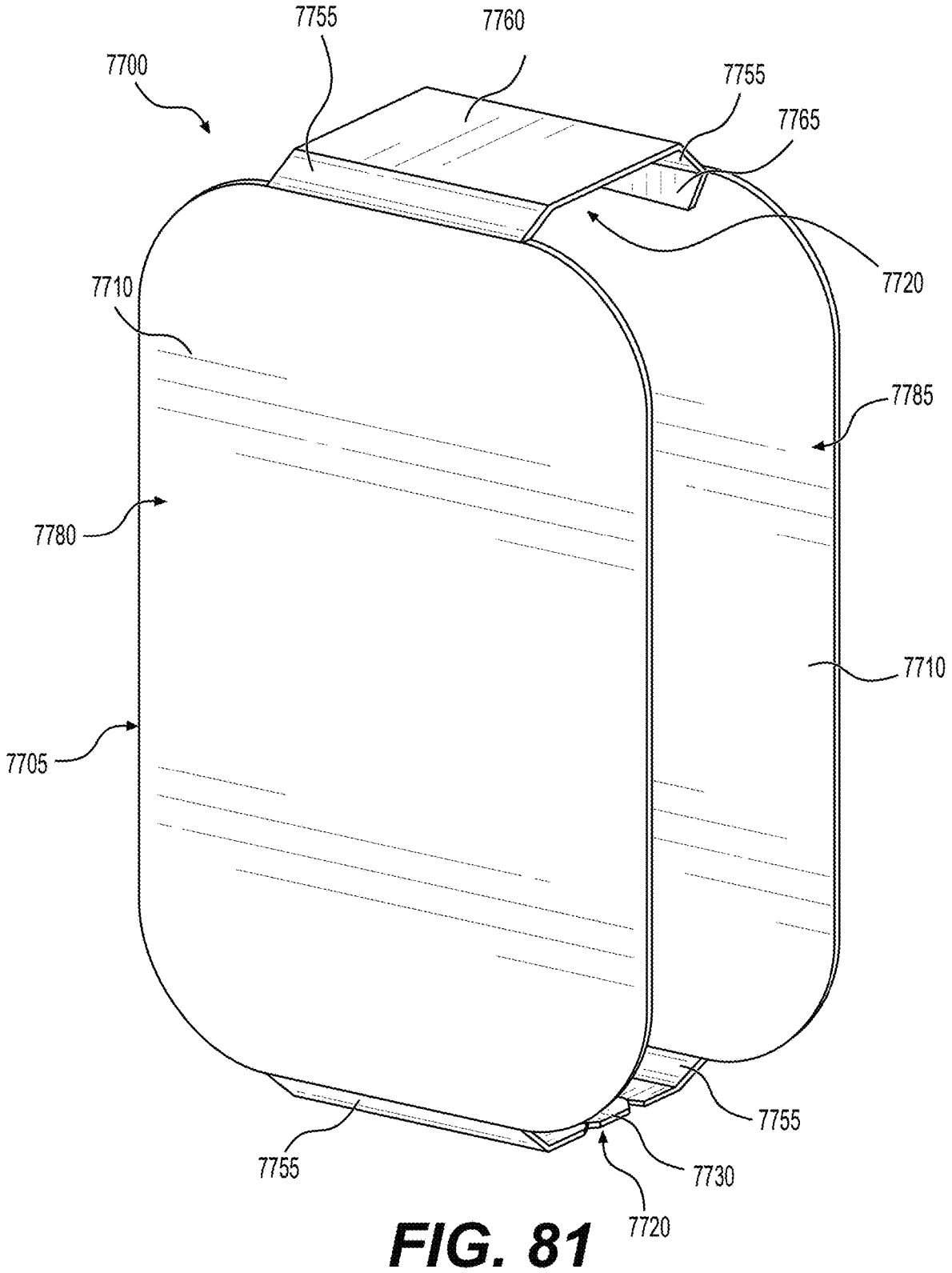
FIG. 81 is an illustration of a perspective view of a band positioned to be connected to a package, in accordance with at least one example embodiment.
Figure 82:
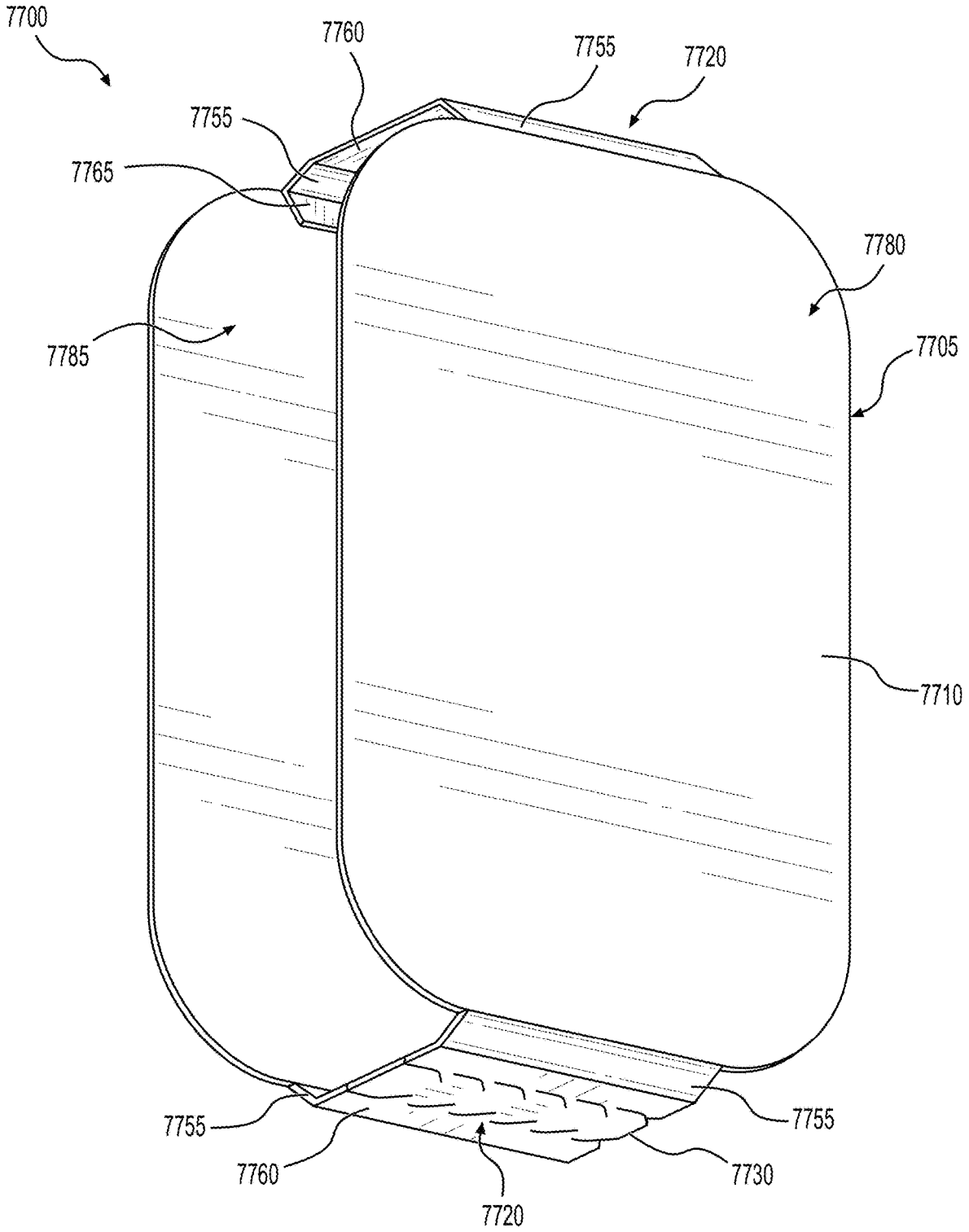
FIG. 82 is an illustration of a perspective view of a band positioned to be connected to a package, in accordance with at least one example embodiment.

FIGS. 81-82 are illustrations of perspective views of the band 7700 positioned to be connected to a package, in accordance with at least one example embodiment. FIGS. 83-87 are illustrations of perspective and side views of the band 7700 on the outer container 100, in accordance with at least one example embodiment.

In at least one example embodiment, the blank 7705 is folded so that the tab 7765 reaches around and connects to the second side 7785 of the blank 7705 to configure the band 7700 to fit around a package (see at least FIGS. 83 and 84). In another example embodiment, the tab 7765 is connected to the first side 7780 of the blank 7705 when the blank 7705 is formed into the band 7700. In at least one example embodiment, the first side 7780 and the second side 7785 of the band 7700 are interchangeable, such that the first side 7780 contacts the outer container 100 rather than the second side 7785 contacting the outer container 100, once the band 7700 is wrapped around the outer container 100 to make the package 4600 (FIGS. 83 and 84).

Figure 87:
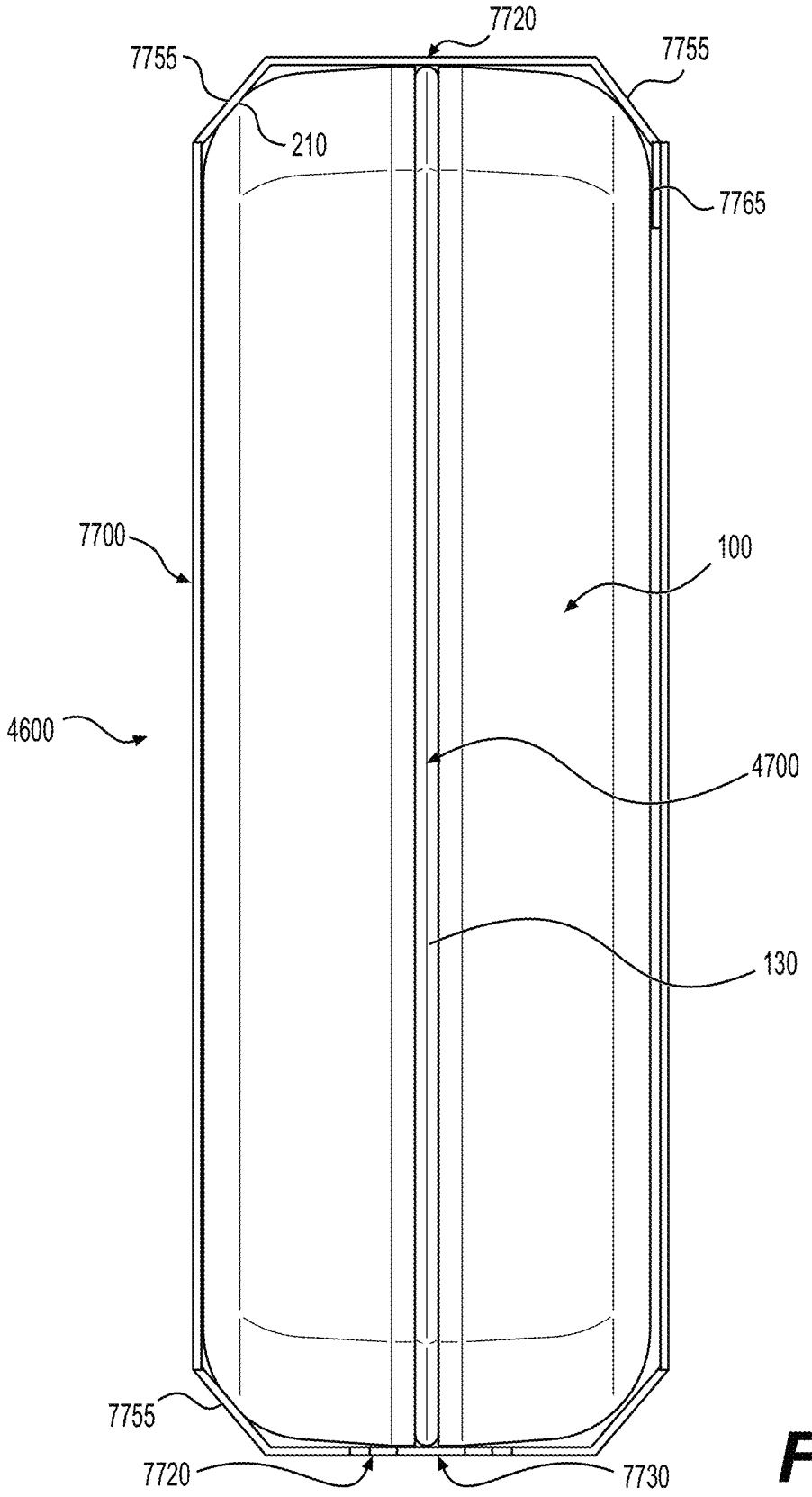
FIG. 87 is an illustration of a side view of a band on a package, in accordance with at least one example embodiment.

In at least one example embodiment, the blank 7705 is formed into the band 7700 by connecting the tab 7765 to a portion of the wide panel 7710 using the added adhesive (see at least FIGS. 81 and 87). In at least one example embodiment, the side panels 7755 form chamfered sections of the narrow panels 7720 to allow the narrow panels 7720 to wrap around the rounded side edges 210 of the outer container 100 when the band 7700 is connected to the outer container 100 (see at least FIGS. 83, 84 and 87). In at least one example embodiment, the band 7700 is connected to the outer container 100 so that the narrow panels 7720 overlay an opening of the outer container 100 to ensure the outer container 100 is not inadvertently opened. In at least one example embodiment, the narrow panels 7720 overlay the seam 4700 of the outer container 100 to provide tamper resistance for the package 4600 once the band 7700 is connected to the outer container 100 (see FIGS. 83-87). In at least one example embodiment, the tear strip 7730 is aligned with the seam 4700 of the outer container 100 (see FIGS. 83 and 87, in particular). In at least one example embodiment, by having the tear strip 7730 overlay and be aligned with a portion of the seam 4700, the seam 4700 allows for an object or fingernails to more easily grip the leading end 8035 of the tear strip 7730 to initiate a tearing of the tear strip 7730.

Figure 85:
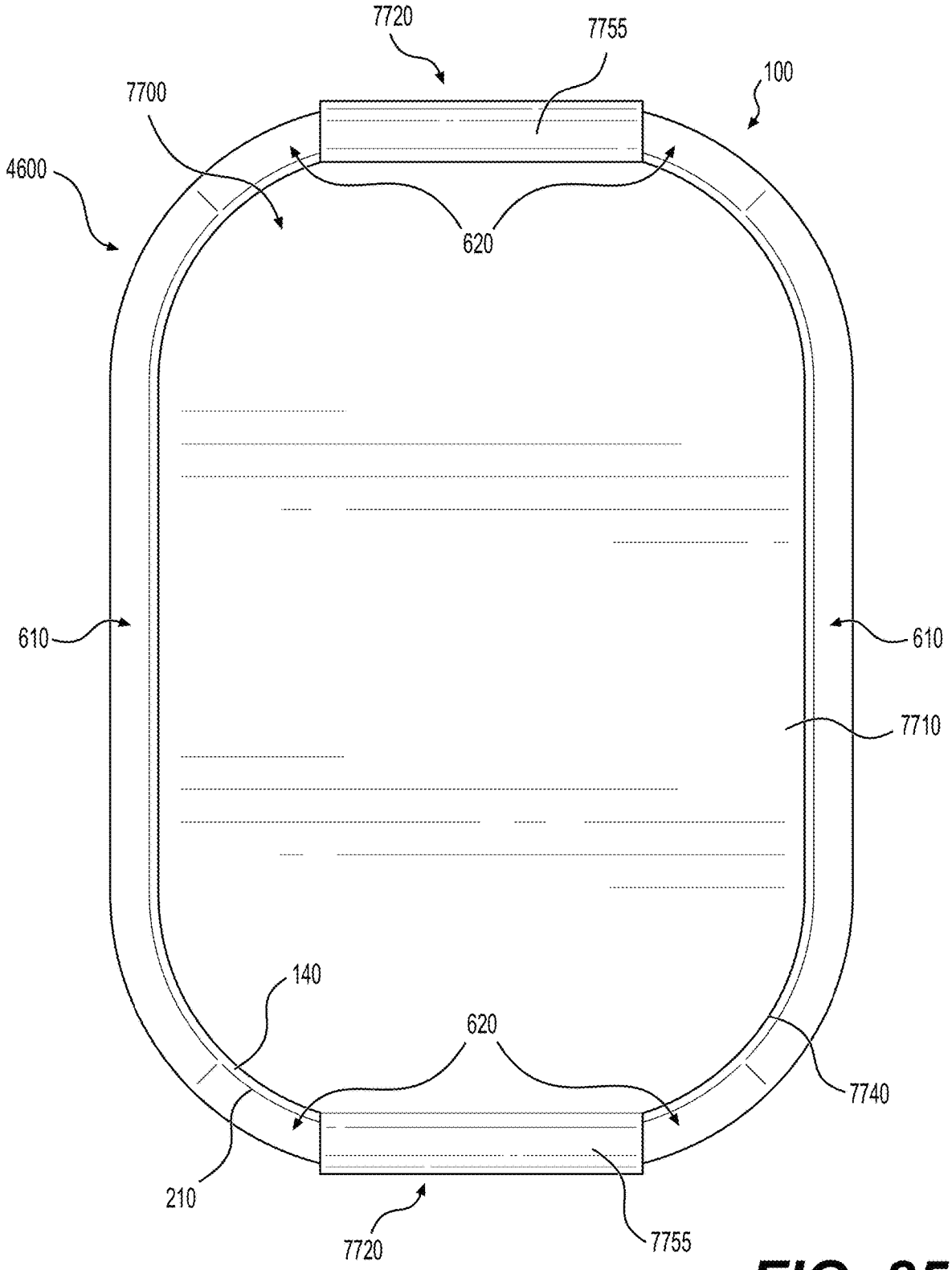
FIG. 85 is an illustration of a perspective view of a band on a package, in accordance with at least one example embodiment.
Figure 86:
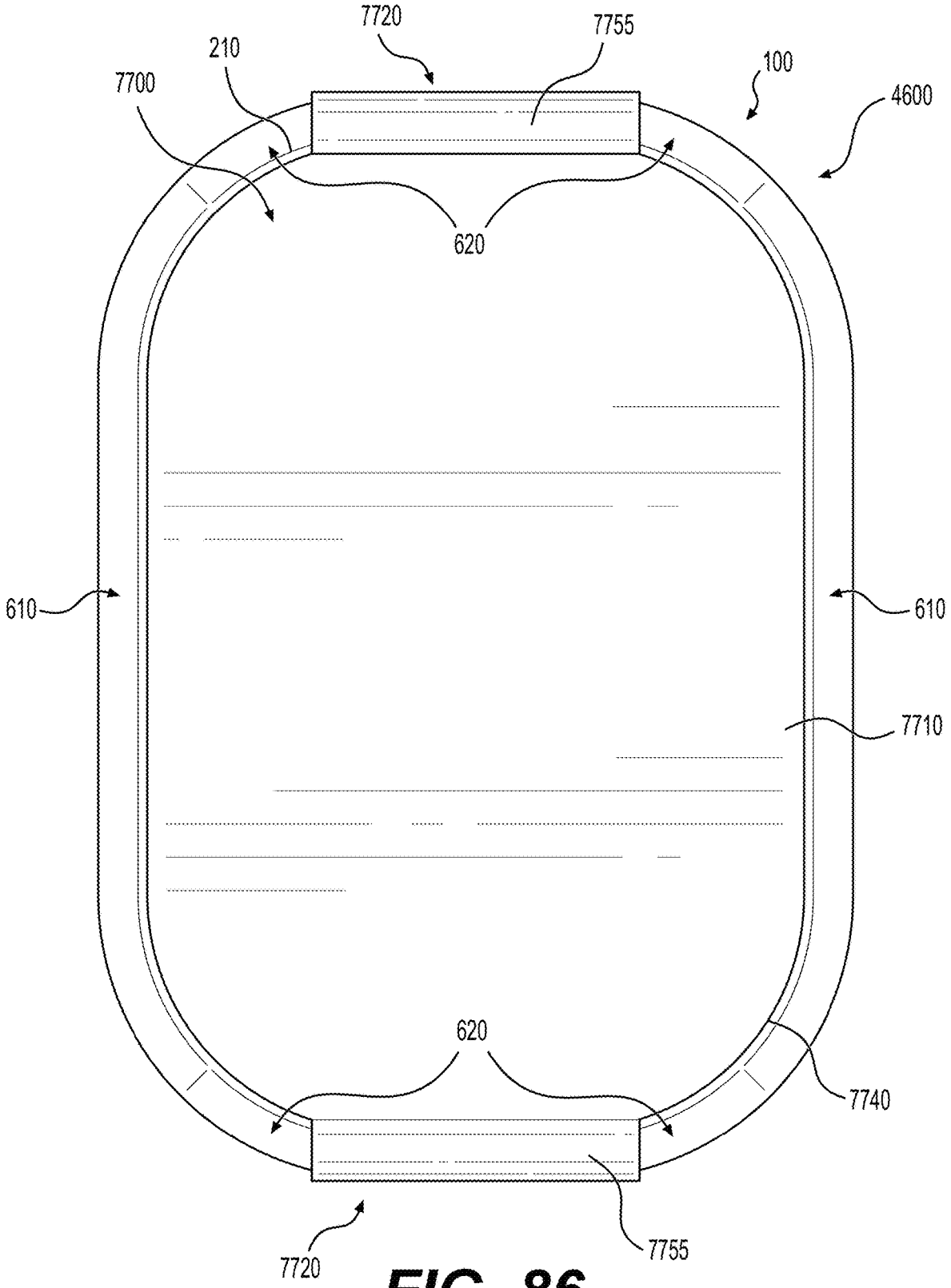
FIG. 86 is an illustration of a perspective view of a band on a package, in accordance with at least one example embodiment.

In at least one example embodiment, the band 7700 runs along a longitudinal length of the outer container 100, such that the narrow panels 7720 extend across the second sidewalls 620 of the outer container 100, where the second sidewalls 620 are shorter than the first sidewalls 610 of the outer container 100 (see FIGS. 84 and 85). In another example embodiment, the band 7700 runs along a width of the outer container 100, such that the narrow panels 7720 extend across the first sidewalls 610 of the outer container 100, where the first sidewalls 610 are longer than the second sidewalls 620 (see at least FIG. 47). In another example embodiment, the first sidewalls 610 and the second sidewalls 620 are a same length, where a size of the band 7700 is conformed to a size of the outer container 100.

Figure 88:
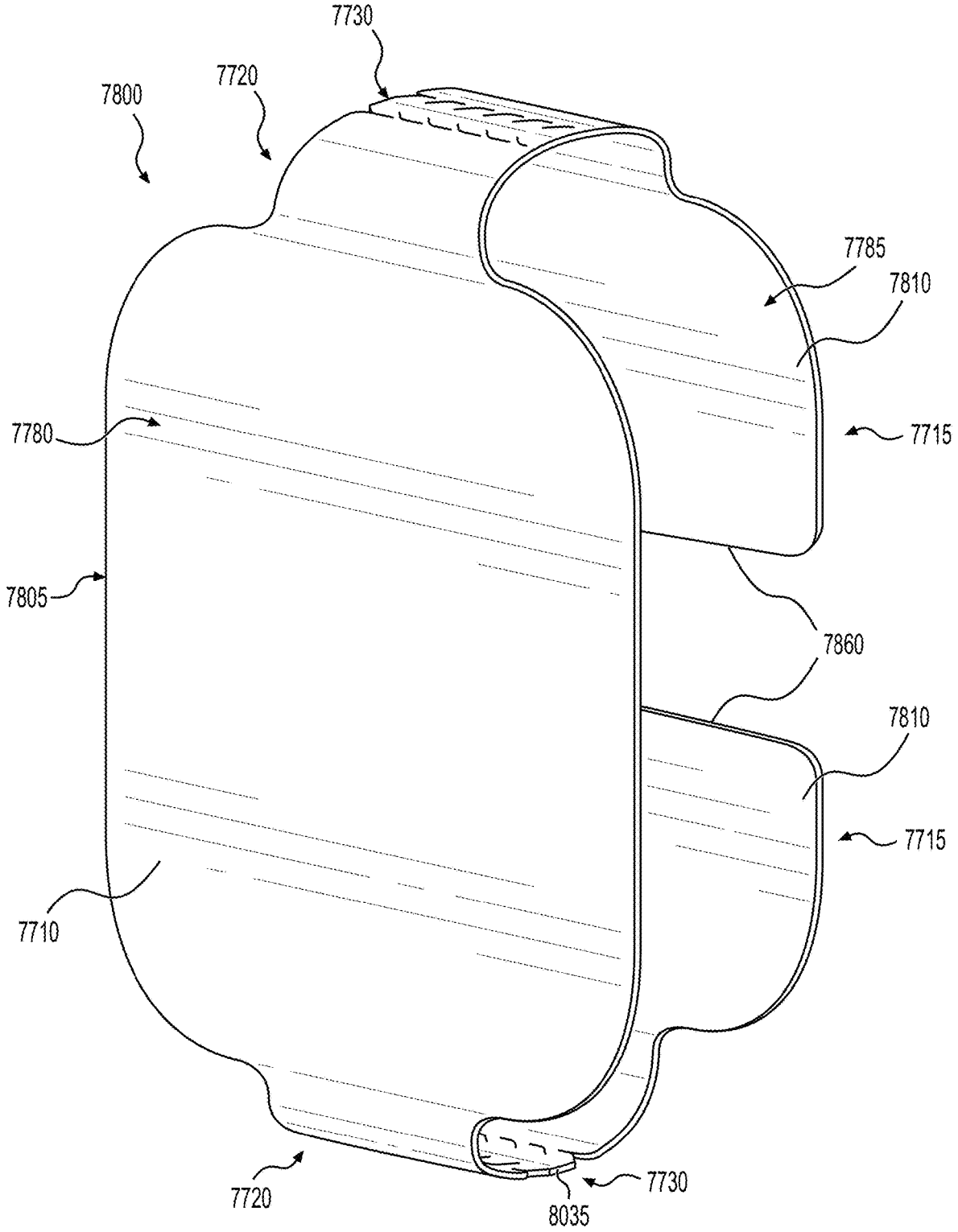
FIG. 88 is an illustration of a perspective view of a band positioned to be connected to a package, in accordance with at least one example embodiment.
Figure 89:
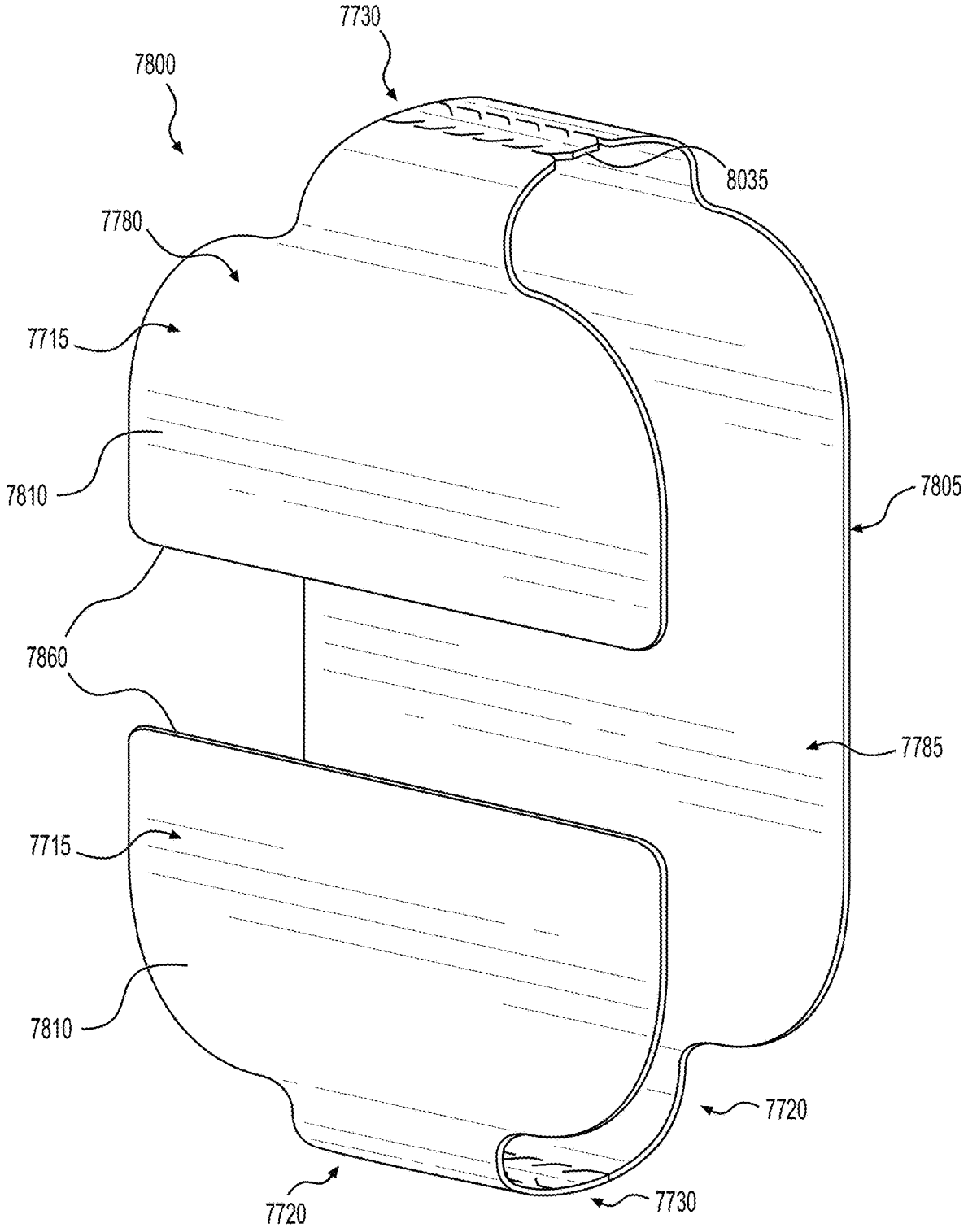
FIG. 89 is an illustration of a perspective view of a band positioned to be connected to a package, in accordance with at least one example embodiment.
Figure 90:
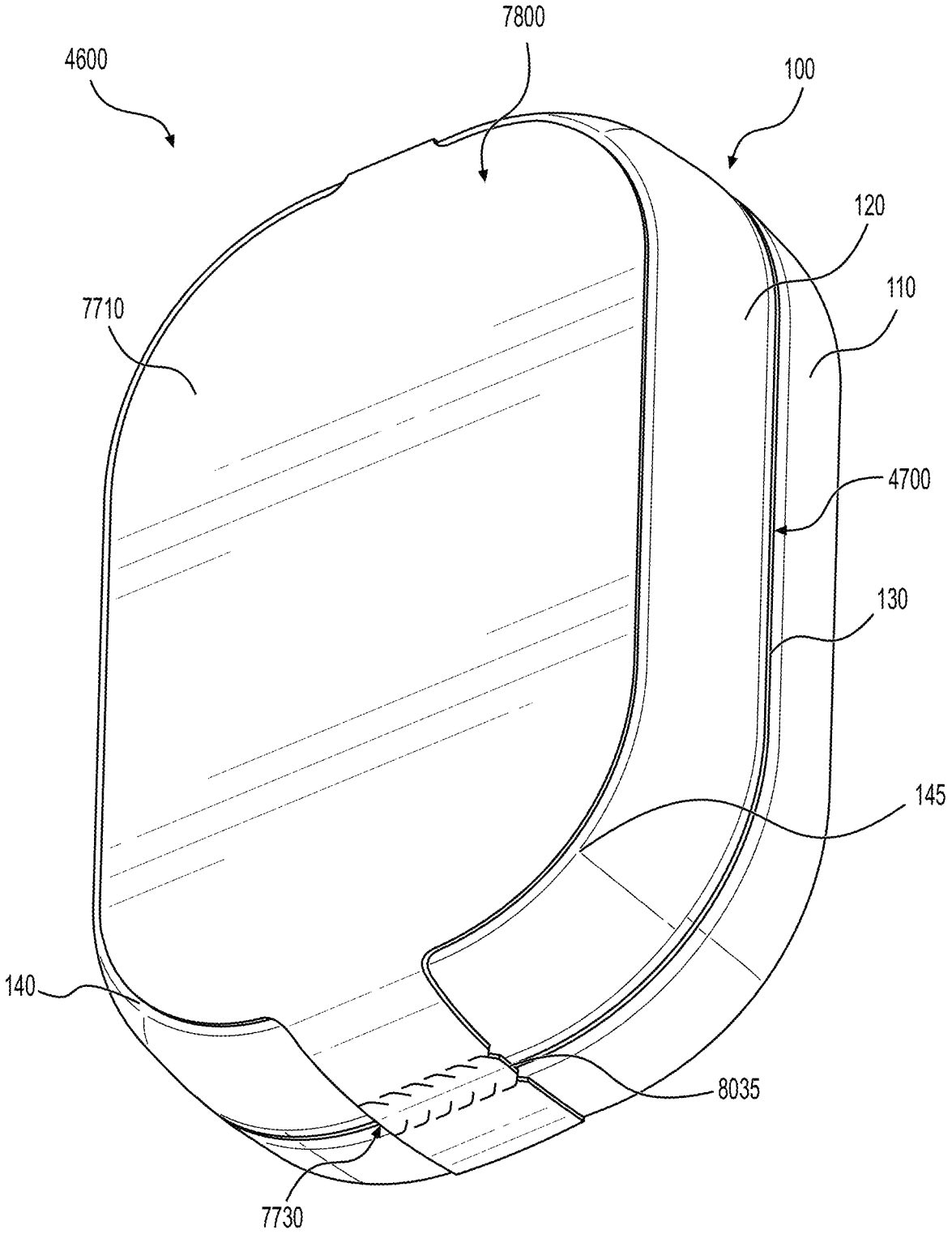
FIG. 90 is an illustration of a perspective view of a band on a package, in accordance with at least one example embodiment.

FIGS. 88-89 are illustrations of perspective views of the band 7800 positioned to be connected to a package, in accordance with at least one example embodiment. FIGS. 90-94 are illustrations of perspective and side views of the band 7800 on the outer container 100, in accordance with at least one example embodiment.

In at least one example embodiment, the band 7800 is connected to the outer container 100 in the same manner as the band 7700, with the following exceptions described herein. In at least one example embodiment, a gap 9100 exists between the end edges 7860 of the terminal panels 7715 of the band 7800, once the band 7800 is connected to the outer container 100 (see at least FIG. 91). In at least one example embodiment, the gap 9100 allows for an exposed portion 9105 of the outer container 100 to be viewable, once the band 7800 is on the outer container 100. In at least one example embodiment, the indicia 7770 and/or the consumer information can be included on the exposed portion 9105.

In at least one example embodiment, the second side 7785 of the band 7800 is connected to the outer container 100 using the temporary adhesive and/or the added adhesive. In at least one example embodiment, the band 7800 hugs outer surfaces of the outer container 100, where the band 7800 hugs the rounded side edges 210 of the outer container 100 (see at least FIG. 94).

Figure 95:
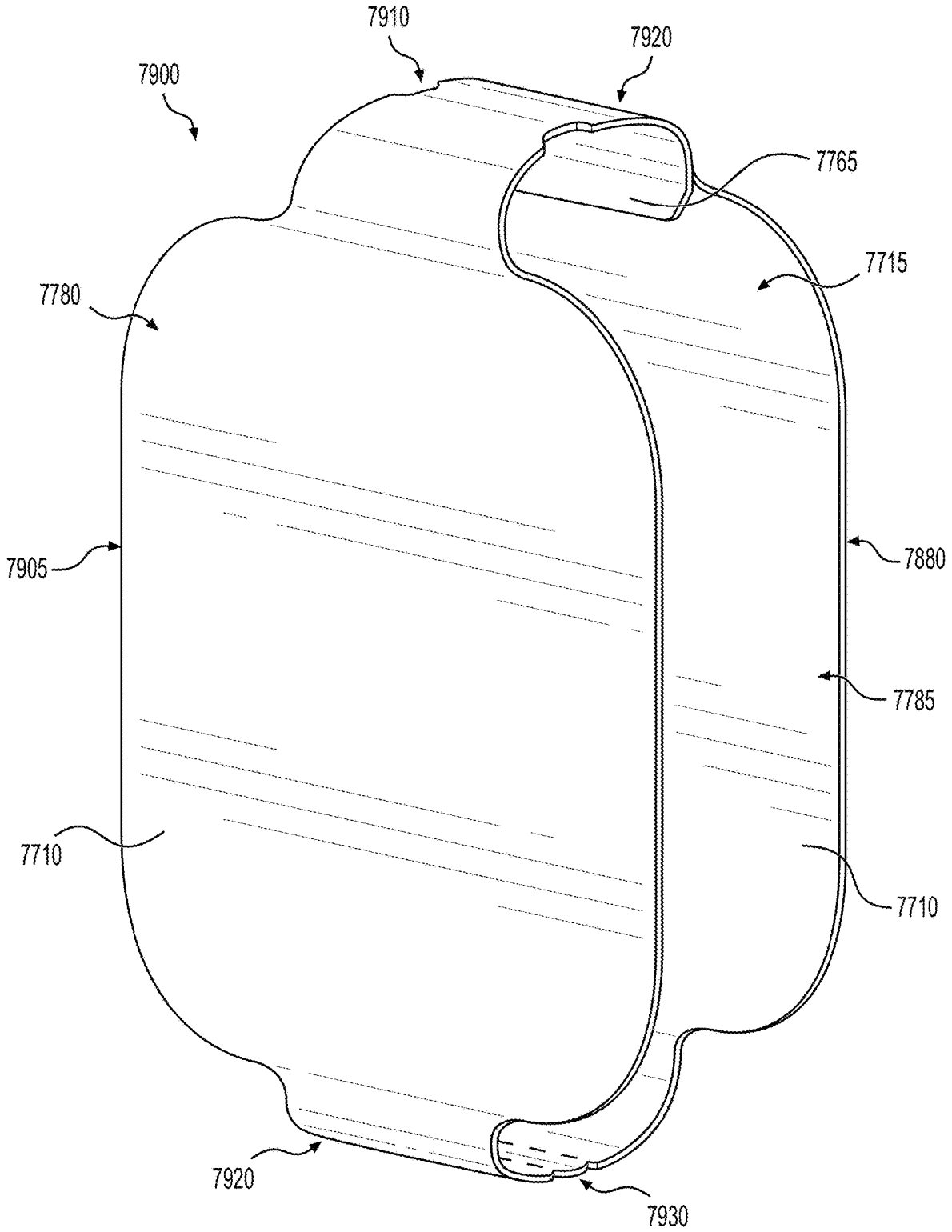
FIG. 95 is an illustration of a perspective view of a band positioned to be connected to a package, in accordance with at least one example embodiment.
Figure 96:
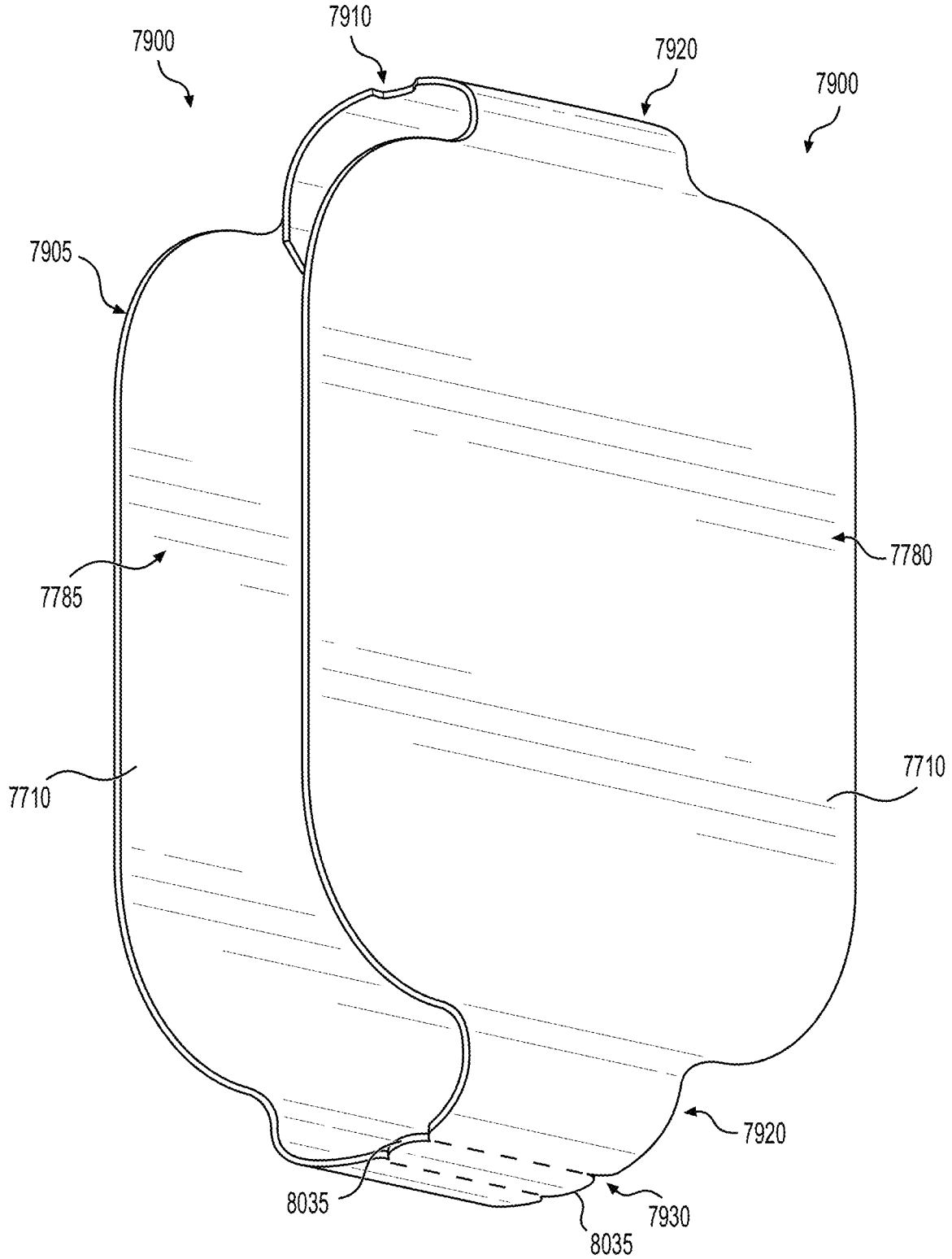
FIG. 96 is an illustration of a perspective view of a band positioned to be connected to a package, in accordance with at least one example embodiment.
Figure 97:
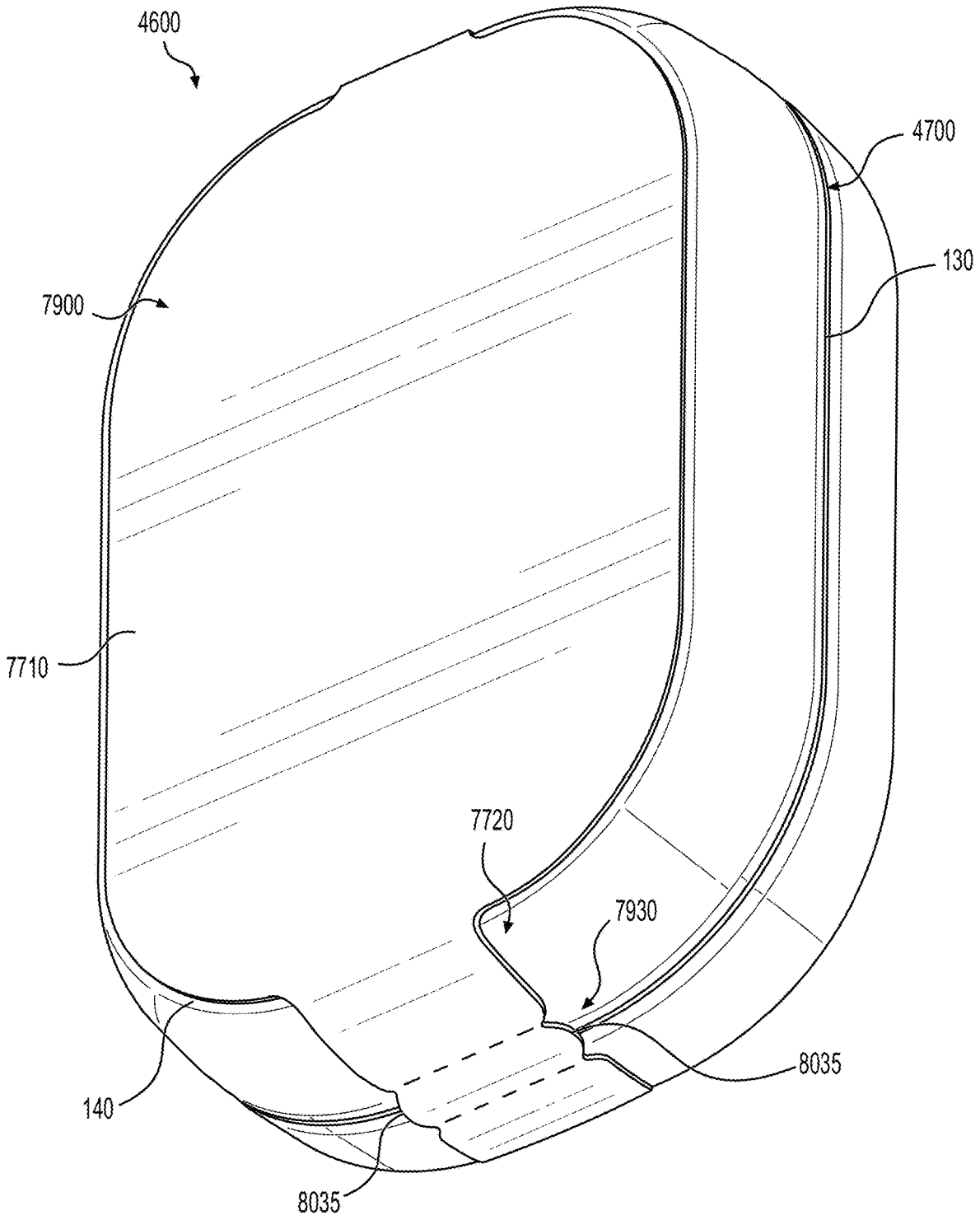
FIG. 97 is an illustration of a perspective view of a band on a package, in accordance with at least one example embodiment.

FIGS. 95-96 are illustrations of perspective views of the band 7900 positioned to be connected to a package, in accordance with at least one example embodiment. FIGS. 97-101 are illustrations of perspective and side views of the band 7900 on the outer container 100, in accordance with at least one example embodiment.

In at least one example embodiment, the band 7900 is connected to the outer container 100 in the same manner as the band 7700, with the following exceptions described herein. In at least one example embodiment, the tab 7765 is connected to the second side 7785 of the blank 7905 to form the band 7900 (see at least FIGS. 95 and 101). In at least another example embodiment, the tab 7765 is connected to the first side of the blank 7905 to form the band 7900. In at least one example embodiment, the tear strips 7930 are aligned with the seam 4700 of the outer container 100, while the wide panels 7710 are positioned to cover at least a portion of the flat major surfaces 140 of the outer container 100 (see at least FIGS. 97-98 and 101).

In at least one example embodiment, the band 7900 is not adhesively connected to the outer container 100. In at least another example embodiment, at least a portion of the second side 7785 of the band 7900 is connected to the outer container 100 using the temporary adhesive and/or the added adhesive. In at least one example embodiment, the first side 7780 and the second side 7785 of the band 7900 is interchangeable, such that the first side 7880 of the band 7900 can be connected to the outer container 100, once the band 7900 is on the outer container 100. In at least one example embodiment, the band 7900 hugs outer surfaces of the outer container 100, where the band 7900 hugs the rounded side edges 210 of the outer container 100 (see at least FIG. 101).

Figure 102:
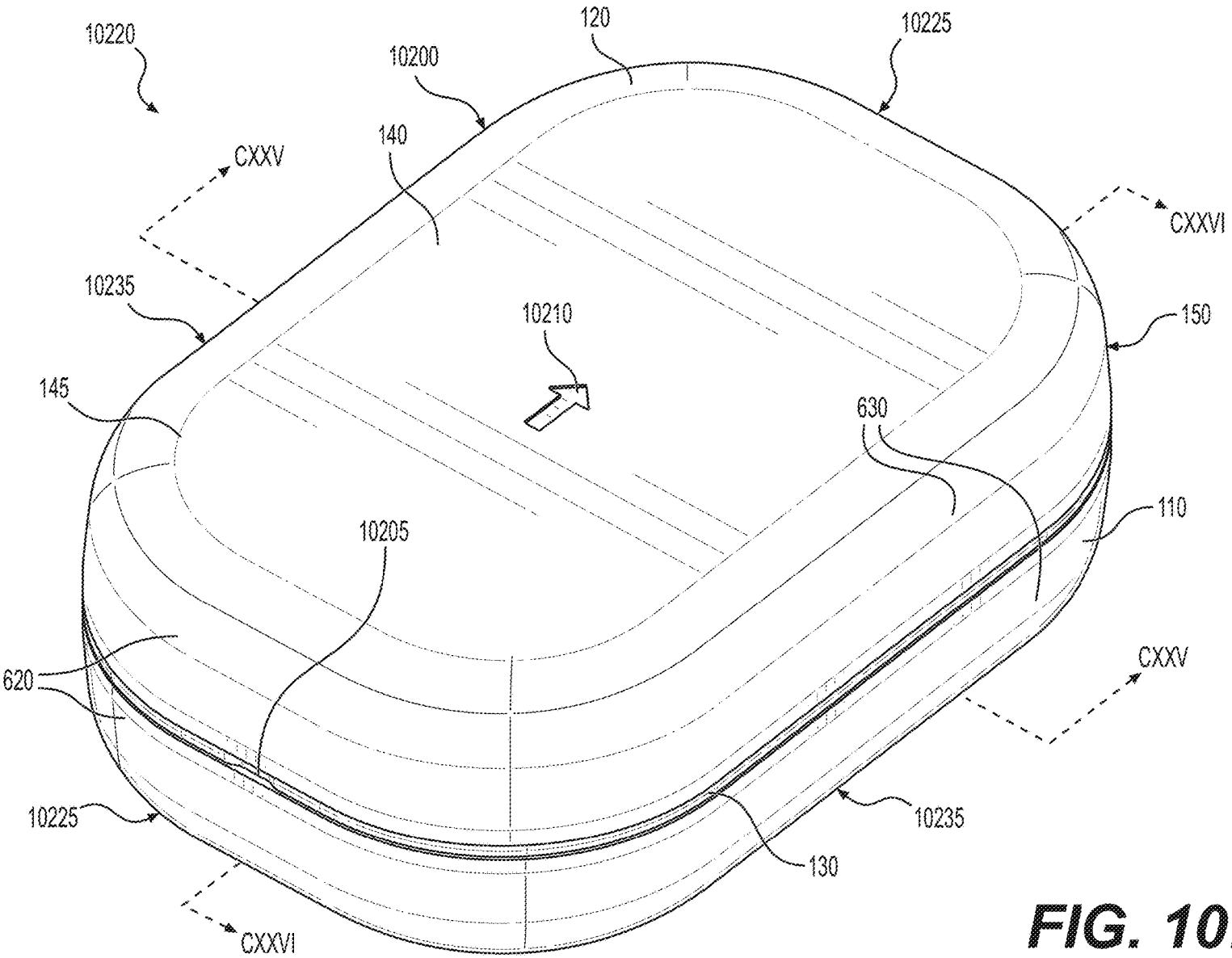
FIG. 102 is an illustration of a perspective view of an outer container for a package, in accordance with at least one example embodiment.
Figure 103:
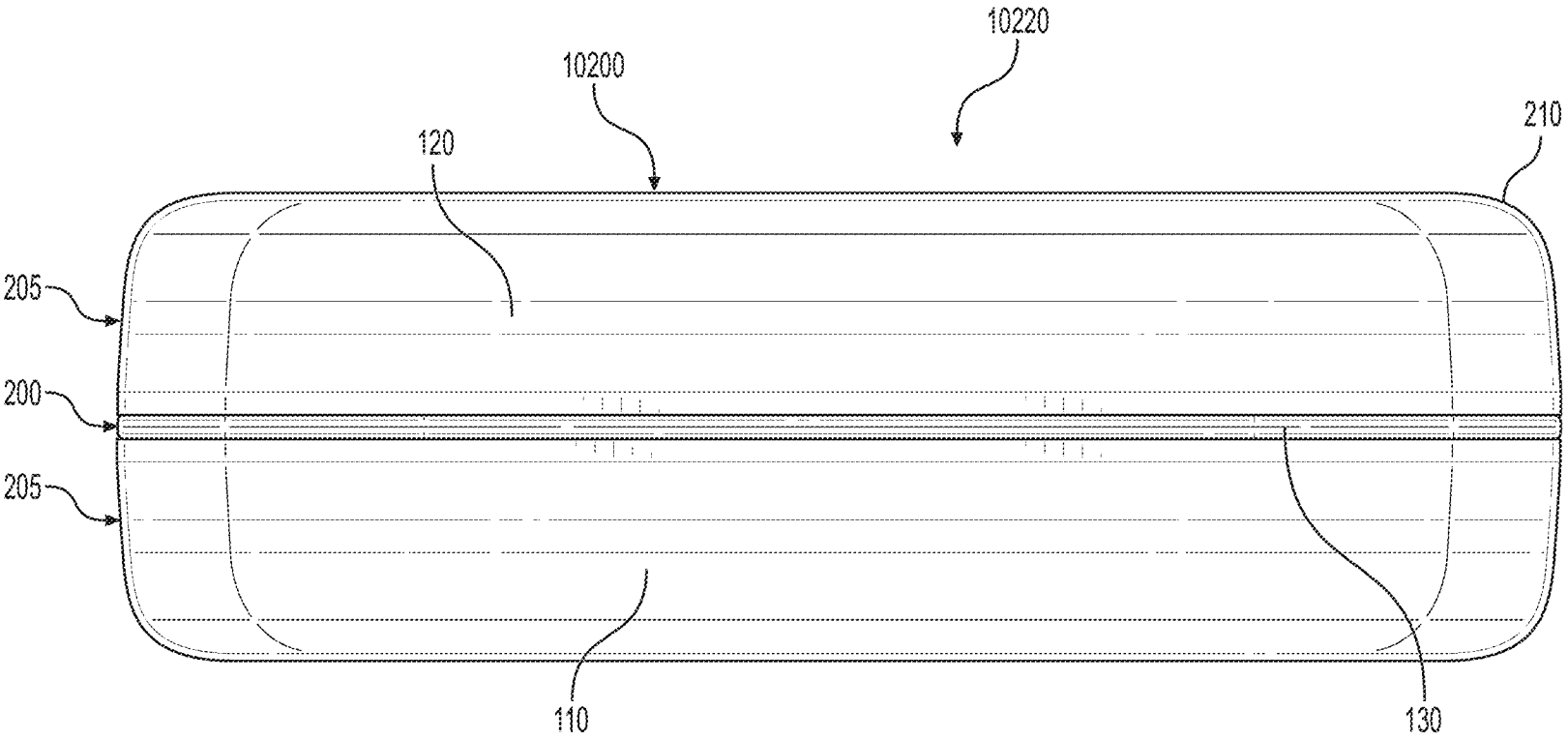
FIG. 103 is an illustration of a side view of the outer container, in accordance with at least one example embodiment.
Figure 104:
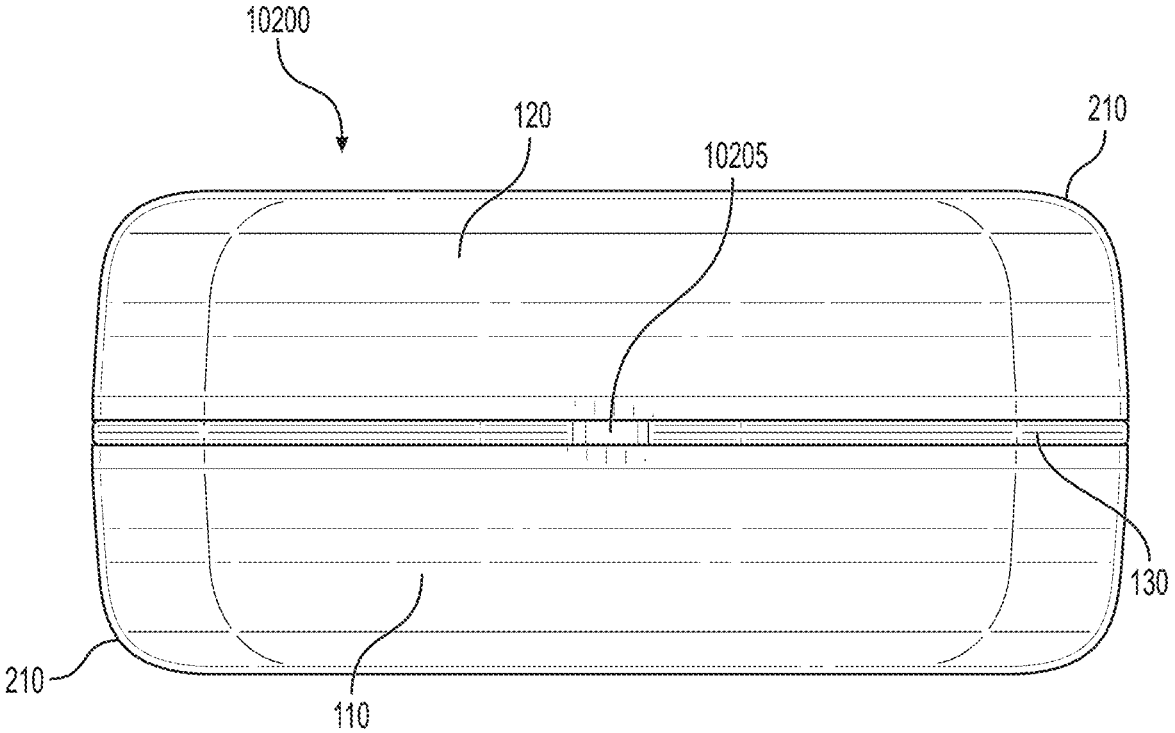
FIG. 104 is an illustration of a back view of the outer container, in accordance with at least one example embodiment.
Figure 105:
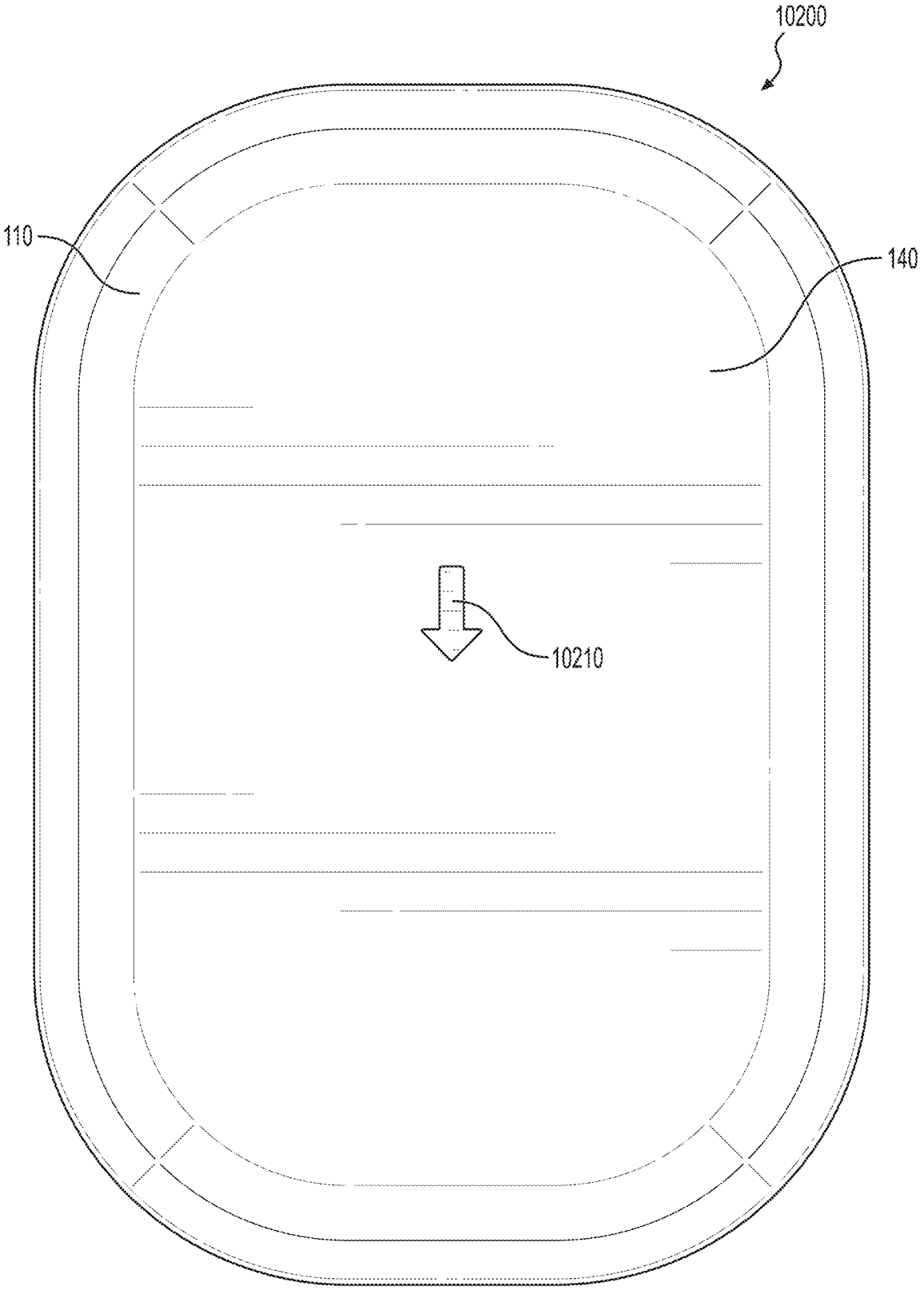
FIG. 105 is an illustration of a bottom view of the outer container, in accordance with at least one example embodiment.

FIG. 102 is an illustration of a perspective view of an outer container 10200 for a package 10220, in accordance with at least one example embodiment. FIG. 103 is an illustration of a side view of the outer container 10200, in accordance with at least one example embodiment. FIG. 104 is an illustration of a back view of the outer container 10200, in accordance with at least one example embodiment. FIG. 105 is an illustration of a bottom view of the outer container 10200, in accordance with at least one example embodiment.

In at least one example embodiment, the package 10220 is the same as the package 4600 (FIG. 46), with the following exceptions and/or clarifying discussion, herein. In at least one example embodiment, the ridge 130 includes a first indicia 10205. In at least one example embodiment, the first indicia 10205 and at least part of the ridge 130 is visible when the outer container 10200 is in a closed position and a first tray 10600 (FIG. 106) is being held within the outer container 10200. In at least one example embodiment, the first indicia 10205 is a mark, a notch, an indentation, or a combination thereof. In at least one example embodiment, the first indicia 10205 is a trademark, an emblem, a logo, a symbol and/or advertising information. In at least one example embodiment, the first indicia 10205 is located in a singular location along the ridge 130. In at least one example embodiment, the first indicia 10205 is located along one of the short ends 10225 of the package 10220, rather than along one of the long ends 10235 of the package 10220. In another example embodiment, the first indicia 10205 is located along one of the long ends 10235 of the package 10220. In at least one example embodiment, the first indicia is an arrow or another type of marker that signifies or represents a direction.

In at least one example embodiment, the first indicia 10205 is centered along one of the short ends 10225 of the package 10220, as shown in at least FIG. 102. In at least one example embodiment, the first indicia 10205 indicate an orientation of the first tray (upper tray) 10600 within the package 10220 (see the first tray 10600 in at least FIG. 106). In at least one example embodiment, the first indicia 10205 can confirm an orientation of the first tray 10600 within the outer container 10200, without the outer container 10200 needing to be opened.

In at least one example embodiment, the first section 110 and the second section 120 each include a second indicia 10210 (see at least FIGS. 102 and 105). In at least one example embodiment, the second indicia 10210 is an arrow, a marker, etc. In at least one example embodiment, the second indicia 10210 is a trademark, an emblem, a logo, a symbol and/or advertising information. In at least one example embodiment, the second indicia 10210 signifies or represents a direction (such as the arrow, shown as an example, in at least FIGS. 102 and 105). In another example embodiment, the second indicia 10210 does not signify or represent a direction. In at least one example embodiment, the second indicia is included on the flat major surface 140 of the first section 110 and the second section 120. In at least another embodiment, the second indicia 10210 is on an outer surface of the sidewalls of the outer container 10200, on either the short ends 10225 or the long ends 10235 of the package 10220.

In at least one example embodiment, the first indicia 10205 and/or the second indicia 10210 can be used during an assembly, labelling, distribution and/or display of the package 10220 to ensure that the first tray 10600 is oriented properly within the package 10220 and labeling is properly applied to the package 10220. In at least one example embodiment, the first indicia 10205 and/or the second indicia 10210 are used to ensure that one of the bands (e.g., the band 7700 of FIG. 77A, the band 7800 of FIG. 78A and/or the band 7900 of FIG. 79A) are properly connected to the package 10220, where labeling or indicia on the bands are properly oriented relative to an orientation of the first tray 10600 within the package 10220. In at least one example embodiment, the first indicia 10205 and/or the second indicia 10210 can provide instructions during an assembly and/or labeling of the package 10220, where for instance the first indicia 10205 can signify a starting location to connect one of the bands to the package 10220, or the first indicia 10205 signify a location for one of the tear strips for one of the bands (e.g., the tear strip 7730 of FIGS. 77A and 78A, or the tear strip 7930 of FIG. 79A). In at least one example embodiment, during an assembly of the package 10220, the alignment notches 7910 of the band 7900 (FIG. 79B) may be initially positioned over the first indicia 10205, where second indicia 10210 signifies or represents a direction with which a remainder of the band 7900 is to be wrapped around the package 10220, prior to the band 7900 being secured onto the package 10220.

Figure 106:
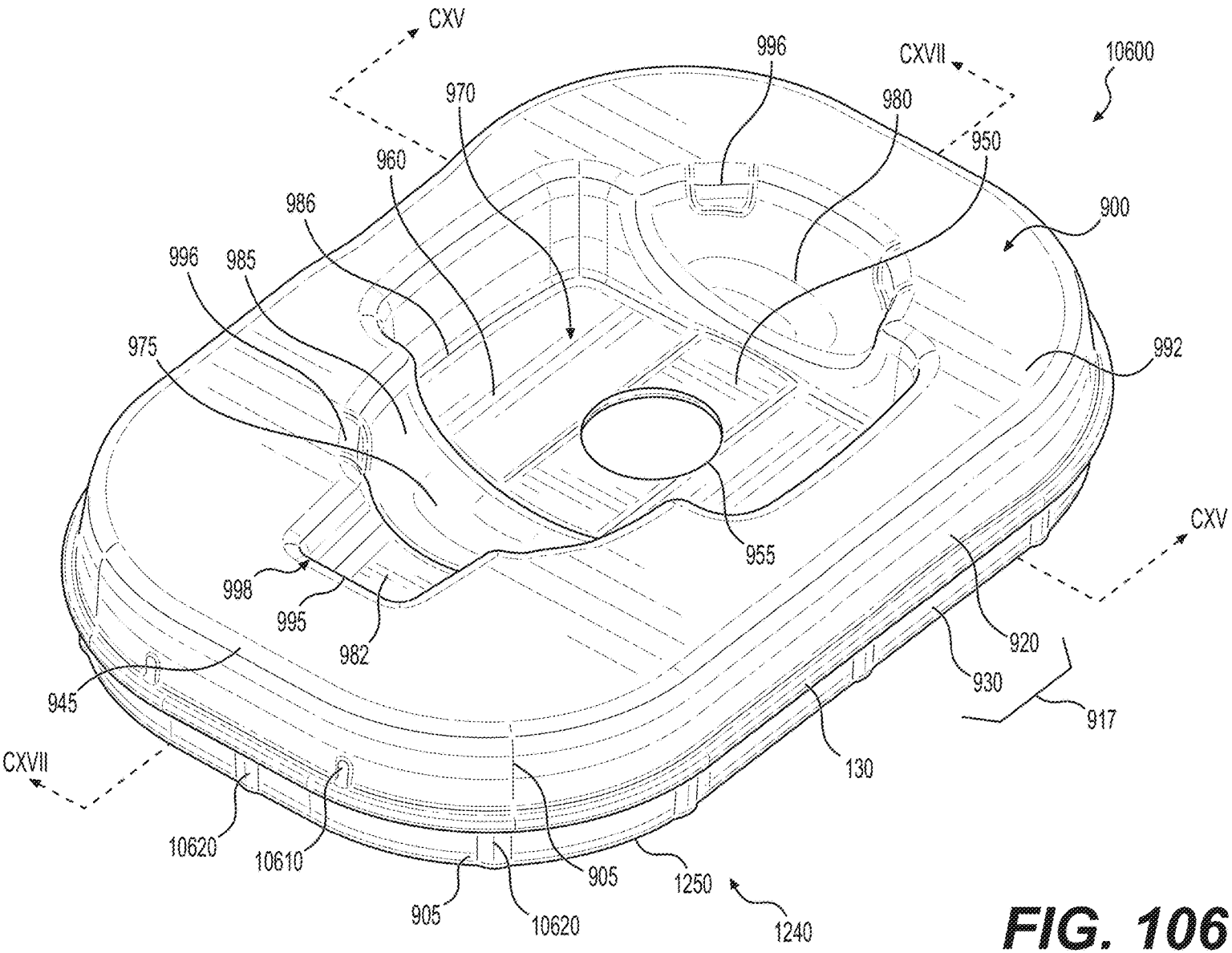
FIG. 106 is an illustration of a perspective view of a first tray of the package, in accordance with at least one example embodiment.
Figure 107:
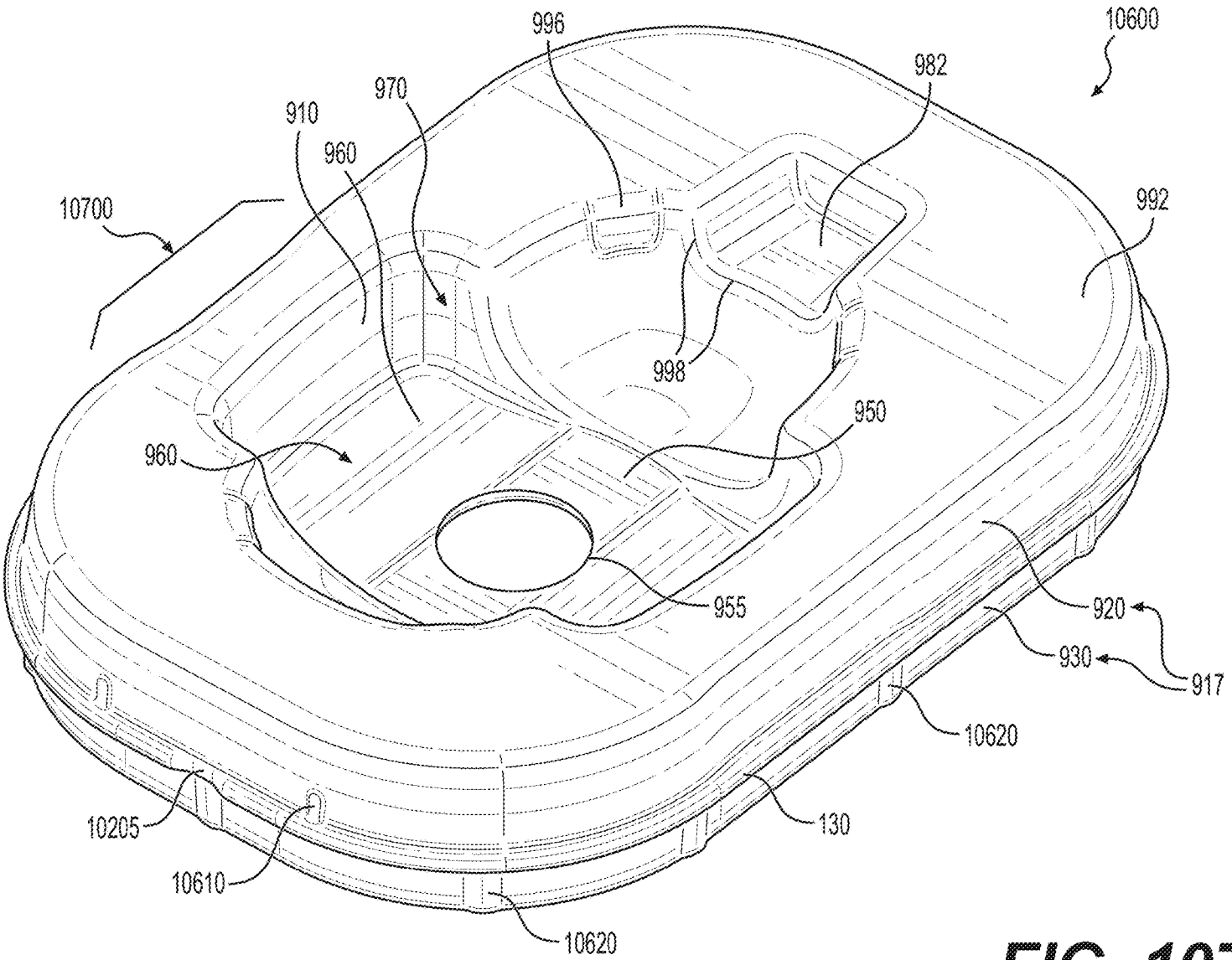
FIG. 107 is an illustration of another perspective view of the first tray, in accordance with at least one example embodiment.

FIG. 106-107 are illustrations of perspective views of the first tray 10600 of the package 10220, in accordance with at least one example embodiment. FIGS. 108-112 are illustrations of a top, bottom perspective, back, and side views of the first tray 10600, in accordance with at least one example embodiment.

In at least one example embodiment, the first tray 10600 is the same as the first tray 500 (FIG. 9), with the following exceptions and/or clarifying discussion, herein. In at least one example embodiment, the sidewalls (first vertical sidewalls) 917 of the first tray 10600 define indentations 10700 (see FIGS. 107, 108A, 110 and 112, in particular). In at least one example embodiment, the indentations 10700 assist in an initially opening, and/or a re-opening, of the package 10220, as explained in more detail herein. In at least one example embodiment, the upper sidewalls 920 of the first tray 10600 define the indentations 10700. In at least one example embodiment, the indentations 10700 include a pair of indentations 10700 that oppose each other on the first tray 10600, where opposing portions of the upper sidewalls 920 converge towards each other at a location of the indentations 10700 (see FIG. 108A in particular). In at least one example embodiment, the indentations 10700 run along a portion of a longitudinal length of the upper sidewalls 920 and are positioned to be near a midsection of sides 10850 of the first tray 10600 (see FIG. 108A). In at least another example embodiment, the indentations 10700 are located on ends 10840 of the first tray 10600 (see FIG. 108A), or on both the ends 10840 and the sides 10850 of the first tray 10600. In at least one example embodiment, a longitudinal length of the sides 10850 of the first tray 10600 are longer than a longitudinal length of the ends 10840 of the first tray 10600. In another example embodiment, the longitudinal length of the sides 10850 are equal to the longitudinal length of the ends 10840. In another example embodiment, the longitudinal length of the sides 10850 are shorter than the longitudinal length of the ends 10840.

Figure 108A:
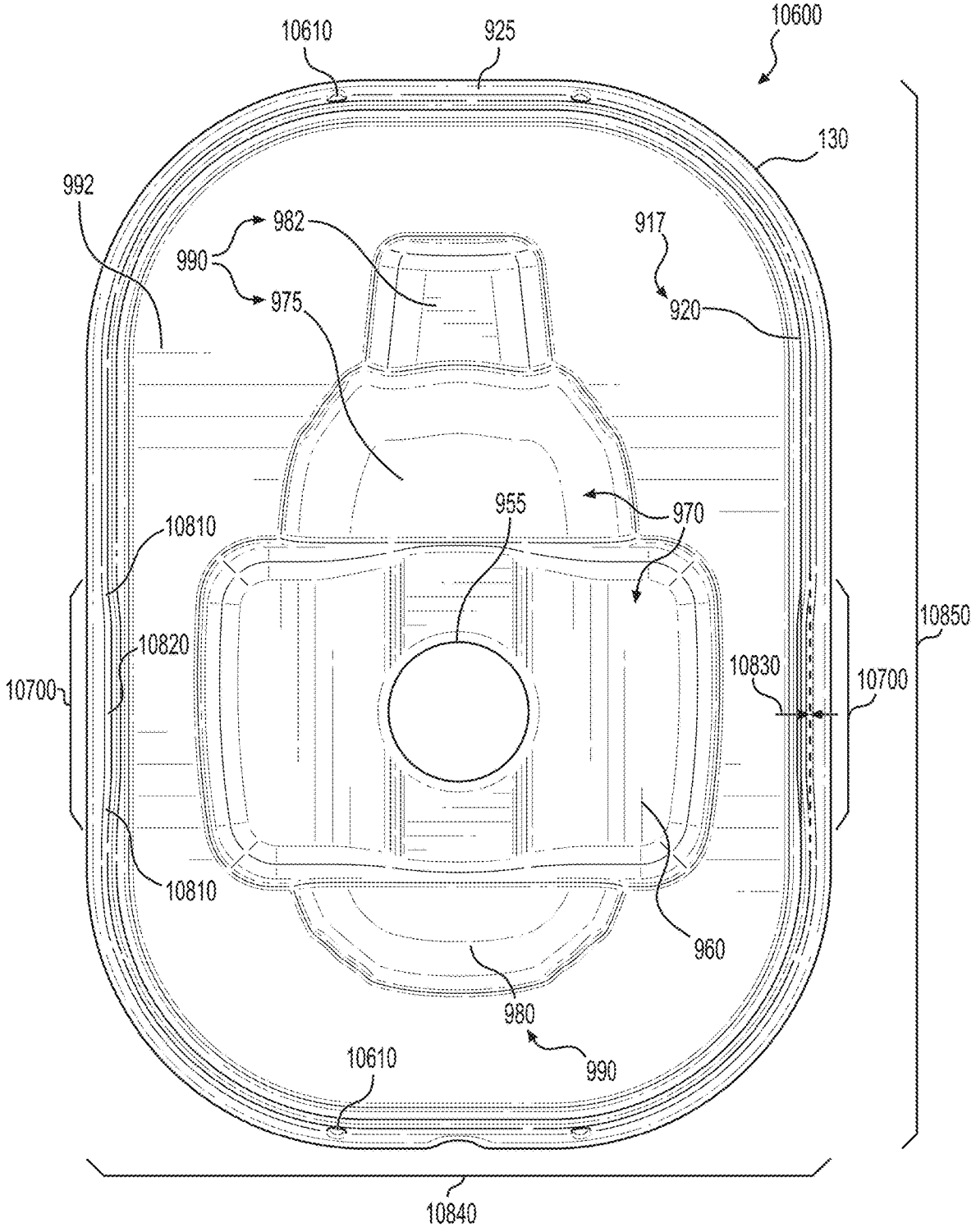
FIG. 108A is an illustration of a top view of the first tray, in accordance with at least one example embodiment.

In at least one example embodiment, each of the indentations 10700 include a pair of arced portions 10810 of the upper sidewalls 920 on ends of the indentations 10700, and a flat (planar) portion 10820 of the upper sidewalls 920 at a midsection of the indentations 10700, as shown in at least FIG. 108A. In at least one example embodiment, a first offset distance 10830 between the flat portion 10820 and a remainder of an outer surface of the upper sidewalls 920 (as shown in FIG. 108A) is about 0.2 mm to 3.0 mm, or about 0.3 mm to about 1.5 mm, or about 0.5 to 1.0 mm.

In at least one example embodiment, the indentations 10700 are located near an upper portion of the upper sidewalls 920. In at least one example embodiment, the upper surface 992 of the first tray 10600 also defines the indentations 10700, where an elevation of the upper surface 992 is lower than a remainder of the upper surface 992 at a location of the indentations 10700 (see at least FIGS. 110 and 112). In at least one example embodiment, a second offset distance 11220 (see FIG. 112) between an upper surface of a midsection of the indentation 10700, and a remainder of a flat planar surface of the upper surface 992 of the first tray 10600, is about equal to the first offset distance 10830.

In at least one example embodiment, the indentations 10700 provide a gap 12510 (FIG. 125) between the first tray 10600 and the second section 120 that helps reduce a vacuum force that may otherwise resist a removal of the second section 120 from a top of the package 10220 during an initial opening, or a re-opening, of the package 10220. In at least one example embodiment, more than two of the indentations 10700 are defined by the upper sidewalls 920.

In at least one example embodiment, the upper sidewalls 920 of the first tray 10600 define upper lugs 10610 (see at least FIGS. 106, 107 and 108A). In at least one example embodiment, the upper lugs 10610 extend from the ridge 130 towards the upper surface 992 of the first tray 10600. In at least one example embodiment, the upper lugs 10610 are on the ends 10840 of the first tray 10600 (see FIG. 108A). In at least one example embodiment, the upper lugs 10610 are on the sides 10850 of the first tray 10600 (not shown). In at least one example embodiment, the upper lugs 10610 can be dispersed along the upper sidewalls 920, on either or both of the ends 10840 and the sides 10850 of the first tray 10600. In at least one example embodiment, the upper lugs 10610 help reduce a vacuum force between the first tray 10600 and the second section 120 that may otherwise resist a removal of the second section 120 from a top of the package 10220 during an initial opening, or a re-opening, of the package 10220.

Figure 108B:
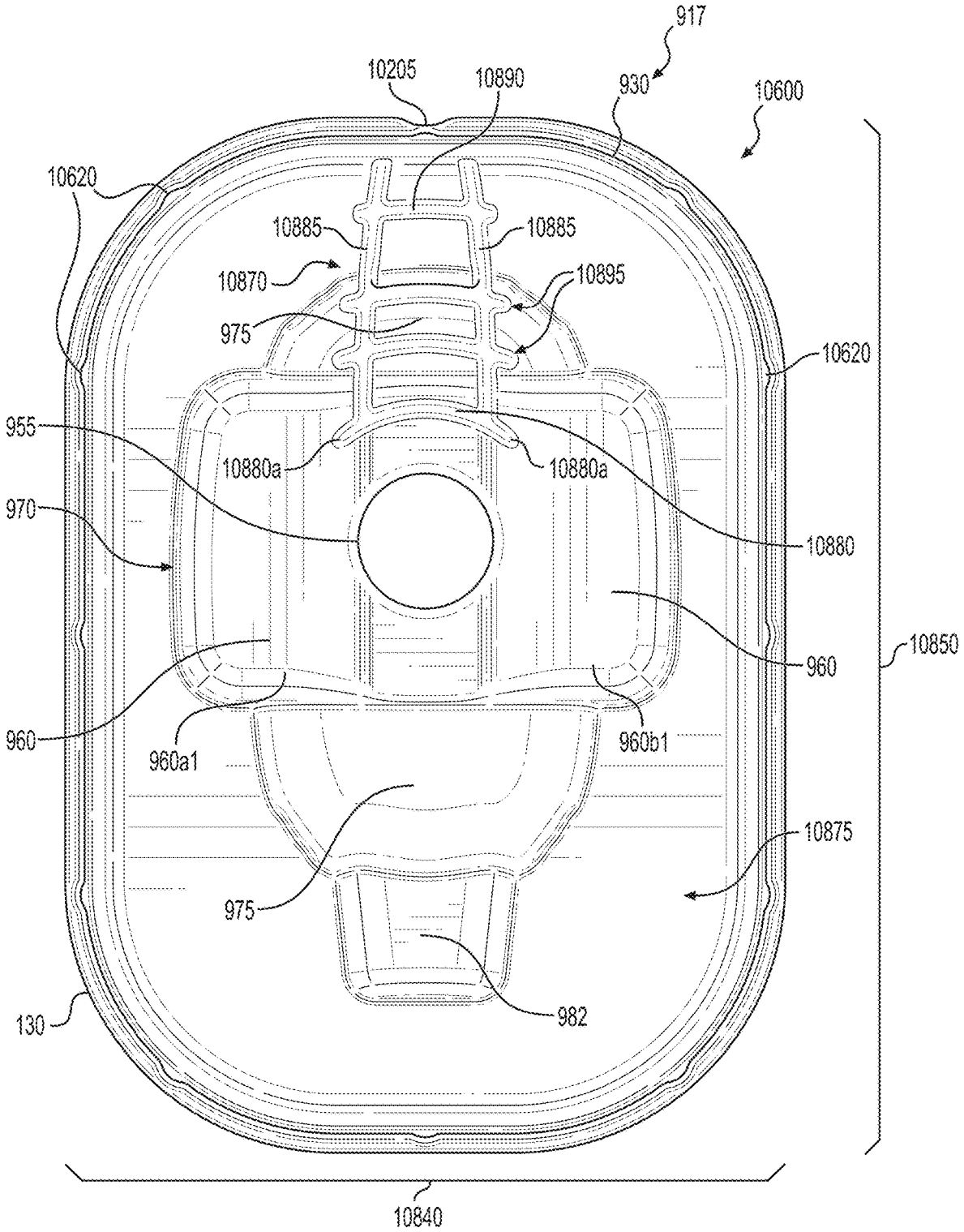
FIG. 108B is an illustration of a bottom view of the first tray, in accordance with at least one example embodiment.
Figure 109:
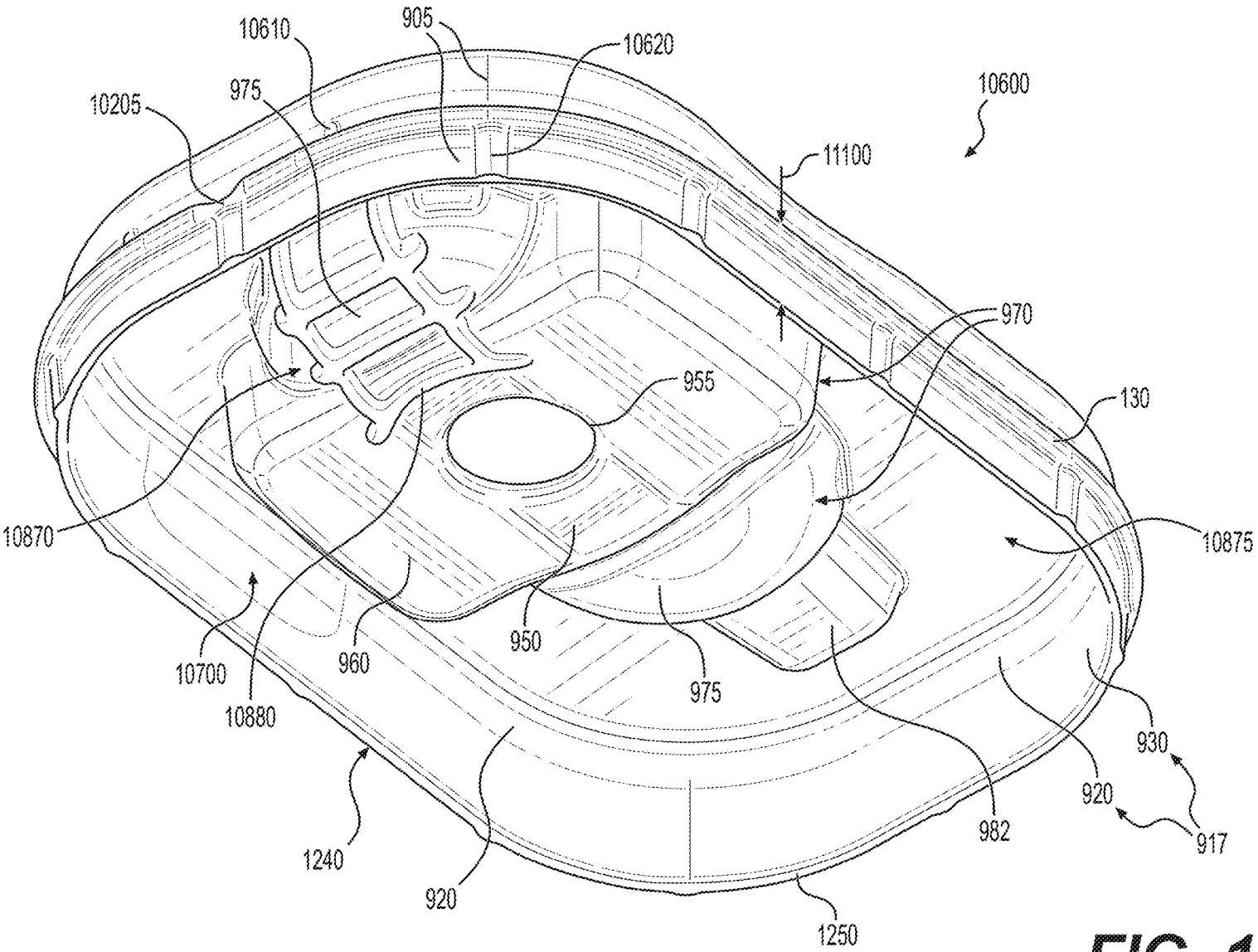
FIG. 109 is an illustration of a bottom, perspective view of the first tray, in accordance with at least one example embodiment.

In at least one example embodiment, the lower sidewalls 930 of the first tray 10600 define lower lugs 10620 (see at least FIGS. 106, 107 and 108B). In at least one example embodiment, the lower lugs 10620 extend from the ridge 130 toward the distal end 1250 of the skirt 1240 of the first tray 10600. In at least one example embodiment, the lower lugs 10620 extend from the ridge 130 down to the distal end 1250 of the skirt 1240 of the first tray 10600. In at least one example embodiment, the lower lugs 10620 are dispersed along the lower sidewalls 930, on either or both of the ends 10840 and the sides 10850 of the first tray 10600 (see FIG. 108B). In at least one example embodiment, at least some of the lower lugs 10620 are positioned on the rounded corners 905 of the sidewalls 917 (FIG. 106). In at least one example embodiment, the lower lugs 10620 help reduce a vacuum force between the first tray 10600 and the first section 110 that may otherwise resist a removal of the first tray 10600 from the package 10220 during an opening of the package 10220.

In at least one example embodiment, a lower interior surface 10875 of the first tray 10600 defines a reinforcing structure 10870 (FIG. 108B) on a bottom portion of the first tray 10600 (where the lower interior surface 10875 is a bottom surface of the first tray 10600 that is within the confines of the sidewalls 917). In at least one example embodiment, the reinforcing structure 10870 can include corrugations or a corrugated surface, ribs, or combinations thereof. In at least one example embodiment, the reinforcing structure 10870 includes ribs that include one or more longitudinal segments 10885, with crosspiece segments (shorter segments) 10890 can span between or across the longitudinal segments 10855. In at least one example embodiment, the reinforcing structure 10870 includes a pair of the longitudinal segments 10855, where the crosspiece segments 10890 span between the longitudinal segments 10855. In at least one example embodiment, the pair of the longitudinal segments 10855 are approximately parallel to each other, with the crosspiece segments 108900 being approximately perpendicular to the longitudinal segments 10855. In at least one example embodiment, the crosspiece segments 10890 include distal ends 10895 that extend beyond the longitudinal segments 10885, as shown in at least FIG. 108B.

In at least one example embodiment, the reinforcing structure 10870 is located under at least a portion of the depression (impression) 970 of the first tray 10600. In at least one example embodiment, the reinforcing structure 10870 is under at least a portion of the first half-bowl 975 and the floor 960 of the depression 970. In at least one example embodiment, the reinforcing structure 10870 is under at least a portion of the floor 960. In at least one example embodiment, the reinforcing structure 10870 is under at least a portion of the first half-bowl 975 and/or the floor 960 of the depression 970. In at least one example embodiment, the reinforcing structure 10870 helps support a weight of the consumer product 1600 within the depression 970 (see FIG. 113), where the reinforcing structure 10870 can reduce an overall use of materials to form the first tray 10600, and/or reduce a use of material to form the upper wall 900 and the lower interior surface 10875 that defines the depression 970 (see FIGS. 106 and 108B).

In at least one example embodiment, the reinforcing structure 10870 includes a first crosspiece segment 10880 on an end of the reinforcing structure 10870. In at least one example embodiment, the first crosspiece segment 10880 is at an elevation that is at least as low as a remainder of the lower interior surface 10875 (see at least FIGS. 110, 123, 124 and 126), as described in more detail herein in relation to FIGS. 121B and 123.

Figure 110:
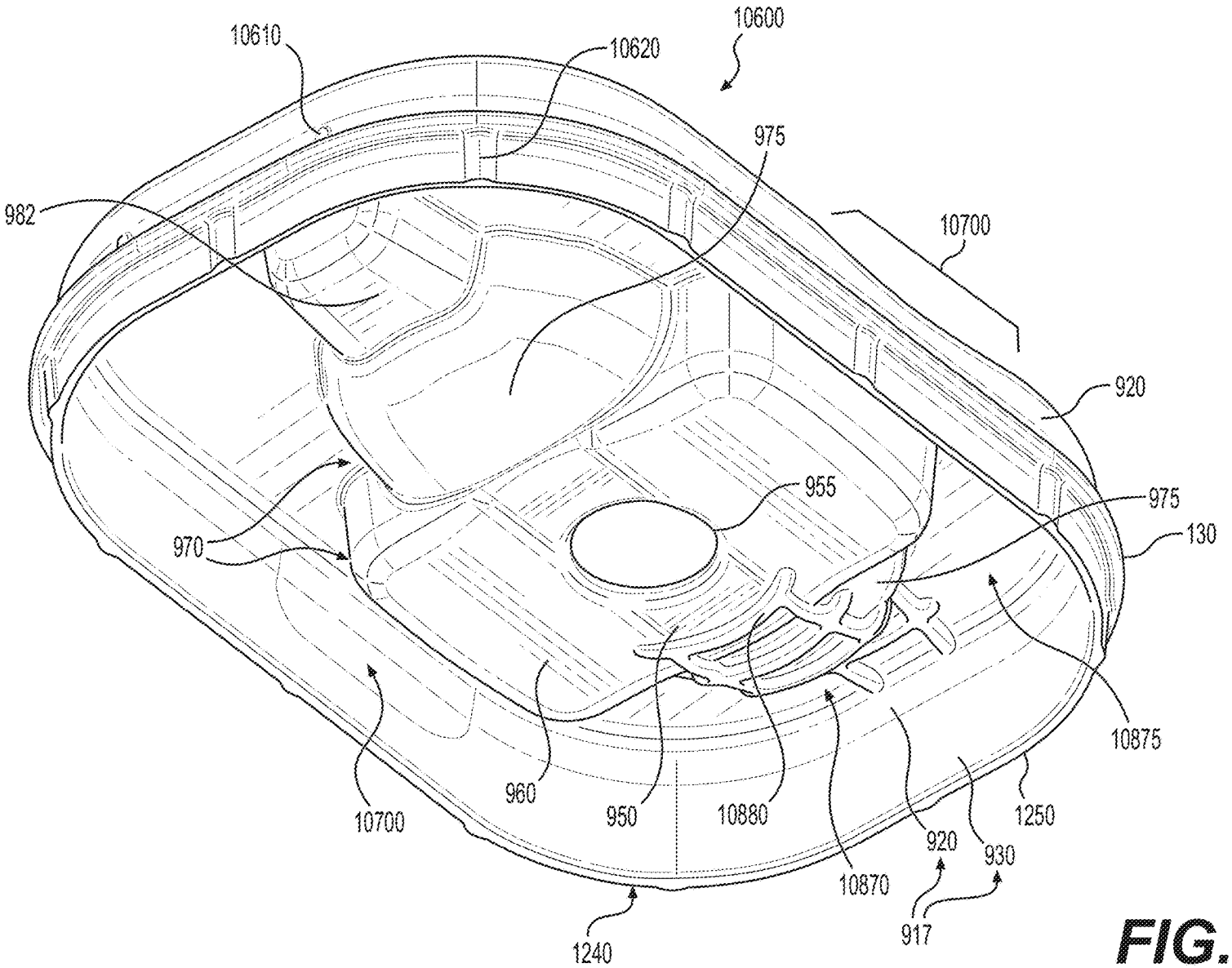
FIG. 110 is an illustration of another bottom, perspective view of the first tray, in accordance with at least one example embodiment.
Figure 111:
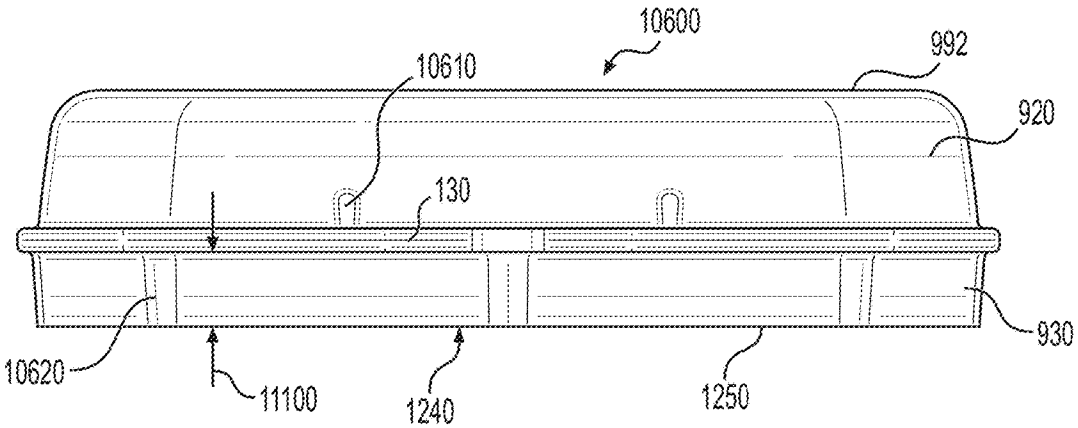
FIG. 111 is an illustration of a back view of the first tray, in accordance with at least one example embodiment.
Figure 112:
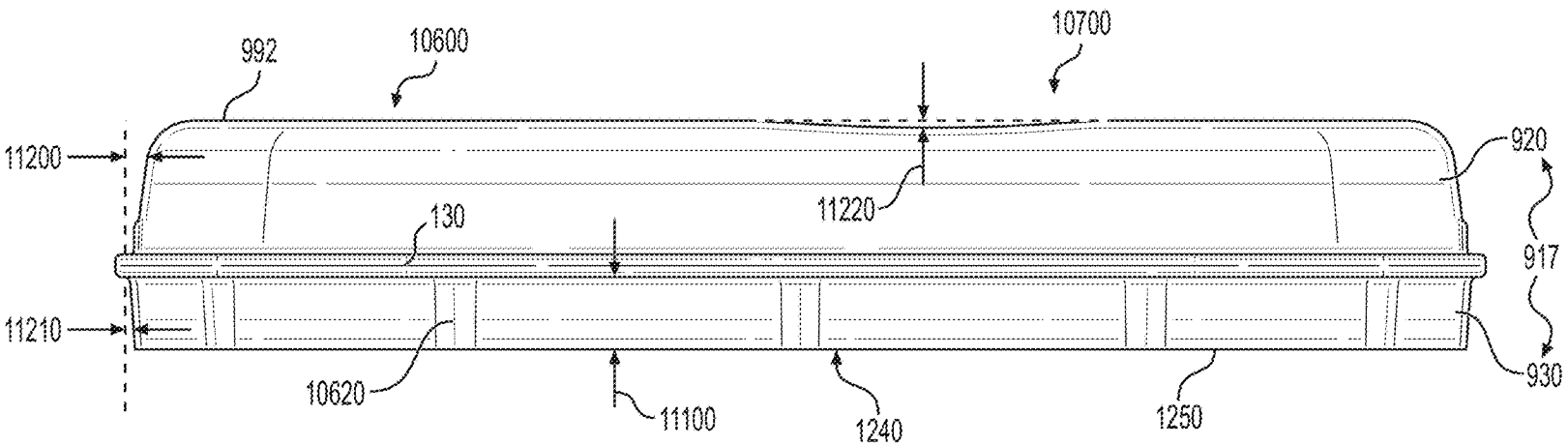
FIG. 112 is an illustration of a side view of the first tray, in accordance with at least one example embodiment.

In at least one example embodiment, a depth 11100 of the skirt 1240 of the first tray 10600 is a uniform (same) depth, around a periphery of the first tray 10600 (see at least FIGS. 110-112). In at least one example embodiment, the skirt 1240 forms a uniform (same) gap 12100 between a ridge 12010 of a second tray 12000 and the distal end 1250 of the skirt 1240, around the periphery of the first tray 10600 and the second tray 12000, when the first tray 10600 is sitting on the second tray 12000 (see at least FIGS. 121A and 122).

In at least one example embodiment, a gap 12110 exists between an interior surface of the sidewalls 917 of the first tray 10600 and an exterior surface of the sidewalls 2340 of the second tray 12000, around a periphery of the first tray 10600 and the second tray 12000 (see FIGS. 121B, 124 and 123). In at least one example embodiment, the sidewalls 917 of the first tray 10600 remain somewhat "suspended" above the ridge 12010 and the sidewalls 2340 of the second tray 12000, as explained more herein.

In at least one example embodiment, the upper sidewalls 920 of the first tray 10600 are sloped inwards (FIG. 112), from the ridge 130 to the upper surface 992. In at least one example embodiment, the upper sidewalls 920 are sloped to match a slope of an interior surface of the walls 610/620 of the second section 120 (see FIGS. 6-8), where an upper portion of the upper sidewalls 920 have an offset distance 11200 that deviates from vertical (vertical being plum with gravity), as shown in at least FIG. 112. In at least one example embodiment, the lower sidewalls 930 are sloped inwards (FIG. 112), from the ridge 130 to the distal end 1250 of the skirt 1240. In at least one example embodiment, the lower sidewalls 930 are sloped to match a slope of the interior surface of the walls 610/620 of the first section 110 (see FIGS. 6-8), where a lower portion of the lower sidewalls 930 have an offset distance 11210 that deviates from vertical (vertical being plum with gravity), as also depicted in FIG. 112. In at least one example embodiment, the lower sidewalls 930 are sloped to cause at least an interior surface of the lower sidewalls 930 to mate with an exterior surface of the sidewalls (second vertical sidewalls) 2340 of the second tray 12000, where an exterior surface of the sidewalls 2340 are also sloped (see at least FIGS. 121B, 123, 124 and 126).

Figure 113:
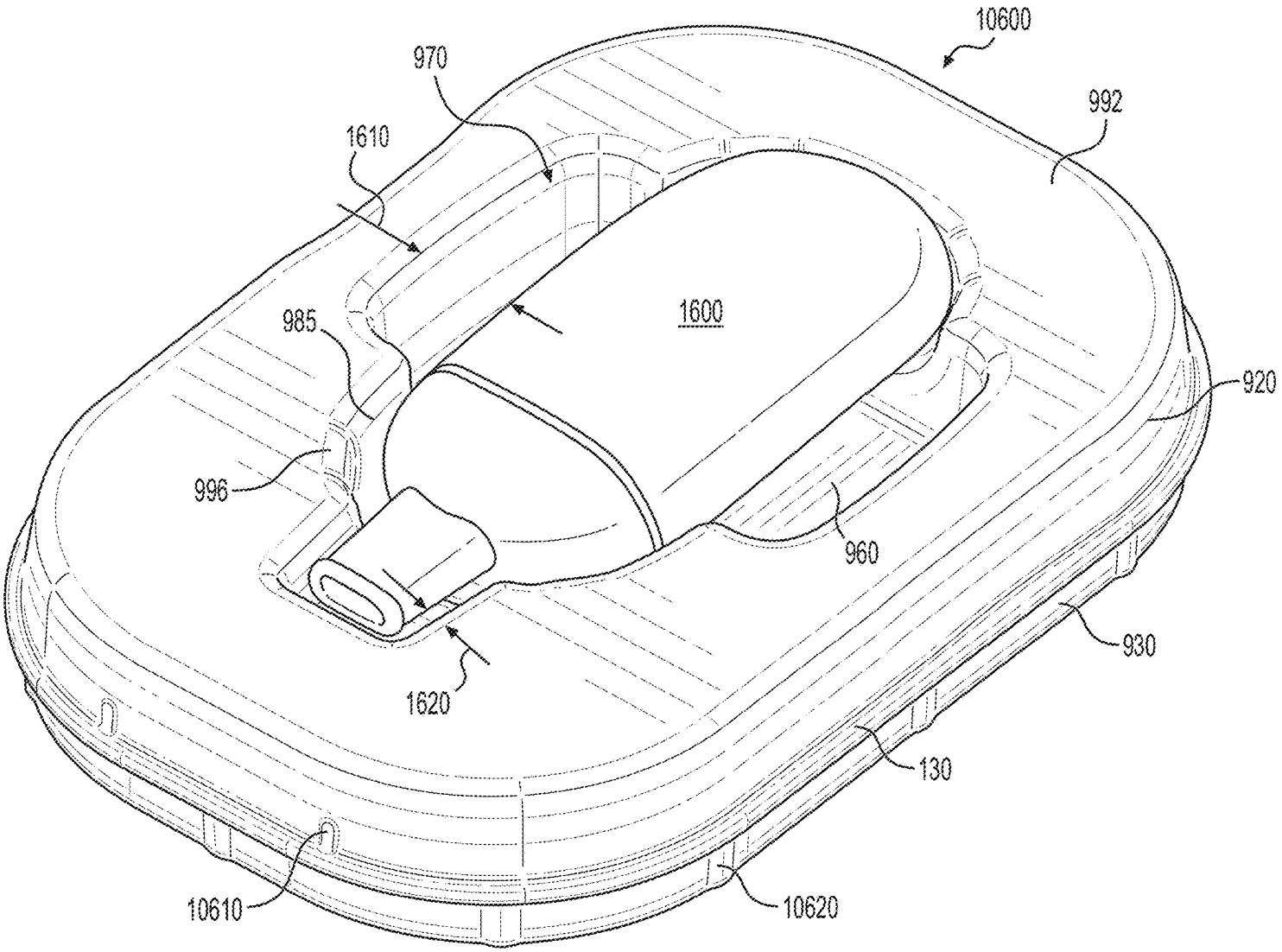
Figure 114:
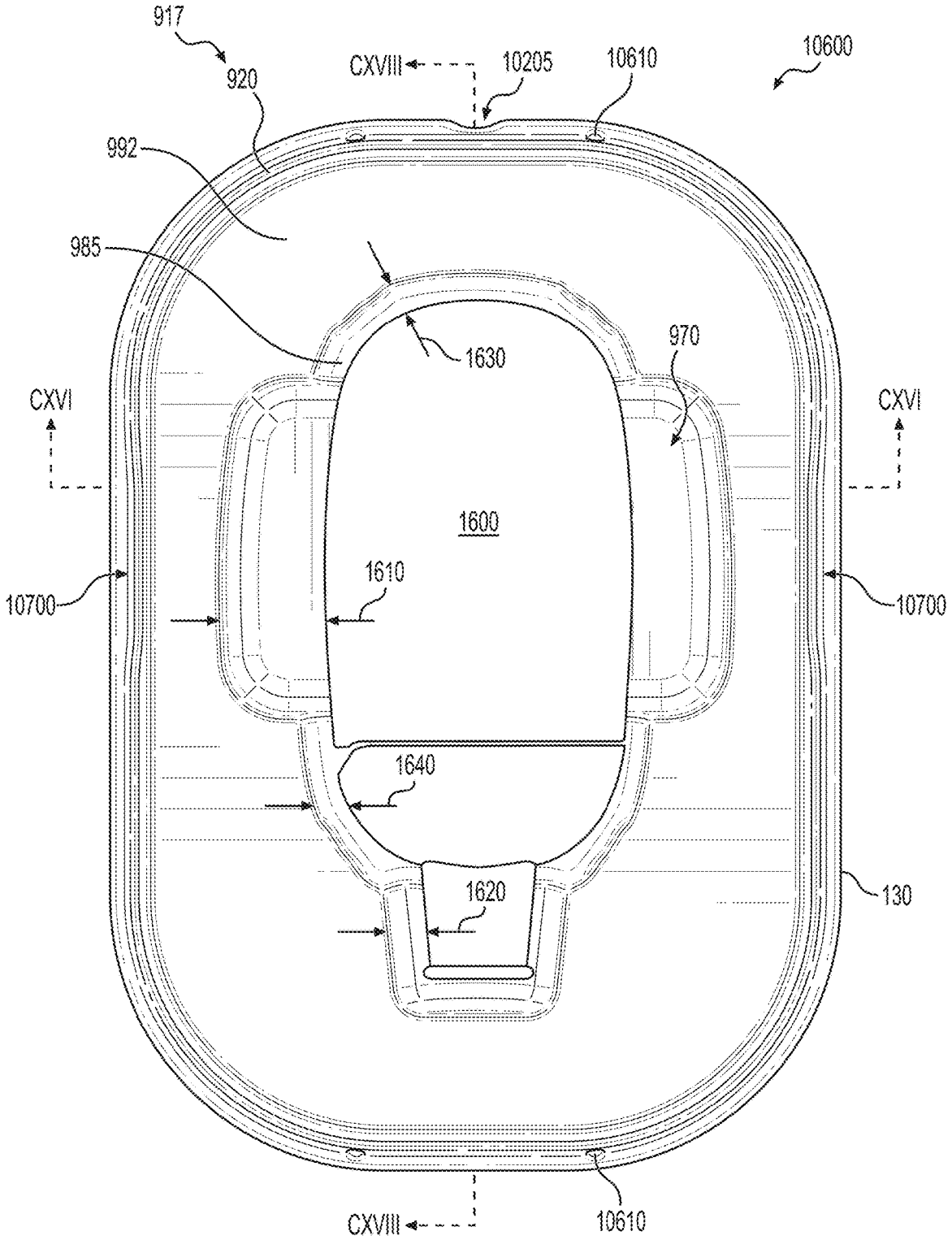
Figure 115:
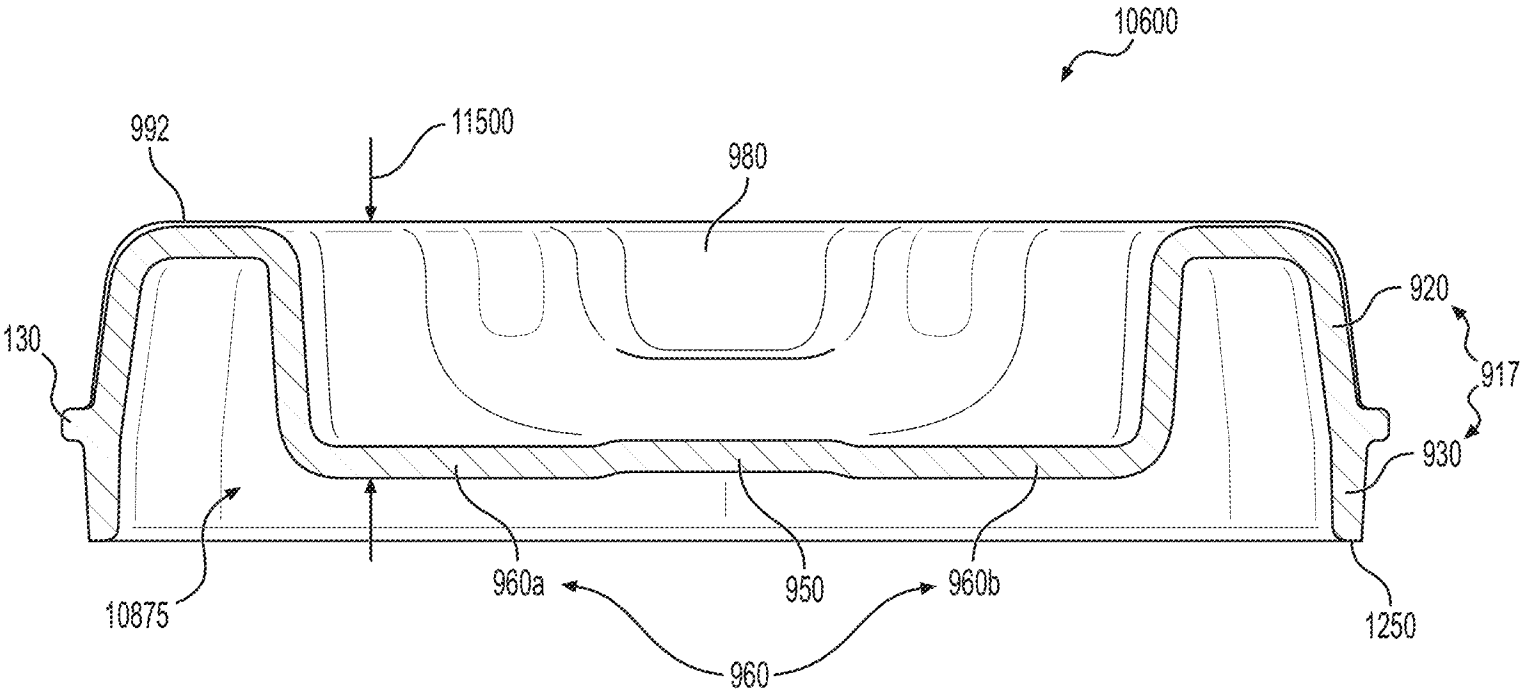
Figure 116:
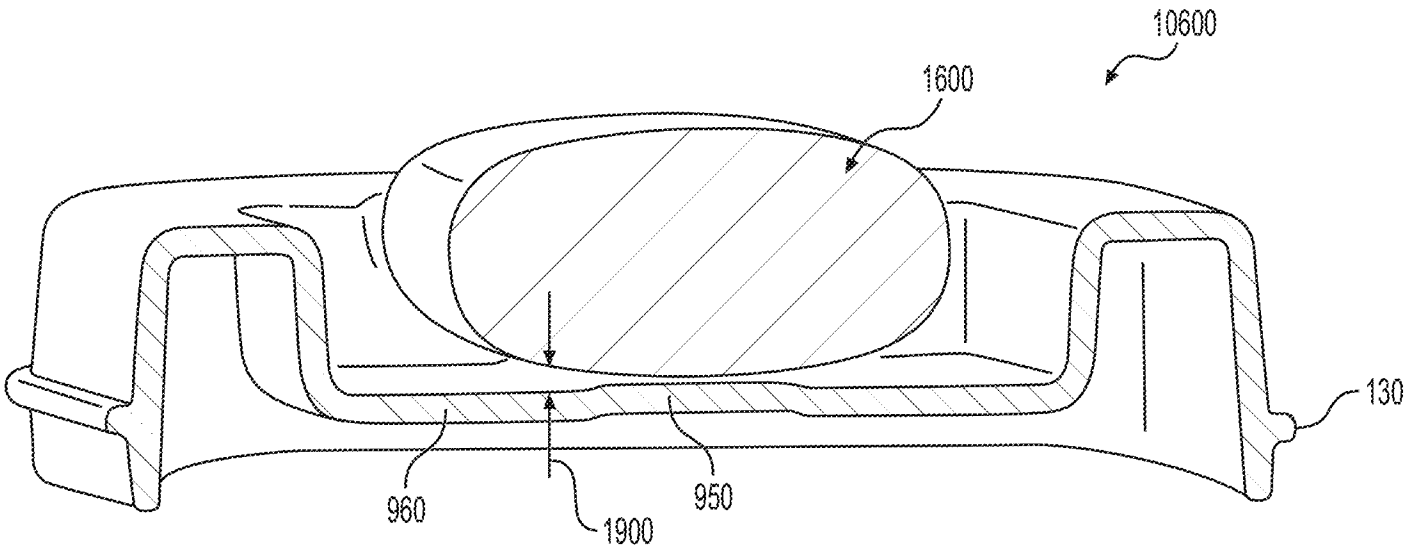
Figure 117:
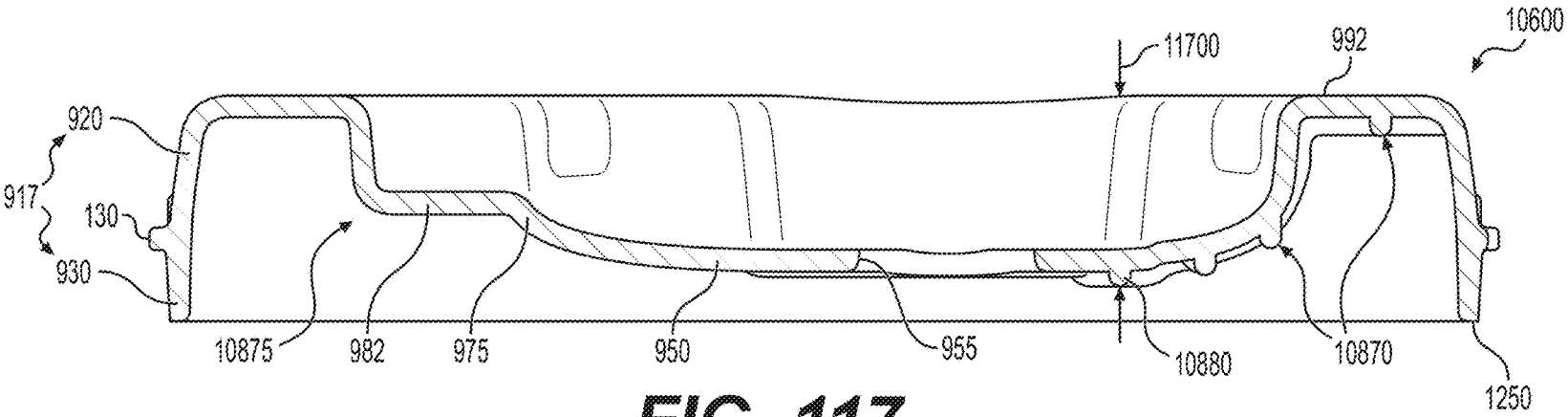
Figure 118:
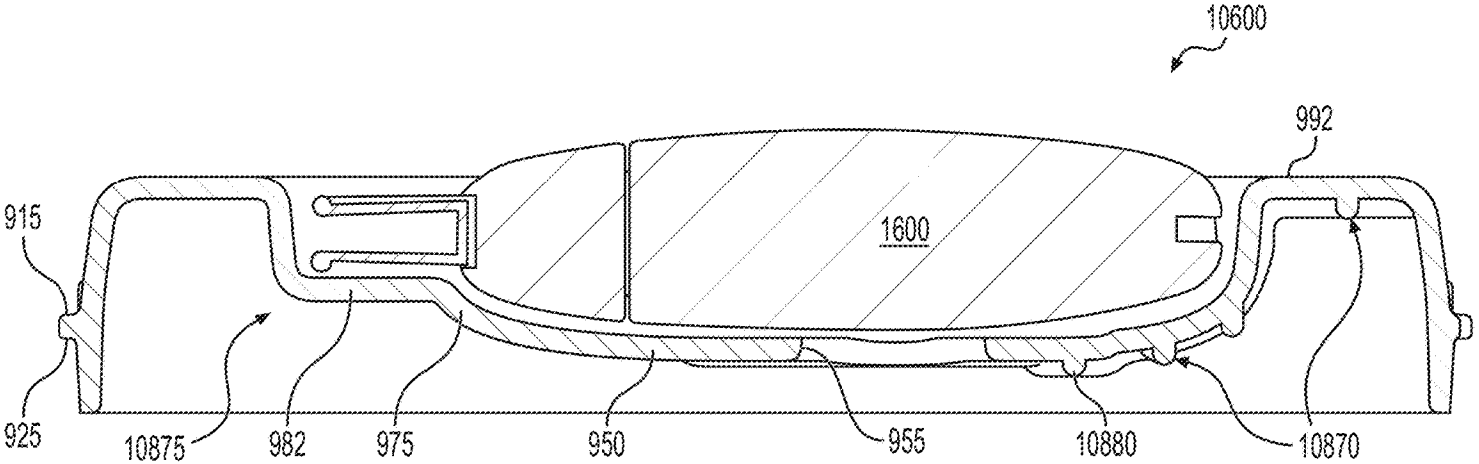
Figure 119:
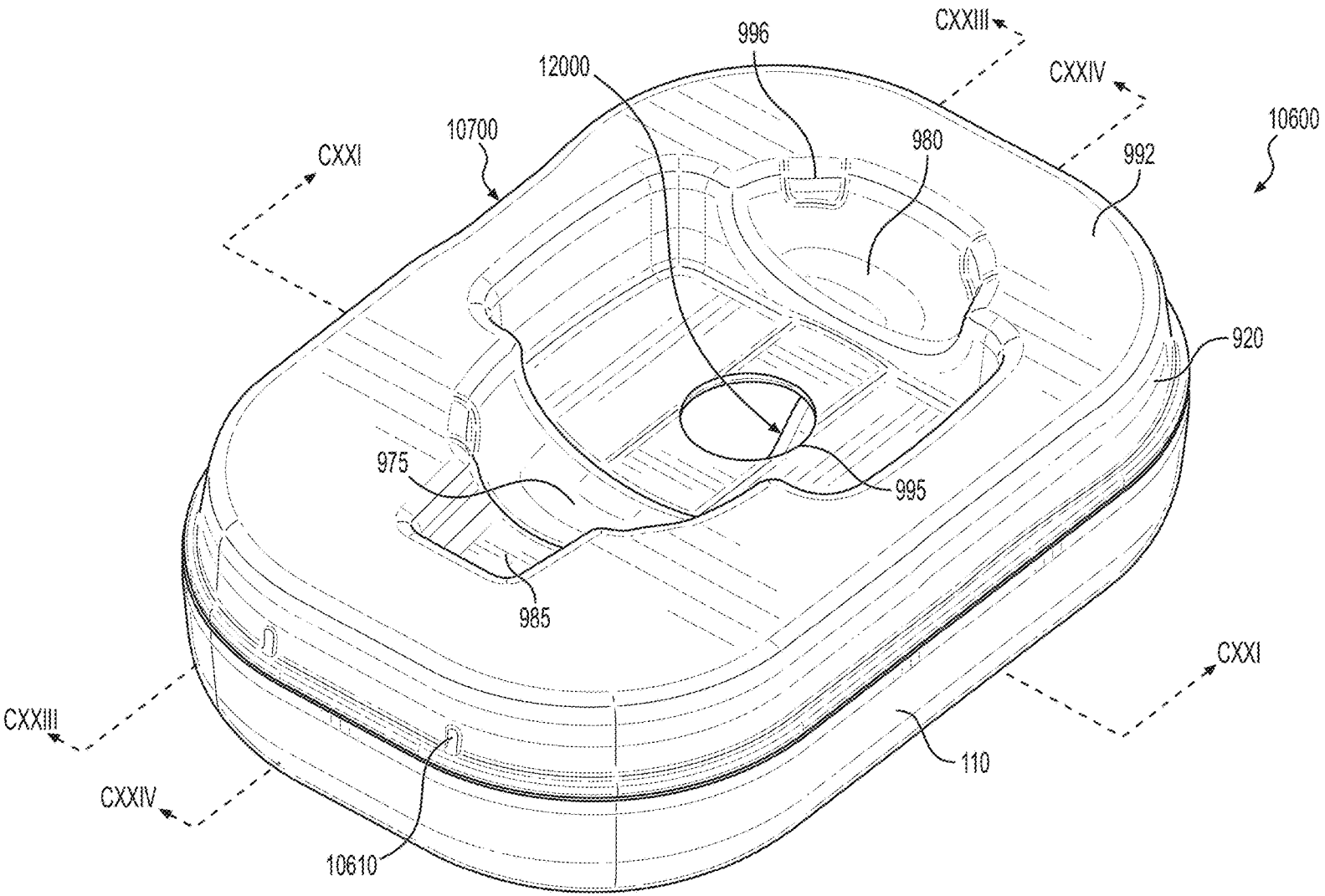

FIGS. 113-114 are illustrations of perspective views of the first tray 10600 holding the consumer product 1600, in accordance with at least one example embodiment. FIG. 115 is an illustration of a cross-section view of the first tray 10600 (view CXV-CXV of FIG. 106), in accordance with at least one example embodiment. FIG. 116 is an illustration of a cross-section view of the first tray 10600 holding the consumer product 1600 (view CXVI-CXVI of FIG. 114), in accordance with at least one example embodiment. FIG. 117 is an illustration of a cross-section view of the first tray 10600 (view CXVII-CXVII of FIG. 106), in accordance with at least one example embodiment. FIG. 118 is an illustration of a cross-section view of the first tray 10600 holding the consumer product 1600 (view CXVIII-CXVIII of FIG. 114), in accordance with at least one example embodiment. FIG. 119 is an illustration of a perspective view of the first tray 10600 and the second tray being held in the first section 110, in accordance with at least one example embodiment.

In at least one example embodiment, a depth 11500 of at least a portion of the floor 960 (FIG. 115) is about equal to a depth 11700 of the first crosspiece segment 10880 (FIG. 117), where these depths are relative to an elevation of the upper surface 992 of the first tray 10600. In at least one example embodiment, the first crosspiece segment 10880 and the floor 960, or the first crosspiece segment 10880 and at least some portions of the floor 960, are at a lowest-most elevation of the lower interior surface 10875 of the first tray 10600 (the lower interior surface 10875 being a bottom surface of the first tray 10600 that is within the confines of the sidewalls 917). In at least one example embodiment, at least part of a first section 960*a* and at least part of a second section 960*b* of the floor 960 (FIGS. 115 and 121B), and the first crosspiece segment 10880 (FIGS. 118 and 123), form three-points of contact with the second tray 12000 and/or elements contained within the second tray 12000. In at least one example embodiment, the first crosspiece segment 10880 (FIGS. 118 and 123) and at least a leading edge 960*a*1 of the first section 960*a* and at least a leading edge 960*b*1 of the second section 960*b* of the floor 960 (FIGS. 108B and 121B) form the three-points of contact with the second tray 12000 and/or elements contained within the second tray 12000. In at least one example embodiment, the three-points of contact are made with the consumer information material 3200 that is being held within the second tray 12000 (FIGS. 121B and 123). In at least one example embodiment, the first crosspiece segment 10880 is arcuate-shaped, where ends 10880*a* of the first crosspiece segment 10880 are pointing toward the leading edges 960*a*1/960*b*1 (FIG. 108B), in order to further stabilize the three-points of contact that the first tray 10600 makes with the second tray 12000.

FIG. 120A-120H are illustrations of perspective, top, bottom, and side views of the second tray 12000 of the package 10220, in accordance with at least one example embodiment.

In at least one example embodiment, the second tray 12000 is the same as the second tray 510 (FIG. 23), with the following exceptions and/or clarifying discussion, herein. In at least one example embodiment, the ridge 12010 extends horizontally away from a lower end of the sidewalls 2340 of the second tray 12000, where an upper surface 12410 of the ridge 12010 forms a step (see FIG. 120A). In at least one example embodiment, the ridge 12010 runs around a periphery of the second tray 12000 (see at least FIGS. 120A, 120C, 120D and 120E). In at least one example embodiment, the ridge 12010 has a height 12005 and a depth 12015 that is uniform (constant) around the periphery of the second tray 12000, as shown in FIG. 120A. As shown in at least FIGS. 120A, 120E and 120G, a height 12020 of the first inset surfaces 2350 and a height 12030 of the major upper surfaces 2345 of the second tray 12000 are uniform (constant), relative to the ridge 12010, across an upper portion of the second tray 12000 (see FIG. 120G, in particular).

FIG. 120I is an illustration of a cross-sectional view (view CXXI-CXXI of FIG. 120C) of the second tray 12000, in accordance with at least one example embodiment. FIG. 120J is an illustration of another cross-sectional view (view CXXI-CXXI of FIG. 120C) of the second tray 12000, where the second tray 12000 is holding consumer information material 3200, in accordance with at least one example embodiment. FIG. 120K is an illustration of another cross-sectional view (view CXXK-CXXK of FIG. 120C) of the second tray 12000, in accordance with at least one example embodiment. FIG. 120L is an illustration of an overhead view of the second tray 12000 within the first section 110 of the outer container 10200, in accordance with at least one example embodiment.

In at least one example embodiment, an outer periphery of the second tray 12000 is conformed to an interior surface of the first section 110, so that the second tray 12000 fits fully inside the first section 110 (see FIGS. 120L, 125 and 126). In at least one example embodiment, the sidewalls 2340 and the upper surface 12410 of the ridge 12010 of the second tray 12000, and the interior surfaces of the walls 610/620 of the first section 110, combine to define a ravine 12040 around an interior perimeter of the first section 110 (FIG. 120L), when the second tray 12000 is in the first section 110. In at least one example embodiment, the distal end 1250 of the skirt 1240 of the first tray 10600 fits into the ravine 12040 to help hold and stabilize the first tray 10600 within the package 10220 (see at least FIGS. 125 and 126), even when the second section 120 is removed from the package 10220.

FIG. 121A is an illustration of the first tray 10600 on top of the second tray 12000, in accordance with at least one example embodiment. FIG. 121B is an illustration of a cross-sectional view (view CXXI-CXXI of FIG. 119) of the first tray 10600 on top of the second tray 12000, in accordance with at least one example embodiment. FIG. 122 is an illustration of the first tray 10600 on top of the second tray 12000, in accordance with at least one example embodiment. FIG. 123 is an illustration of a cross-sectional view (view CXXIII-CXXIII of FIG. 119) of the first tray 10600 on top of the second tray 12000, in accordance with at least one example embodiment. FIG. 124 is an illustration of another cross-sectional view (view CXXIV-CXXIV of FIG. 119) of the first tray 10600 on top of the second tray 12000, in accordance with at least one example embodiment.

In at least one example embodiment, part of an upper portion of the second tray 12000 is fitted within a lower portion of the first tray 10600 (as shown in at least FIGS. 121B, 123 and 124), when the first tray 10600 is set on top of the second tray 12000. In at least one example embodiment, the upper portion of the second tray 12000 that is fitted into the lower portion of the first tray 10600, or fitted within the confines of the distal end 1250 of the skirt 1240 of the first tray 10660, include the first inset surfaces 2350, the major upper surfaces 2345, and at least an upper portion of the sidewalls 2340 of the second tray 12000 (see FIGS. 121B and 123, in particular).

In at least one example embodiment, at least a portion of the reinforcing structure 10870 and/or at least a portion of the floor 960 directly contacts the second tray 1200 and/or elements held within the second tray 1200, such that the distal end 1250 of the skirt 1240 of the first tray 10600 remains "suspended" above the second tray 1200. In at least one example embodiment, the first tray 10600 can be seated on top of the second tray 12000, where the distal end 1250 of the skirt 1240 of the first tray 10600 fits within, or fits directly adjacent to, a trough 12400 that is formed at a seam between the ridge 12010 and the sidewall 2340 of the second tray 12000 (see FIGS. 121B, 123 and 124). In at least one example embodiment, the gap 12110 exists between the interior surface of the sidewalls 917 of the first tray 10600 and the sidewalls 2340 of the second tray 12000 (as described above), where the distal end 1250 of the skirt 1240 of the first tray 10600 does not contact the upper surface 12410 of the ridge 12010, the sidewalls 2340 and/or the trough 12400 of the second tray 12000, when the first tray 10600 rests on top of the second tray 12000 and the first tray 10600 and the second tray 12000 are in a stable and stationary position on a flat surface (see FIGS. 121B and 123-126). In at least one example embodiment, the interior surfaces of the sidewalls 917 and/or the distal end 1250 of the skirt 1240 makes only minor contact with the upper surface 12410 of the ridge 12010, the sidewalls 2340 and/or the trough 12400, as the first tray 10600 may be shifted on top of the second tray 1200.

FIG. 125 is an illustration of a cross-sectional view (view CXXV-CXXV of FIG. 102) of the outer container 10200 containing the first tray 10600 and the second tray 12000, in accordance with at least one example embodiment. FIG. 126 is an illustration of another cross-sectional view (view CXXVI-CXXVI of FIG. 102) of the outer container 10200 containing the first tray 10600 and the second tray 1200, in accordance with at least one example embodiment. FIG. 127 is an illustration of a cross-sectional view (view CXXV-CXXV of FIG. 102) of the outer container 10200 containing the first tray 10600 and not the second tray 12000, in accordance with at least one example embodiment. FIG. 128 is an illustration of another cross-sectional view (view CXXVI-CXXVI of FIG. 102) of the outer container 10200 containing the first tray 10600 and not the second tray 12000, in accordance with at least one example embodiment.

In at least one example embodiment, and as shown in FIGS. 125 and 127, the gap 12510 exists between the upper sidewalls 920 of the first tray 10600 and the second section 120 due to the indentation 10700, thereby allowing the second section 120 to more easily be separated from the rest of the package 10220.

In at least one example embodiment, a gap 12500 exists between the consumer product 1600 and the end wall 600 of the second section 120. In at least one example embodiment, the gap 12500 is in the range of about 0.1 mm to 4 mm, or about 0.5 mm to 3 mm, or about 1.0 to 1.5 mm. In at least one example embodiment, the gap 12500 is negligible or does not exist, such that the consumer product 1600 directly contacts the end wall 600 of the second section 120, when the consumer product 1600 is in the first tray 10600 and is being contained within the outer container 10200 while the outer container 10200 is the closed configuration.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

What is claimed is:

1. An assembled package, comprising:

an outer container including a first section and a second section; and a first tray within the outer container, the first tray defining a first ridge along a periphery of the first tray, the first ridge being held between a first peripheral edge of the first section and a second peripheral edge of the second section when the outer container is in a closed position, the first tray including first vertical sidewalls that extend downward from a first top surface of the first tray, the first ridge extending horizontally away from the first vertical sidewalls, a first upper portion of the first vertical sidewalls defining at least one first indentation that creates a first gap between an interior surface of second vertical sidewalls of the second section and the first vertical sidewalls at the at least one first indentation.

2. The assembled package of claim 1, wherein the at least one first indentation includes a first indentation and a second indentation, and the first vertical sidewalls include a first sidewall and a second sidewall that oppose each other, and upper portions of the first sidewall and the second sidewall respectively define the first indentation and the second indentation which oppose each other and run along a portion of a longitudinal length of the first sidewall and the second sidewall.

3. The assembled package of claim 2, wherein the first vertical sidewalls further include a third sidewall and a fourth sidewall that oppose each other, the first sidewall and the second sidewall having a first longitudinal length that is longer than a second longitudinal length of the third sidewall and the fourth sidewall.

4. The assembled package of claim 3, wherein the first ridge includes a first indicia that is visible when the outer container is in the closed position, the first indicia being along the third sidewall or the fourth sidewall.

5. The assembled package of claim 2, wherein the first sidewall and the second sidewall converge towards each other at the first indentation and the second indentation.

6. The assembled package of claim 2, wherein the first indentation and the second indentation are respectively defined along a midsection of the first sidewall and the second sidewall.

7. The assembled package of claim 2, wherein the first top surface partially defines the first indentation and the second indentation, such that the first top surface has a lower elevation than a remainder of the first top surface at the first indentation and the second indentation.

8. The assembled package of claim 3, wherein the third sidewall and the fourth sidewall each define at least one upper lug, the at least one upper lug extending from the first ridge towards the first top surface along a first outer surface of the third sidewall and the fourth sidewall.

9. The assembled package of claim 8, wherein a second outer surface of the first vertical sidewalls define at least one first lower lug, the at least one first lower lug extending from the first ridge toward a lower distal end of the first vertical sidewalls.

10. The assembled package of claim 1, wherein a first portion of the first vertical sidewalls define at least one upper lug, the at least one upper lug extending from the first ridge towards the first top surface along a first outer surface of the first vertical sidewalls.

11. The assembled package of claim 10, wherein a second outer surface of the first vertical sidewalls define at least one first lower lug, the at least one first lower lug extending from the first ridge to a lower distal end of the first vertical sidewalls.

12. The assembled package of claim 1, wherein the first tray defines an impression of a first consumer product.

13. The assembled package of claim 12, wherein part of a lower surface of the first tray defines a reinforcing structure.

14. The assembled package of claim 13, wherein the reinforcing structure is directly below at least a portion of the impression, the reinforcing structure including ribs with a pair of longitudinal segments running parallel to each other and crosspiece segments spanning between the pair of longitudinal segments.

15. The assembled package of claim 13, wherein a distal end of the first vertical sidewalls form a lowest-most portion of the lower surface, the distal end of the first vertical sidewalls running along a lower periphery of the first tray, at least one first portion of the reinforcing structure forming a second-lowest-most portion of the lower surface across a lower interior surface of the first tray, the lower interior surface being confined within the first vertical sidewalls.

16. The assembled package of claim 15, wherein at least two portions of a bottom surface of the impression further form the second-lowest-most portion of the lower surface across the lower interior surface.

17. The assembled package of claim 1, further comprising:

a second tray within the outer container, wherein a first upper portion of the second tray is fitted within a first lower portion of the first tray.

18. The assembled package of claim 17, wherein the first tray and the second tray are selectively removable from the outer container.

19. The assembled package of claim 17, wherein the second tray includes second vertical sidewalls that extend downward from a second top surface of the second tray, a second ridge extending horizontally away from a lower end of the second vertical sidewalls.

20. The assembled package of claim 19, wherein the first lower portion of the first tray is defined in part by a distal end of the first vertical sidewalls that run along a lower periphery of the first tray, the first upper portion being fitted through the distal end of the first vertical sidewalls.

21. The assembled package of claim 20, wherein the first upper portion includes an upper part of the second vertical sidewalls.

22. The assembled package of claim 19, wherein a trough is defined at a seam between the second ridge and the second vertical sidewalls, the trough running around an outer periphery of the second tray, a distal end of the first vertical sidewalls being directly adjacent to the trough.

23. The assembled package of claim 22, wherein the second ridge extends around the outer periphery of the second tray, an outer surface of the second ridge contacting an interior surface of the first section.

24. The assembled package of claim 22, wherein a second gap exists between the distal end and the trough.

25. The assembled package of claim 17, wherein a distal end of the first vertical sidewalls run along a lower periphery of the first tray and circumscribe a lower interior surface of the first tray, a lowest-most portion of the lower interior surface including at least two portions of the first tray that partially define an impression within the first tray and at least one first portion of a reinforcing structure that is directly below part of the impression.

26. The assembled package of claim 25, wherein the at least two portions and the at least one first portion form three points of contact with the second tray, elements held within the second tray, or both the second tray and elements held within the second tray.

27. The assembled package of claim 17, wherein a first exterior surface of the first vertical sidewalls and a second exterior surface of the second tray are conformed to a shape of a first interior surface of the first section.

28. The assembled package of claim 27, wherein the second tray includes third vertical sidewalls that extend downward from a second top surface of the second tray, a second ridge extending horizontally away from a lower end of the third vertical sidewalls, a lower portion of an interior surface of the first vertical sidewalls and an exterior surface of the third vertical sidewalls both being sloped and shaped to mate with each other.

29. The assembled package of claim 28, wherein a trough is defined at a seam between the second ridge and the third vertical sidewalls, a distal end of the first vertical sidewalls being directly adjacent to the trough.

30. The assembled package of claim 27, wherein third vertical sidewalls of the second tray, an upper surface of a second ridge extending horizontally from the second vertical sidewalls, and fourth vertical sidewalls of the first section define a ravine, a distal end of the first vertical sidewalls of the first tray being fitted into the ravine.

31. The assembled package of claim 30, wherein the ravine is defined along a periphery of the second tray.

32. The assembled package of claim 17, further comprising:

at least one first consumer product contained within at least one first impression defined by the first tray; and at least one second consumer product contained within at least one second impression defined by the second tray.

33. The assembled package of claim 32, further comprising:

consumer information material contained within an inset surface defined by an upper part of the second tray.

34. The assembled package of claim 33, wherein a first part of a lower surface of the first tray defines a reinforcing structure, a second part and a third part of the lower surface defines at least a portion of the at least one first impression, and at least some of the first part, the second part and the third part form three points of contact with the consumer information material such that the first tray is at least partially suspended apart from the second tray.

35. The assembled package of claim 32, wherein at least one surface of the at least one first consumer product is viewable within the at least one first impression when the second section is removed from the assembled package and the first tray is held within the first section.

36. The assembled package of claim 17, wherein a lower surface of the second tray contacts an end wall of the first section of the outer container.

37. The assembled package of claim 17, wherein a first upper surface of the first tray forms at least a portion of a second upper surface of a remaining portion of the assembled package when the second section of the outer container is removed from the assembled package and the first tray and the second tray are held within the first section.

38. The assembled package of claim 37, wherein a second upper portion of the first ridge forms part of the second upper surface.

39. The assembled package of claim 1, wherein a first outer surface of the first ridge forms part of an overall outer surface of the assembled package when the outer container is in the closed position.

40. The assembled package of claim 1, wherein the first ridge includes a first indicia that is visible when the outer container is in the closed position.

41. The assembled package of claim 40, wherein a first outer surface of the first section and a second outer surface of the second section each includes a second indicia.

42. The assembled package of claim 41, wherein each of the second indicia signify a direction.

43. The assembled package of claim 40, further comprising:

a band circumscribing at least a portion of the outer container, the band including at least one wide panel that is conformed to and in direct contact with at least one major surface of the first section, the second section or both the first section and the second section, wherein the band defines at least one tear strip that runs across a width of a portion of the band, the at least one tear strip being aligned with and running in front of a portion of the first ridge.

44. The assembled package of claim 1, wherein each of the first section and the second section have the second vertical sidewalls that extend from an end wall, the first section and the second section being identical to each other.

45. The assembled package of claim 44, wherein the second vertical sidewalls have a horizontal cross-section that is substantially rectangular in shape.

* * * * *